US012377307B2

(12) United States Patent
Monti

(10) Patent No.: US 12,377,307 B2
(45) Date of Patent: Aug. 5, 2025

(54) EXERCISE APPARATUS

(71) Applicant: Jonathan Monti, Newport, RI (US)

(72) Inventor: Jonathan Monti, Newport, RI (US)

( * ) Notice: Subject to any disclaimer, the term of this patent is extended or adjusted under 35 U.S.C. 154(b) by 0 days.

(21) Appl. No.: 18/079,151

(22) Filed: Dec. 12, 2022

(65) Prior Publication Data

US 2023/0113661 A1 Apr. 13, 2023

Related U.S. Application Data

(63) Continuation of application No. 16/781,303, filed on Feb. 4, 2020, now Pat. No. 11,524,205, which is a continuation-in-part of application No. 16/266,884, filed on Feb. 4, 2019, now Pat. No. 11,135,470, which is a continuation-in-part of application No. 15/266,589, filed on Sep. 15, 2016, now Pat. No. 10,195,478.

(51) Int. Cl.

| | |
|---|---|
| ***A63B 21/00*** | (2006.01) |
| ***A63B 21/002*** | (2006.01) |
| ***A63B 22/20*** | (2006.01) |
| ***A63B 23/02*** | (2006.01) |
| ***A63B 23/04*** | (2006.01) |
| ***A63B 23/12*** | (2006.01) |

(52) U.S. Cl.

CPC .... *A63B 21/4029* (2015.10); *A63B 21/00058* (2013.01); *A63B 21/0023* (2013.01); *A63B 21/4009* (2015.10); *A63B 21/4034* (2015.10); *A63B 21/4035* (2015.10); *A63B 22/20* (2013.01); *A63B 23/0205* (2013.01); *A63B 23/1236* (2013.01); *A63B 2023/0411* (2013.01); *A63B 2225/093* (2013.01)

(58) Field of Classification Search

CPC ..... A63B 2023/0411; A63B 21/00058; A63B 21/00069; A63B 21/0023; A63B 21/068; A63B 21/4009; A63B 21/4001; A63B 21/4029; A63B 21/4034; A63B 21/4035; A63B 21/4033; A63B 21/4047; A63B 22/20; A63B 23/0216

See application file for complete search history.

(56) References Cited

U.S. PATENT DOCUMENTS

| | | | | |
|---|---|---|---|---|
| 7,229,394 | B1 * | 6/2007 | Tyree | A63B 21/1663 482/142 |
| 9,662,536 | B1 * | 5/2017 | Lin | A63B 21/4033 |
| 10,220,233 | B2 * | 3/2019 | Schmidt | A63B 21/4035 |
| 2019/0247713 | A1 * | 8/2019 | Tylee | A63B 69/0062 |

* cited by examiner

*Primary Examiner* — Megan Anderson
(74) *Attorney, Agent, or Firm* — Bay State IP, LLC

(57) ABSTRACT

A piece of exercise equipment particularly for improved strength training exercises. More particularly, the invention relates to equipment that allows the user to vary tension when performing different exercises. The present invention is specifically designed for improved exercise through the variability of a tension component for use in such exercises as the plank exercise, sit-ups, push-ups and supine pull-ups that includes a core support, a guide arm, a head support, and a foot support that work in conjunction to most optimally support the user. The core support, the head support and the foot support are all connected, supported, and elevated from the floor by a central support system.

7 Claims, 131 Drawing Sheets

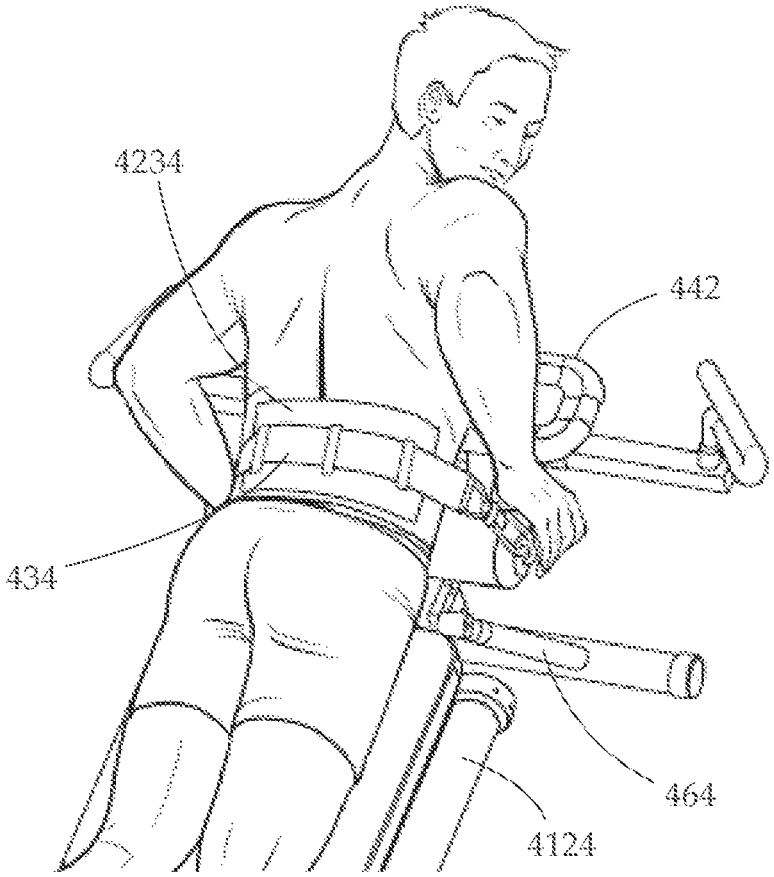
Fig. 114
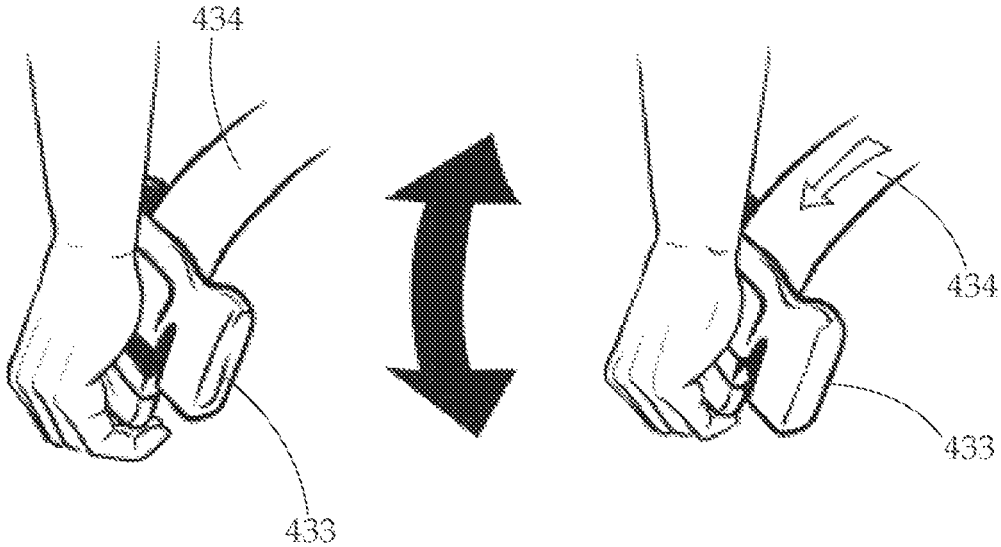
Fig. 115A
Fig. 115B

EXERCISE APPARATUS

CROSS REFERENCE TO RELATED APPLICATION

This application is a continuation application and takes priority from U.S. patent application Ser. No. 16/781,303 filed on Feb. 4, 2020, which is a continuation-in-part application and takes priority from U.S. patent application Ser. No. 16/266,884 filed on Feb. 4, 2019, which is a continuation-in-part application and takes priority from and claims the benefit of U.S. patent application Ser. No. 15/266,589, filed on Sep. 15, 2016, the contents of which are herein incorporated by reference.

BACKGROUND OF THE INVENTION

Field of the Invention

The present invention relates generally to exercise equipment for improved, and highly efficient strength training exercises. More particularly, the invention relates to equipment that allows the user to vary tension when performing different body weight resistive exercises.

Description of the Related Art

Currently, and as has been the case for decades, many types of exercise equipment exist and are used for maintaining a healthy lifestyle, getting back into shape, rehabilitation and various other physical fitness purposes. Some of the existing equipment attempts to limit the strain on the body of the user in performing certain exercises. Certain concurrent equipment improves the user's ability to perform certain exercises, improvement to increase support to the user while simultaneously allowing the user to perform certain exercises in a more efficient and effective way with less strain on their body and increased stability. Devices that can be used for broad range of types of push-ups are great resources in this capacity.

Furthermore, devices that would work in concert with these broad range of push-ups devices and thus allows users to perform static and semi-static exercises such as the plank, bird dog and downward dog off the floor in a comfortable, inviting, safe and highly efficient manner are concurrently are highly desirable. Also, devices that allow a user to be positioned upright upon completion of the exercise circuit and not prone on the floor are concurrently are highly desirable.

Further desirable are devices that allow a user to influence the look and strength of their abdominal muscles without having to use a specific and targeting sit-up type device as well as devices that can measure and verify push-ups for push-up testing in military, police and fire training, applications. Additionally, important are machines that allow the user to adjust the provided tension for an exercise with greater ease but still provide varied tension levels for different user ability level as well as allowing for a choice of difficulty level, while varying exercise routines in an innovative way to perform both progressive and regressive body weight resistance exercises.

SUMMARY OF THE INVENTION

The instant apparatus and system, as illustrated herein, is clearly not anticipated, rendered obvious, or even present in any of the prior art mechanisms, either alone or in any combination thereof. A versatile system, method and series of apparatuses for creating and utilizing an exercise device and performing a series of health cultivating exercises. The system affords the user the ability to change exercises in a quick and efficient manner.

It is therefore an object of the present invention to provide exercise equipment that is specifically designed for improved exercise through the variability of a tension component for use in such body weight resistive exercises as planks, sit-ups, push-ups, bird dog, half boat and downward dog yoga poses and supine pull ups.

It is an object of the system to provide the safe, efficient, and inviting device known today for performing, plank, push-up, bird dog, yoga half boat, and supine pull-up exercises. It is an object of the system to add to the challenge, experience and effect of common exercise movements such the downward dog. It is an object of the system to allow the user to work through fatigue while doing progressive or regressive body weight resistance exercises.

It is an object to provide a "real technology" for affecting the abdominal musculature as well as an exercise technology that provides a psychological component wherein a user has a goal to get to a level where they can perform added load exercise a state where the body sees the greatest and most efficient changes. It is an object to provide a system and a method wherein a user starts with assistance and has the ultimate goal to get to added load.

It is an object of the system to have a configuration that utilizes less core parts, possesses the structural integrity of a commercial piece of equipment, but yet is very light in its construction. Further to this point, different methods of fusing metal together may be able to be employed in its construction.

It is an additional object to provide an exercise technology that allows a user to experience benefits and changes in the body with a very small amount of exercise in a very short amount of time per exercise session. It is an object that the technology provides a very significant improvement for a device that can measure, and verify push-up testing for military, police and fire applications. It is an objective to introduce a system wherein that the supportive force applied to the user during static exercises also allows the exercises to be performed in semi-static fashion.

Structurally, an objective of the instant system includes providing a core support, a guide arm, a head of machine support, a foot support and a central support system wherein the core support comprises a body support pad and is attached to the guide arm at a fulcrum and through a force component. At one end of the core support, the core support is telescopically attached to the head of machine support which comprises a safety pad and at least two handlebars. At the opposite end, the core support is telescopically attached to the foot support which comprises of a foot pad, a foot element for resistance and/or support, and a foot element positioner. The core support, the head of machine support and the foot support are all connected to and supported by a central support beam having legs.

It is a further object that the system to store energy to counterbalance the user during certain static pose exercises, such as the plank, birddog, and yoga half boat and downward dog exercise. It is an object that the placement of the safety pad provides improved support to the user during certain static exercises. It is an object of the system that the placement of the safety pad is integral in the operation of machine, in setting up for exercises and getting off of the machine.

It is an object of the system to provide a foot element support and restraining member to augment performance of certain exercises on the machine, specifically contributing to the user's ability to perform improved closed kinetic chain exercises by providing additional support and stability, while ensuring the user's safety while performing the exercises.

It is an object of the instant system to provide a head support including telescoping capabilities in order to allow the user to perform plank and push-up exercises with different angles employed in the shoulder as the user connects to the plank pad or handles of the machine through the arms.

A further object is to introduce a system wherein the combination of the positions of a safety pad and foot element assist the user in maintaining the correct posture for certain exercises. It is an object of the system that the placement of a fulcrum is ideal for closed kinetic chain exercises, specifically plank, push-up and supine pull-up exercises. It is an object of the system that the fulcrum may be strategically positioned so there is no need to make any adjustments as the user switches from one exercise to another.

It is an object of the system to introduce a guide arm that assists the user in maintaining proper positioning while performing certain exercises, such as preventing the user's back to sag during a plank exercise, additionally, preventing the user from maintaining a cheat like pose with their derriere in the air.

Further, it is an object of the system to introduce a guide arm that is located in the center of the apparatus, such that a user has sufficient freedom to move his or her legs forward, such as in a mountain climber plank exercise.

It is an additional object of the system to introduce a force component wherein minor adjustments to the force component will allow the user to move from level to level or set to set with not too much neuromuscular shock to the body, therefore, making it so this difference in levels is not too great or noticeable, and still therefore will not create a heightened sense of fatigue too quickly during any bout of exercise A further object of the system is to provide the user various levels of resistance, counterbalance, and/or added load depending on the type of exercise the user is doing. It is an object additionally, in the alternative, to provide a system wherein large changes in the force component will cause great stress to the neuromuscular system and therefore create a greater challenge to a user, as would be highly appreciated by elite athletes and those looking to shock their muscles.

It is an object of the system that the raised position of the core support relative to the floor allows the user to improve the level and benefits of certain exercises by providing the user the ability to incorporate a greater range of motion during the exercise. An example of this would be the user having the ability to move their leg past parallel when doing a one footed push-up or plank exercise. Or, a dynamic bird dog exercise with assistance or added load.

It is an object of the system that the raised position of the core support relative to the ground surface, as provided by the system, allows the user to activate additional muscle groups when performing certain exercises. An example of this is when a user does sit-up type exercises with one foot on the floor and one up in the machine, and thus the oblique muscles can be affected from either side when a twist is incorporated.

It is an object of the system that the raised position of the core support relative to the floor allows the user to more easily get on and/or off of the machine. It is an object of the system that the guide arm may positioned in different positions depending on the user's choice of exercise.

It is an object of the system to introduce a machine that assists and allows the user to laterally move the torso while performing sit-up exercises, that it is perfectly suited for angular oblique sit-up exercises and is foldable to be more easily stored and carried.

There has thus been outlined, rather broadly, the more important features of the exercise equipment embodiments in order that the detailed description thereof that follows may be better understood, and in order that the present contribution to the art may be better appreciated. There are additional features of the system, accompanying methods and apparatuses that will be described hereinafter and which will form the subject matter of the claims appended hereto.

In this respect, before explaining at least one embodiment of the system, accompanying methods and apparatuses in detail, it is to be understood that the system, accompanying methods and apparatuses are not limited in application to the details of construction and to the arrangements of the components set forth in the following description or illustrated in the drawings. The system, accompanying methods and apparatuses are capable of other embodiments and of being practiced and carried out in various ways. Also, it is to be understood that the phraseology and terminology employed herein are for the purpose of description and should not be regarded as limiting.

These together with other objects of the system, accompanying methods and apparatuses, along with the various features of novelty, which characterize the invention, are pointed out with particularity in the claims annexed to and forming a part of this disclosure. For a better understanding of the system, its operating advantages, and the specific objects attained by its uses, reference should be made to the accompanying drawings and detailed descriptive matter in which there are illustrated several embodiments of the system.

BRIEF DESCRIPTION OF THE DRAWINGS

Advantages of the present invention will be apparent from the following detailed description of exemplary embodiments thereof, description should be considered in conjunction with the accompanying drawings, in which having thus described the invention in general terms, reference will now be made to the accompanying drawings, which are not necessarily drawn to scale, and wherein:

FIG. 106 is a view of the top of the machine with the body pad removed and the guide arm in the down position.

FIG. 107 illustrates the same as above except the force producing element is comprised of pneumatic reducing and amplifying load cylinders.

FIG. 108 is a side view of the exercise machine with a user performing an assisted static plank pose position exercise.

FIG. 109 illustrates one embodiment of a user utilizing the machine to perform an assisted dynamic plank.

FIG. 110 is a side view of a user performing an assisted static plank pose exercise on the machine with their feet on the floor.

FIG. 111 is a perspective view of the core support illustrating a retractable belt harness, with a ratcheting mechanism, and a latching element.

FIG. 112 illustrates the retractable harness being extended from the harness retracting mechanism.

FIG. 113 illustrates when the user has met the first hand with the second hand and is extending the belt to the latching mechanism.

FIG. 114 is a back view of a user utilizing an embodiment of the harness containing a harness pad.

FIG. 115A-115B illustrate the third phase of the operation whereby the user is ratcheting the belt to the desired tightness.

FIG. 116 is a side view of a user on the machine performing an added load static plank position exercise.

FIG. 117 illustrates another embodiment of a user utilizing the machine to perform a magnifying load version of the exercise described in FIG. 109.

Figure 118:
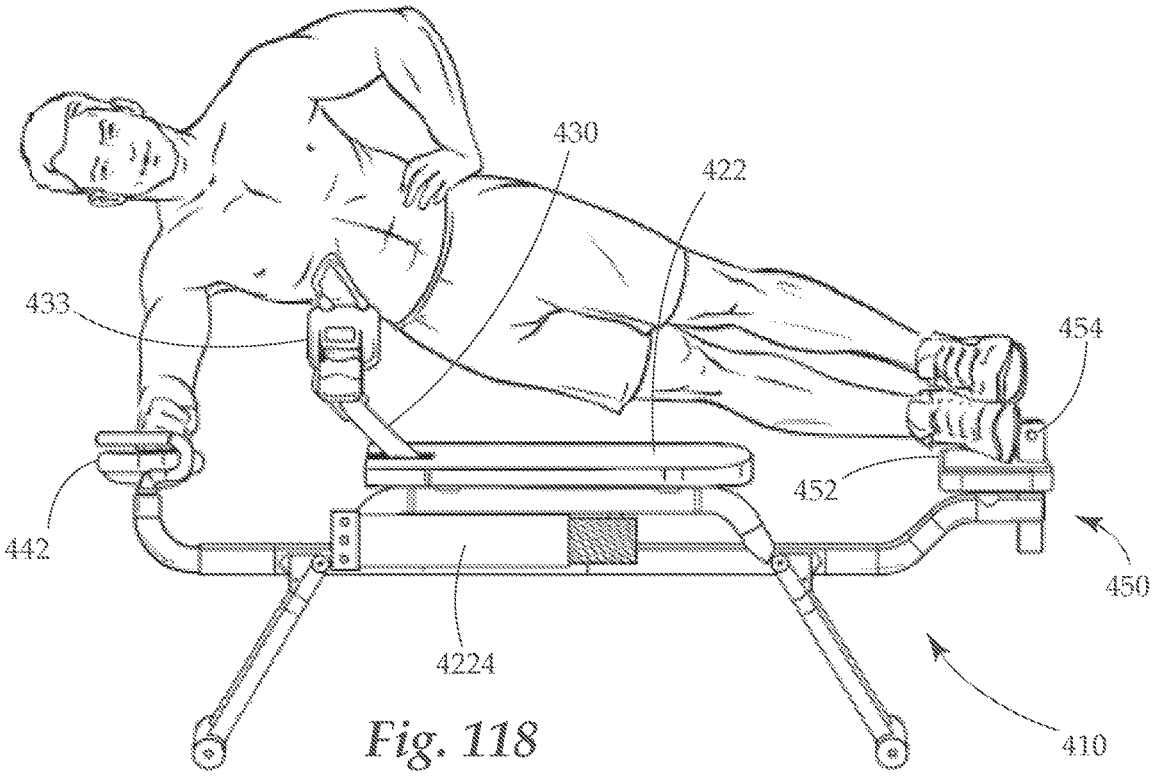

FIG. 118 is a side view of a user on the machine performing a reducing load side plank pose exercise.

Figure 119:
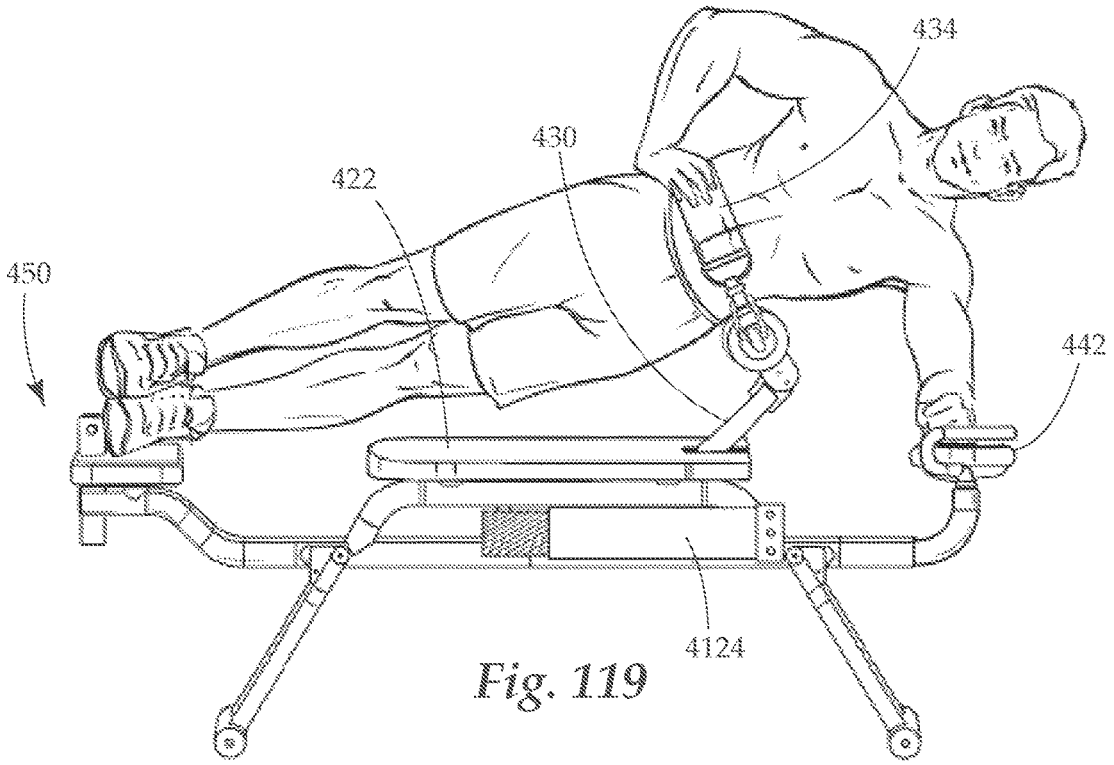

FIG. 119 is a side view of the machine with a user on it performing a magnifying load side plank pose exercise.

Figure 120:
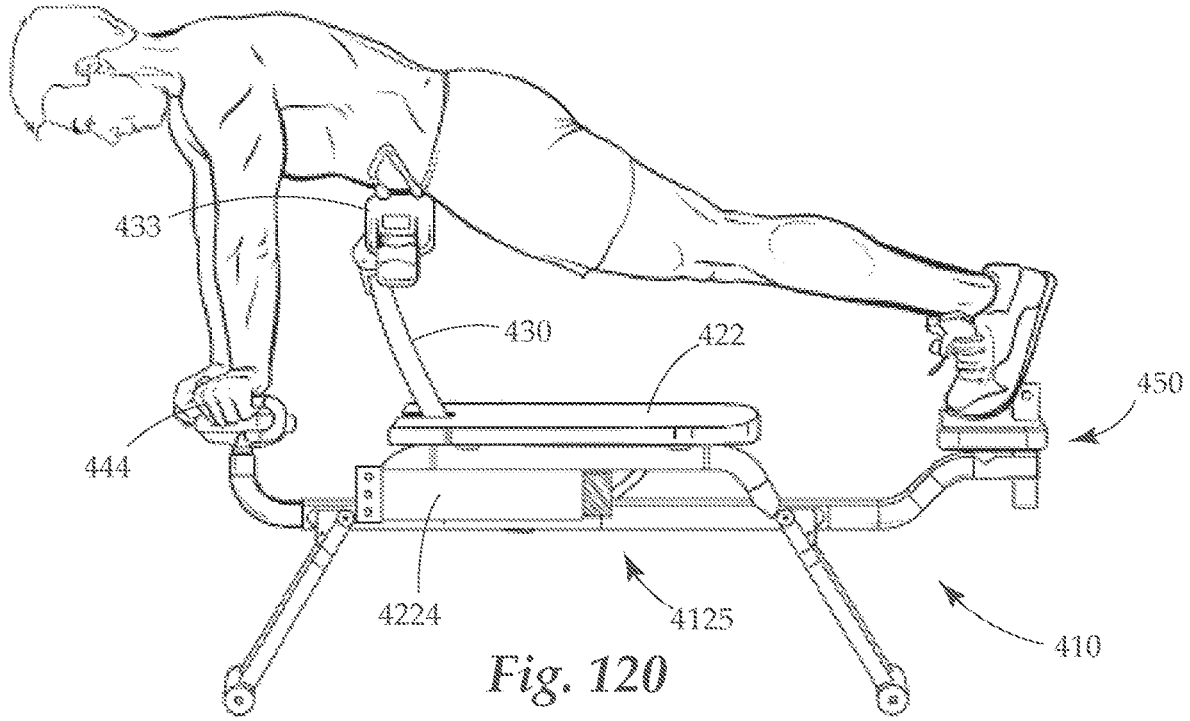

FIG. 120 is a side view of a user on the machine performing a reducing load push-up exercise.

Figure 121:
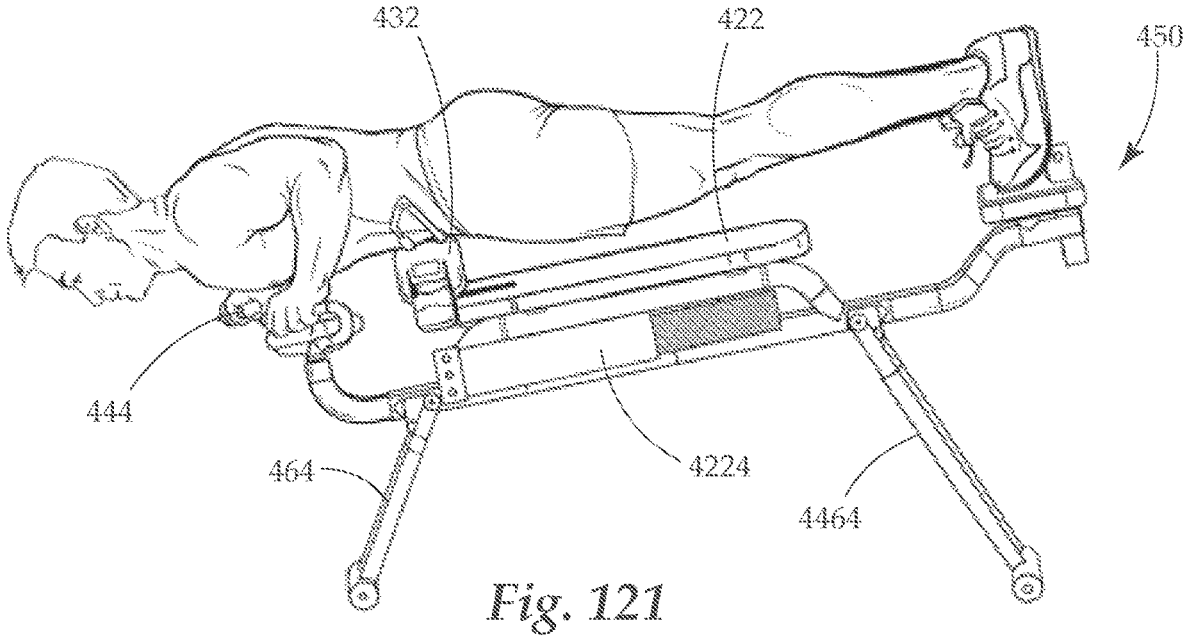

FIG. 121 illustrates an embodiment of the machine wherein the machine can be propped up by a jack or a telescoping leg mechanism to form a decline.

Figure 122:
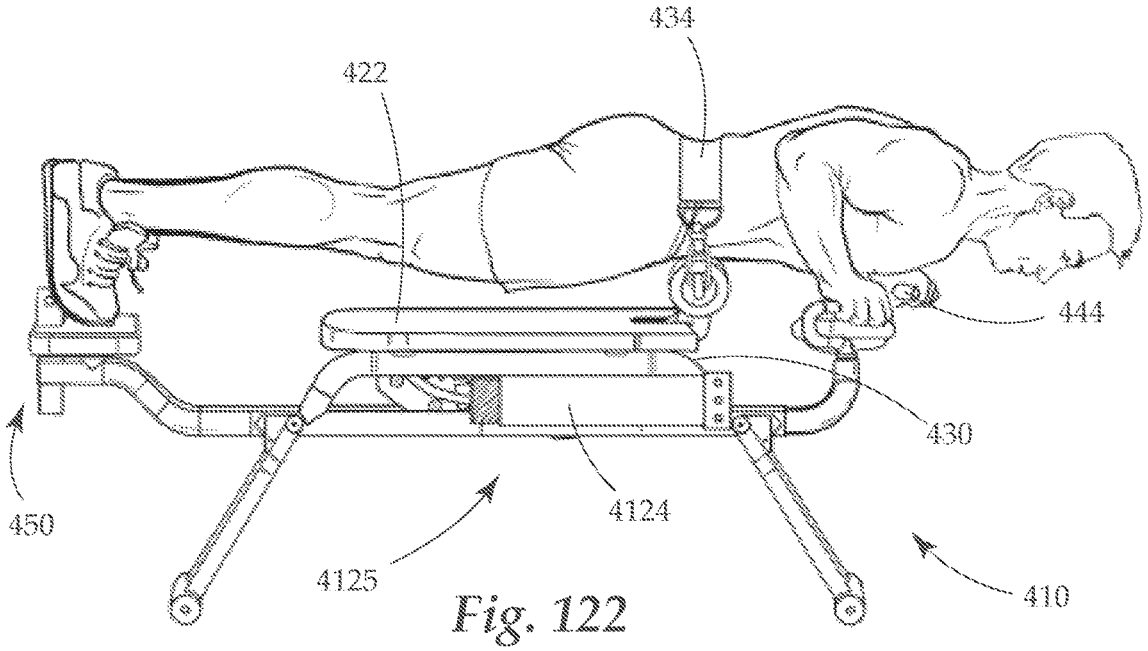

FIG. 122 is a side view of a user on the machine performing a magnifying load push-up.

Figure 123:
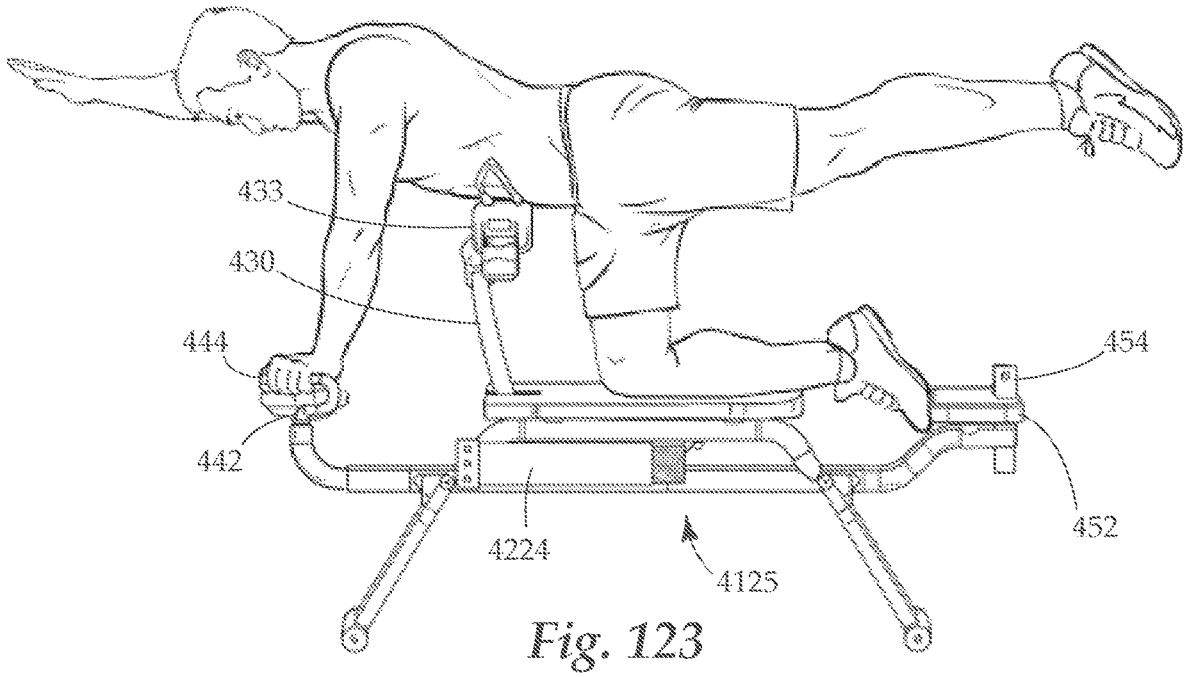

FIG. 123 is a side view of a user on the machine performing a reducing load bird dog static pose exercise.

Figure 124:
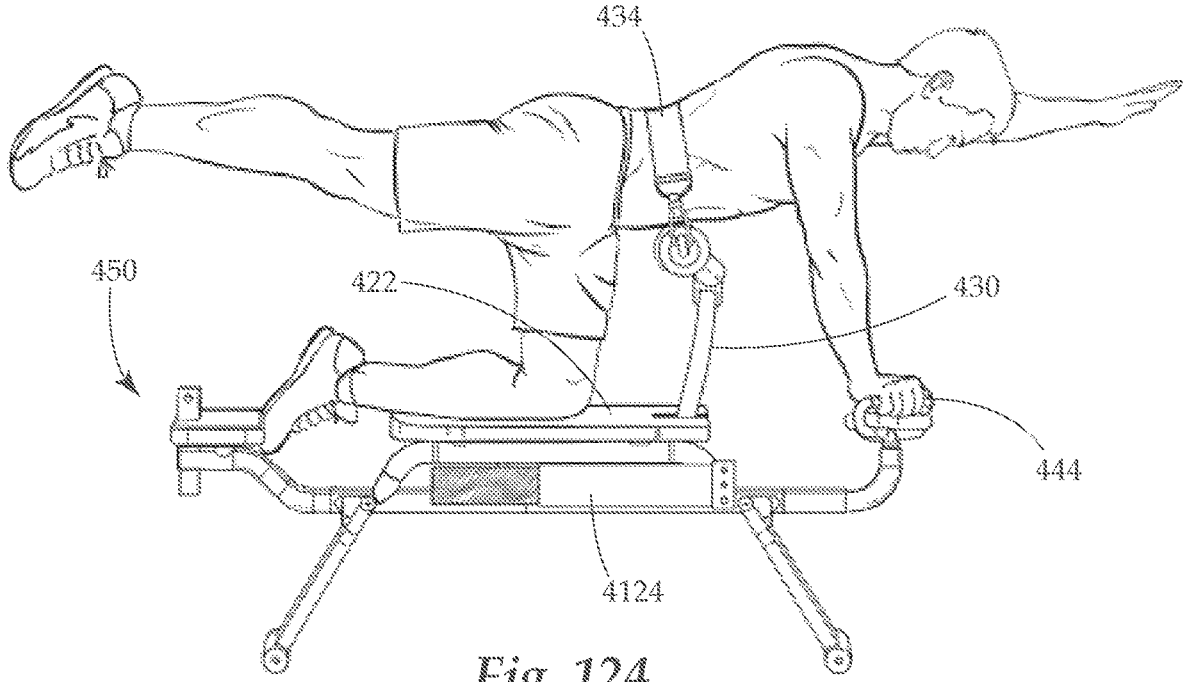

FIG. 124 is a side view of a user on the machine performing a magnifying load bird dog pose exercise.

Figure 125:
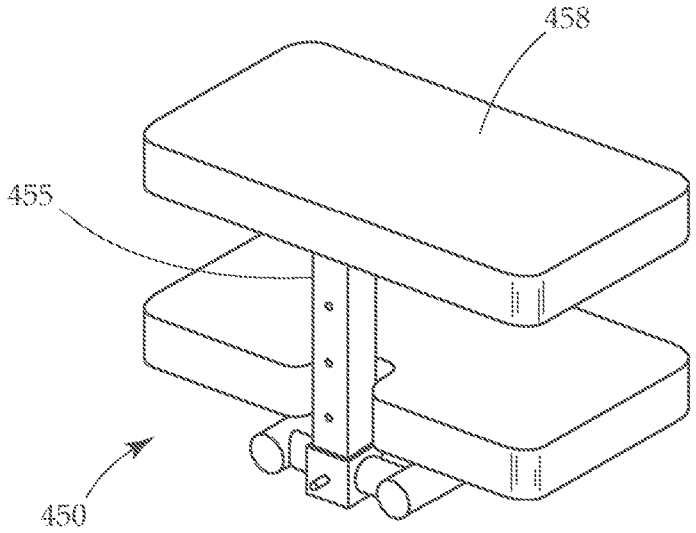

FIG. 125 is a perspective view of the machine adapted with the auxiliary foot support attachment consisting of an auxiliary foot pad.

Figure 126:
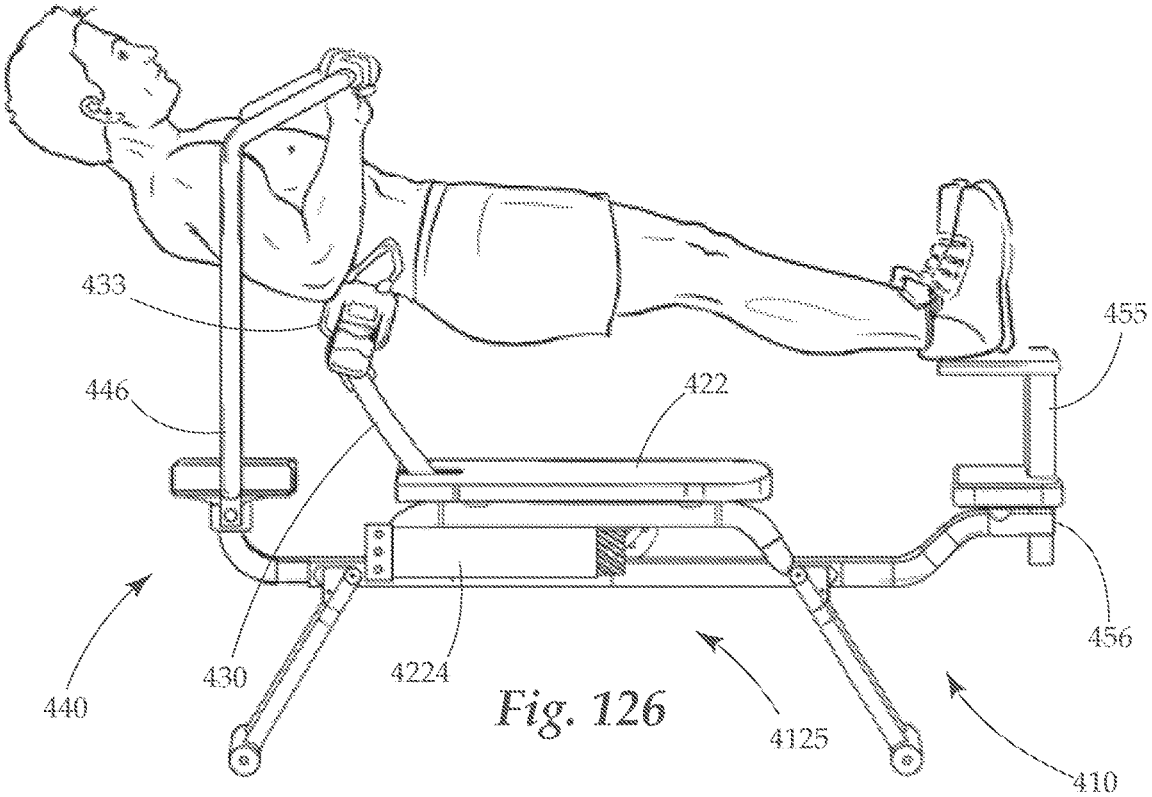

FIG. 126 is a side view of a user on the machine performing a reducing load supine pull-up.

Figure 127:
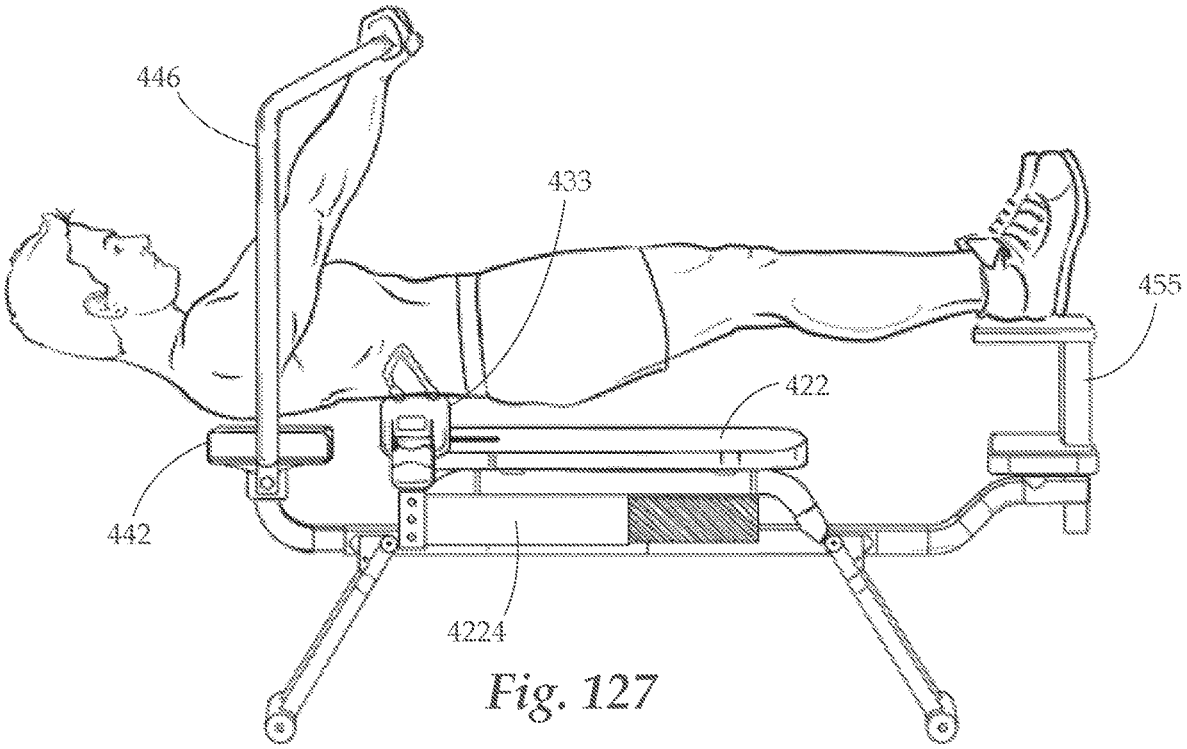

FIG. 127 illustrates the user performing the second phase of the figure above.

Figure 128:
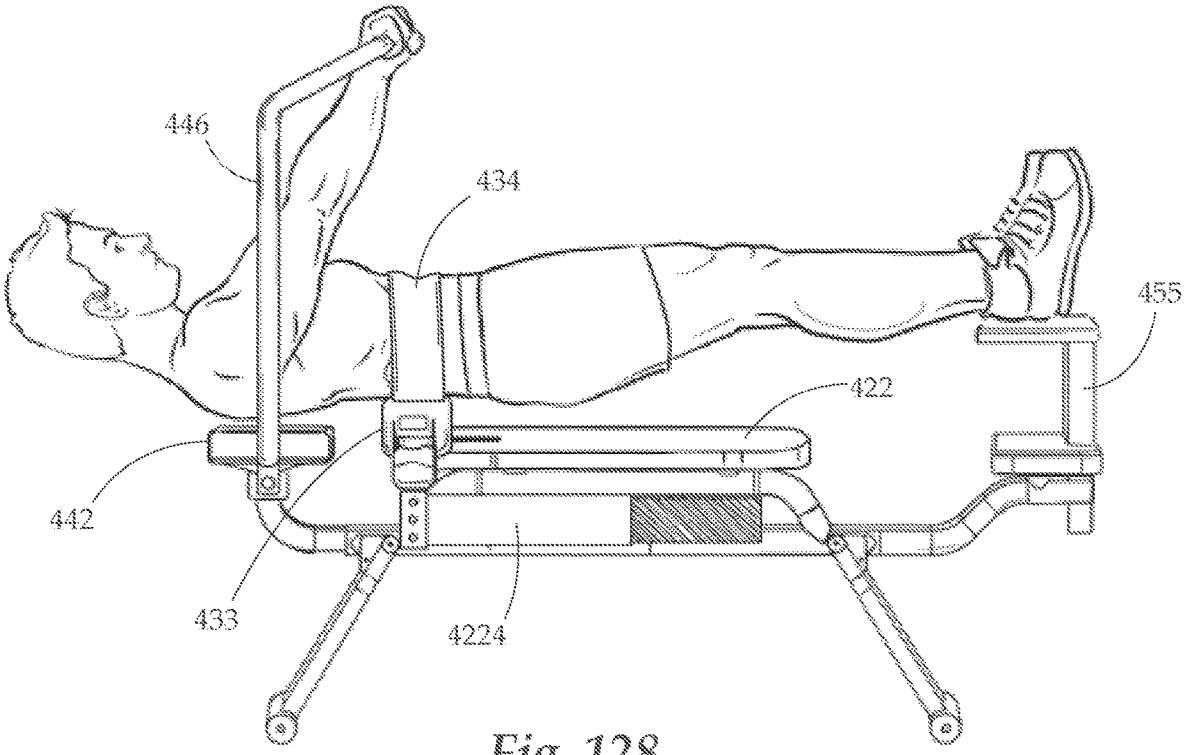

FIG. 128 illustrates a user in the bottom of the range of motion in the performance of an amplified load horizontal pull-up.

Figure 129:
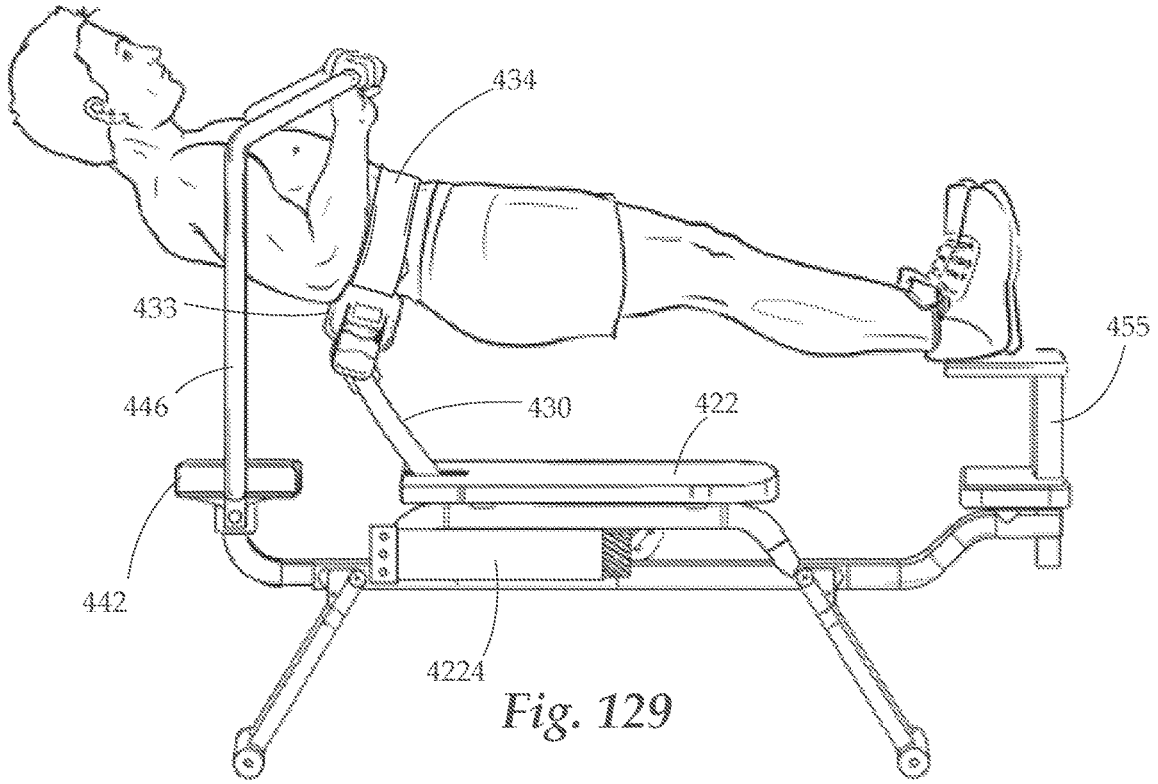

FIG. 129 illustrates a user in the upper phase of the movement above.

Figure 130:
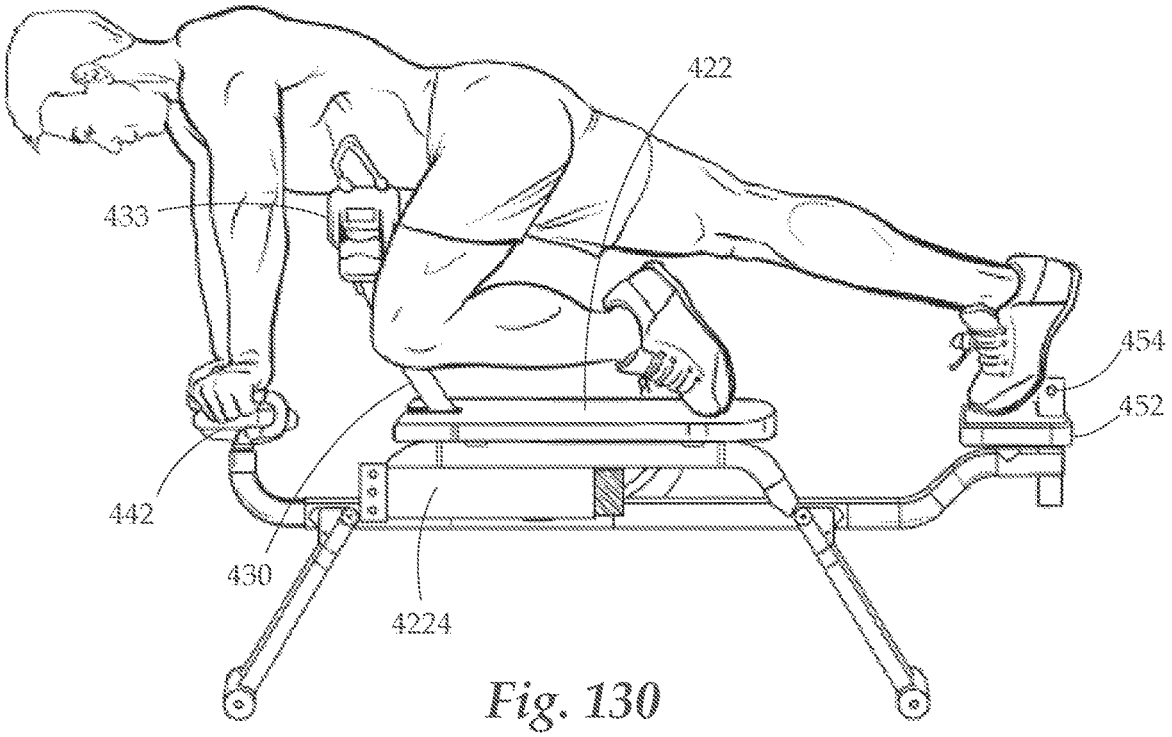

FIG. 130 illustrates a side view of a user on the machine performing a reducing load mountain climber plank supported by the guide arm of the machine.

Figure 131:
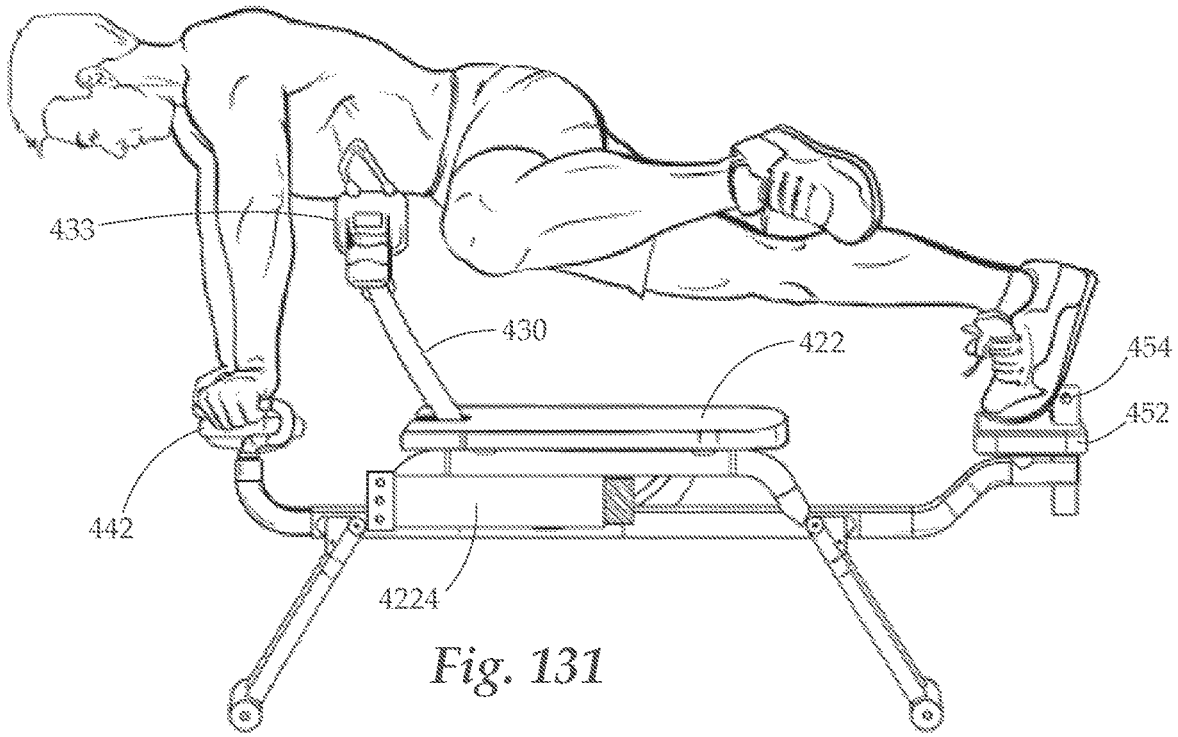

FIG. 131 is a side view of a user on the machine performing a reducing load spider man or knee to elbow plank.

Figure 132:
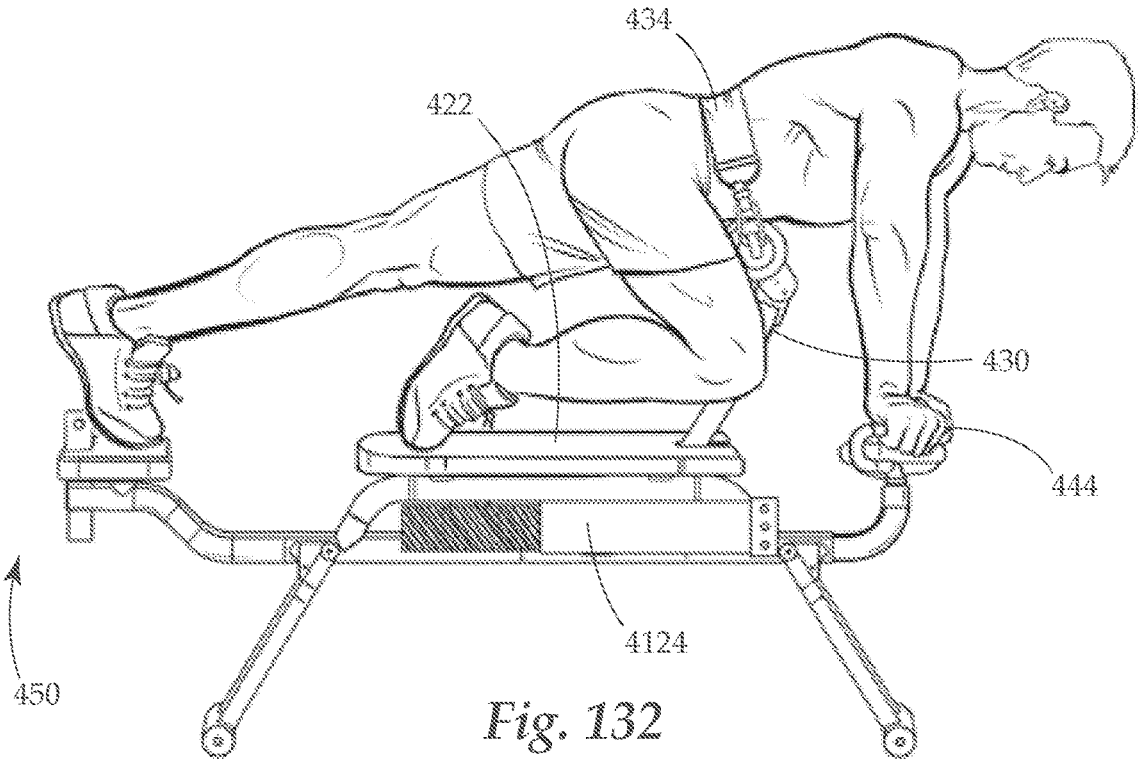

FIG. 132 is a side view of a user on the machine performing a magnifying load mountain climber plank connected to the machine with a belt harness.

Figure 133:
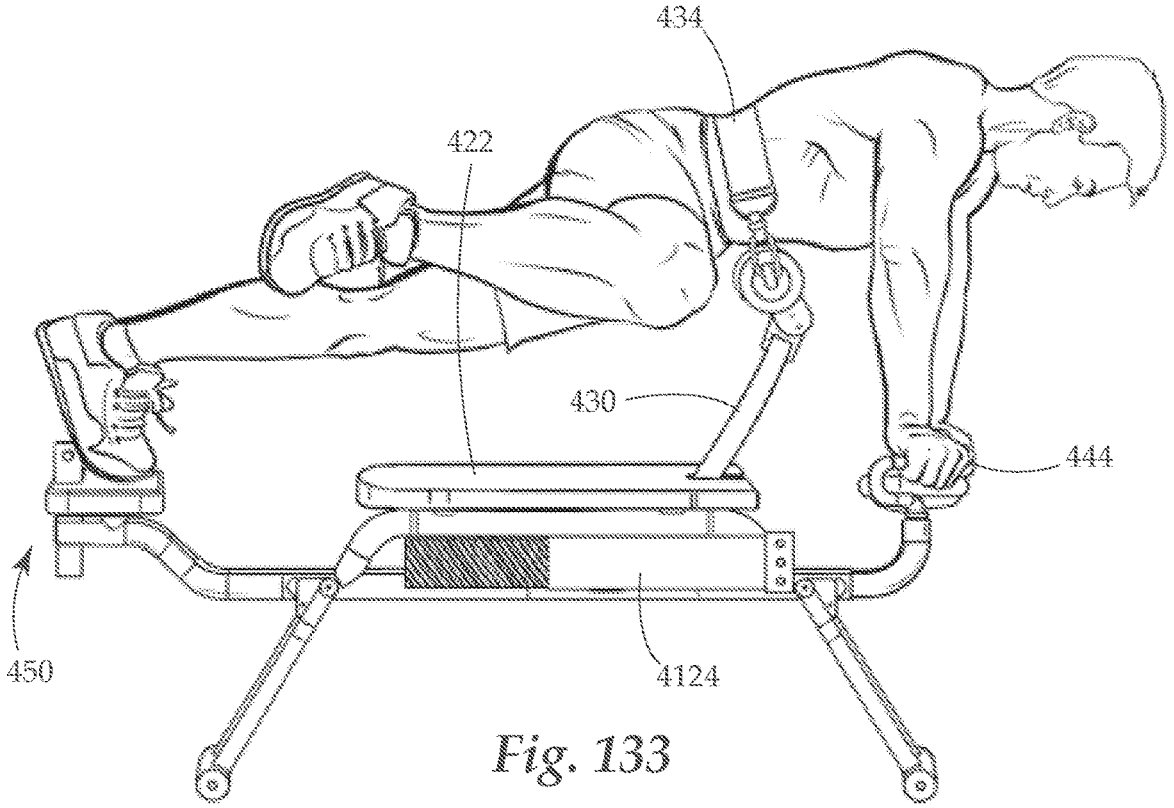

FIG. 133 is a side view of a user on the machine performing a magnifying load Spiderman knee to elbow plank connected to the machine with a belt harness.

Figure 134:
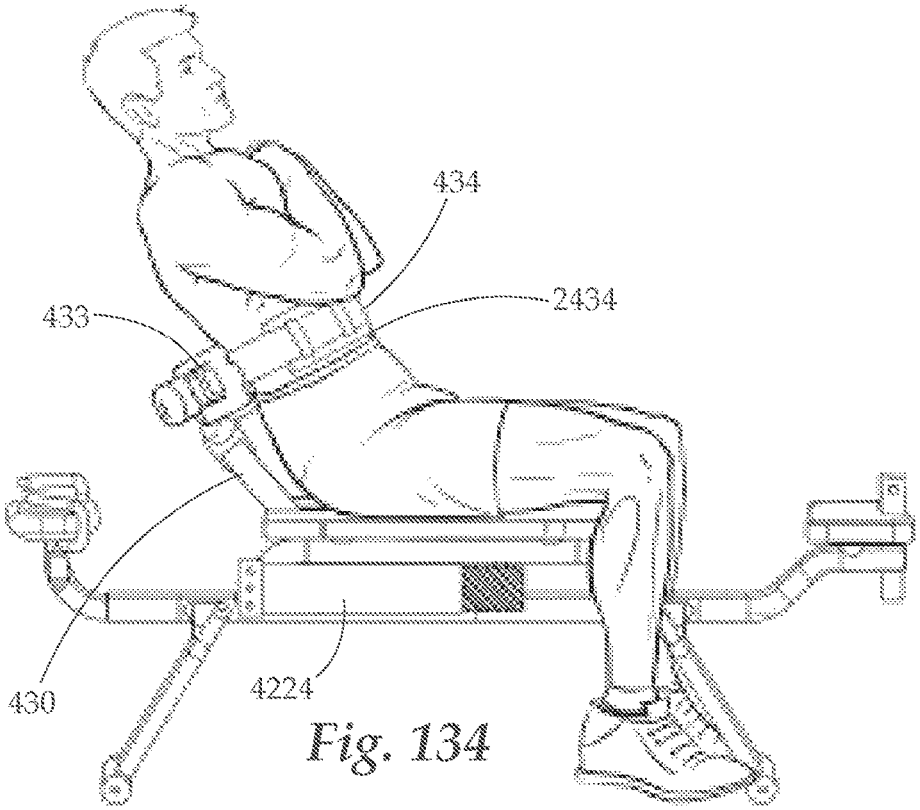

FIG. 134 illustrates one embodiment of a reducing load seated abdominal exercise with the user's abdomen enveloped by a corset pad that is ratcheted tight.

Figure 135:
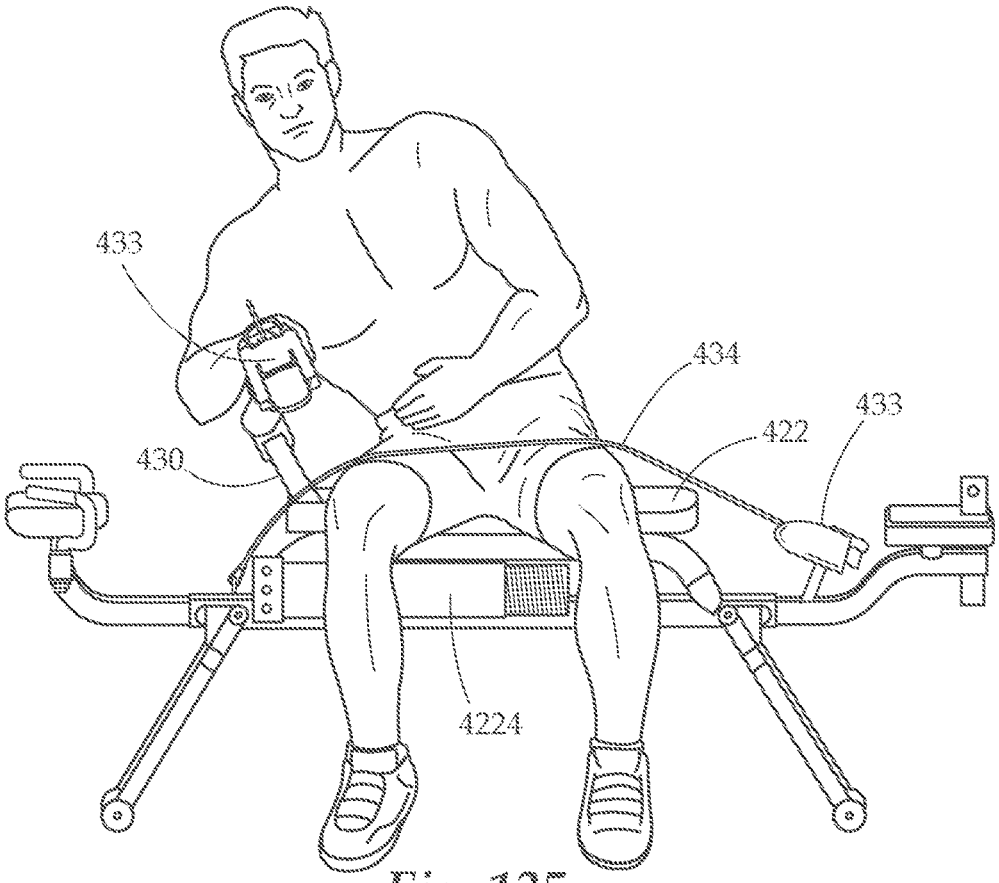

FIG. 135 illustrates a patient or exerciser performing a reducing load side vertical abdomen exercise.

FIGS. 136-139 illustrate the three phases of getting into the machine for an abdominal and core strength baseline test.

Figure 139:
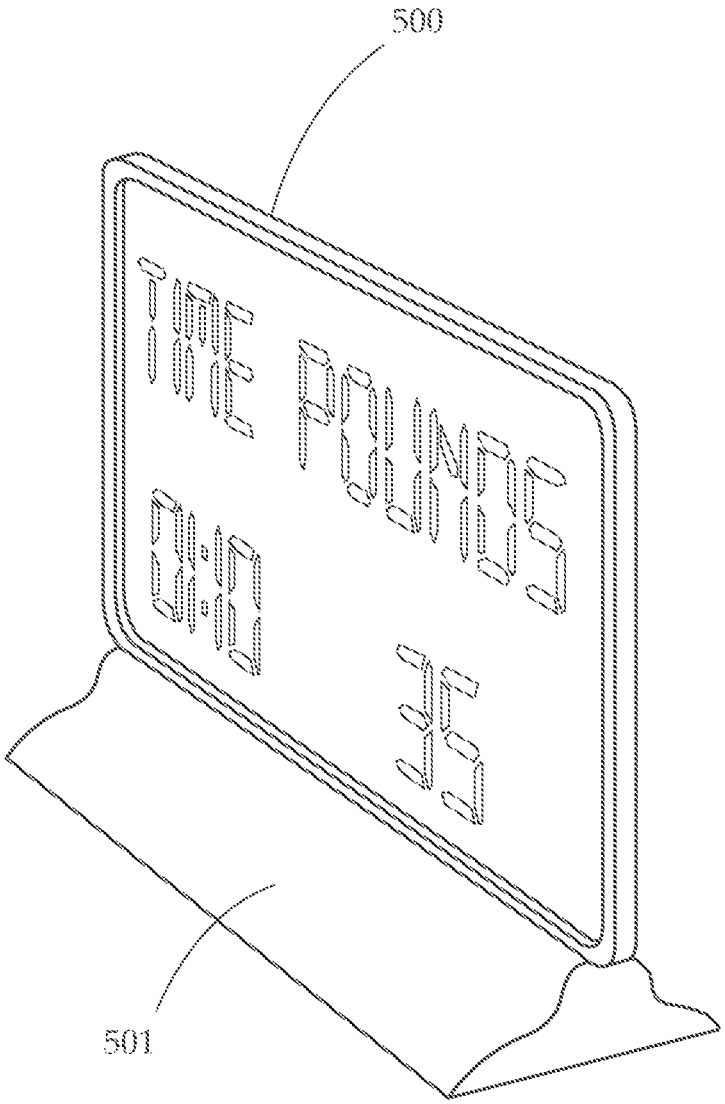

FIG. 139 illustrates a digital screen that is supported by a base.

Figure 140:
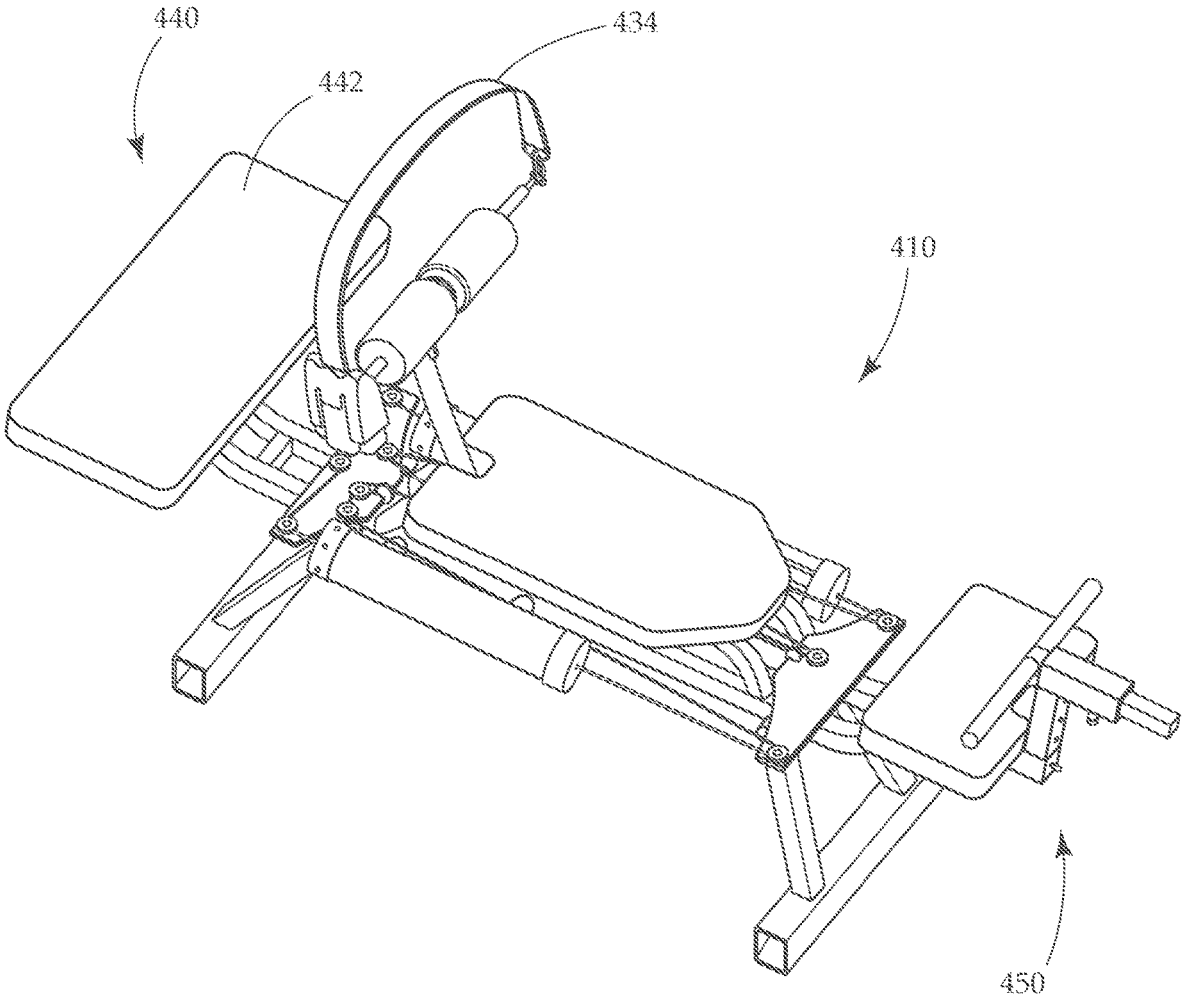

FIG. 140 illustrates an adapted embodiment for the head area of the machine.

Figure 141:
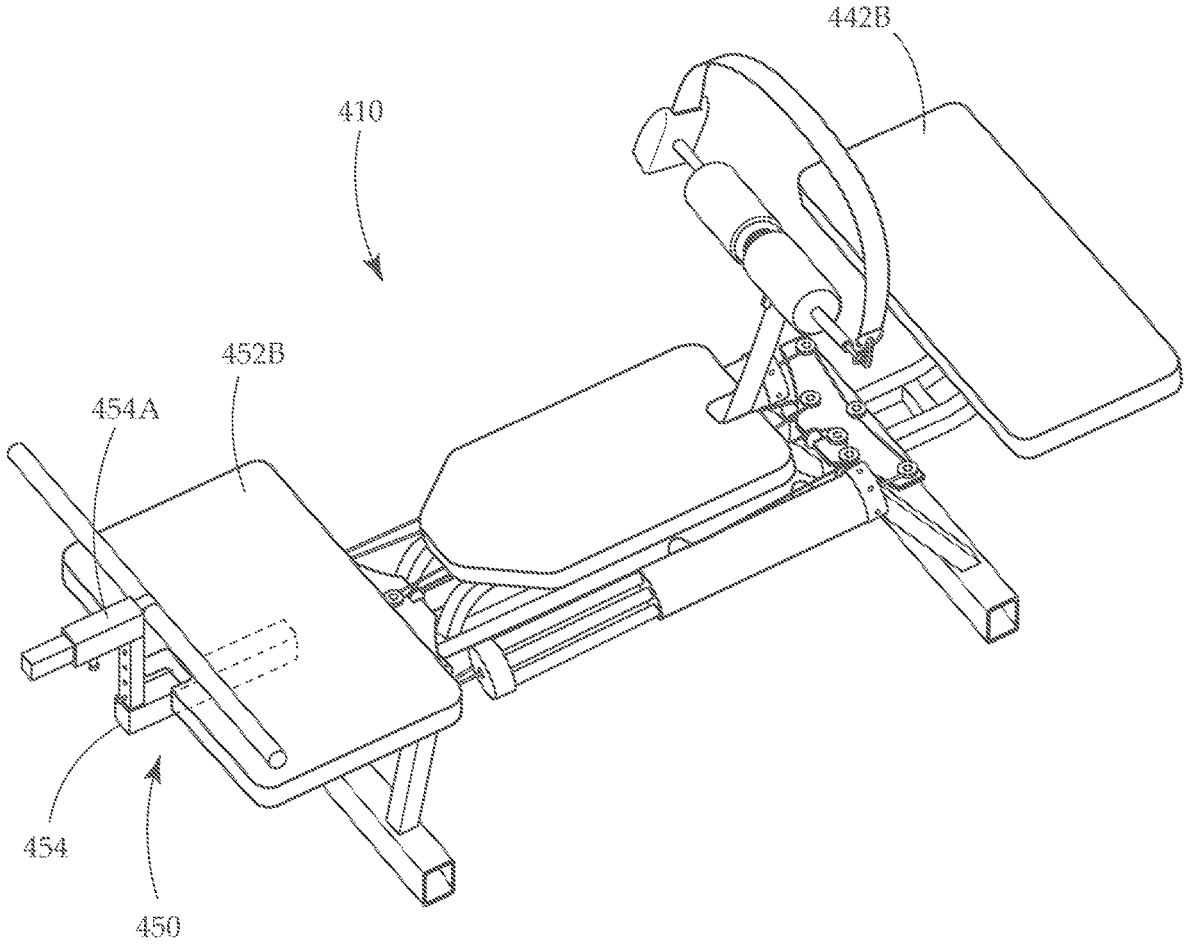

FIG. 141 illustrates the machine adapted with a front and back platform with a more robust and non folding construction.

Figure 142:
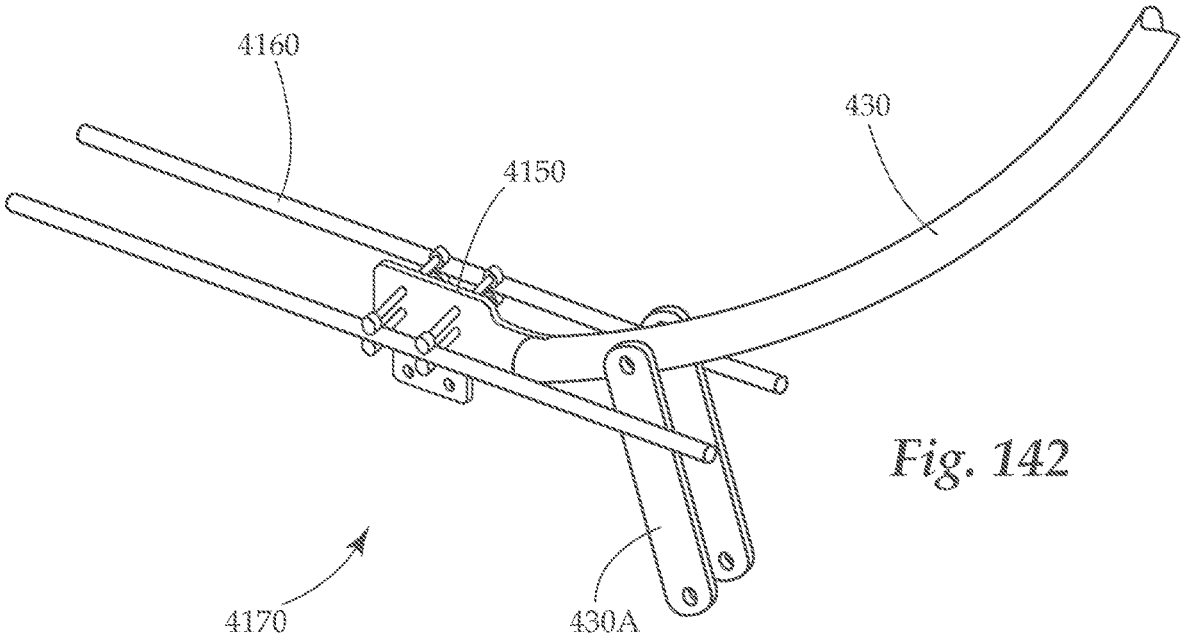

FIG. 142 illustrates the multiple bar linkage system.

Figure 143:
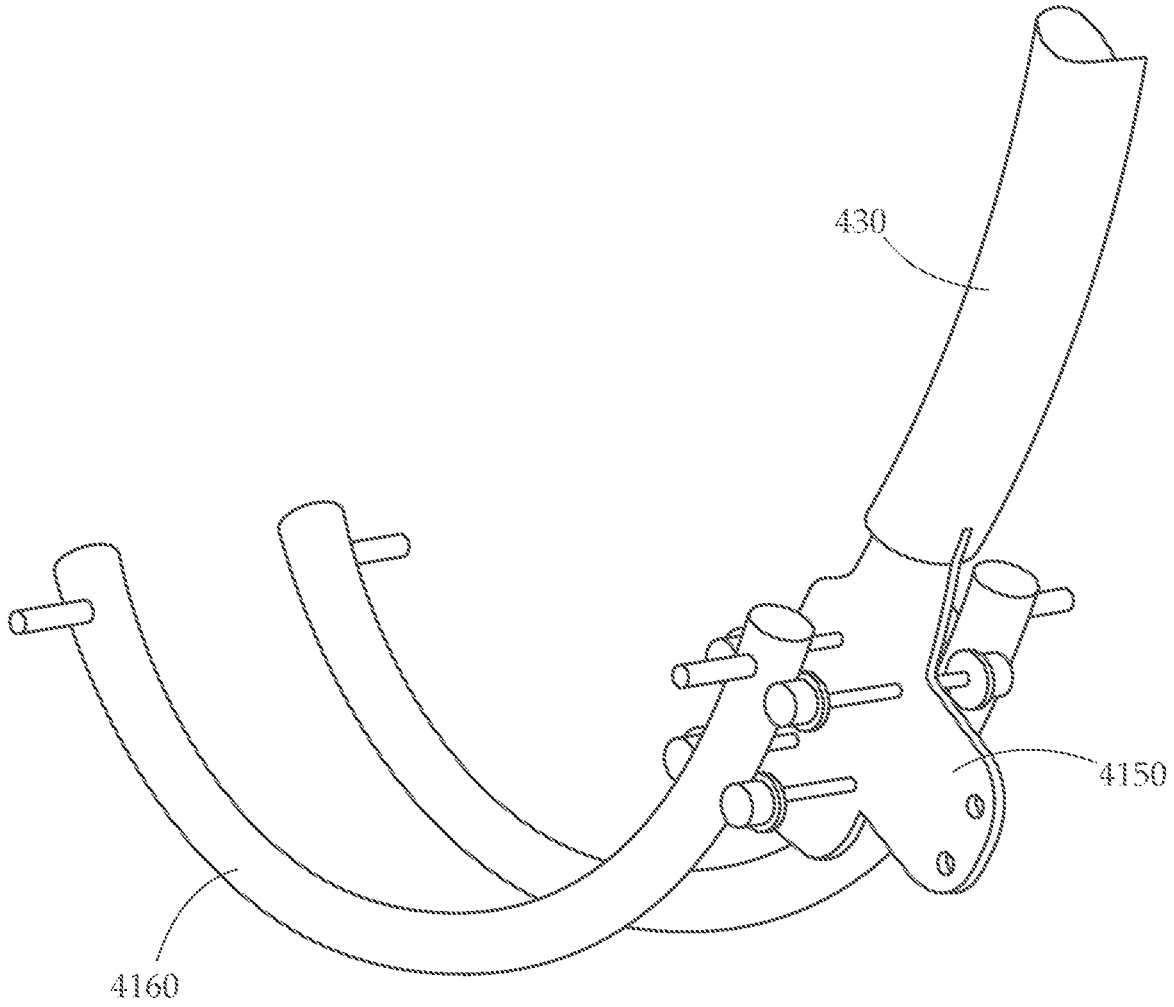

FIG. 143 illustrates the trolley and curved rail system that is connected to the guide arm as seen in the figures above.

Figure 144:
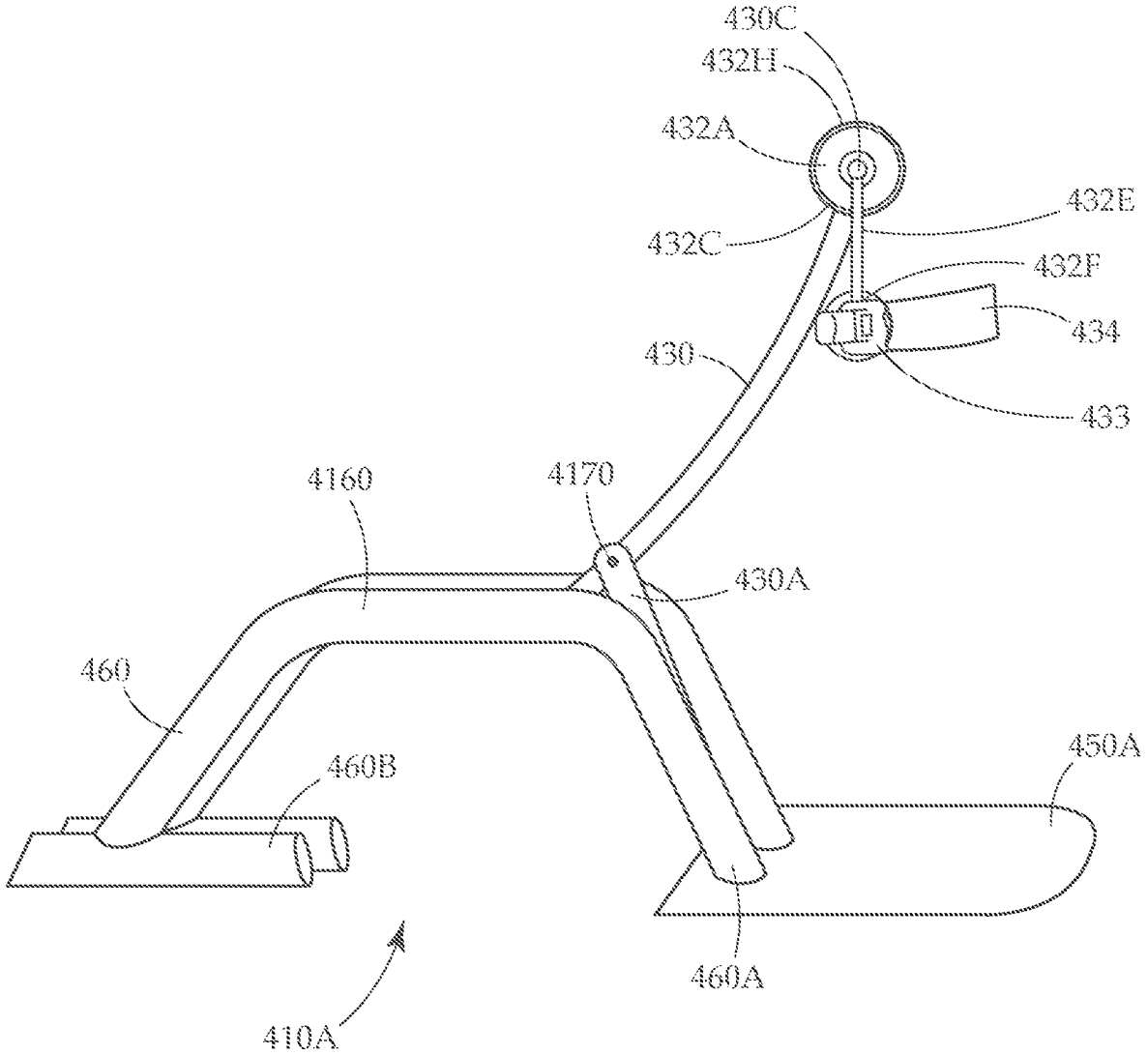

FIG. 144 illustrates an innovative squatting machine.

Figure 145:
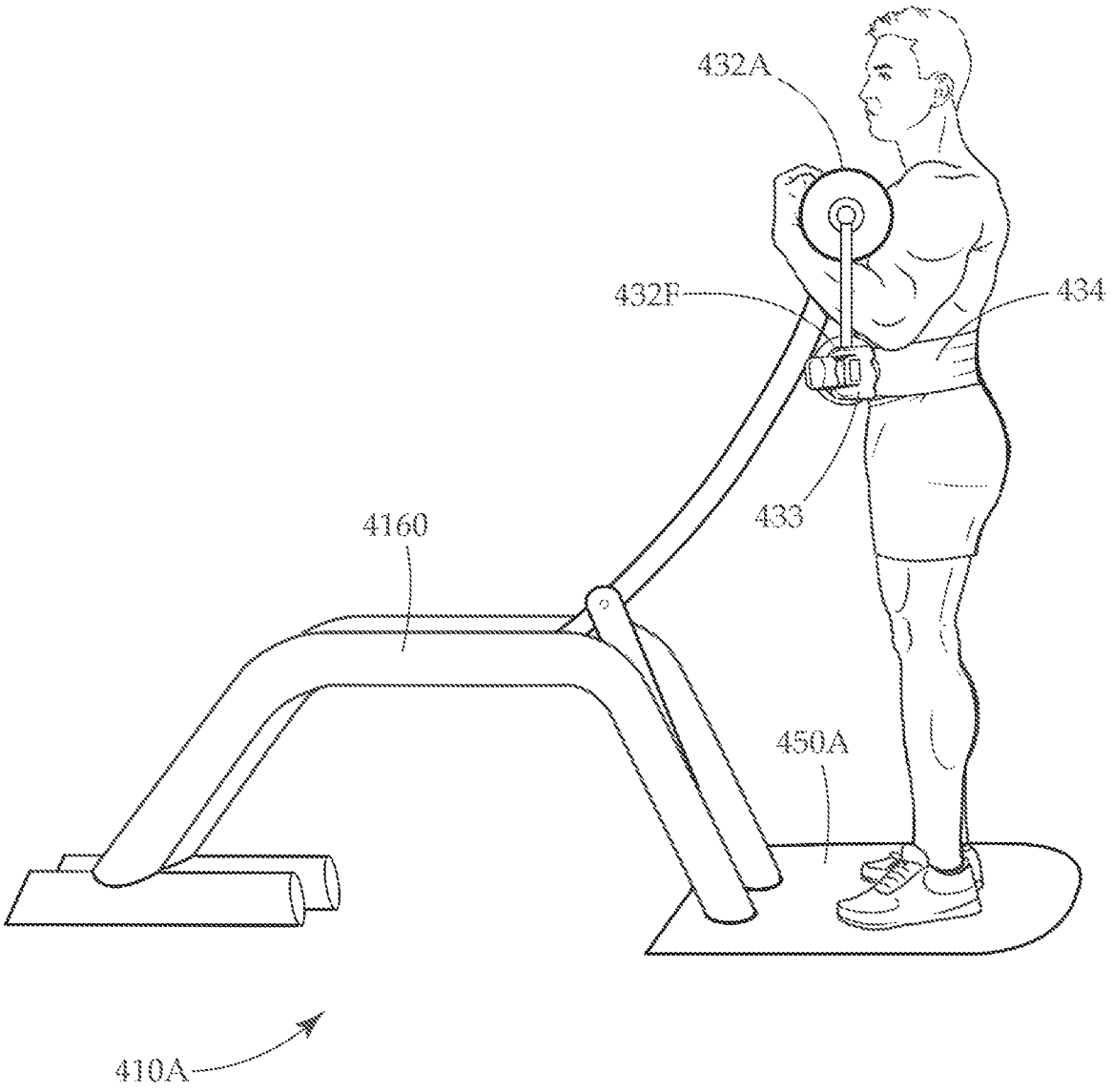

FIG. 145 illustrates the side view of an exerciser performing a reducing load squat on the squat machine.

Figure 146:
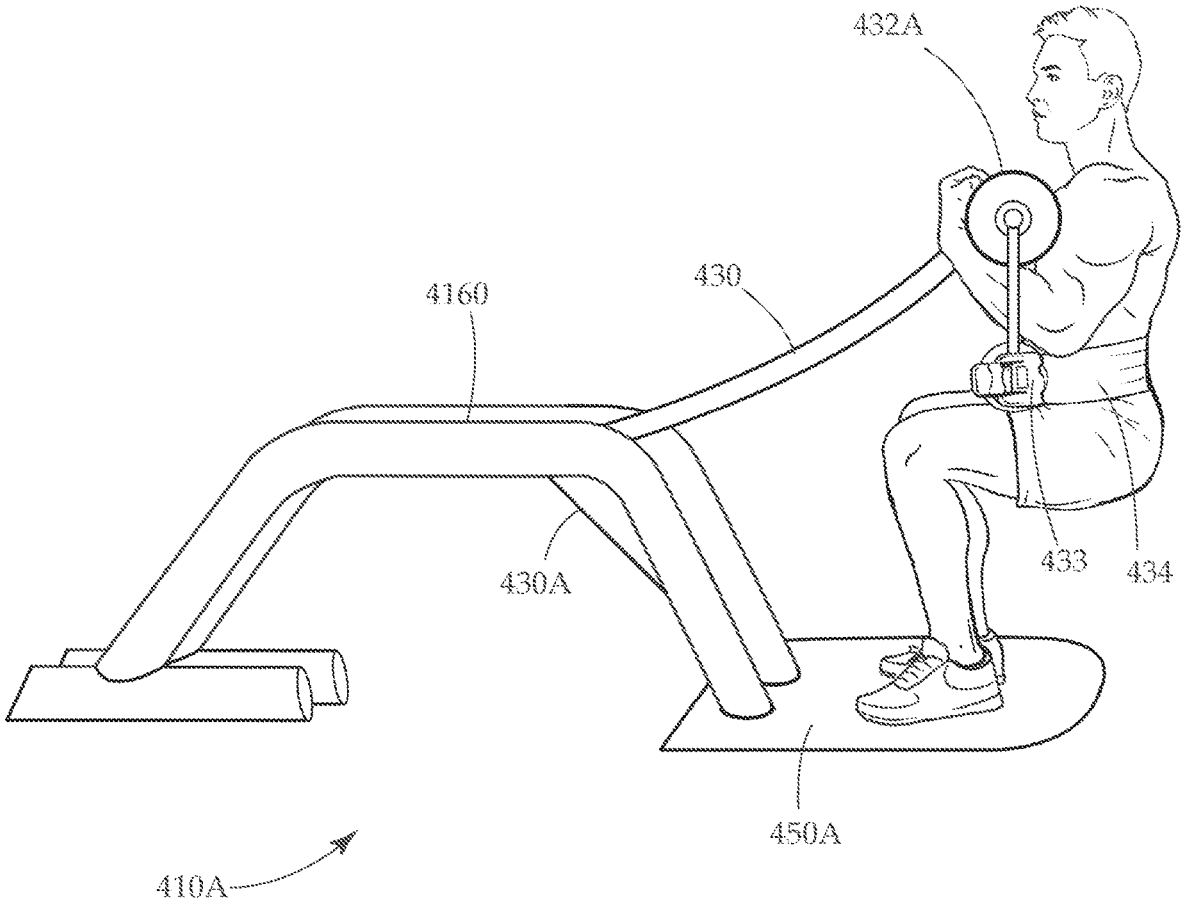

FIG. 146 illustrates the user in the squat exercise machine in the bottom of the range of motion.

Figure 147:
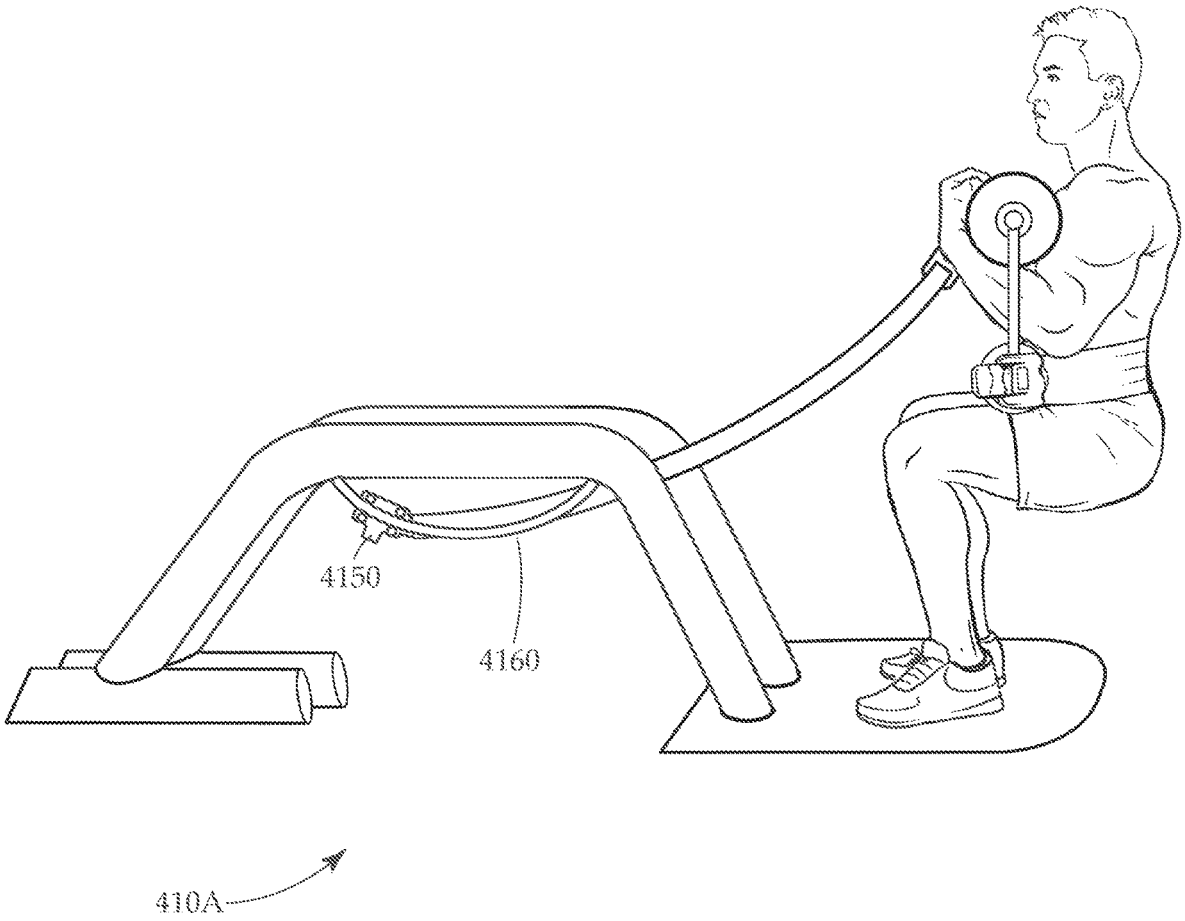

FIG. 147 illustrates a side view of an exerciser performing the first phase of a magnifying load squat on the squat machine adapted with the guide arm, trolley, and curved rail assembly.

Figure 148:
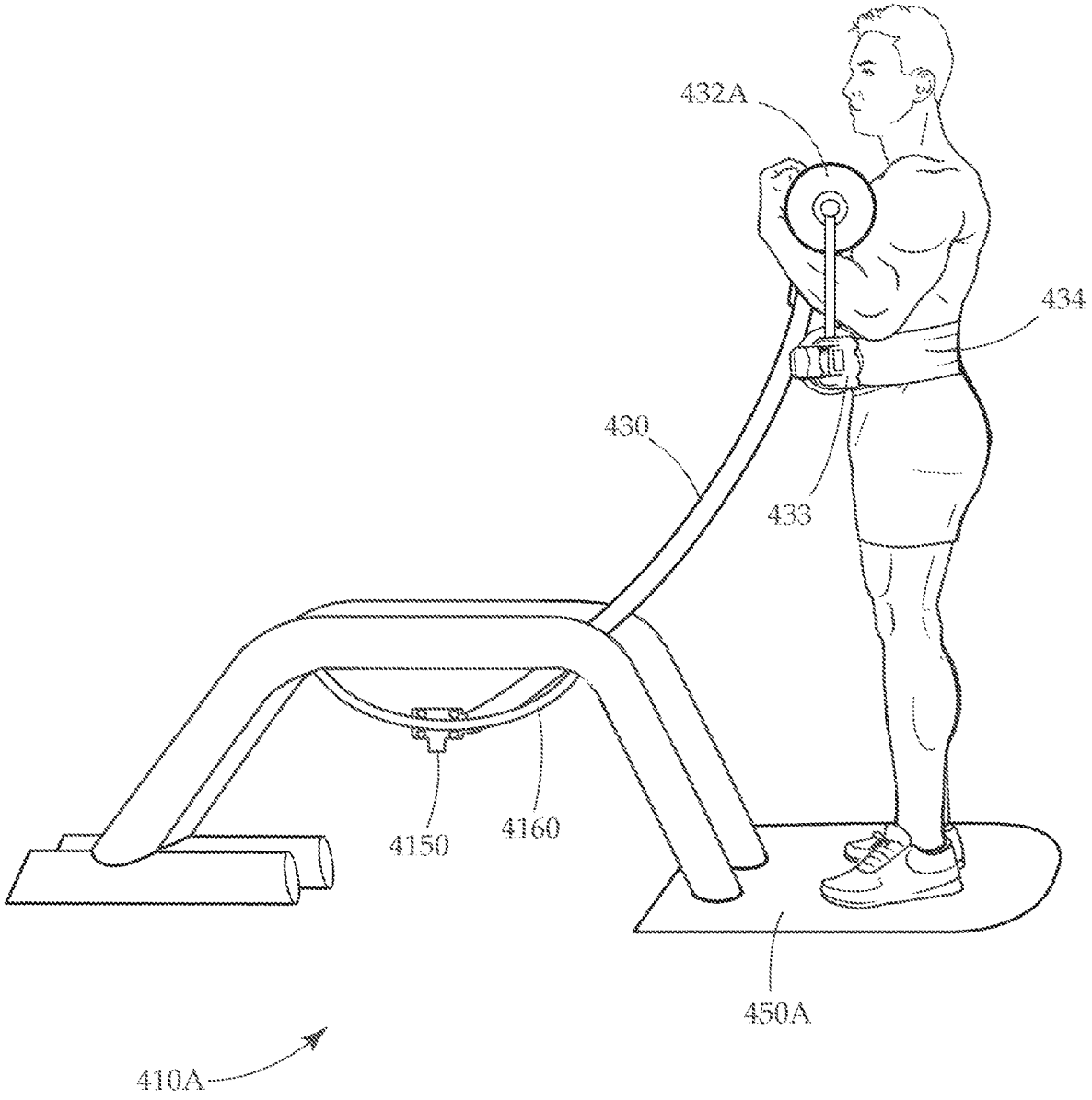

FIG. 148 illustrates the top phase of a side view of an exerciser performing a magnifying load squat.

DETAILED DESCRIPTION OF THE SEVERAL EMBODIMENTS

Figure 1:
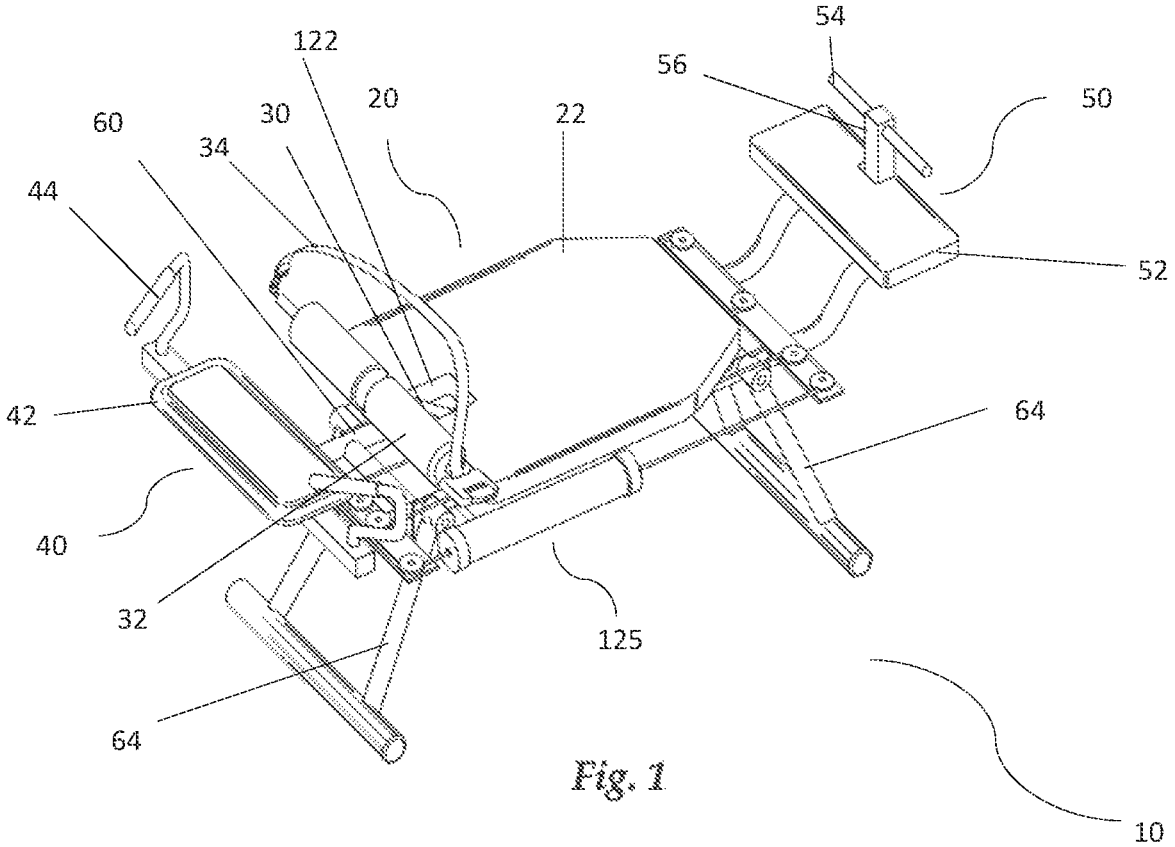
FIG. 1 is a perspective view of exercise equipment.

FIG. 1 is a perspective view of exercise equipment 10. The exercise machine 10, also a system and series of apparatuses, may comprise three main support and utilization members, namely at least one core support 20, at least one head support 40, at least one foot support 50, and at least two legs 64. The exercise equipment 10 is a main support frame 60 which supports the three main support members 20, 40, 50. The head support 40, more closely depicted in FIGS. 8-10, consists of a plank support pad 42 and handlebars 44. The position of the handlebars 44 may be adjusted by the user depending on the type of exercise desired. The foot support 50, more closely depicted in FIGS. 11-13, consists of a foot pad 52, a foot element 54, and a foot element positioner 56.

Figure 14:
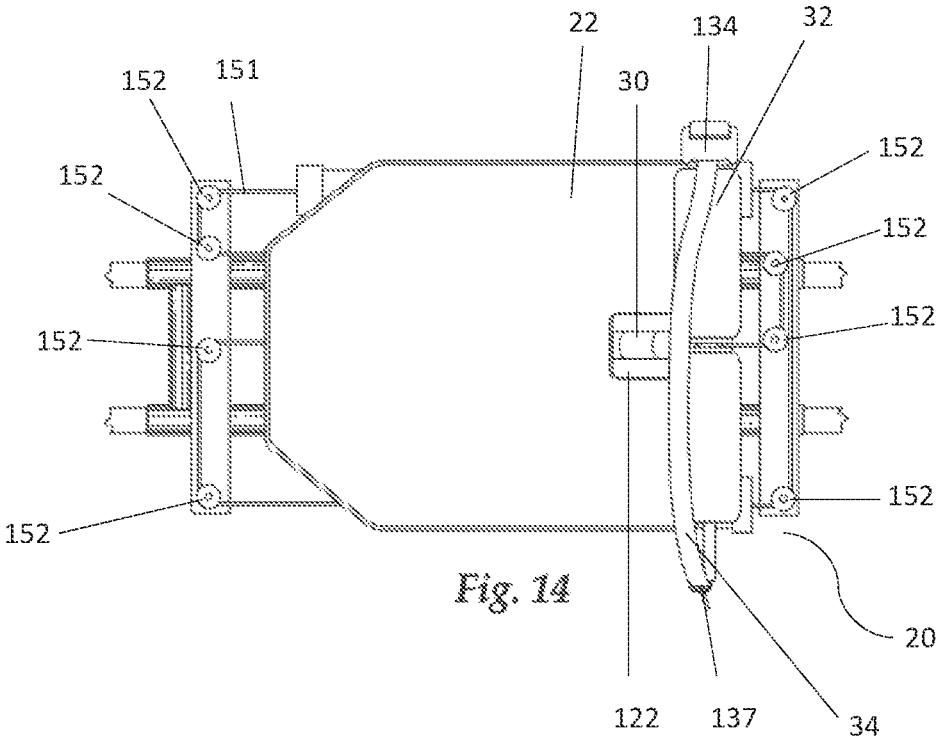
FIG. 14 is a partial top view of the core support.
Figure 15:
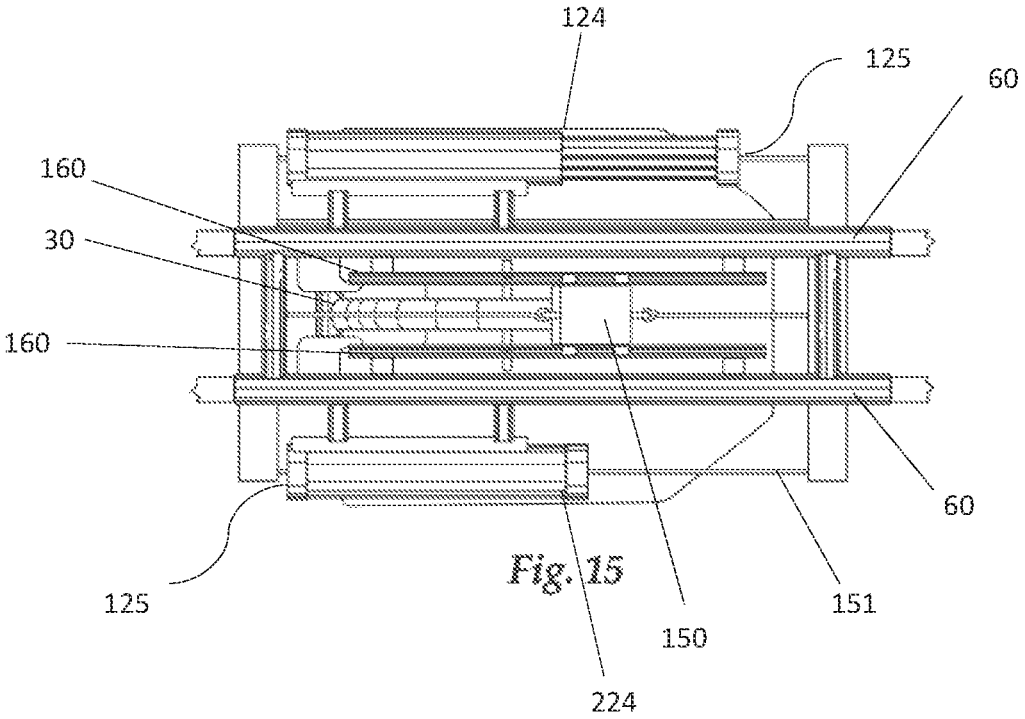
FIG. 15 is a partial bottom plan view of the core support.
Figure 16:
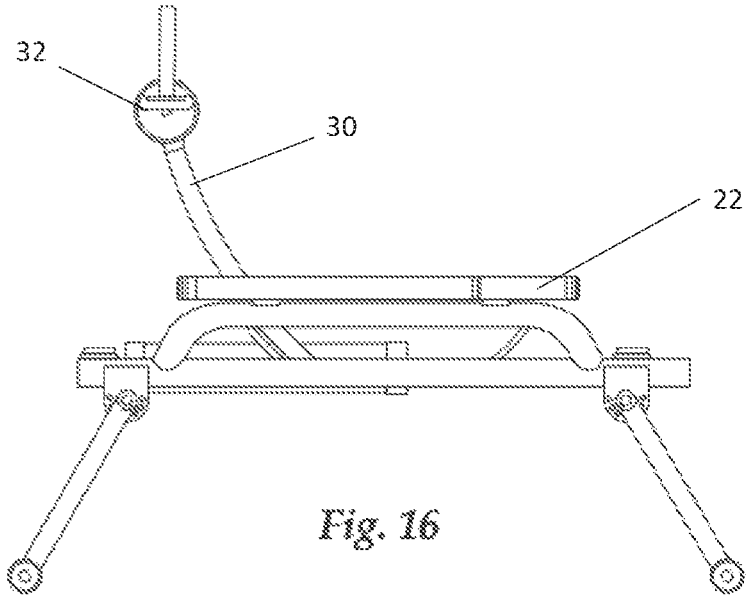
FIG. 16 is a partial front side view of the core support.

The core support 20, more closely depicted in FIGS. 14-16, may comprise a body support pad 22, a guide arm 30 and a guide arm pad 32, and a retractable harness 34. The guide arm 30 is connected to the core support 20 by at least one fulcrum 26 that allows the guide arm 30 to move with the user. The guide arm is connected by at least one fulcrum 26 to the center of the core support 20 and can be extended upwards through a groove 122 in the body support pad 22. In another embodiment, the guide arm 30 is also connected to a force component 125 that can be varied and adjusted according to the user. The force component 125 is depicted more closely in FIGS. 20, 20A, and 21.

Figure 1A:
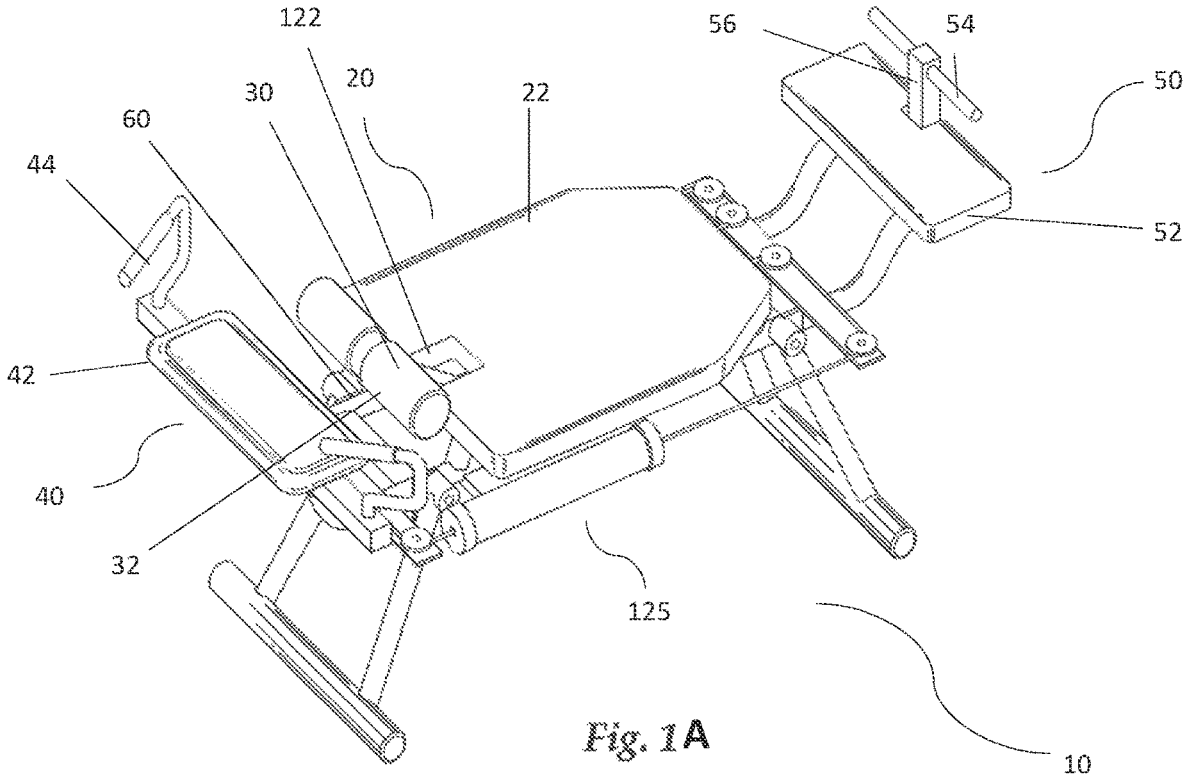
FIG. 1A is a perspective view of the exercise equipment without a retractable harness.

FIG. 1A is a perspective view of the exercise equipment shown in FIG. 1. In this embodiment, the machine does not have the retractable harness.

Figure 1B:
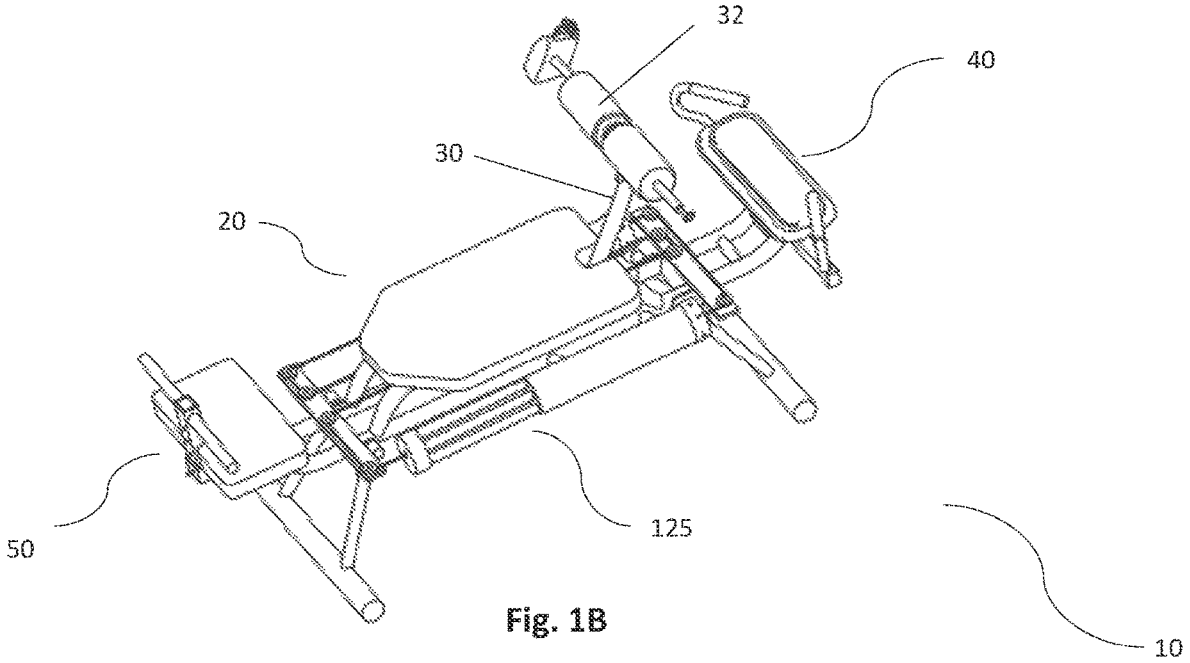
FIG. 1B is a perspective view of the exercise equipment with the guide arm up.

FIG. 1B is a perspective view of the exercise equipment as shown in FIG. 1. In illustration the guide arm is up.

Figure 2:
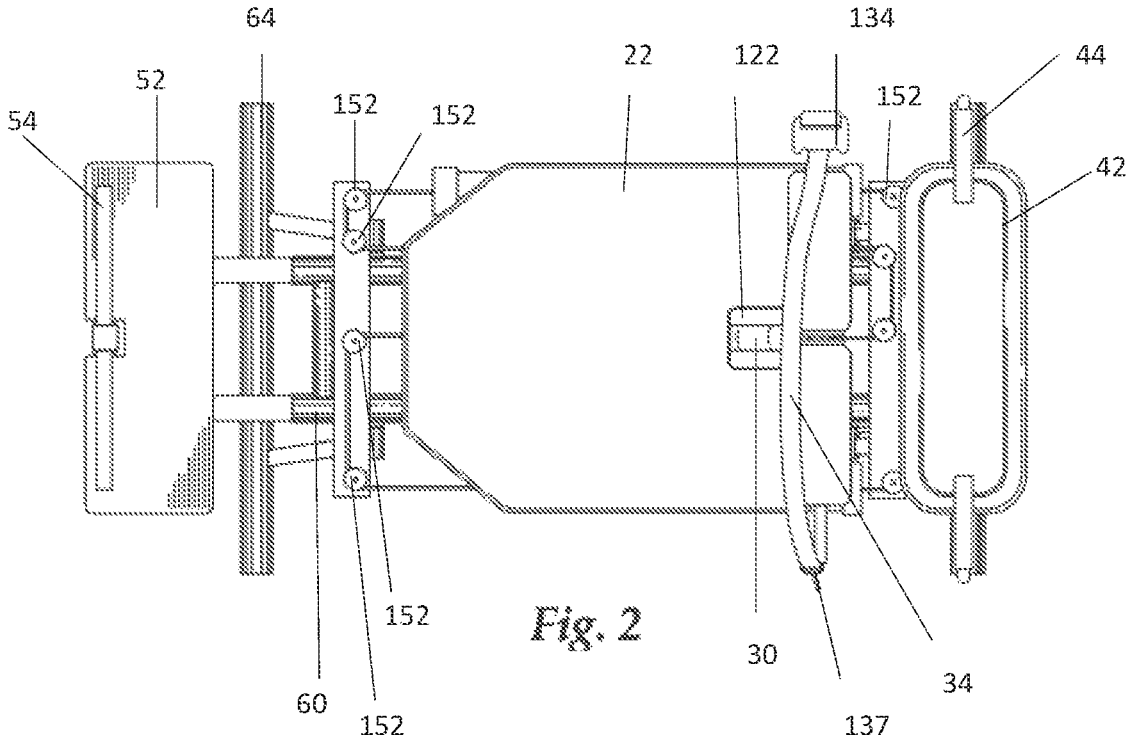
FIG. 2 is a top plan view of the exercise equipment.

FIG. 2 is a top view of the exercise machine, a main support frame 60 supports the body pad 22, foot pad 52, and plank support pad 42. The guide arm 30 extends through the groove 122 of the body support pad 22. In this embodiment, the retractable harness 34 extends from the guide arm 30 and works through a harness ratchet mechanism 134 before attaching to a harness latch 137. In this view, the rotating guide members 152 of the force mechanism 125 can also be seen below the body pad 22.

Figure 3:
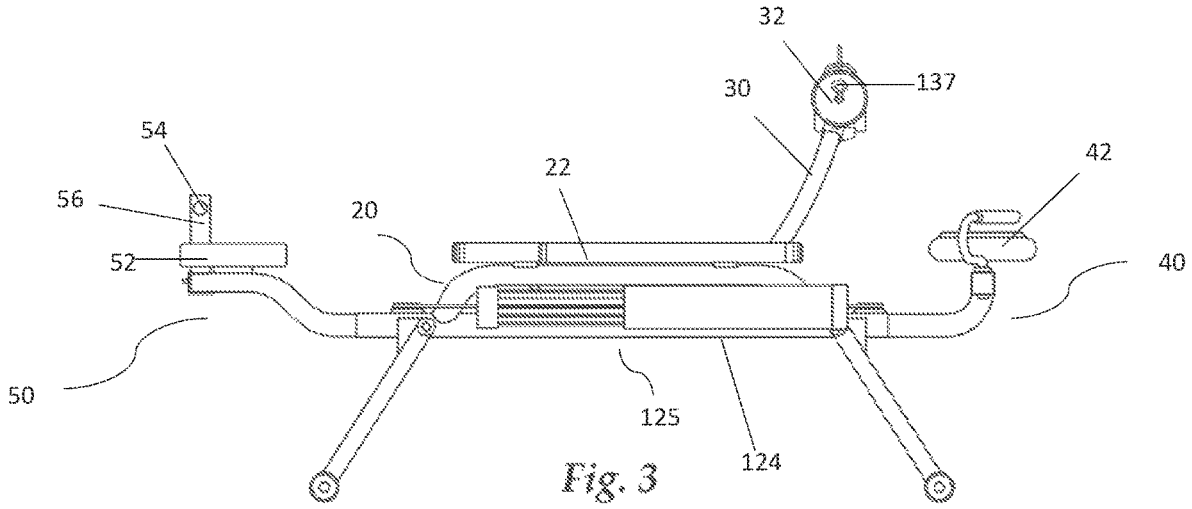
FIG. 3 is a front side view of the exercise equipment.

FIG. 3 is a side view of the exercise machine, in this view a main support beam frame supports the core support 20, head support 40, and foot support 50 which support the body pad 22, plank support pad 42, and foot pad 52, respectively. The guide arm 30 extends through the body support pad, and the retractable harness is attached to the harness latch. The foot pad 42 supports a foot 56 element positioner located perpendicularly to the foot pad. The foot element positioner further supports a foot element 54 positioned parallel to the foot pad. In this view, the added load canister 124 of the force component 125 is located beneath the body support pad 22 next to the core support frame 60.

In one embodiment, the force component, 125 consists of at least one added load canister 124 and at least one assisted canister 224 comprising a grouping of male tubes 126 and a grouping of female tubes 127, wherein the male tubes 126 have a smaller diameter than the female tubes and wherein as the male tubes 126 of one canister unit starts to extend out of the female tubes 127, a male canister 126 of a second canister unit starts to move into the corresponding female tubes 127 of a second female canister unit. In this embodiment canisters are connected via a guide cable such that they create a loop 129. One canister unit is active while the other canister unit is inactive, the active canister unit then pulls the inactive canister unit.

Figure 4:
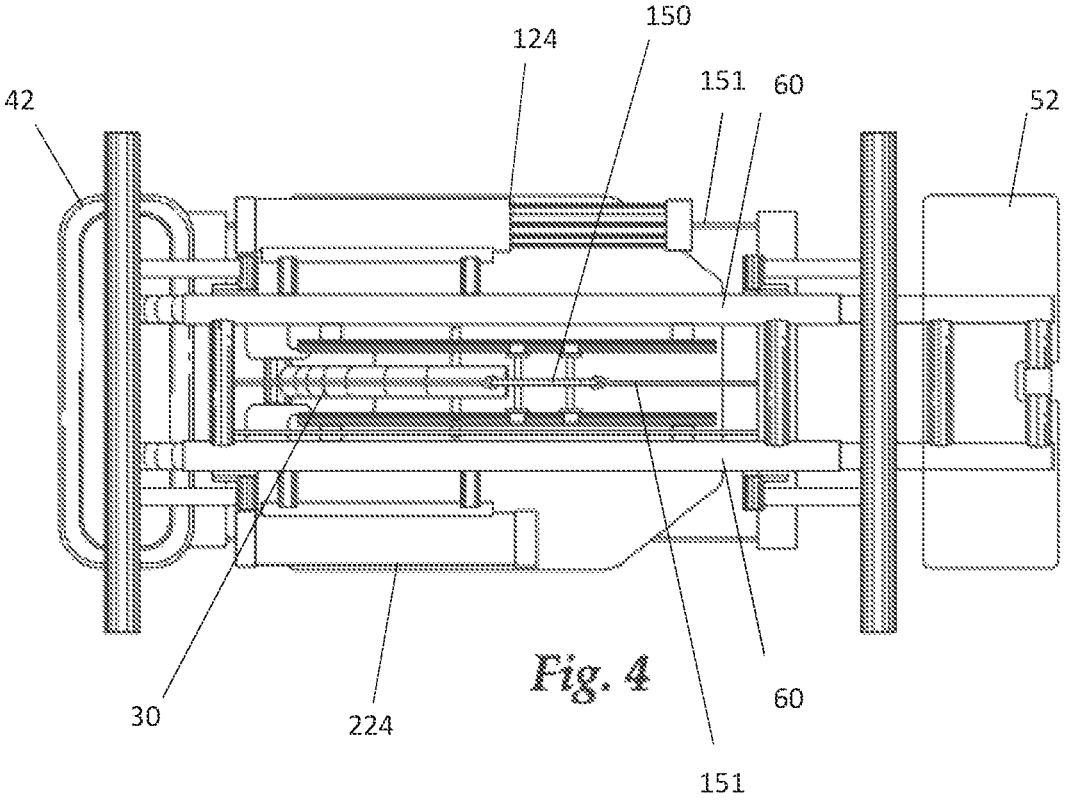
FIG. 4 is a bottom view of the exercise equipment.

FIG. 4, is a view from the bottom, a main support frame 60 runs the length of the exercise machine 10 and connects the three main supports members 20, 40, 50 of the exercise equipment 10. In this embodiment, the main support frame consists of two vertical beams connected by two cylindrical horizontal beams, forming a rectangular frame. Other embodiments could be imagined, such as a single beam, or horizontal or vertical multiple beams, for additional support. From the bottom, the force component can be seen 125, including the assisted canister 224 and the added load canister 124, located on opposing sides of the machine. The assisted canister and the added load canister are connected via a guide cable 151. The guide cable 151 connects the assisted canister to a trolley 150 before connecting the trolley to the added load canister. The guide cable 151 then completes a loop by connecting the added load canister 142 to the assisted canister 224. The force component will be described in greater detail and view in FIGS. 20, 20(*a*), and 21.

Figure 5:
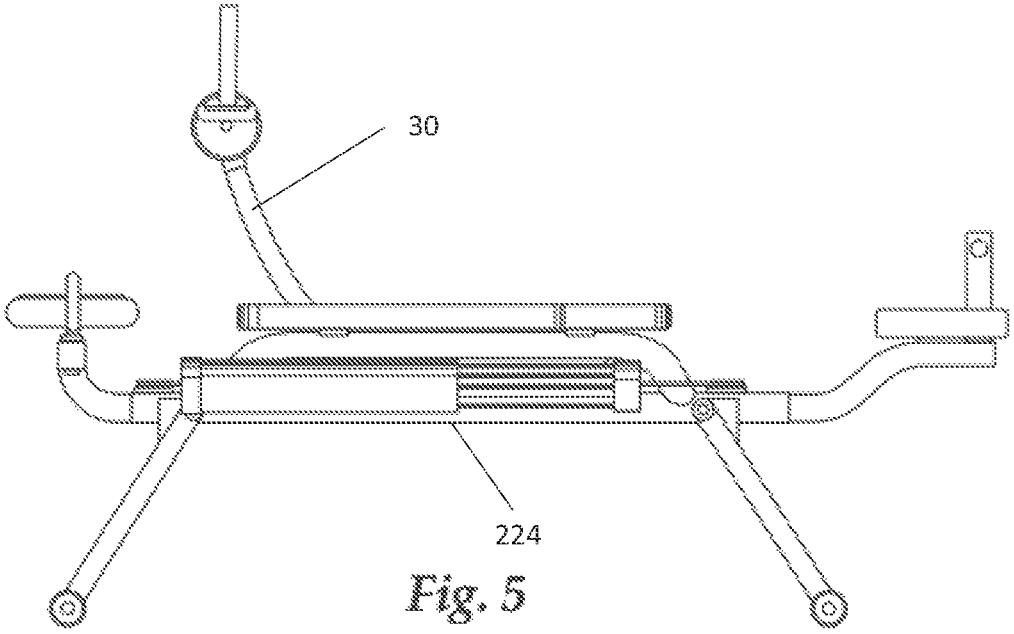
FIG. 5 is a side view of the exercise equipment.

FIG. 5 is a side view of the exercise equipment. In this view, the guide member 30 of the core support 20 is up and the assisted canister 224 of the force mechanism 125 can be seen on the side of the exercise machine.

Figure 6:
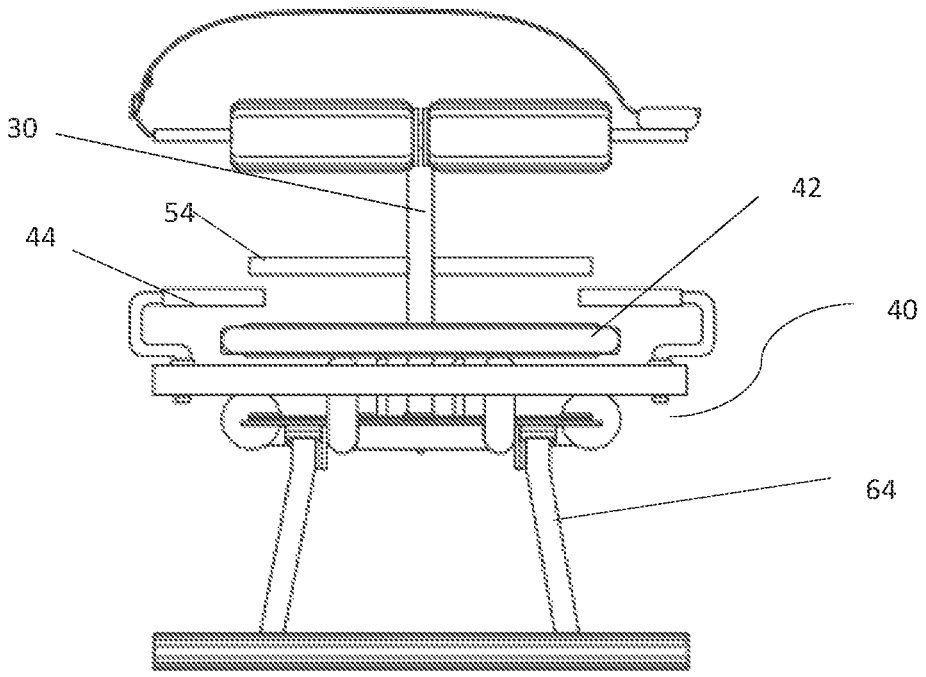
FIG. 6 is a view of the exercise equipment from the head of the equipment.

FIG. 6 is a view from the head of one embodiment of the exercise machine 10. It is essentially the front of the machine. It consists of the head of machine leg 64 the head support 40, the front of the plank support pad 42, the handlebars 44 and in the background, is seen the foot element 54 and the foot element positioner 56.

Figure 7:
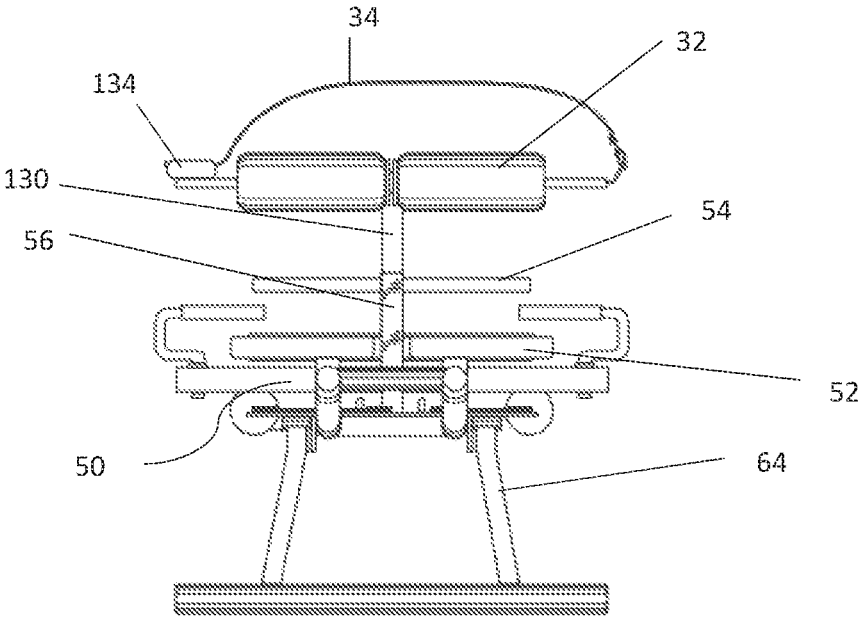
FIG. 7 is a view of the exercise equipment from the feet.

FIG. 7 is a view from the foot of the exercise machine 10. It is essentially the back of the machine. It consists of the foot area leg 64, the foot support 50, the back end of the foot pad 52, the foot element 54, the foot element positioner 56, and the handle bars 44 are seen in the background. Additionally, the guide arm 30, guide arm pad 32, retractable harness 34, and harness ratchet mechanism 134 can be seen.

Figure 8:
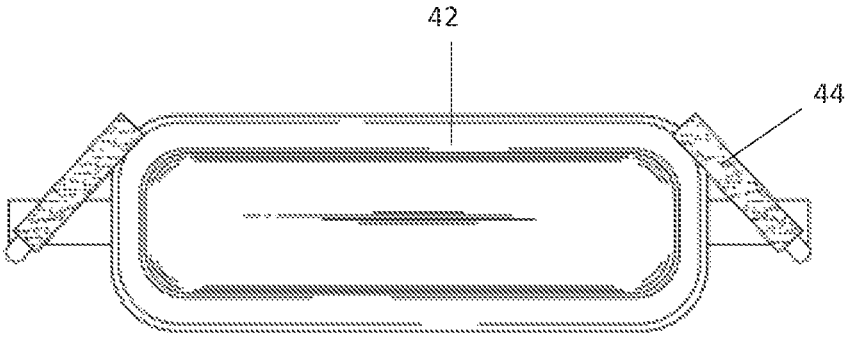
FIG. 8 is a partial top plan view of the head of machine support.
Figure 9:
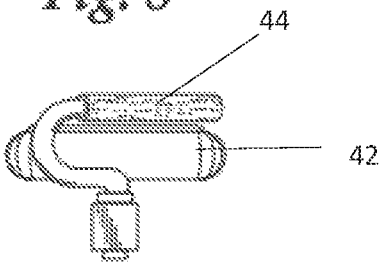
FIG. 9 is a partial front side view of the head of machine support.
Figure 10:
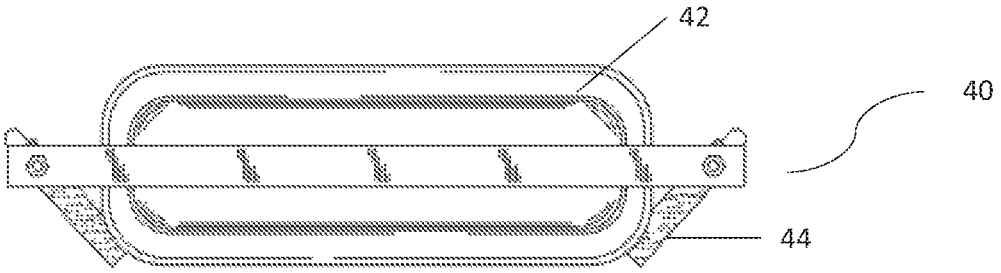
FIG. 10 is a partial bottom view of the head machine support.

FIG. 8 is the top plan view of the head of the machine support 40. It consists of the plank pad 42, the handle bars 44 and the foot of the front leg 64. FIG. 9 is a partial front side view of the head of the machine support 40. It consists of a side view of the plank pad 42 and the handlebars 44. FIG. 10 is a partial bottom view of the head of the machine support 40, which may comprise a plank pad 42, and the handlebars 44.

Figure 11:
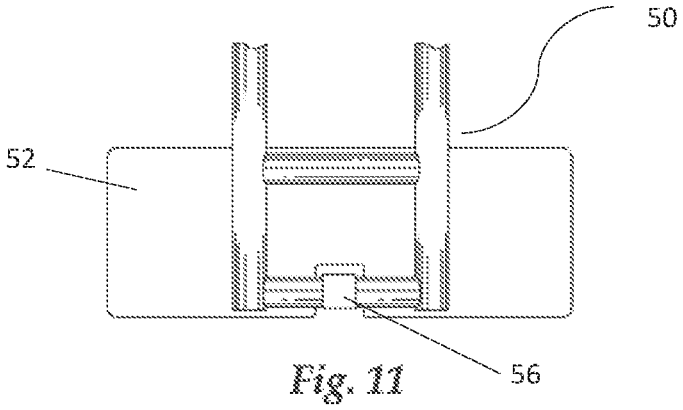
FIG. 11 is a partial bottom view of the foot support.
Figure 12:
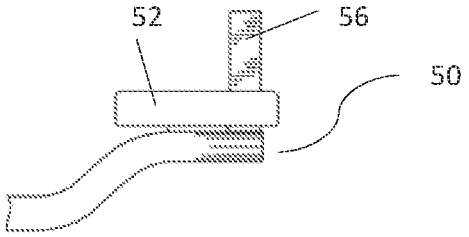
FIG. 12 is a partial front side view of the foot support.

FIG. 11 is a partial bottom view of the foot support 50 which comprises a foot support pad 52, a foot element 54 and a foot element positioner 56. FIG. 12 is a partial front side plan view of the foot support 50 further illustrating the back end of the core support system 60, a side view of the foot support pad 52, a side view of the foot element 54 and the foot element positioner 56.

Figure 13:
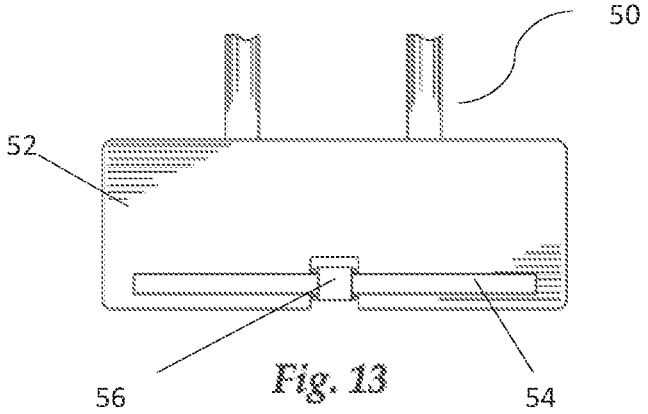
FIG. 13 is a partial top view of the foot support.

Additionally, FIG. 13 is a partial top view of the foot support 50. It consists of the top view of the foot support pad 52, the top view of the tube of the foot element 54 and the top view of the tube of the foot element positioner 56.

FIG. 14 is a partial top plan view of the core support 20 illustrating the body support pad 22, the groove 122 in the body support pad, the guide arm 30 and the guide arm pad 32.

Additionally, the rotating guide members 152, and the guide cable 151 of the force component 125 can be seen below the body support pad.

FIG. 15 is a partial bottom view of the core support 20 which comprises a central support frame 60, body support pad 22, the guide arm 30, and the force component comprising the assisted canister 224, the added load canister 124, at least two rails 160, a trolley 150, a guide cable 151.

FIG. 16 is a partial front side view of the core support 20 illustrating the body pad 22, the guide arm 30, and the guide arm pad 32.

Figure 17:
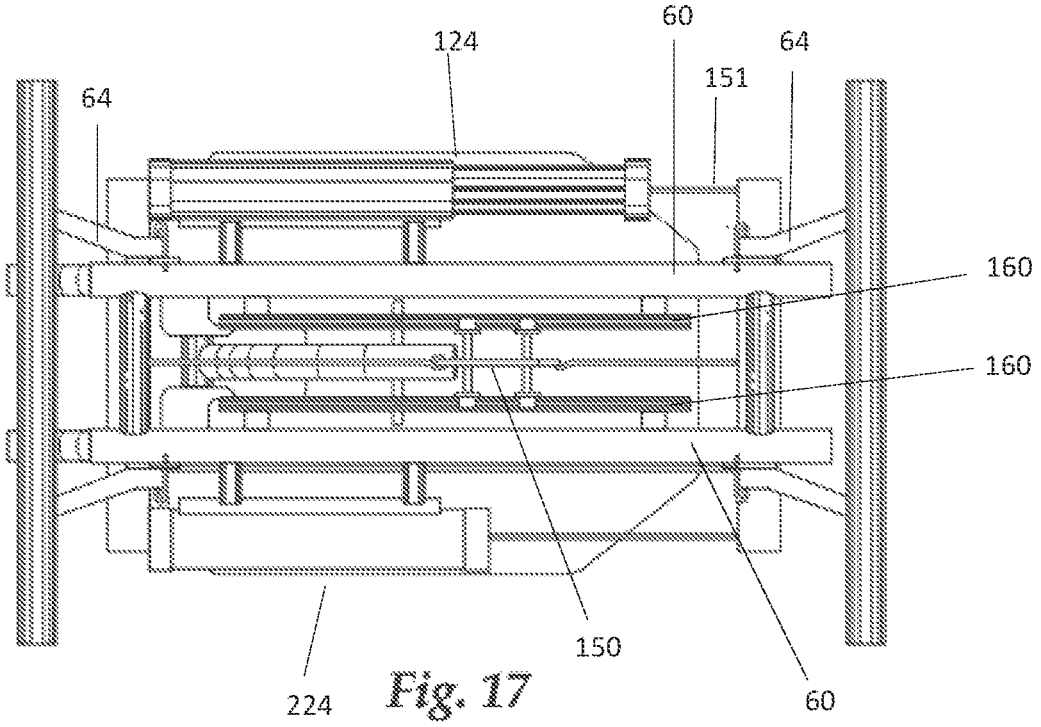
FIG. 17 is a bottom view of the core and force component.

FIG. 17 is the bottom view of the main support frame 60 and the head and foot area legs 64. The force component 125 is also illustrated, as in FIG. 15.

Figure 17A:
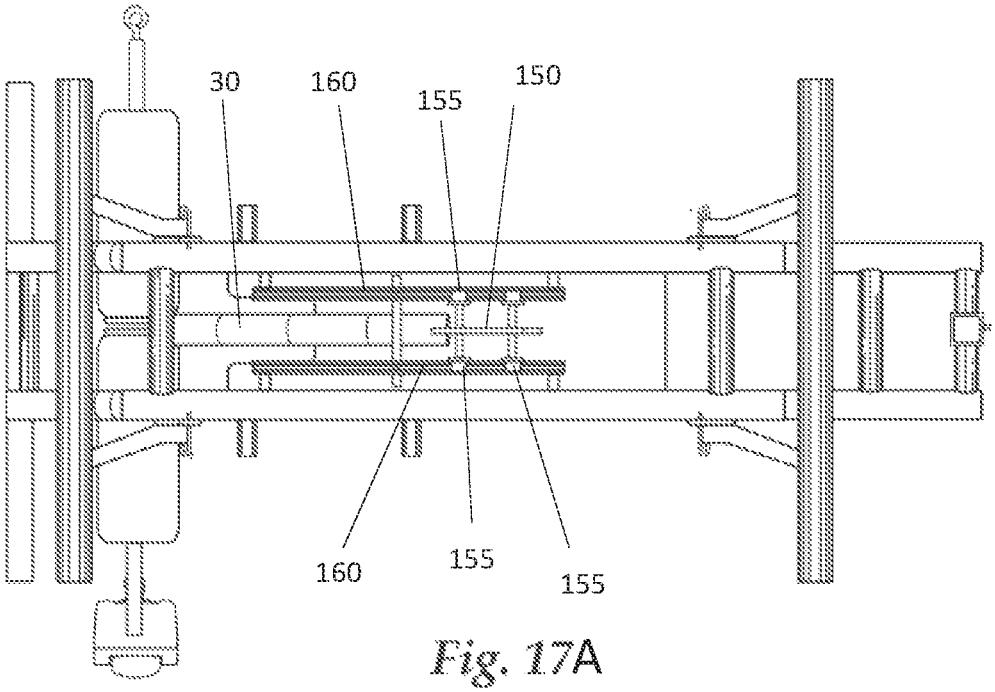
FIG. 17A is a bottom view of the apparatus without the canisters.

FIG. 17A is a bottom view of the rail and trolley system without the added load 124 or assisted canister 224 or the body pad 22. In this view, the guide arm 30 is down and the trolley wheels 155 can be seen on the rails 160.

Figure 18:
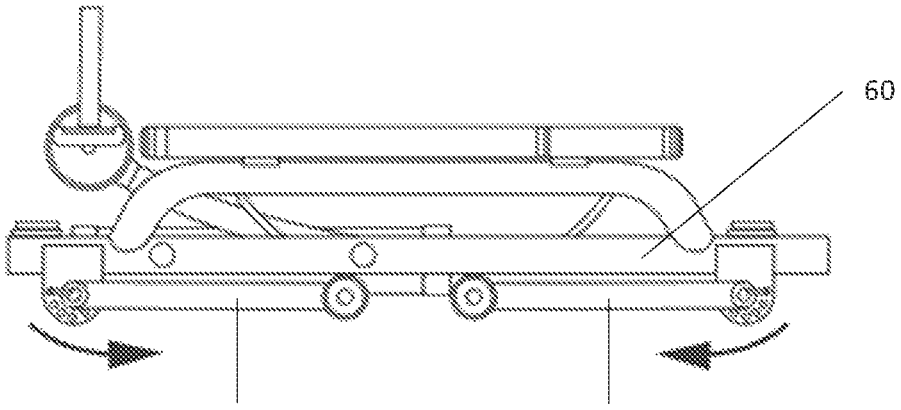
FIG. 18 is a view of the equipment with the legs folded inward.

FIG. 18 illustrates the exercise machine with the legs 64 folded inward beneath the main support frame 60 to save space for storage and during transport.

Figure 19:
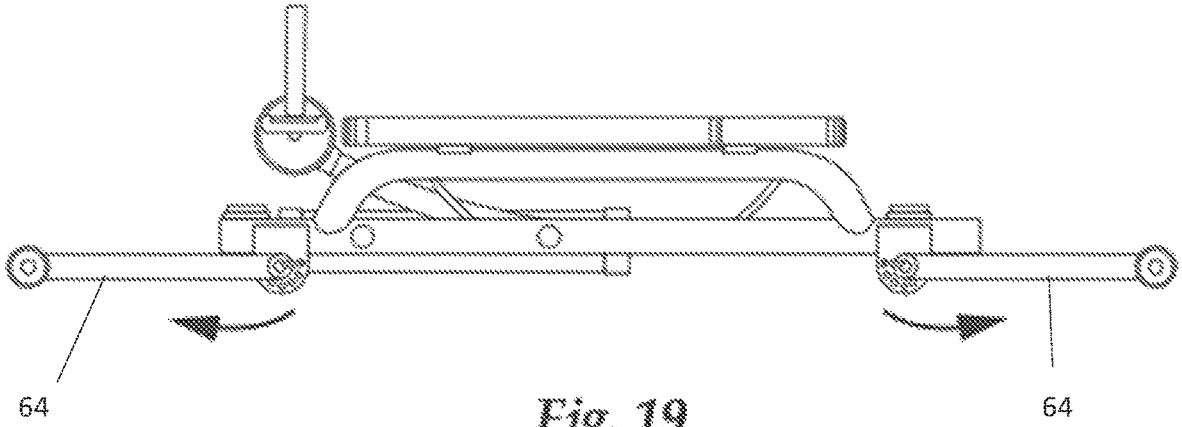
FIG. 19 is a side view of the exercise machine in a folded configuration with the legs folded outward.

FIG. 19 is a side view of the exercise machine 10 illustrating the head of the machine and foot of the machine legs 64 folded outwardly such that the machine takes up less space vertically, for storing in spaces such as underneath a bed.

Figure 20:
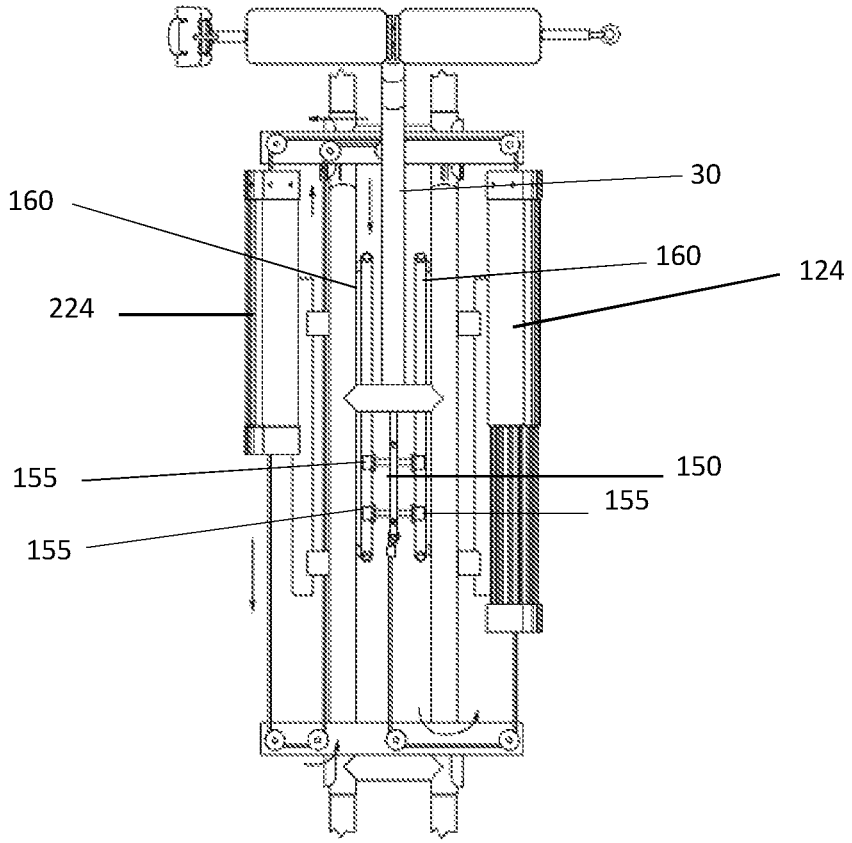
FIG. 20 is a top view of the exercise equipment with the body pad removed to reveal the force component and frame.

FIG. 20 is a top view of the exercise machine with the body pad removed to show the main support frame 60, the force component 125, the guide arm 30, the guide arm pad 32. The force component 125 comprises a loop connecting an assisted canister 224, and added load canister 124, and a trolley 125. The added load canister and the assisted canister each further comprise a plurality of telescoping tubes. The telescoping tubes further comprise male tubes 126 and female tubes 127. The female tubes 126 are fixed inside the canister at a front end of the tube, the male tubes 127 are fixed to the canister cap 128 such that when the male tubes are fully inserted into the female tubes the cap creates a closed canister. The male tubes of each canister has a smaller diameter than the female tubes such that the male tubes can be inserted into and extend from the female tubes. If no force is applied in the system, the male tubes 126 of the assisted canister starts 224 extend as the male members 126 of the added load canister 124 begins to retract into the female member, as shown by the arrows. The action of each canister therefore counteracts each other. If the assisted canister 224 has a selection of force, the canister on the right, the added load canister, will have zero force. The action of the assisted canister 224 therefore pulls the added load canister such that the male tubes 126 of the added load canister 124 are completely inserted and the canister cap closes the canister system. The two canisters and trolley are connected via the guide cable 151. The guide cable comprises at least three guide cable members, 151*a*, 151*b*, and 151*c*. One guide cable member 151*a* connects the canister cap 128 of the assisted canister 224 to the trolley 150. One guide cable member 151*b* connects the front end of the assisted canister to the front end of the added load canister 124. Another guide cable member 151*c* connects the canister cap 128 of the added load canister 224 to the trolley 150. The guide cable is looped through a plurality of rotating guide members as it connects the canisters and the trolley.

Figure 21:
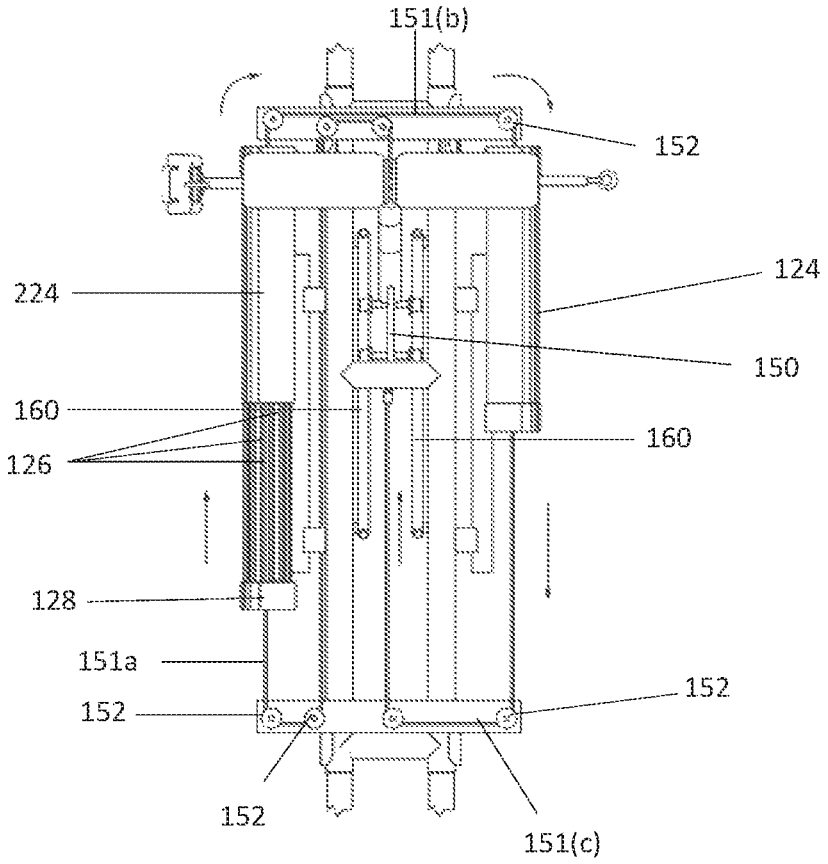
FIG. 21 is a top view of the exercise equipment with the body pad removed to reveal the force component and frame without a harness.

FIG. 21 illustrates an embodiment of the machine in which the body pad 22 has been removed. In this embodiment, the guide arm 30 is up and the added load canister has a force selected. As shown by the arrows, the male members of the added load canister extend and pull the guide cable, thus pulling the male members 126 of the assisted canister into the female tube members of the assisted canister until the male tube members are completely in line with the canister and the canister cap 128 closes the canister. The added load system functions when the loop goes in the opposite direction of what was described in FIG. 20. That is, the added load canister 124 has a selection of force while the assisted canister has a zero force. Action of the added load canister 124 pulls the assisted canister until the male tubes of the assisted canister is completely inserted and the canister cap 128 is on the assisted canister.

Figure 21A:
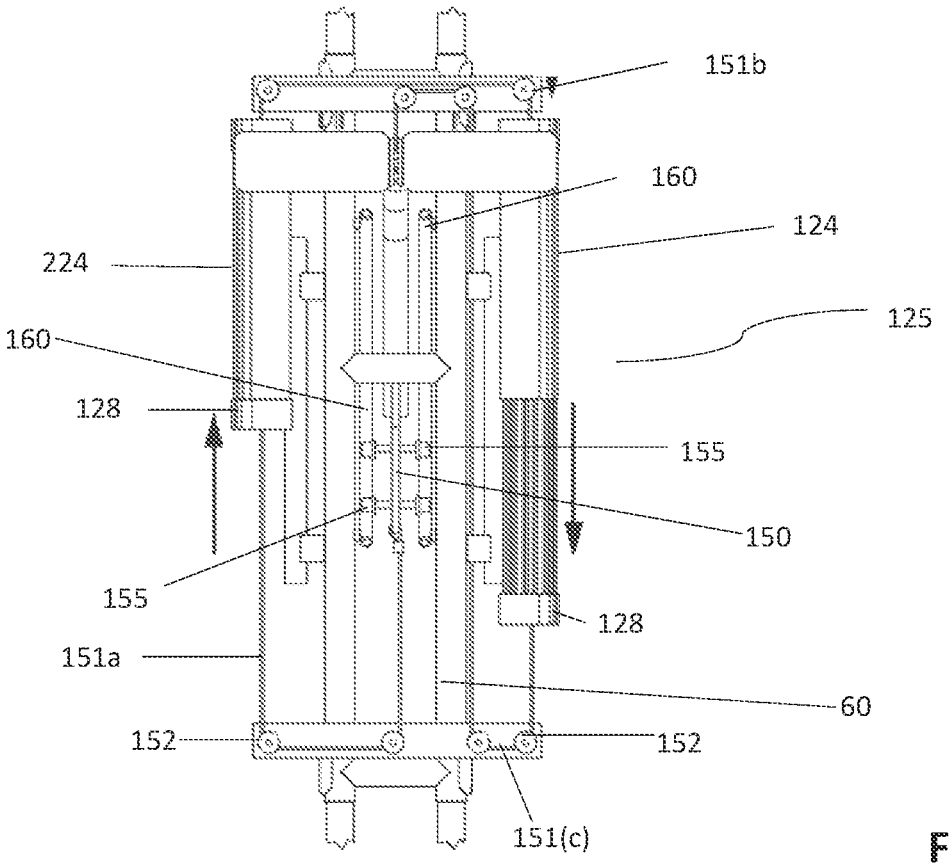
FIG. 21A is a top view of the exercise equipment with the body pad removed to reveal the force component and frame with the guide arm up.

FIG. 21A is a view of the top of the machine with the body pad removed and the guide arm 30 in the up position. In this embodiment, the added load canister has a selection force and the trolley 150 at the front of the rails 160. In this illustration, the male member tubes 126 of the added load canister have been completely extended and the male member tubes 126 of the assisted canister have been pulled such that they are completely inserted into the assisted canister female tube members 127. The rail system comprises at least two rails 160, a trolley 150, the and the guide arm 30 which is connected to the trolley 150. The trolley further comprises at least two wheels 155 which hold the trolley to the wheels. The top wheels of the trolley may be eccentric to help the trolley sit on the rails better. Further, the rails can be cut to include a channel in which the trolley wheels can be located.

Figure 22:
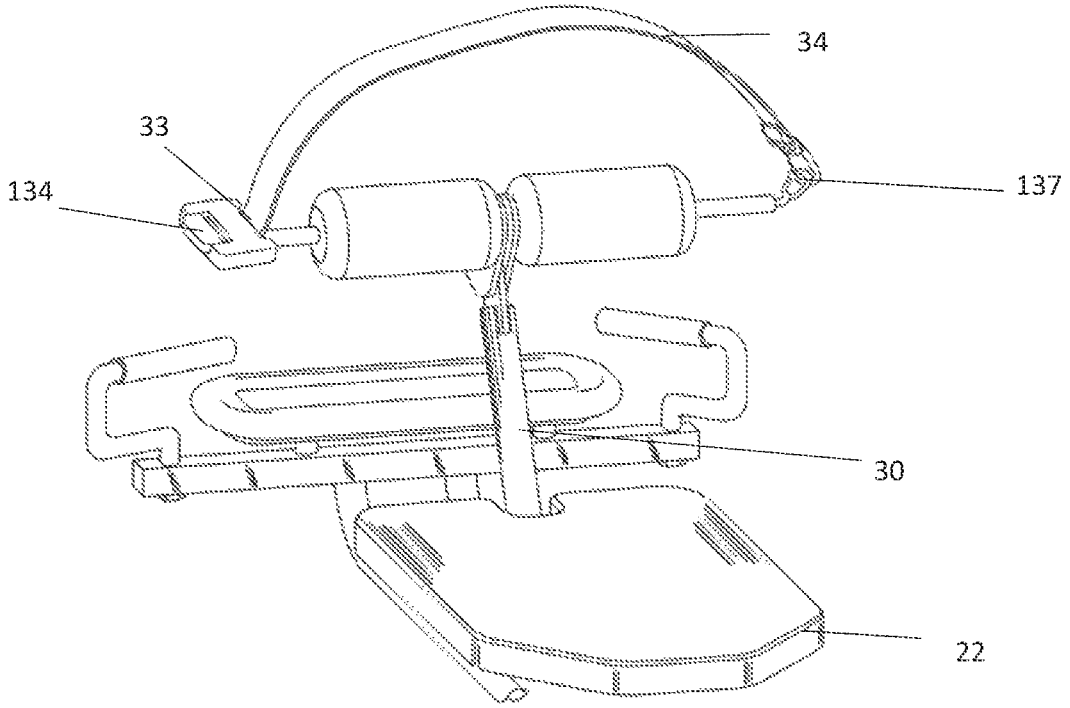
FIG. 22 is perspective view of a harness retracting mechanism.

FIG. 22 is a perspective view of the core support 20 illustrating a retractable harness 34, with a retracting mechanism 33, a ratcheting mechanism 134, and a latching mechanism 137. This retractable harness configuration is housed in the guide arm pad 32 structure and acts as a connection point to the machine for times when a user is performing added load exercises. This structure may also just be utilized as a hooking area and the retractable mechanism 33 may be housed in the belt or harness and hook to the machine at said point.

Figure 23:
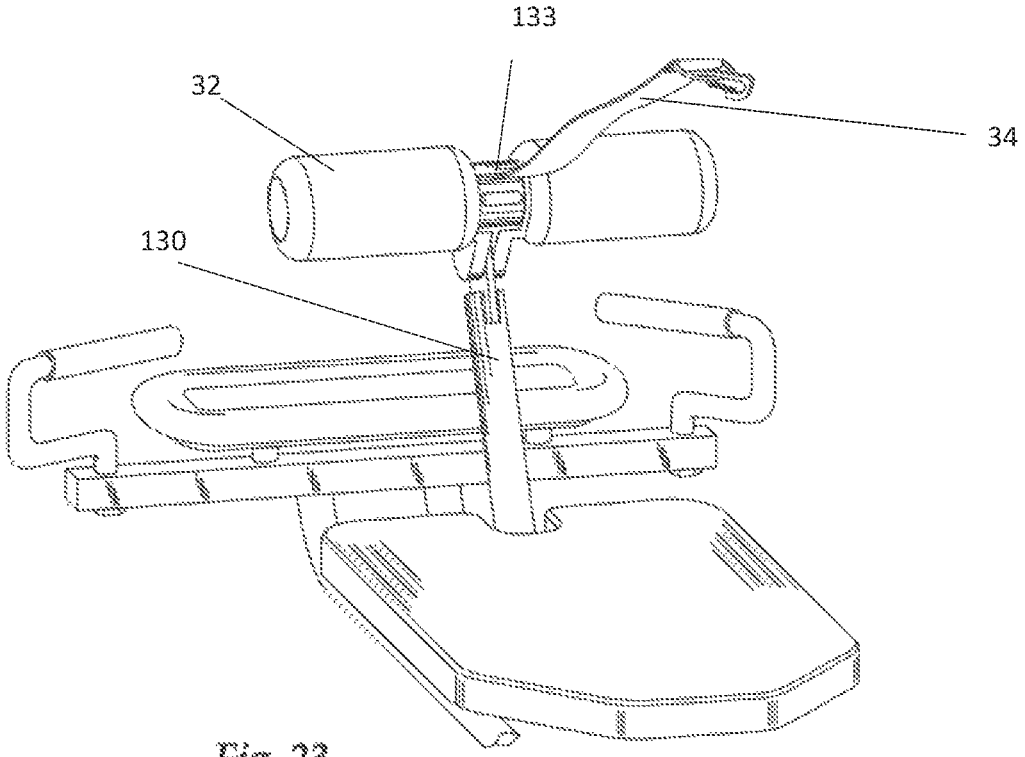
FIG. 23 is an alternate embodiment of a harness retracting mechanism.

FIG. 23 illustrates another embodiment of a harness retracting mechanism 133 located is the center of the guide arm 30 between two segments of the guide arm pad 32.

Figure 24:
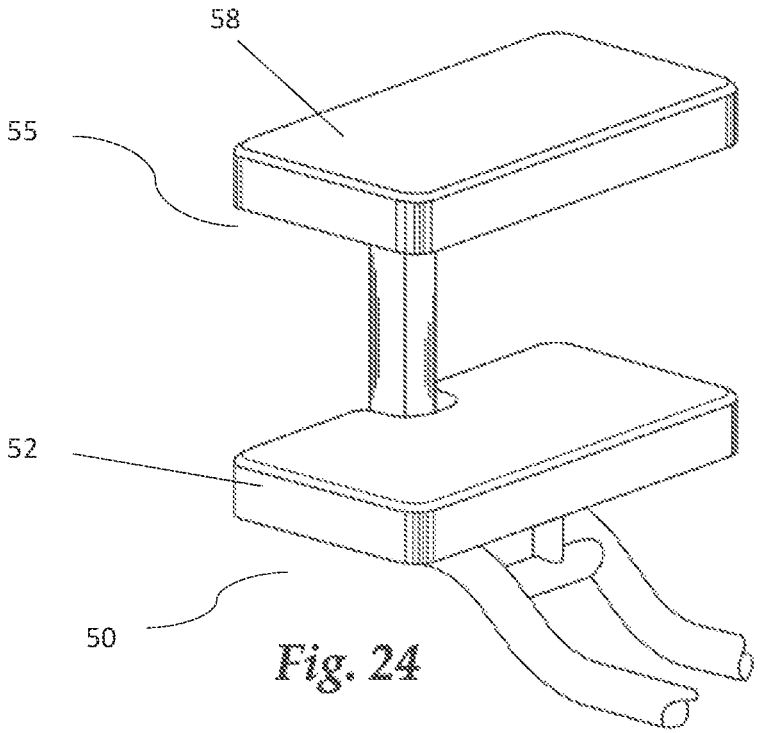
FIG. 24 is a perspective view of an auxiliary foot support.

FIG. 24 illustrates an embodiment of the foot support 50 with an auxiliary foot support 55 and auxiliary foot support pad 58 placed on top of the foot support element positioner 56 for the purposes of providing a support to elevate a user's feet.

Figure 24A:
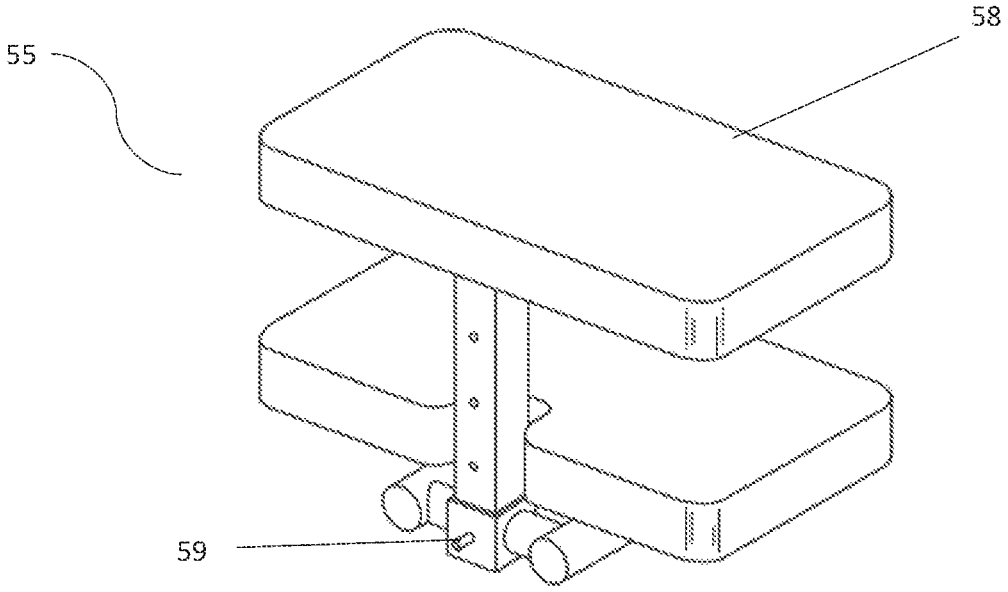
FIG. 24A is a view from the back of the auxiliary foot support.

FIG. 24A illustrates an embodiment of the auxiliary foot support 55 wherein the height of the auxiliary foot support 55 can be adjusted by securing a pin or a peg 59 through a hole in the foot element positioner 56 or a hole in a vertical support rod of the auxiliary foot support that corresponds to the desired height.

Figure 25:
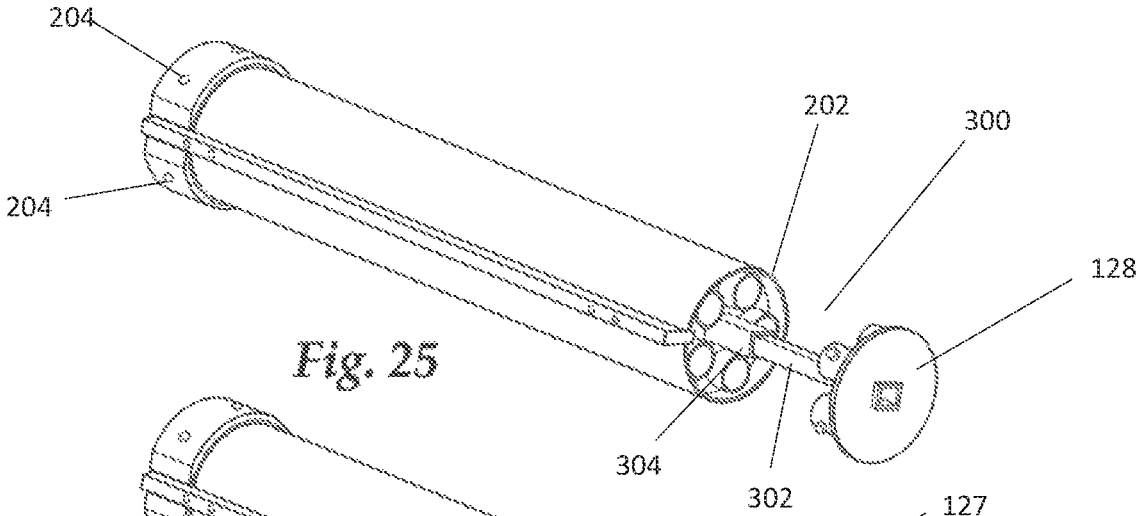
FIG. 25 is an exploded view of a canister.

FIG. 25 illustrates an expanded view of one embodiment of a canister 124 or 224 comprising a wrapping 202, a button arrangement at the front of a canister 204, a telescoping tracking protocol 300. The telescoping member keeps the male and female tube members in line and prevent twisting so that selection can occur can be further divided into a male tracking member 302 and a female tracking member 304. The button arrangement 204 is used to select the amount of force desired. While the canister and the internal tubes are depicted as cylindrical, other shapes such as squares or hexagons are possible. If the canisters are not part of a loop, as they are in this embodiment, the female tubes 127 will need to be actuated by a weak spring to bring them back for selection.

Figure 26:
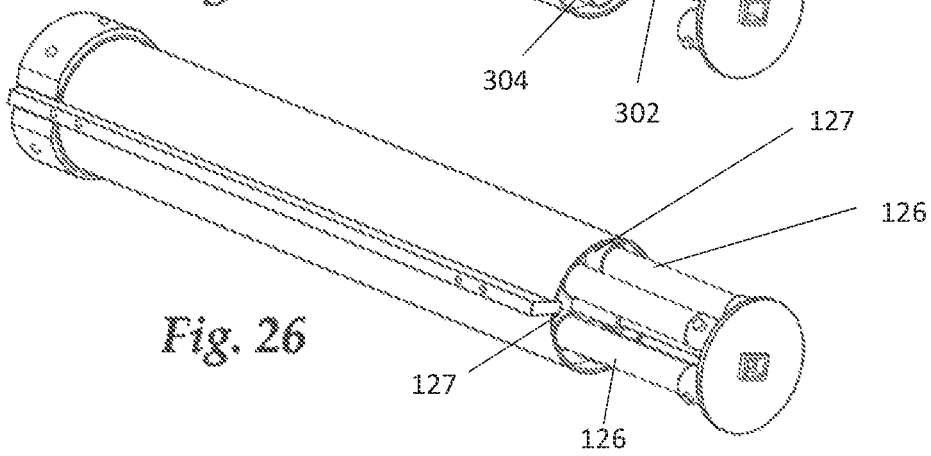
FIG. 26 is an exploded view of a canister with telescoping tubes extended.

FIG. 26 illustrates an expanded view of a canister with the male tubes 126 extended from the female tube 127. Housed in each male member tube 126 is a resilient member and a plunger receiver fixed to the resilient member. The plunger receiver receives a plunger for the purposes of turning the resilient member on or off. Each female member has a key member that receives a male member key for the purposes of keeping the tubes together. The grouping of female tubes is held together by a strapping member. In the front area of the canister is the selection member. This member is comprised of corresponding plungers or buttons which are in line with the corresponding receiving members of the male tubes when they are pulled into place by the mechanisms of the machine and kept in line by the respective key elements. When said members are in place they can be turned on and off. When they are engaged they will essentially be connected to the front end of the canister and selectedly fixed into the front end where the female tubes connect. As the canister expends, the resilient members inside the turned on male members will produce force through the range of motion and this force will be transferred through the machine. The resilient members inside the male tubes that are not turned on will just go for the ride, but offer no force at all.

Figure 26A:
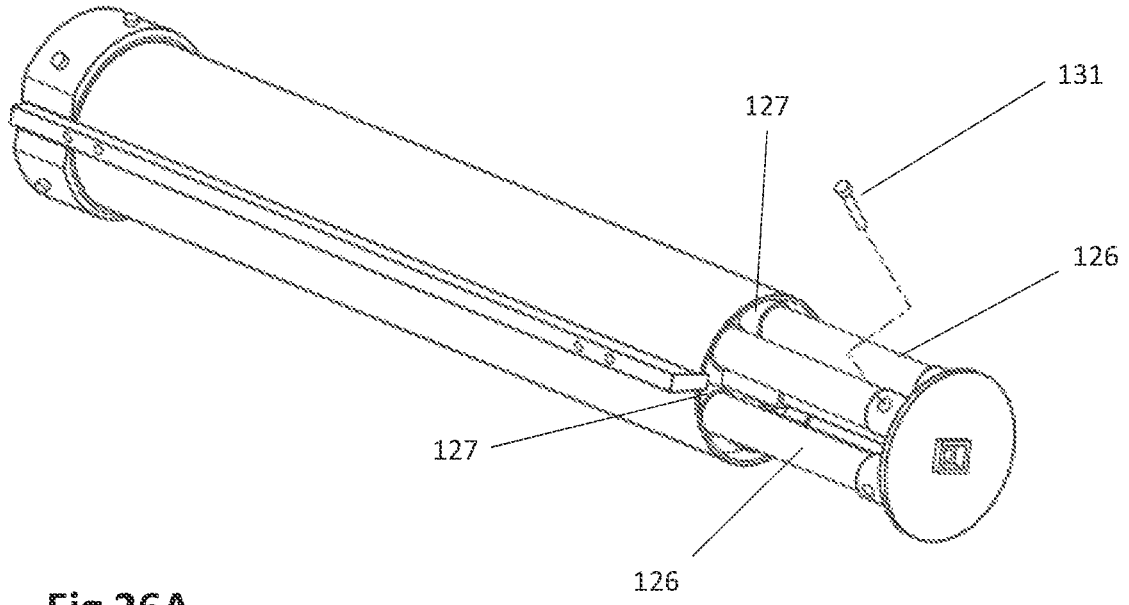
FIG. 26A shows the same expanded view of a canister as shown in FIG. 26 wherein a pin or peg is used to secure the male tube member in place.

FIG. 26A shows the same expanded view of a canister as shown in FIG. 26. In this view, a pin or peg 131 is used to secure the male tube member in place.

Figure 27:
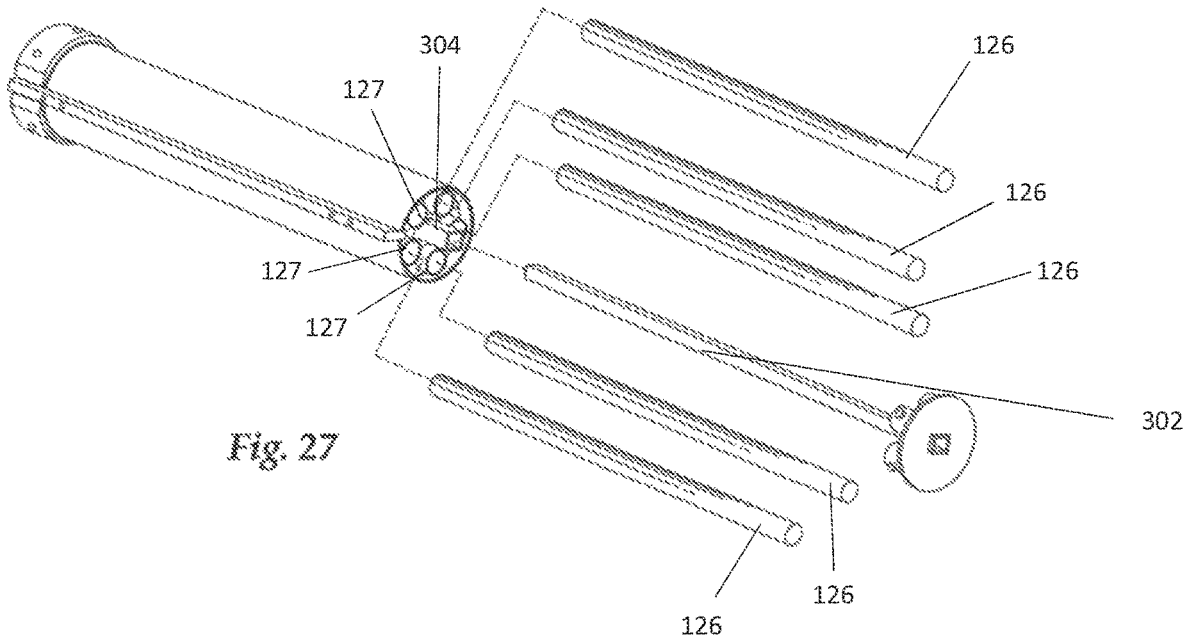
FIG. 27 is an exploded view of a canister with the male tube members separated from the female members.

FIG. 27 is an expanded view of a canister with the male tubes 126 removed from the female tubes 127, as well as the telescoping tracking protocol 300 separated into its component male and female pieces, 302 and 304 respectively.

Figure 27A:
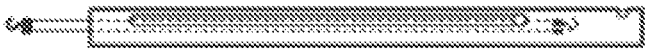
FIG. 27A is an exploded view of the telescoping tubes collapsed.

FIG. 27A is an expanded view of an embodiment of the male and female tubes. In this illustration, the male tube member is inserted inside the female tube member. Inside the male member is a resilient member and a plunger receiver. Inside the female member is a key member.

Figure 27B:
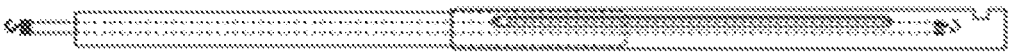
FIG. 27B is an exploded view of the extended telescoping tubes.

FIG. 27B is an expanded view of an embodiment of the male and female tubes in which the male tube is extended from the female tube.

Figure 27C:
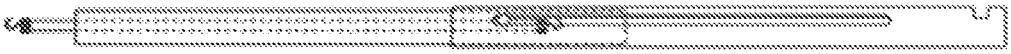
FIG. 27C is an exploded view of the extended telescoping tubes.

FIG. 27C shows another expanded view of an embodiment of the male and female tubes in which the male tube is extended from the female tube. This embodiment represents the configuration of the tubes in an embodiment that does not have a canister system as a force component. In this embodiment, a weak spring is employed to move the portion of the force component that is not directly engaged.

Figure 28:
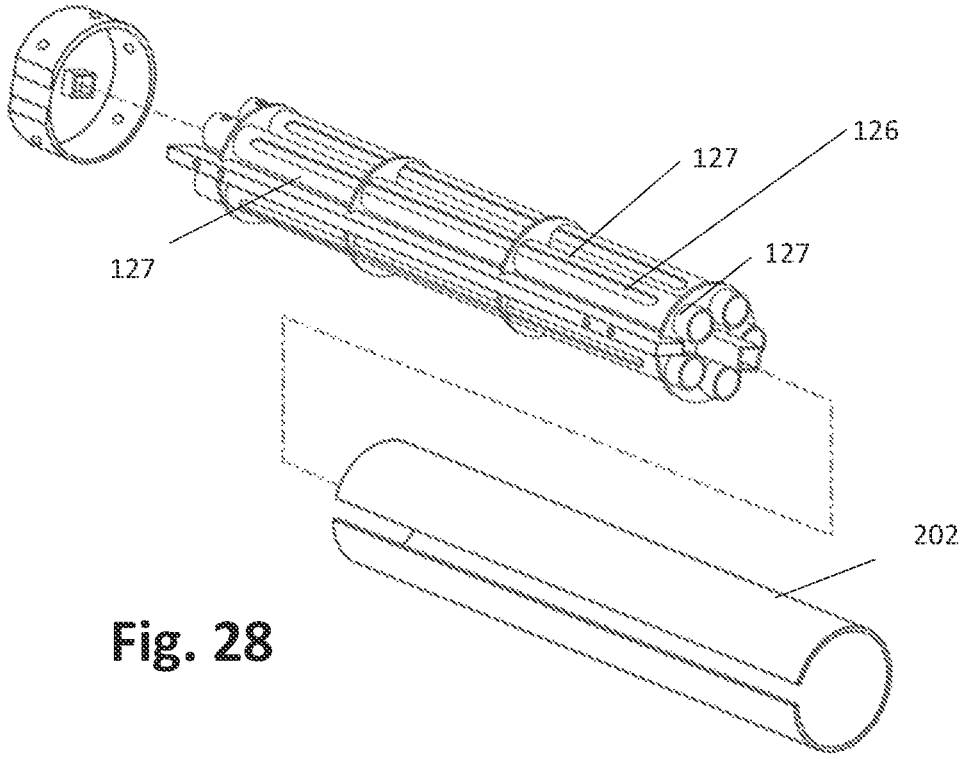
FIG. 28 is an exploded view of the canister with the tube members grouped and the wrapping removed.

FIG. 28 is an expanded view of a canister with the tubes grouped but the canister encasing, including the front of the canister and the canister cap, removed.

Figure 29:
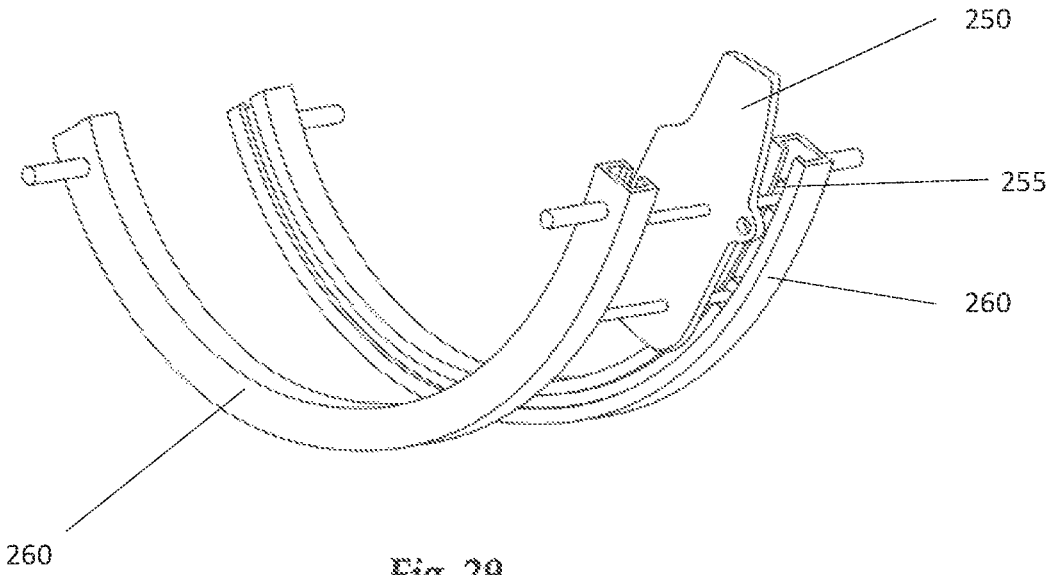
FIG. 29 is a view of one embodiment in which the trolley and track are curved members.

FIG. 29 illustrates one embodiment of a trolley and rail system in which the trolley 250 is a curved female member on a curved male member wherein the curved mail member functions as the tracking member. In this embodiment, the rails 260 are curved and contain a channel such that modified trolley wheels 255 can fit inside the rails. In another embodiment, multiple bar linkage can serve to replace the curved member and actuating member assemblies connected to the guide member. The guide member is pinned in the front so as to produce actuation. At a strategic spot on said guide arm it is pinned a second time by a lifting member. The lowest end of said guide arm in housed in a track. This assembly mimics the movements of the guide arm, trolley and rail system.

Figure 29A:
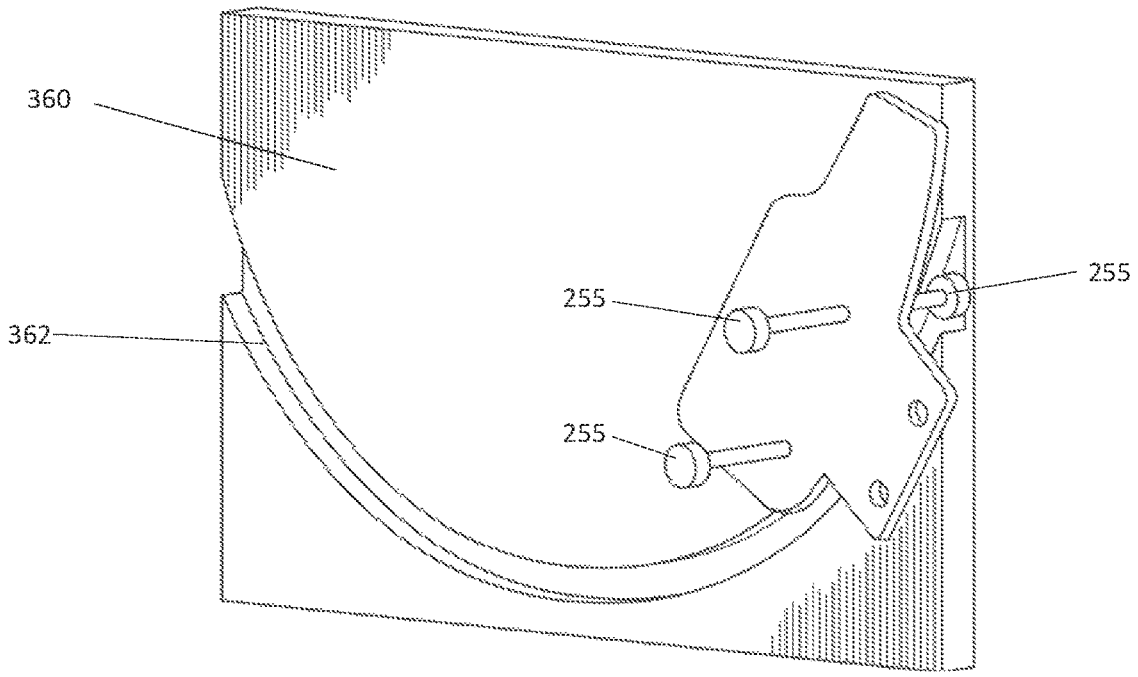
FIG. 29A is a view of another embodiment of a trolley and rail system with a solid wall.

FIG. 29A illustrates another embodiment of a curved trolley and rail system in which the rail system consists of a solid wall 360 with a carved, curved channel 362. The modified trolley wheels 255 fit inside the carved, curved channel.

Figure 29B:
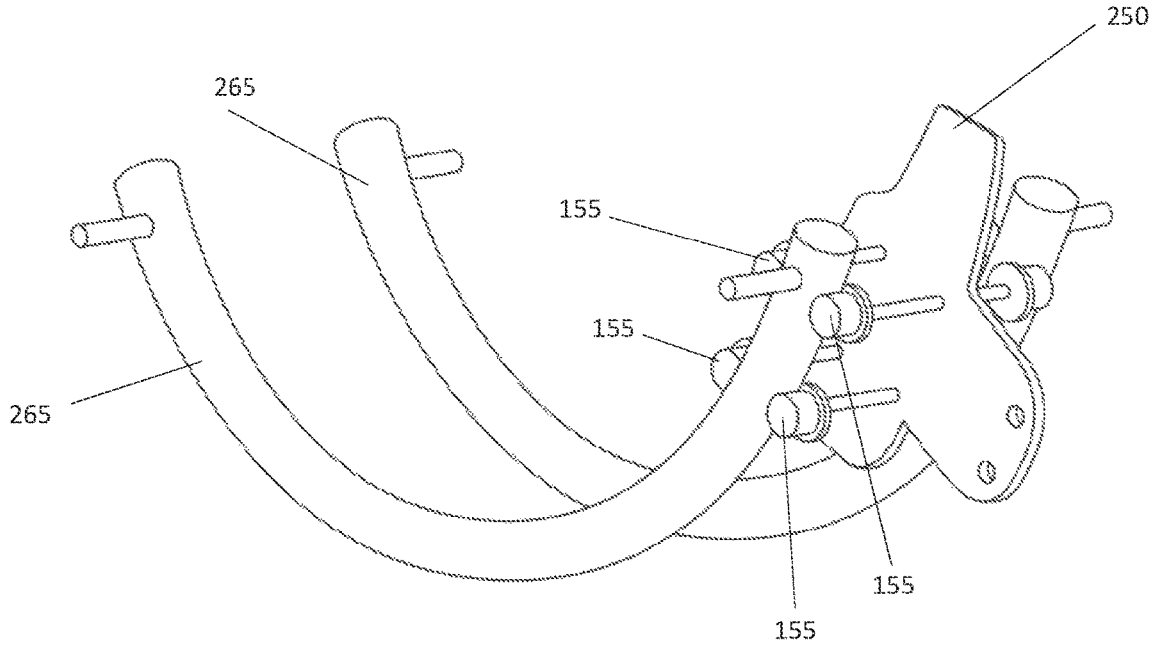
FIG. 29B is a view of another embodiment of a curved trolley and rail system.

FIG. 29B illustrates another embodimend of a curved trolley and rail system in which the at least two trolley wheels 155 of the sit on top of and under the curved rails 265. In this embodiment, the rails 265 do not have a channel.

Figure 30:
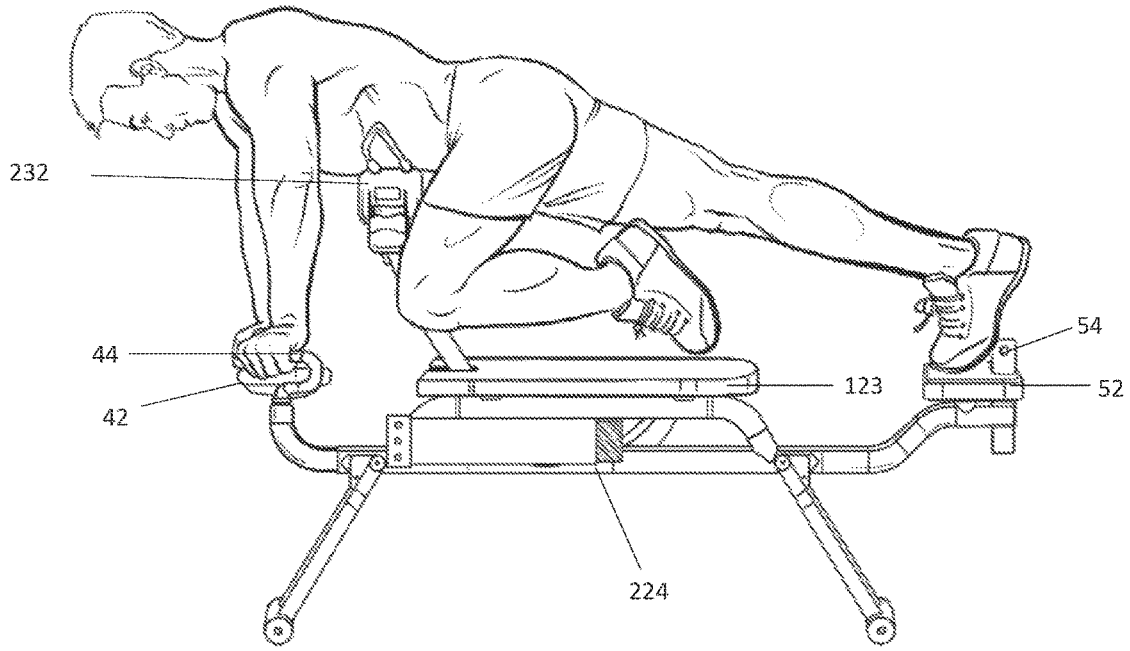
FIG. 30 is a side view of a user performing an assisted mountain climber plank.

FIG. 30 is a side view of a user on the machine performing an assisted mountain climber plank. In this position, a user places his or her hands on the handle bars 44 or the plank safety support pad 42 while his or her feet are placed on the foot support pad 52 against the foot support element 54. The abdomen of the user is in contact with a rectangular embodiment of the guide arm pad 232. In operation of this exercise, the user moves one knee inwards towards his or her chest while keeping the both hands on the handle bars or plank safety support pad and one foot on the foot support pad. The user then returns the foot of the leg which has been moved inward back to the foot support pad 52. This operation continues for a number of reps or is timed. The guide arm 30 and guide arm pad 232 allow a unique support and positioning which stabilizes the upper body in strict positioning allowing the user to focus exercise on the lower abdomen and hip flexor muscles. If desired, the user can employ the belt harness 34 and ratcheting belt mechanism to provide protection for the user or to form the abdomen.

Figure 31:
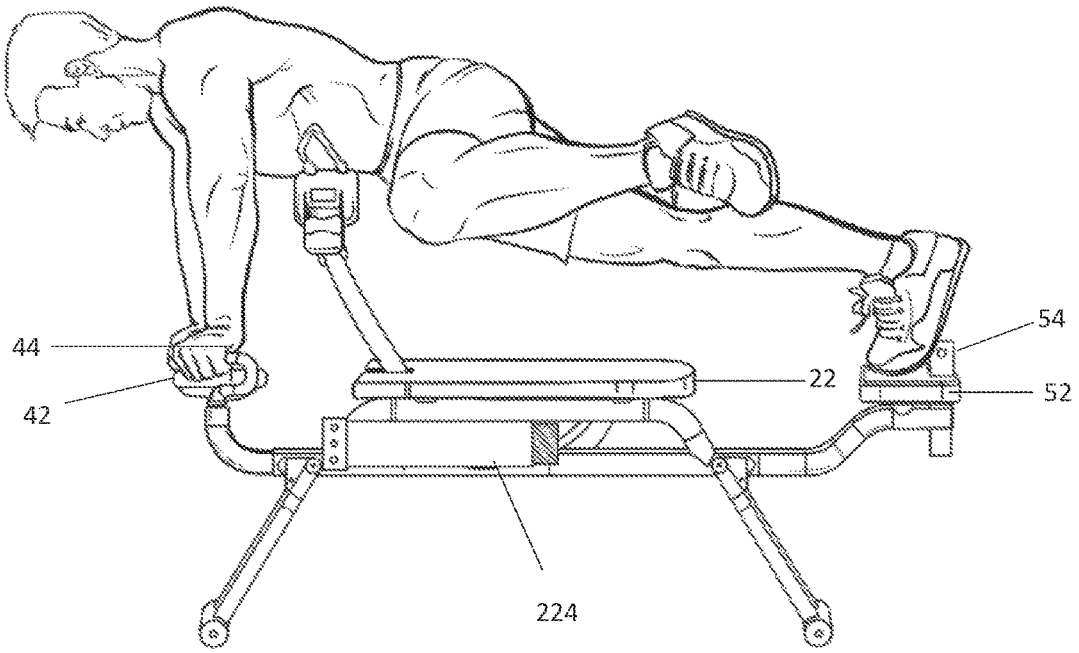
FIG. 31 is a side view of a user performing an assisted spiderman plank movement.

FIG. 31 is a side view of a user on the machine performing an assisted spider man or knee to elbow plank. In this position, a user places his or her hands on the handle bars 44 or the plank safety support pad 42 while his or her feet are placed on the foot support pad 52 against the foot support element 54. In operation of this exercise, the user lifts one knee outward to the side of the body, such that the leg is perpendicular to the body. The force originates from the head of the machine support area 40 which may be anchored as part of or outside of the core support 20 and insertion attachment to the bottom of the guide arm 30.

This figure is an illustration of an embodiment that is adapted to provide for both radial and telescopic adjustment. There are many planes of adjustment in both the head area and the foot area of the machine. For instance, all the adjustment points are not only seen at vertical and horizontal right angles, they can be seen in all radial ranges of motion as well. That is the purpose of the embodiment shown. The adjustments are not only vertically and horizontally oriented, but they can be radially oriented from two separate pivot points constructed in the head area, and two separate pivot points constructed in the foot area. The adjustment in the foot area is a bit more interesting, because they offer the exerciser the ability to widen their footprint by widening their foot position or by offering varied hand positioning. These hand positions can be the same or staggered.

Figure 32:
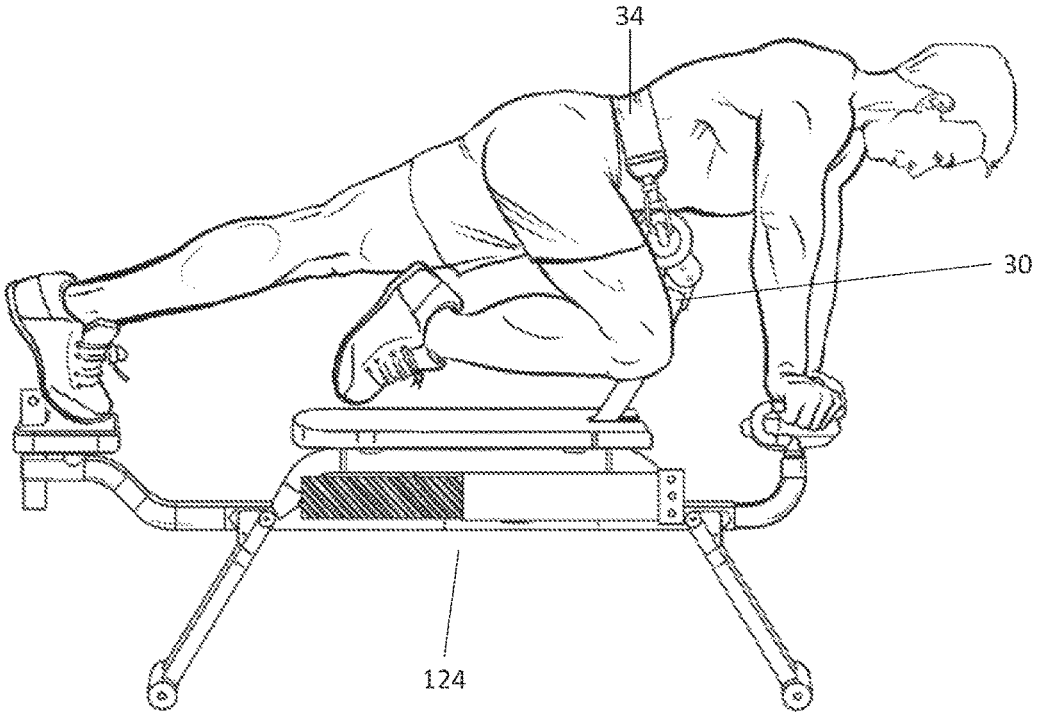
FIG. 32 is a side view of a user performing an added load mountain climber plank.

FIG. 32 is a side view of a user on the machine performing an added load mountain climber plank connected to the machine with a belt harness 34. In this view, the added load canister 124 is shown producing an added force. In this configuration, the assembly hinders the user as they attempt to complete the exercise, allowing for a more difficult exercise and increasing the workout level.

This figure is an illustration of an adapted embodiment for the head area of the machine. Instead of the preferred head area embodiment, a large padded platform is shown. The principal reason for this would be to allow the exerciser the ability to perform exercises whereby the pads of their hands come into contact with the machine for pushing up. There may be a desire to perform standard hand on floor type push-ups, or there may be a desire to perform more of a plyometric type push-up. That is what this platform embodiment would be for.

Figure 33:
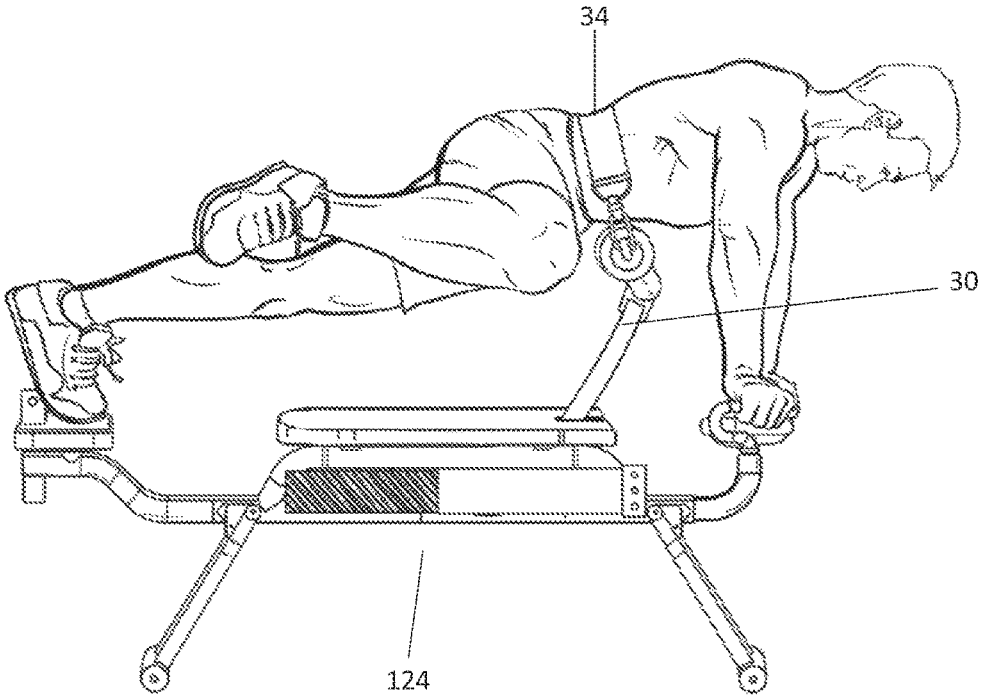
FIG. 33 is a side view of a user performing an added load spiderman plank movement.

FIG. 33 is a side view of a user on the machine performing an added load knee to elbow plank connected to the machine with a belt harness 34. Like in FIG. 31 the force of the added load canister hinders the user while they attempt to complete the exercise, allowing for a more challenging workout.

Figure 34:
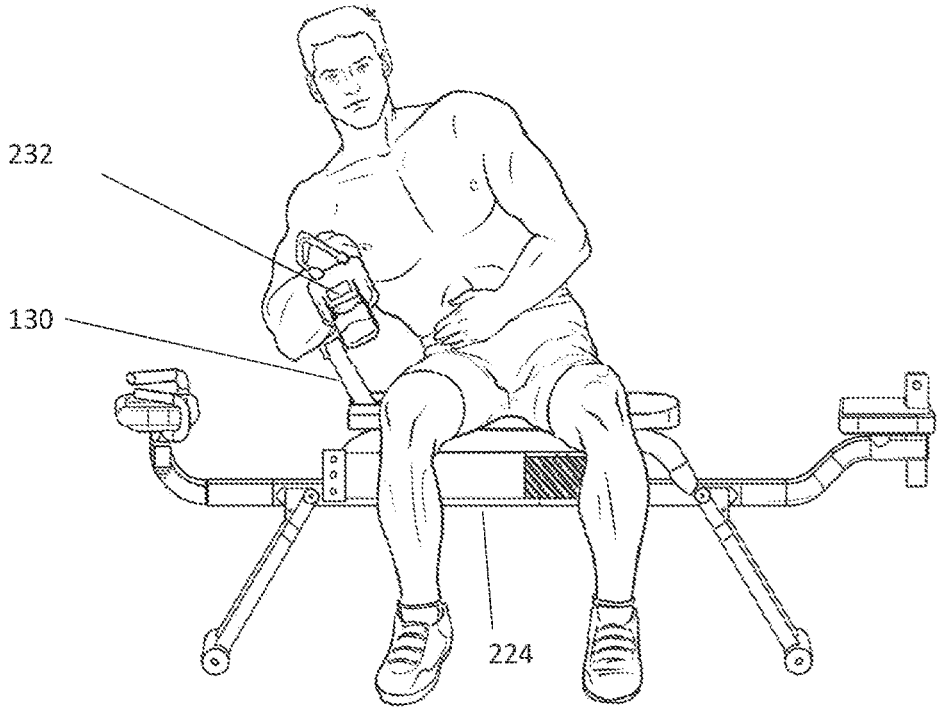
FIG. 34 is a side view of a user performing an assisted side torso exercise in the active position.

FIG. 34 illustrates a side view of one embodiment of the exercise machine with the machine facing left and the exerciser facing the viewer of the drawing, performing an assisted side torso movement exercise. The machine is set up such that the assisted canister 224 is producing assistive force. To perform this exercise, the user declines his or her body either to the side or backwards, while hugging the guide arm pad 232 and being assisted by the machine. Once the user is at the bottom of the range of motion, he or she will then return to a vertical position. In this exercise, the assistance of the machine allows the user to concentrate on creating a vacuum in his or her abdomen and concentrate the vacuum in a specific area. This exercise can be used to combat and affect diastasis recti which is a condition whereby the fibrous tissue in between the two halves of the abdomen becomes weak and create a protrusion.

Figure 35:
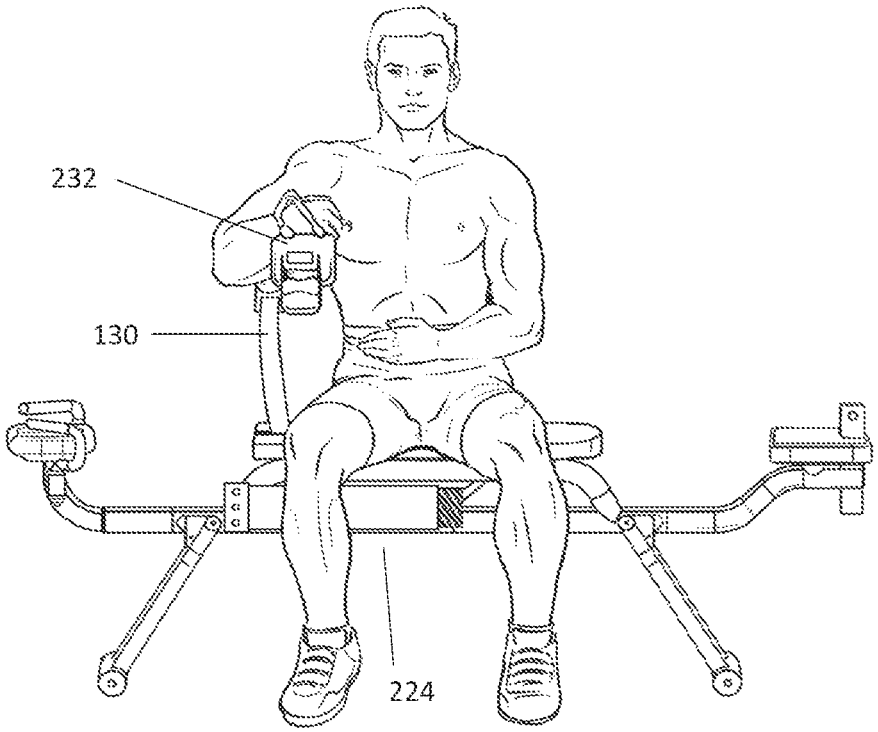
FIG. 35 is a side view of a user in the neutral position of an assisted side torso exercise.

FIG. 35 illustrates one embodiment in which the user is in the vertical, neutral position of the side torso movement exercise as described in FIG. 34.

Figure 36:
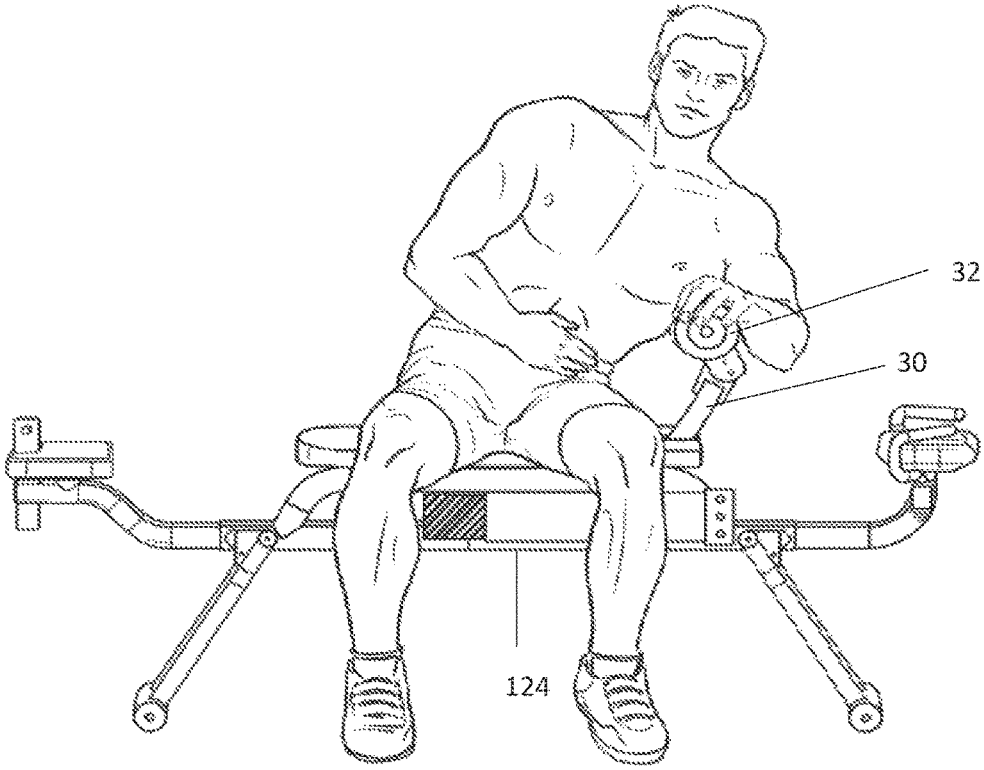
FIG. 36 is a side view of a user in an active position of an added load side torso exercise.

FIG. 36 illustrates one embodiment of an added load side torso movement exercise. The added force is produced by the added force canister 124. This exercise is performed in a similar manner as described in FIG. 34, however in this embodiment the user picks up the guide arm 30 and hugs the cylindrical embodiment of the guide arm pad 32 with his or her arm. The guide arm 30 will then hinder the user as he or she tries to return to a vertical position, thus making the exercise more difficult and increasing the intensity of the workout. The user can perform this side torso exercise either concentrically or eccentrically. When performing this exercise, the counterbalancing half of the abdomen has a propensity to want to move toward the active half of the abdomen. This is very exciting when trying to promote abdomen exercises that have the goal of pulling the abdomen in. Further, this is beneficial because it does not require putting outward pressure on the middle of the abdomen whereby making a diastasis rectis worse. Instead, performing the exercise in this way can promote the coming together of the two halves of the abdomen. When doing this eccentrically this is further exciting. This is because having the user hinder the movement of the machine in this fashion causes the two halves of the torso to come together with even more intensity.

Figure 37:
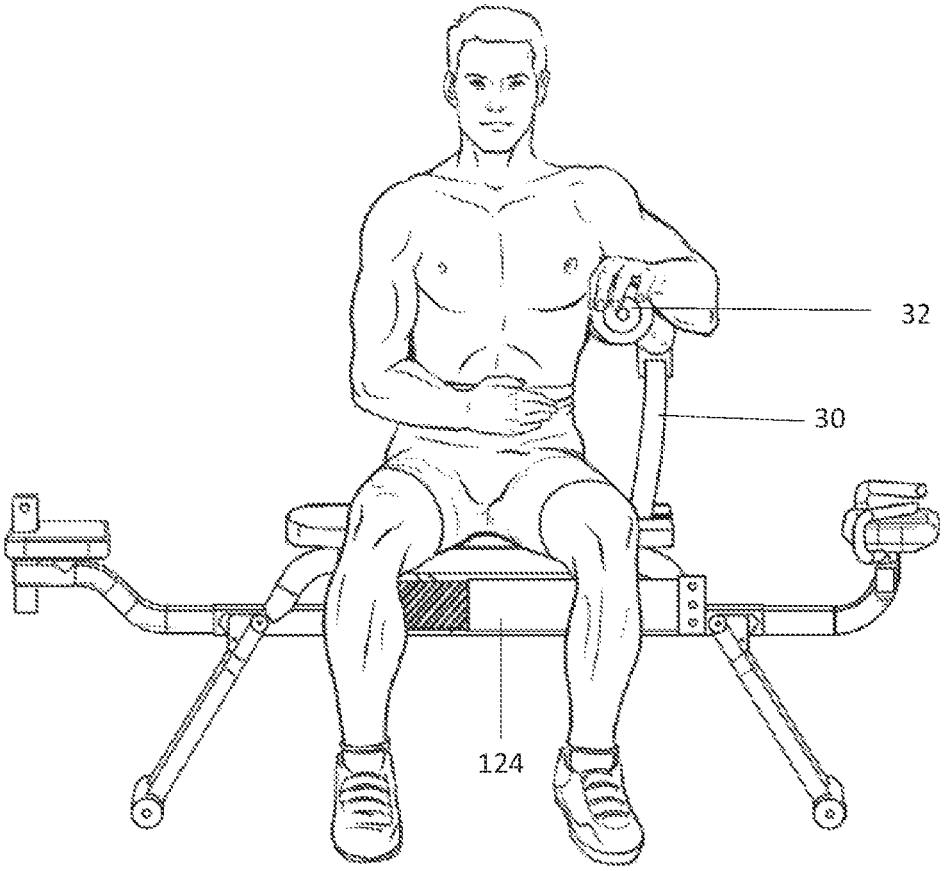
FIG. 37 is a side view of a user in a neutral position of an added load side torso exercise.

FIG. 37 illustrates one embodiment in which the user is in the vertical, neutral position of the side torso movement exercise as described in FIG. 36.

Figure 38:
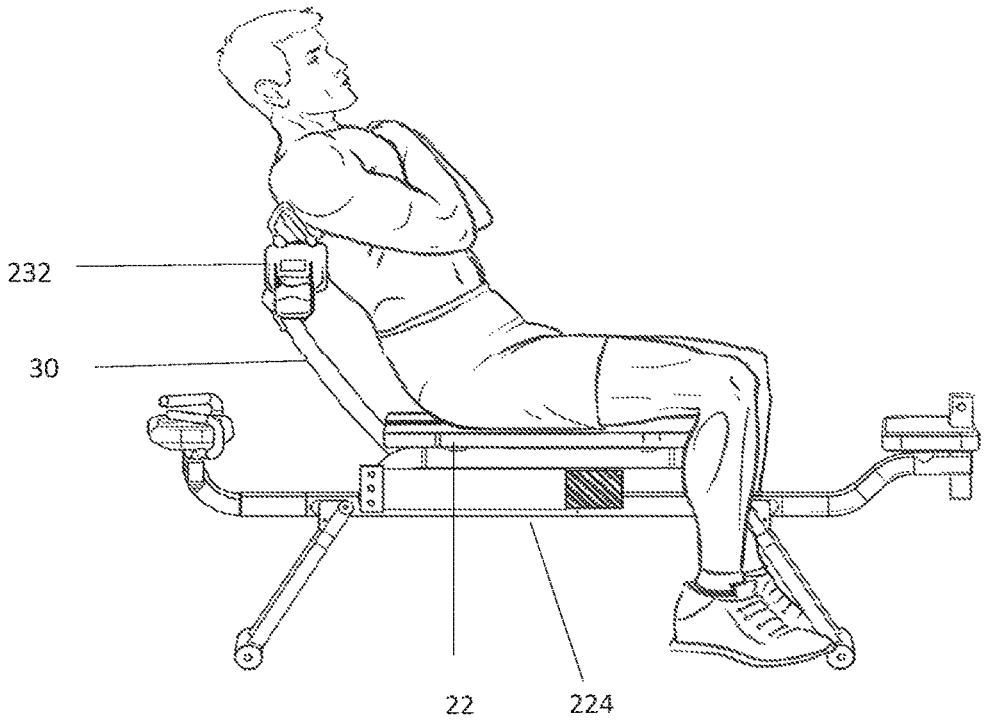
FIG. 38 is a side view of a user performing an assisted seated abdominal exercise in the active position.

FIG. 38 illustrates one embodiment of an assisted seated abdominal exercise. In this embodiment, the machine is facing left and the user is facing right. The assisted canister 224 is producing force to assist the user in performing this exercise. To perform this exercise the user starts in the vertical position. The user can either put their arms across their chest or hold the harness over their shoulders. To proceed, the user leans backward 15 to 20 degrees. At this point the user starts to head back toward the beginning position while simultaneously pressing their feet into the floor. As stated above, this causes the hip flexor muscles to go in the opposite direction and thereby promotes the movement to be performed more by the abdominal muscles in a very safe and efficient manner. This exercise is accentuated and can be intensified by the strictness inherent in the guide arm 30. A derivative of this assisted vertical abdomen exercise would be to twist during the range of motion. This would engage the oblique musculature more intensely.

Figure 39:
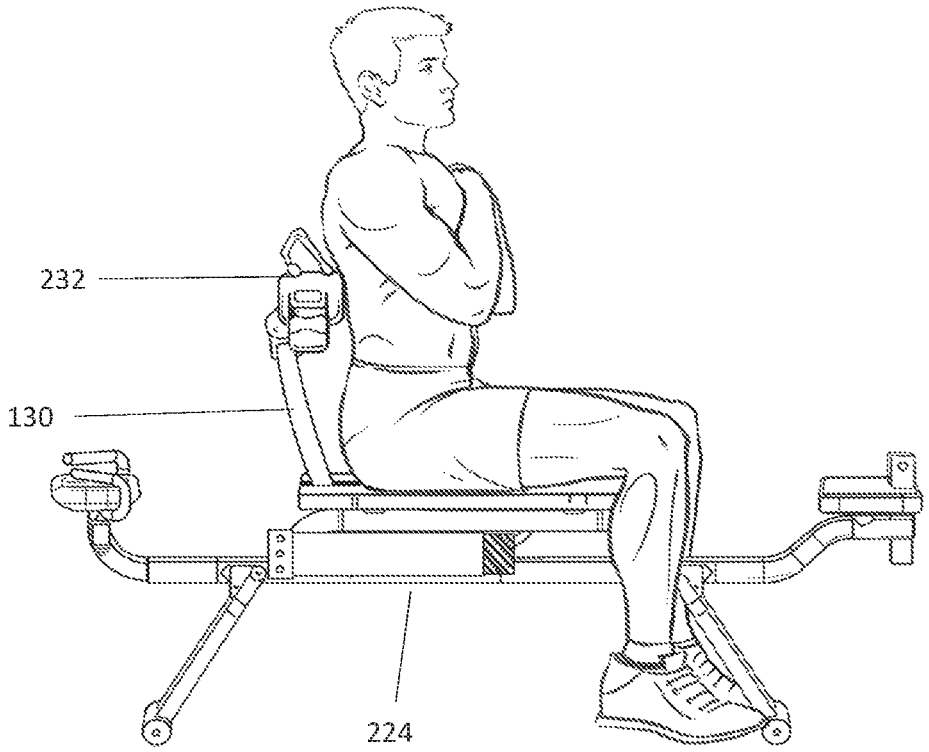
FIG. 39 is a side view of a user performing as assisted seated abdominal exercise in the neutral position.

FIG. 39 illustrates the neutral position of the same exercise as described in FIG. 38.

Figure 40:
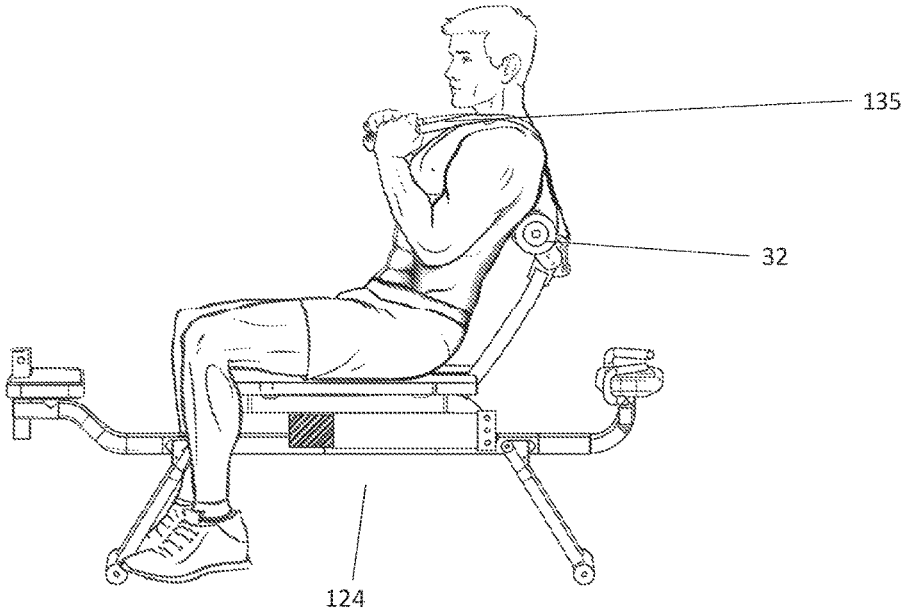
FIG. 40 is a side view of a user performing an added load seated abdominal exercise in the active position.

FIG. 40 illustrates one embodiment of the added load variation of the exercise described in FIG. 38. In this embodiment, the user is facing left while the machine is facing right. The force is exerted by the added load canister 124 to hinder the workout and increase the difficulty. To perform this exercise the user must pick up the harness 135 holding it by the hand grips. Raise it overhead while the harness is connected to the machine which is in the down position. The user should then secure the harness on his or her shoulders as shown in the figure. In further performance of the exercise, the user starts in a vertical position and leans backward against one embodiment of the guide arm pad 32 and pushes against the guide arm 30. Once the user reaches the comfortable end of the range of the exercise they proceed to pull the machine back to vertical by contracting their abdomen and moving their torso forward.

Figure 40A:
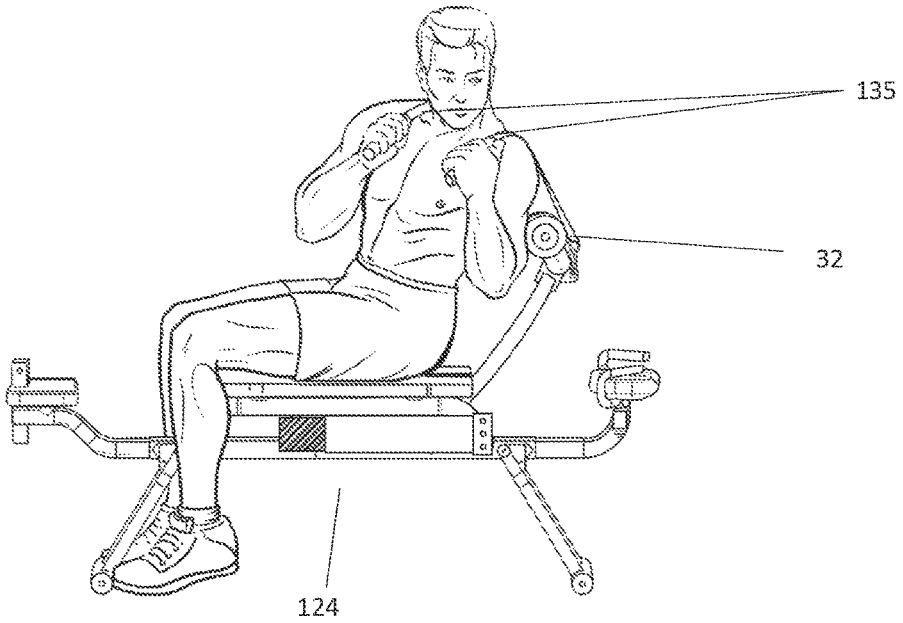
FIG. 40A is a side view of a user performing a seated abdominal exercise with twisting.

FIG. 40A illustrates the same exercise as described in FIG. 40, however in this illustration twisting motions are performed by the user to exercise the obliques.

Figure 41:
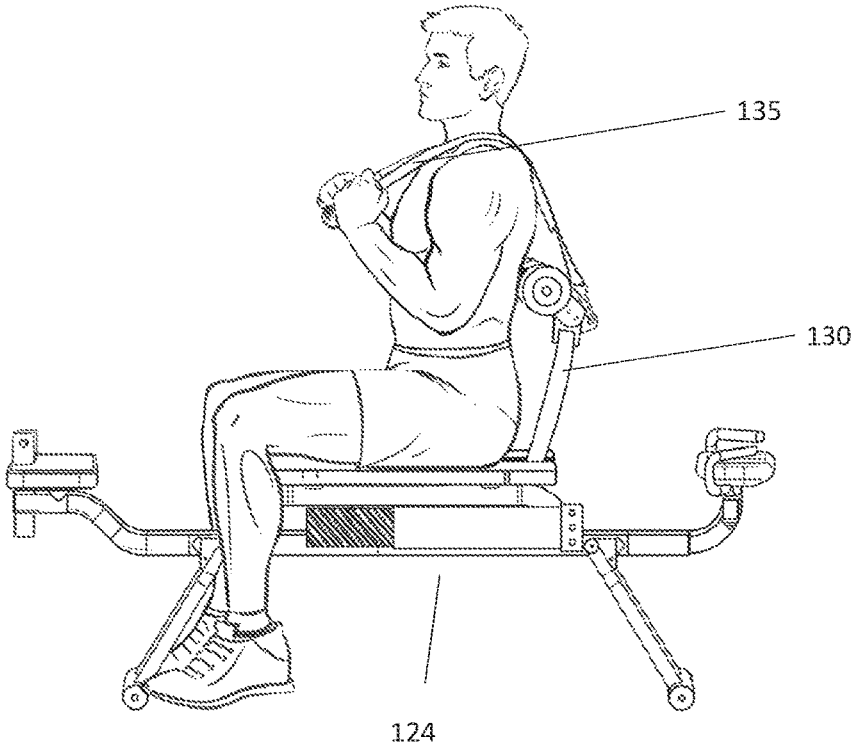
FIG. 41 is a side view of a user performing an added load seated abdominal exercise in the neutral position.

FIG. 41 illustrates one embodiment of neutral position of the exercise described in FIG. 40.

Figure 42:
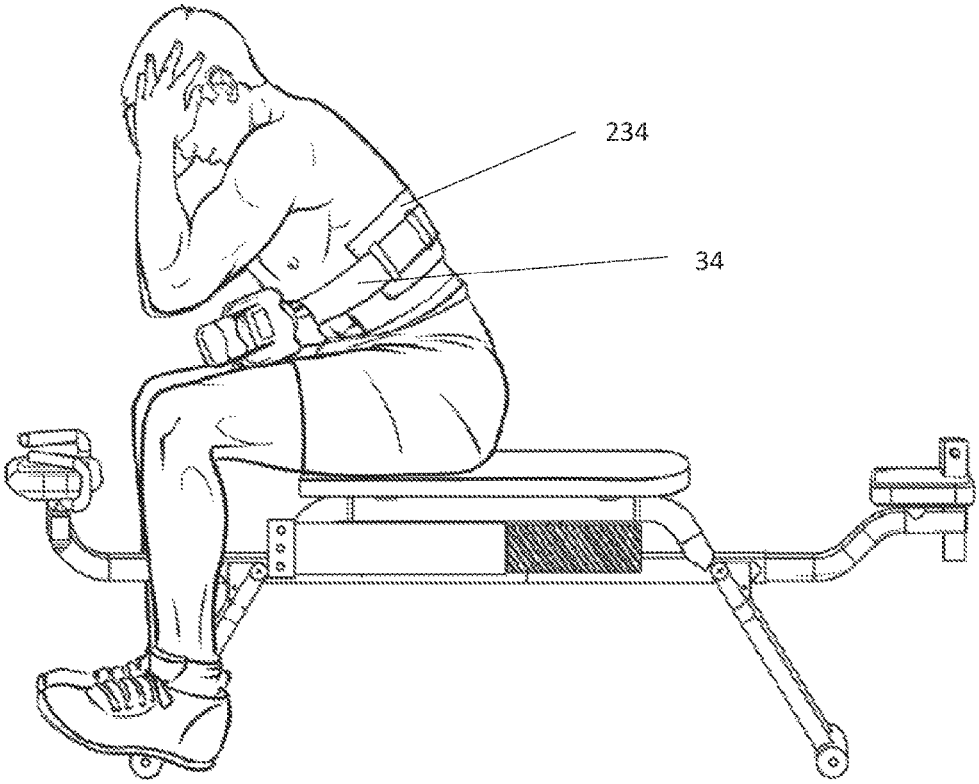
FIG. 42 is a side view of a user performing a seated back extension as part of an abdominal exercise.

FIG. 42 this is a side view of the machine with an exerciser facing left. The exerciser is performing a very unique and correct back extension exercise. This figure illustrates the second phase of the movement. The first phase is moving from neutral to the position shown. To perform this exercise, the user sits on the machine as shown. The user then grasps the guide arm 30 as it is in added load. They then proceed to put the strap of the belt harness 34 around their upper back and clip it to the receiving member. A pad 234 on the belt as shown is usually used here. When in this position the user ratchets the belt, and creates a tighter connection between themselves and the rollers of the guide arm. Even though the user ratchets, they do not ratchet all the way and leave some slack between themselves and the rollers. From the neutral position the user bends forward with the resistance of the machine pulling them in this direction.

Figure 43:
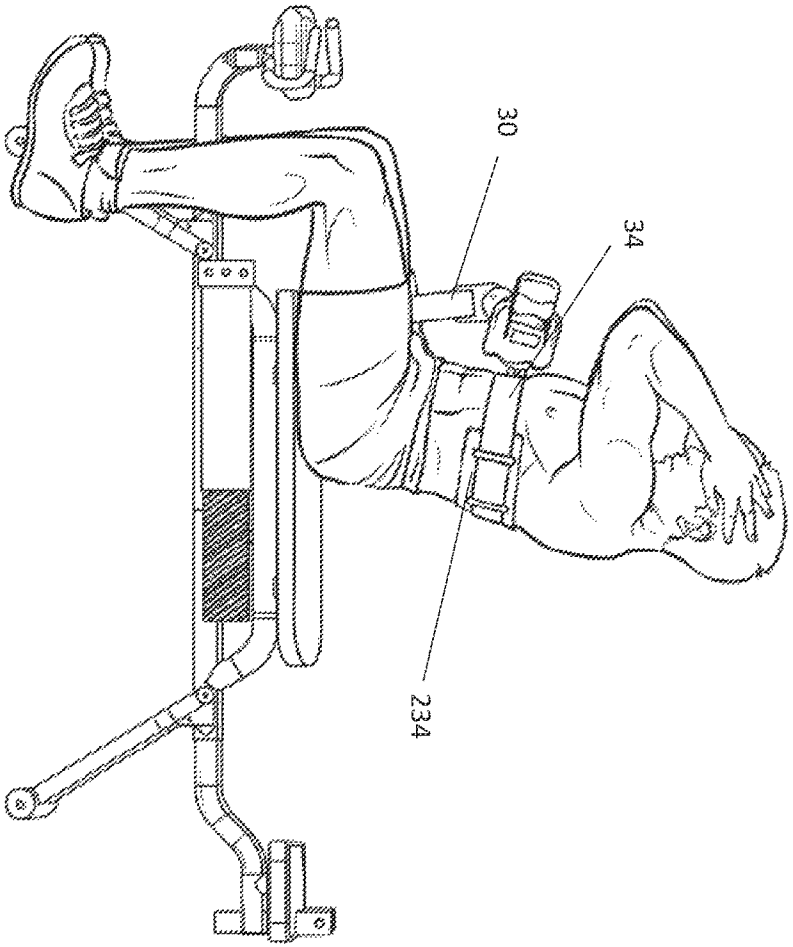
FIG. 43 is a side view of a user performing a seated abdominal exercise.

FIG. 43 in this figure, the third and final phase of the exercise in FIG. 42 is illustrated. To perform this phase the exerciser tightens their abdominal muscles and moves backward to a position just past or somewhere past neutral based on how far the machine will let them. This is a very different type of back extension exercise that possibly has never been done before. It is surprising how much the abdomen is involved in this movement. In the performance of the phase of the exercise the user is pulling the body backward against the resistance of the machine. This is much different and more correct than an exerciser pushing against a force that is pushing on them. This is also excellent because the machine as well as the design of the exercise does not allow the exerciser to perform said exercise past safe ranges of motion into hyperextension.

Figure 44:
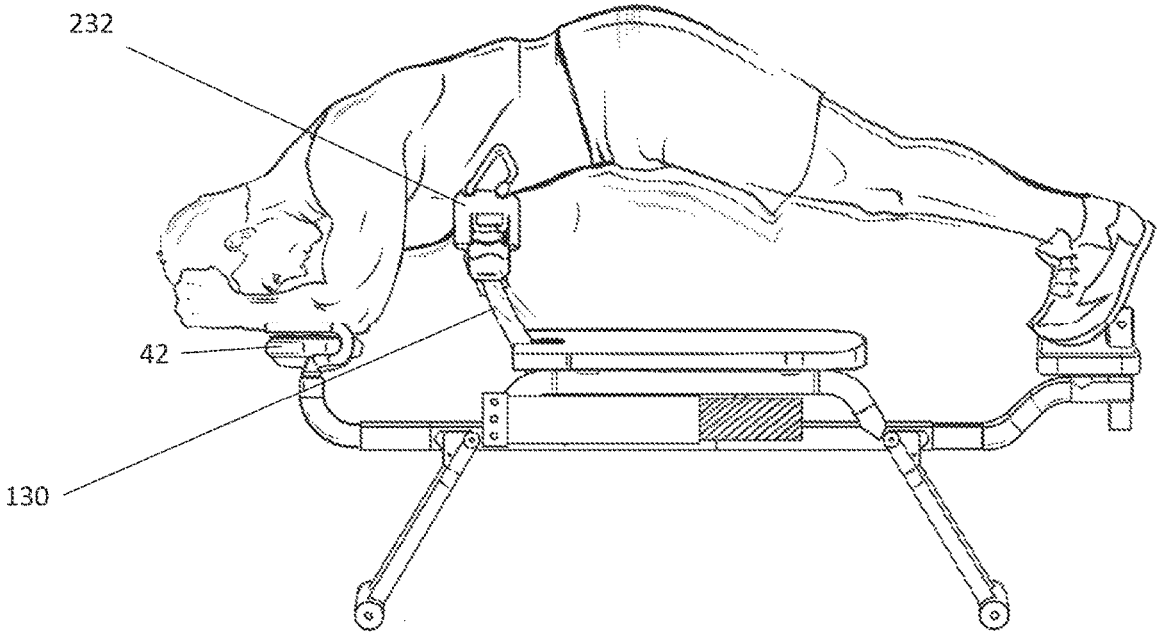
FIG. 44 is a side view of a user performing an assisted major movement plank.

FIG. 44 illustrates one embodiment of a user utilizing the machine to perform an assisted major movement plank. To perform this exercise, a user starts in plank position and pulls his or her body up to achieve the position shown. The user's chest is supported by the guide arm 30 and the guide arm pad 232 while the user's arms are on the plank support pad 42.

Figure 45:
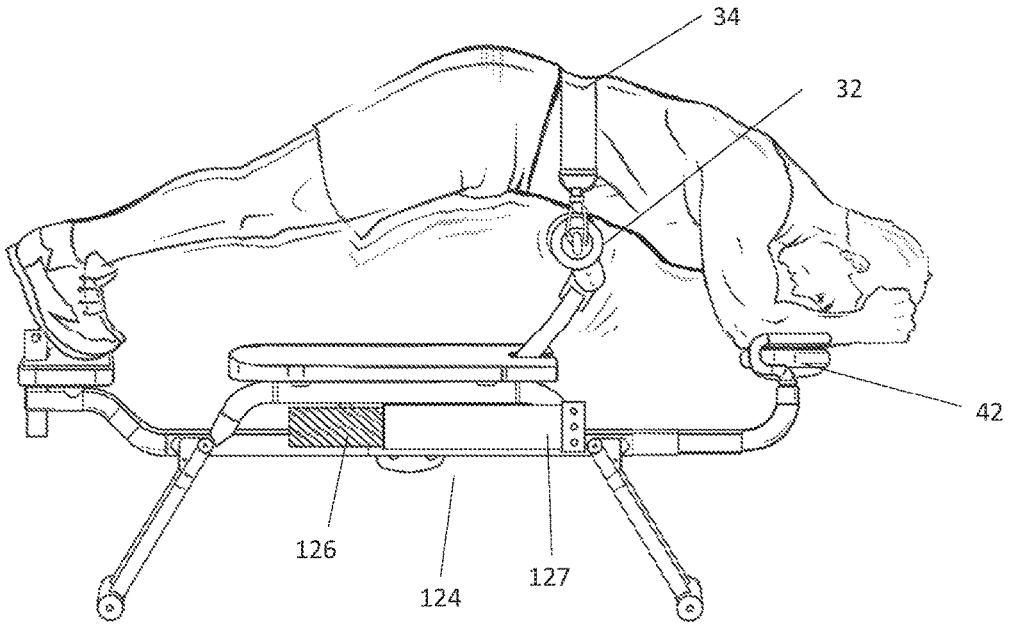
FIG. 45 is a side view of a user performing an added load major movement plank.

FIG. 45 illustrates another embodiment of a user utilizing the machine to perform an added load version of the exercise described in FIG. 44. The ratcheting and protecting element of the guide arm 30 and belt assembly 34 allow a user to perform this added load exercise. The exercise is performed by starting in plank position and pulling the body up to achieve the position as illustrated. In doing this the user imparts a very different stimulus on the abdomen. The same rib and chest musculature are involved as well as with exercises in the above figures of FIGS. 6 and 6*a*.

Figure 46:
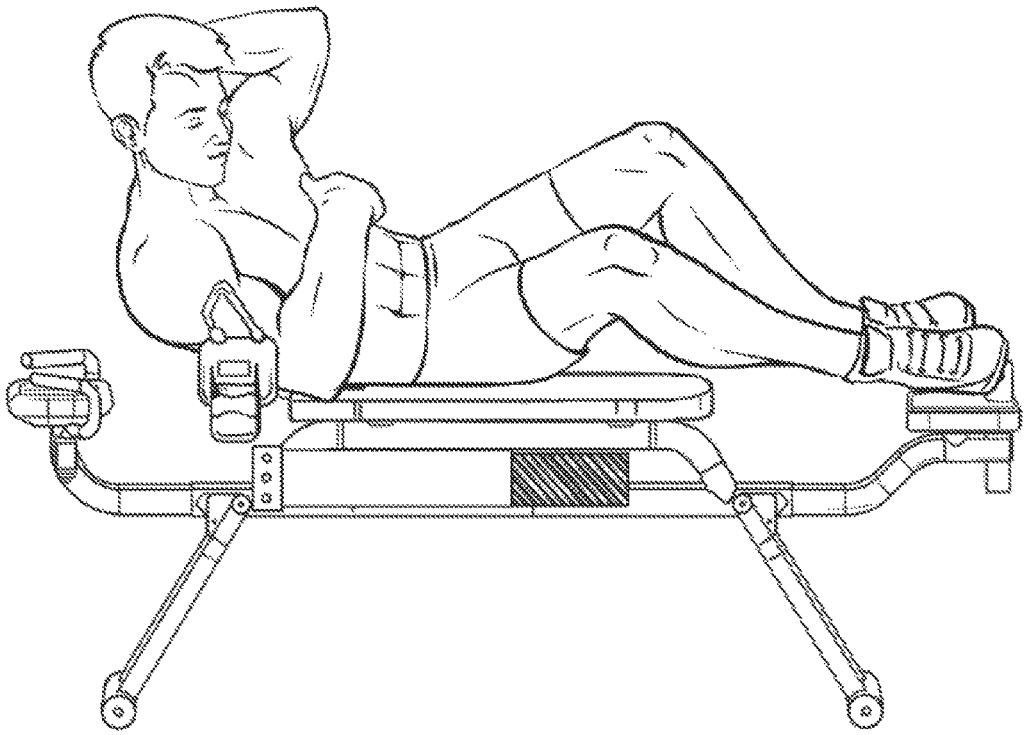
FIG. 46 is a side view of a user performing a twisting sit up exercise.

FIG. 46 illustrates an embodiment of a use of the machine in which a user performs a horizontally oriented traditional sit-up.

This exercise is performed by getting on the machine in a regular sit-up position and then rolling over onto one hip or the other. The shoulder of the opposite side being affected is usually principally in contact with the roller. In light of the assistance this exercise can be performed in many different angles. The exercise can be performed almost completely straight up and down in the sagittal plane. This is because of the assistance and guidance. This would be close to impossible without the machine.

Figure 47:
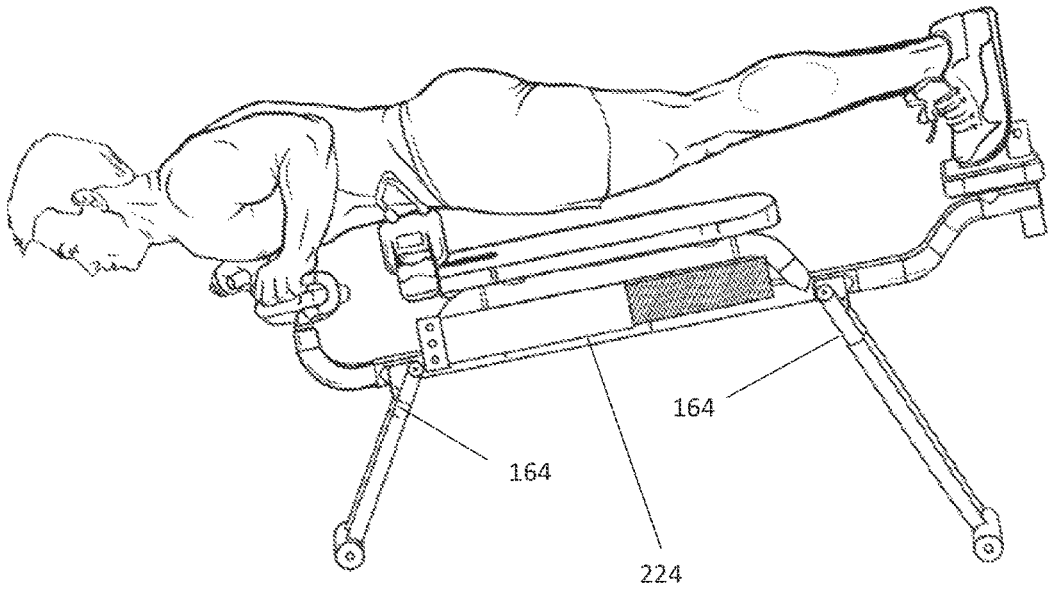
FIG. 47 is a side view of a user performing a decline push up exercise.

FIG. 47 illustrates an embodiment of the machine wherein the machine can be propped up by a jack or a telescoping leg mechanism 164 to form a decline. This creates greater force across the upper chest than is put across the upper chest in a flat bench position, much like how the upper chest is targeted more by performing an incline bench press as opposed to a flat bench press. The purpose of this figure is to illustrate how the user could put their body on an angle thereby affected how the force is being applied to the musculature of the upper body. In the figure, the user is facing left, the machine is facing left and the canister on the left side of the machine is the assisted canister 224 producing assistive force.

Figure 48:
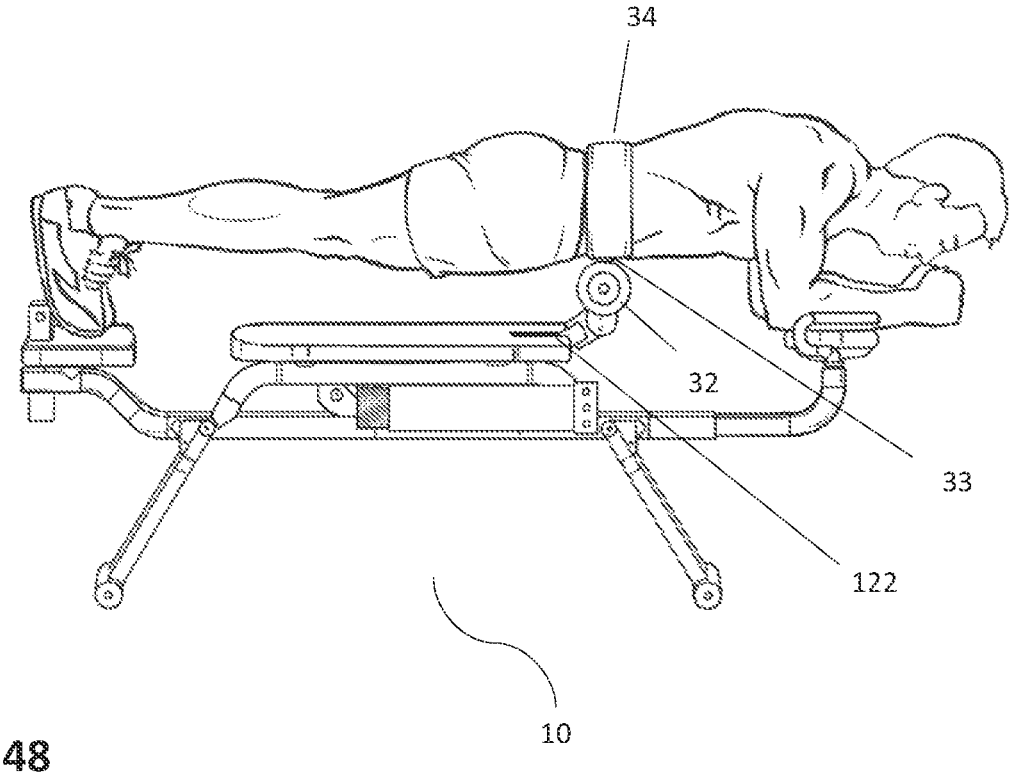
FIG. 48 is a side view of a user on the machine performing an added load plank pose exercise connected to the machine with a belt harness.

FIG. 48 is a side view of a user engaging the machine 10 and doing an added load plank pose exercise connected to the machine with a belt harness 34. The user performs the exercise as shown and is connected to the machine with a belt harness 34. The retractable mechanism 33 can be inside the belt harness 34 or housed in the guide arm pad 32 part of the machine.

Figure 49:
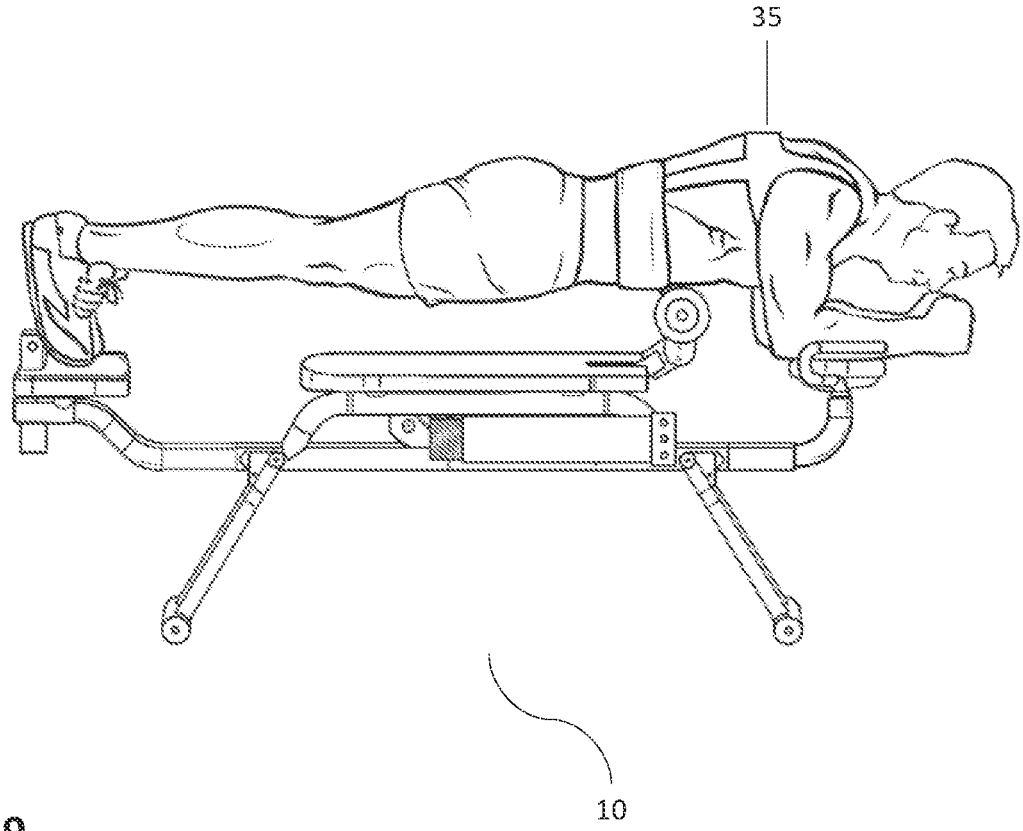
FIG. 49 is a side view of a user on the machine performing an added load plank pose exercise connected to the machine with a shoulder harness.

FIG. 49 is a side view of a user on the machine doing an added load plank pose exercise connected to the machine with a shoulder harness 35 operation, in the same configuration as FIG. 28 except that the user is connected to the machine 10 with a shoulder harness 35 instead.

Figure 50:
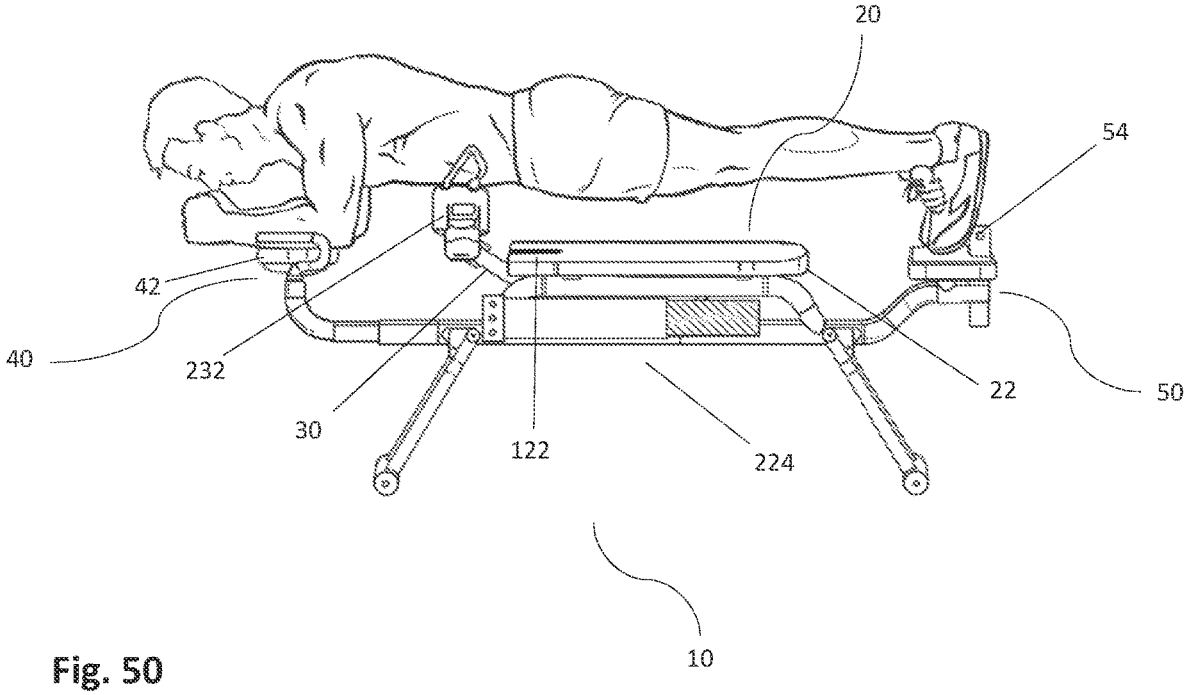
FIG. 50 is a side view of a user on the machine performing an assisted plank pose exercise.

FIG. 50 is a side view of the exercise machine 10 with a user performing an assisted static plank pose position exercise. In the operation of the exercise the user first kneels on the body support pad 22. Then one hand has the natural inclination to touch one embodiment of the guide arm support pad 232 and the other has an inclination to secure positioning on the plank pad 42. Eventually both hands are on the plank pad and the abdominal area is in contact with the guide arm pad 232. In the next portion of the procedure, the feet engage the foot support element 54 of the foot support 50 with the balls of their feet against the foot support element 54. Once in this position the user puts their forearms in a comfortable position on the plank pad 42.

After this sequence, the user assumes the plank position by making their body as straight as a board hence "the plank". The machine 10 aids tremendously in this effort as in this position the force originates, from the head of machine area 40 and is anchored as part of or outside of the core support 20. This force is radiated through the guide member 30 and during the performance of the exercise the purpose is to strengthen the entire core, although, the user tightens their entire body to hold the position. The exercise machine 10 provides stability for the entire exercise. More particularly, the guide arm support pad keeps the abdominal muscles from bowing out which is something that is commonly seen when a user has weak abdominal muscles. The variations in the force that can be created by the force producing element 125 offer the user the ability to change the neuromuscular stimulus differently than what they can achieve from their body alone. When the user is finished with the exercise, he she brings the guide arm 30 back to its up position by kneeing and raising their body off of the guide arm 30. This alignment removes the tension from the force producing element 125. At this point the user disengages the machine and very comfortably walks away.

Figure 51:
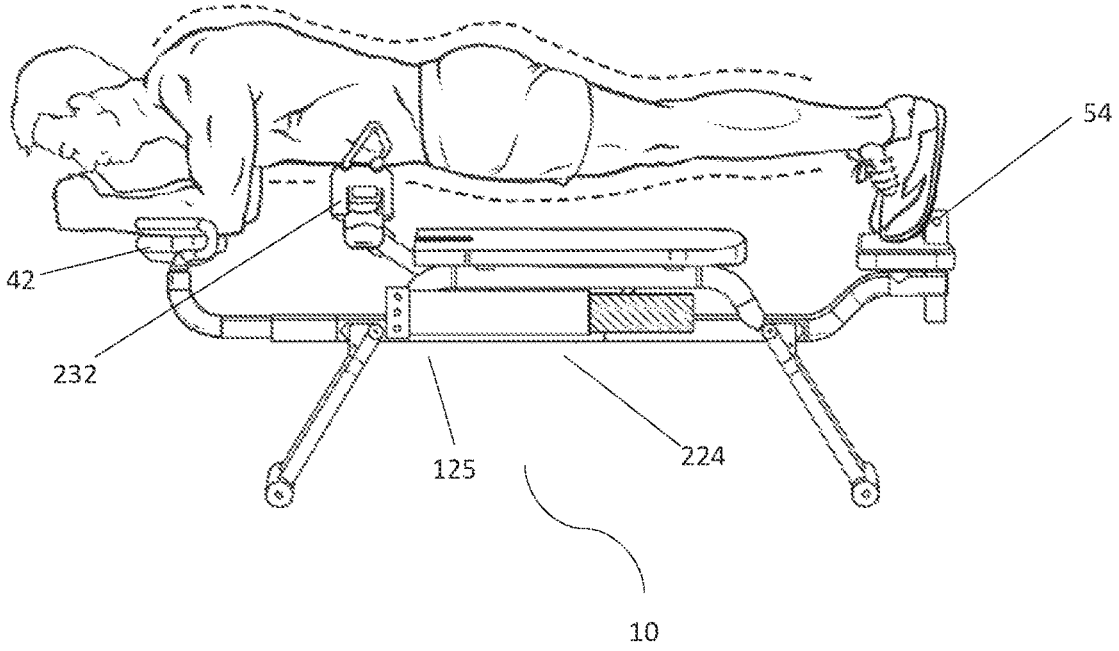
FIG. 51 is a side view of a user on the machine performing an assisted semi-static plank exercise.

FIG. 51 is the same as FIG. 50 however the body is illustrated to be moving ever so slightly in the configuration of a semi-static plank exercise. The support of the machine 10 accentuates this type of exercise differently than if the user did it on the floor without the machine.

Figure 52:
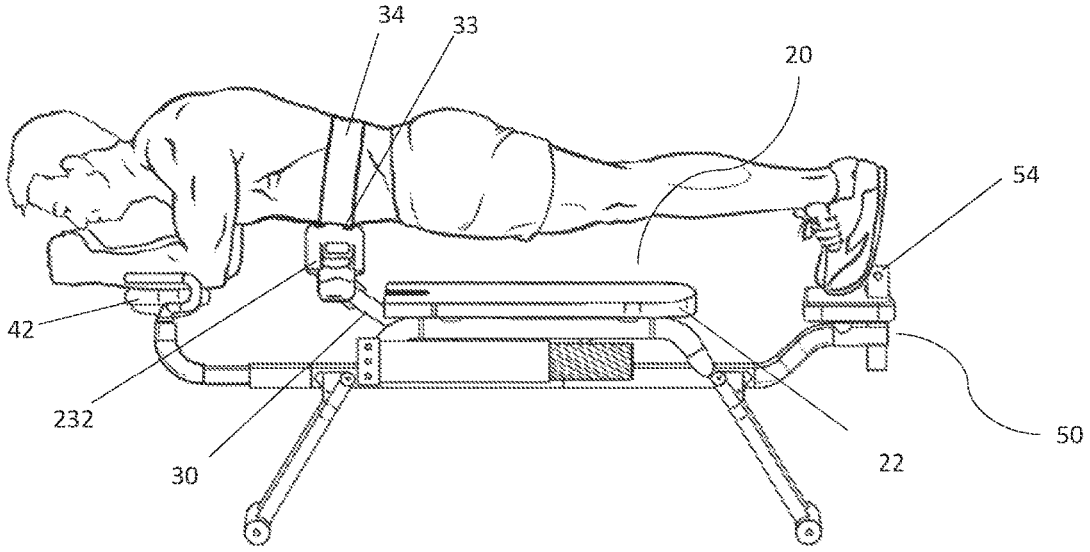
FIG. 52 is a side view of a user on the machine performing an added load plank pose exercise.

FIG. 52 is a side view of a user on the machine 10 performing an added load static plank position exercise. The operation of the exercise is similar to that shown in FIGS. 50 and 51, although, the force is now originating from the foot area 50 of the machine and is anchored as part of or outside of the core support 20. When the user engages the machine 10, the guide member 30 is under load and is in the down position. In order to operate the machine for this type of exercise the user needs to be connected to the machine. This achieved by a belt 34 or shoulder harness 35 being connected to the guide arm 30.

Thus, in line with FIG. 50, the user kneels on the machine, engages their feet with the foot support element 54 then they lay across the machine with their chest on the plank safety/support pad 42 and their abdominal area across the guide arm pad 32 which is in the down position and under load. While the user is resting on the machine, their hands are free, which is crucial so that the user can lock and unlock a retractable belt mechanism 33 that creates the connection. As stated above, this retractable belt mechanism 33 can be housed in the structure of the guide member 30 and within the belt 34 or shoulder harness 35. Once the user is secured they can proceed to get into the plank position with the machine providing more resistance then what their body produces naturally. To perform the exercise the user holds the position for a number of seconds.

When the exercise is completed the user reclines across the body support pad 22 and the plank pad 42, with hands free and is able to disengage from the resistance of the guide member 30 and get up and walk away from the machine as seen in FIG. 25. The added load planks affect the entire body and work to create a great pump within the body muscular area of the user in the performance of such exercise.

Figure 53:
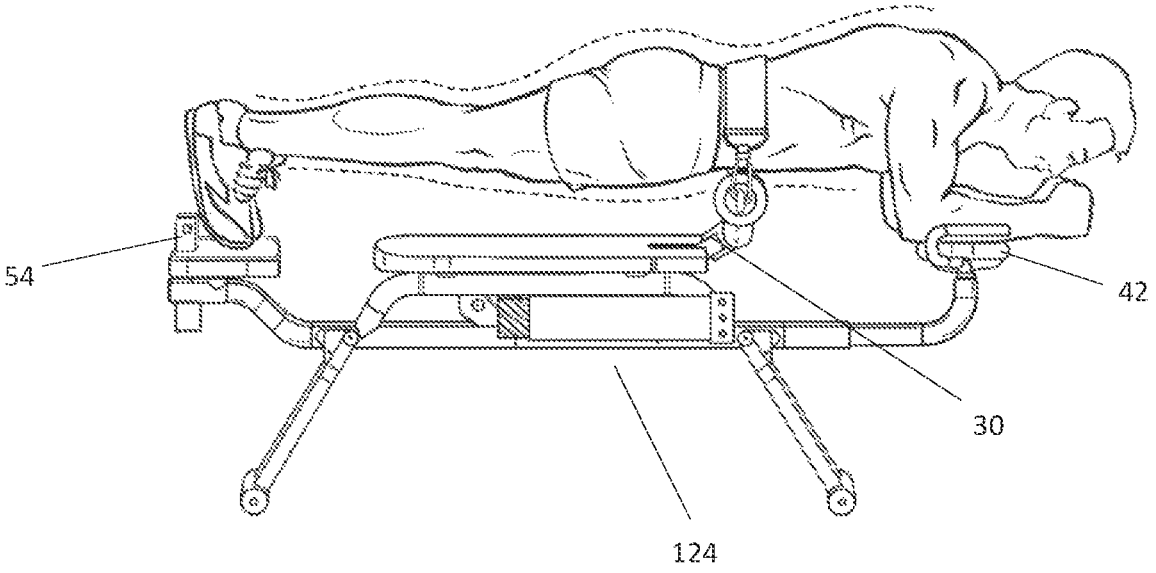
FIG. 53 is a side view of a user on the machine performing an added load semi-static plank exercise.

FIG. 53 is a side view of a user performing an added load semi-static plank exercise, as seen in FIG. 51 except that the machine 10 is now producing added resistance, yet still supporting the abdominals of the user is in a structured configuration. This configuration renders these semi-static exercises more intense and targeted.

Figure 54:
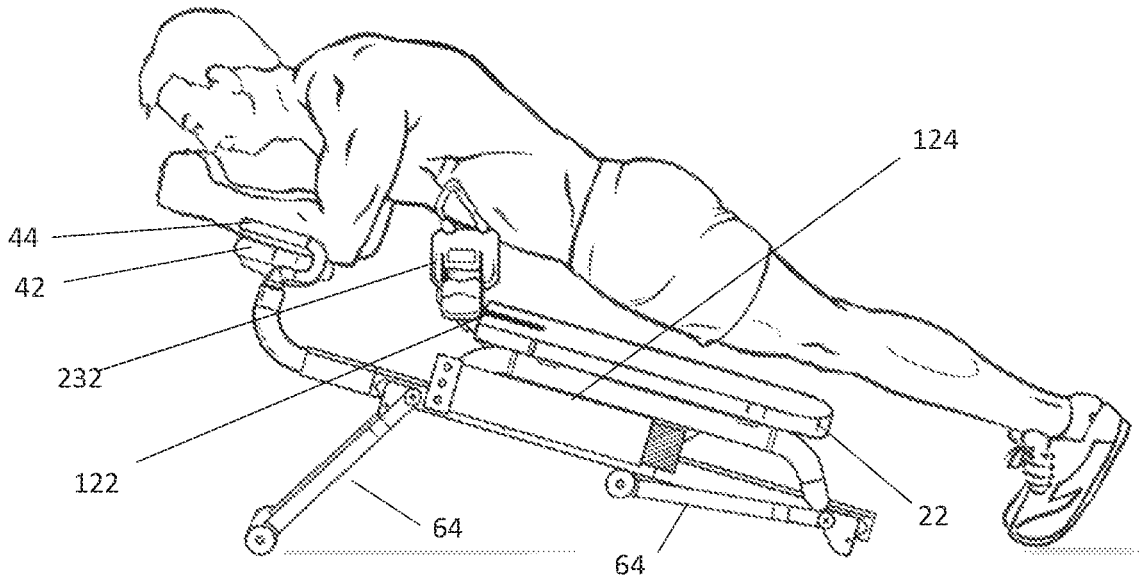
FIG. 54 is a side view of a user on the machine performing an assisted plank pose exercise with their feet on the floor.

FIG. 54 is a side view of a user performing an assisted static plank pose exercise on the machine 10 with their feet on the floor. This may be utilized in the same or in a separate embodiment. When it is the same embodiment, the foot support area of the machine 10 is removed to make room for the user to get into the position shown with their feet on the floor. The advantages to this may be for a very debilitated person to be able to engage with the machine 10 easier.

Figure 55:
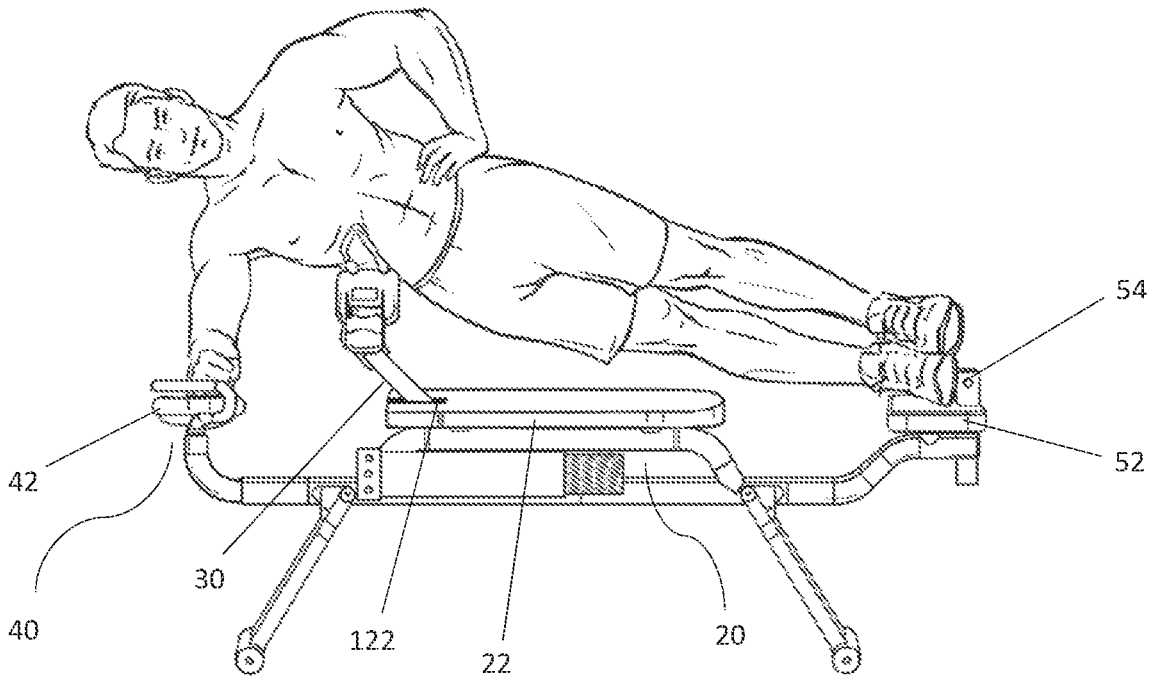
FIG. 55 is a side view of a user on the machine performing an assisted side plank pose exercise.

FIG. 55 is a side view of a user on the machine 10 performing an assisted side plank pose exercise which is performed much like the assisted straight plank pose exercises as seen in FIGS. 25 and 26 except the user is on the side and the emphasis is on the oblique musculature. Further, instead of both forearms being on the plank pad 42, only one is located therein and the other arm is positioned with hand on the hip. The user's feet are on top of one another on the foot area support 50 with the side of the bottom foot contacting the foot support pad 52 and the bottom of the bottom foot contacting the foot support element 54. The force is generated in the same manner as well and originates from the head of the machine support area 40 which may be anchored as part of or outside of the core support 20 and insertion attachment to the bottom of the guide arm 30.

Figure 56:
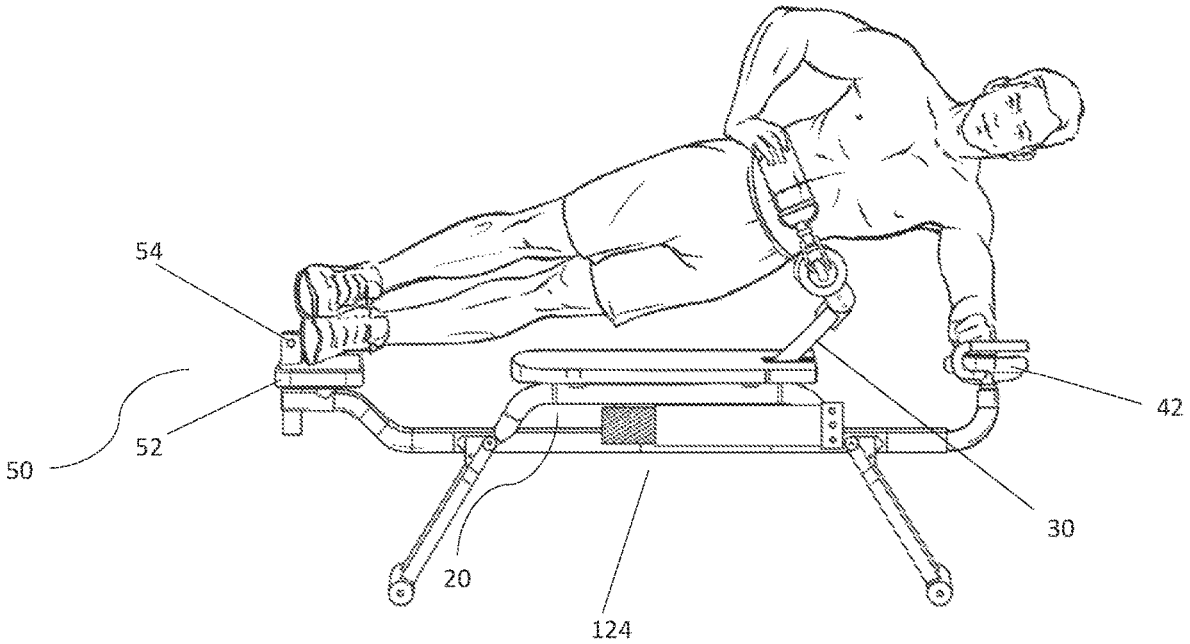
FIG. 56 is a side view of a user on the machine performing an added load plank pose exercise.

Mounting and dismounting the machine 10 in this position is a little different. The user is on their side the whole time. The process is the nearly identical, just that the user is on the hip as opposed to the position shown in FIGS. 50 and 51. FIG. 56 is a side view of the machine with a user on it performing a side plank pose exercise with added load. The exercise is performed much like the added load straight plank pose exercise as seen in FIGS. 48-49 and 52. In the performance of this exercise only one of the forearms is supported on plank pad 42. The other arm is placed on the hip, and both of the user's feet are on top of one another on the foot area support 50 in the same manner as FIG. 55. The force is generated in the same manner as in FIG. 42 whereby it is anchored as part of outside of the core support 20 and originates from the foot support side of the machine.

Additionally, the force generating element 125 is attached to the bottom of the guide member 30. When the user performs the exercise, this configuration pulls their hip toward the floor. The user performs the exercise by resisting such movement by creating a static pose in the position shown.

Figure 57:
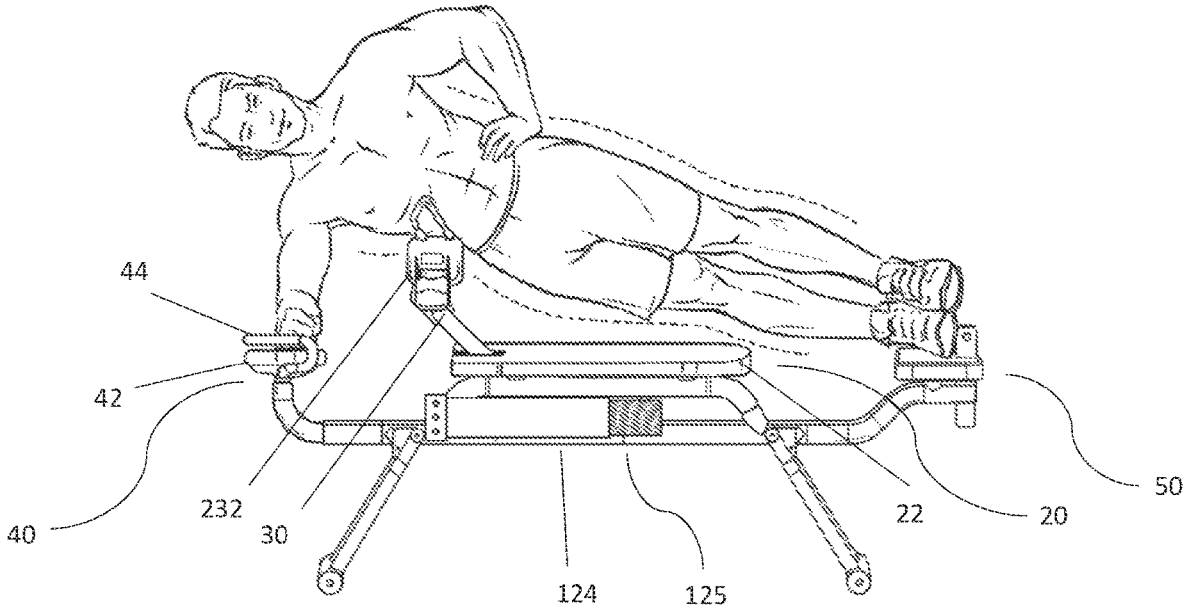
FIG. 57 is a side view of a user on the machine performing a semi-static assisted side plank exercise.
Figure 58:
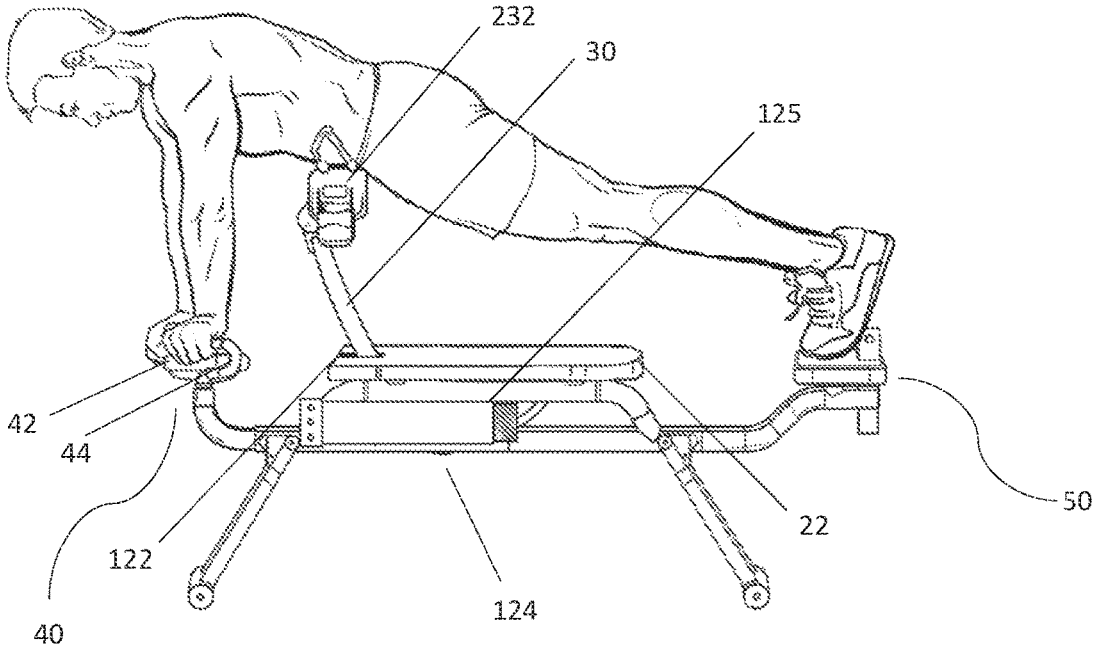
FIG. 58 is a side view of a user on the machine performing an assisted push-up exercise.

FIG. 57 is a side view of a user on the machine performing an added load semi-static side plank exercise. Once again, this is the same as FIG. 53, although the exercise is done in the side plank position. FIG. 58. is a side view of a user on the machine 10 performing an assisted push-up exercise. In the operation of this exercise the user engages the machine 10 much like they would in the performance of the plank exercise. After kneeling on the body pad 22 the user's inclination is to put one hand on one embodiment of the guide arm pad 232 and then proceed to put one and then the other on the plank pad 42 and next the handlebars 44.

In conjunction with the prior described alignment, the abdominal area is in contact with the guide arm pad 232. The user's feet are supported on the foot area support 50. While in the upward position the user reclines their body while being supported by the guide arm 30. The force of the force producing element 125 originates in the head of machine area 40 and is anchored as part of or outside of the core support 20 and its insertion is connected to the guide arm 30. The insertion of the force is under the body pad 22. As the user declines toward the bottom of the range of motion, energy is stored in the force producing element 125.

Figure 59:
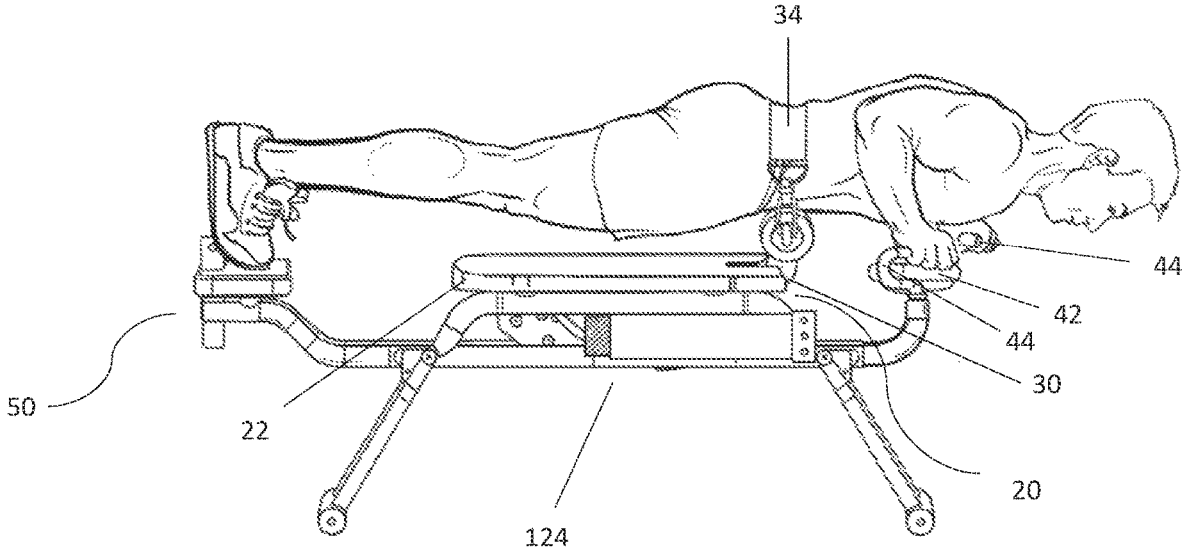
FIG. 59 is a side view of a user on the machine performing an added load push up exercise.
Figure 60A:
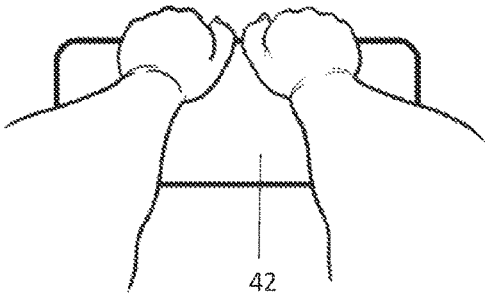
FIGS. 60A-60D are views of multiple variations of hand placements on the plank support pad.
Figure 60B:
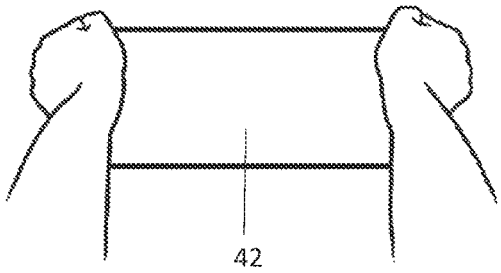
Figure 60C:
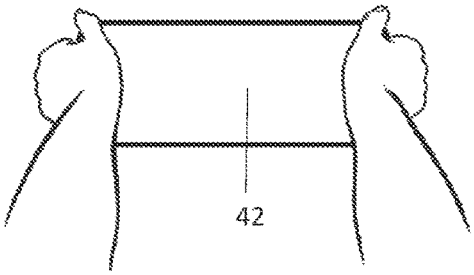
Figure 60D:
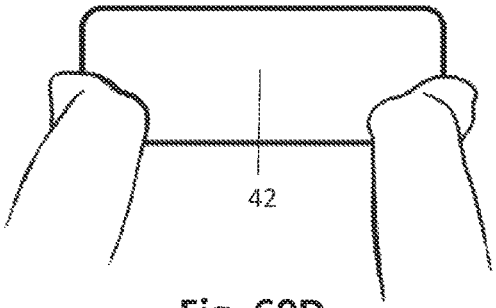

Next, once the user gets to the bottom of the range of motion and starts the concentric, or upward phase of the movement, the force producing element assists the user as they perform the exercise. When the user is finished with the exercise, the user kneels on the body pad 22, disengages the guide arm pad 32, places the feet on the floor and walks away from the machine 10. Also, FIG. 59 is a side view of a user on the machine 10 performing an added load push-up. In the operation of the machine 10 for this exercise, the user utilizes the same process as shown in FIG. 33 above. Except the force is originated in the foot area support 50 of the machine 10 and is anchored as part of or outside the core support 123 and the guide arm 130 is under load and in a down position. To engage the machine the user is harnessed to the machine in the methods shown above in FIGS. 48, 49 and others for planking exercise. The operation of the force element 125 is such that when the user goes from the down position to the up position, the force in the machine 10 is radiated through the guide arm 30 to add a greater load than what the user's body produces naturally. This is seen to be an extremely efficient and effective exercise.

FIGS. 60A-60D illustrate multiple top views of the head support 40 of the machine and different placements on the plank support pad. These placements include, the top of the pad, the top sides of the pads, the center sides of the pad and holding the bottom of the pad with the user's hands in a reversed positon. In this way, a user can have various gripping options depending on what is most comfortable. This allows for safe and comfortable exercise. The plank support pad 42 allows for the pressure on the hands and wrists to be greatly reduced. Additionally, the variation of hand positions allows a user to target different muscle groups.

Figure 61:
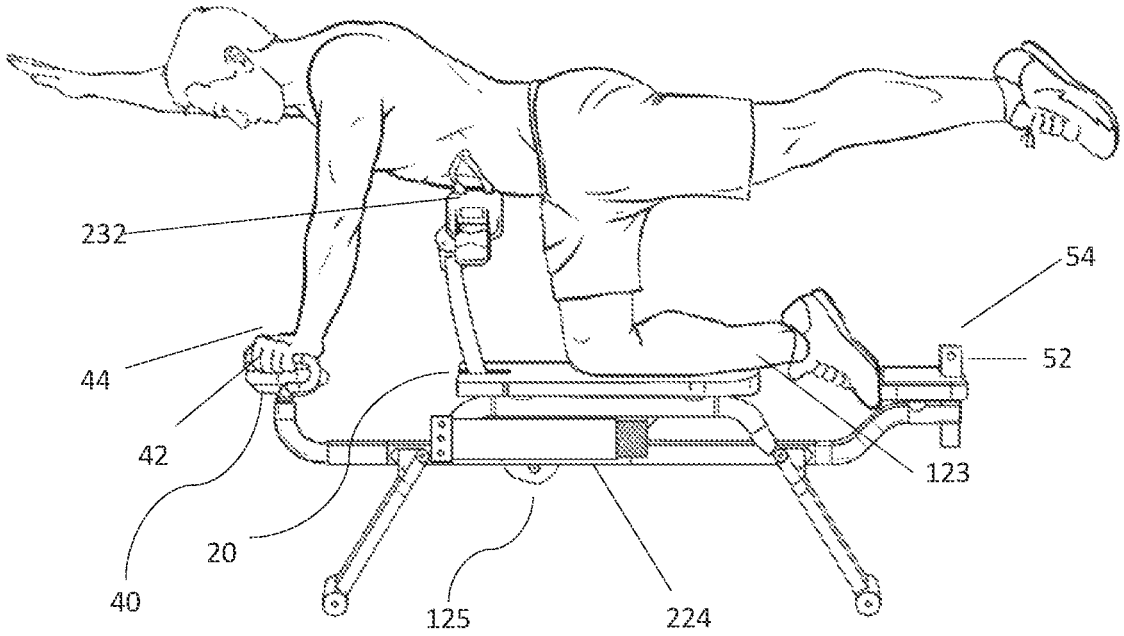
FIG. 61 is a side view of a user on the machine performing an assisted bird dog pose exercise.

FIG. 61 is a side view of a user on the machine 10 performing an assisted bird dog static pose exercise and this exercise is performed by assuming the position like a dog pointing at a bird, and hence the "bird dog." When the user performs this exercise, the user kneels on the machine much like is shown in many of the figures above. They have an inclination to put one hand on one embodiment of the guide arm support pad 232 and one hand on the plank pad 42 or one of the handles of the handlebars 44. In this position, the user's abdomen is in contact with the guide arm pad 232, one knee is down on the body support pad 22, the down hand is on the plank pad 42 and opposite the knee on the body support pad 22 or alternately described as diagonal from. Said arm and hand are in the air and pointing preferable straight in front of the user. On the other side of the machine, the foot of the down leg is in contact with the foot pad 52 and the foot element 54. The leg and foot diagonally across the body from the arm and hand in the air is also in the air and preferably pointing back straight.

Much like in performing the plank, the user holds this position for a number of seconds while the machine fortifies their position and allows them to concentrate on good performance of the exercise. This exercise is really great for strengthening the core musculature. In operation of the machine in this position the force is originating from the head of machine support 40 end of the machine and is anchored as part of or outside of the core support 20 and its insertion is connected to the bottom of the guide arm under the body pad 22 or the core support 20. This connection and action stores energy inside the force element 125 and assists the user to maintain the position shown.

Figure 62:
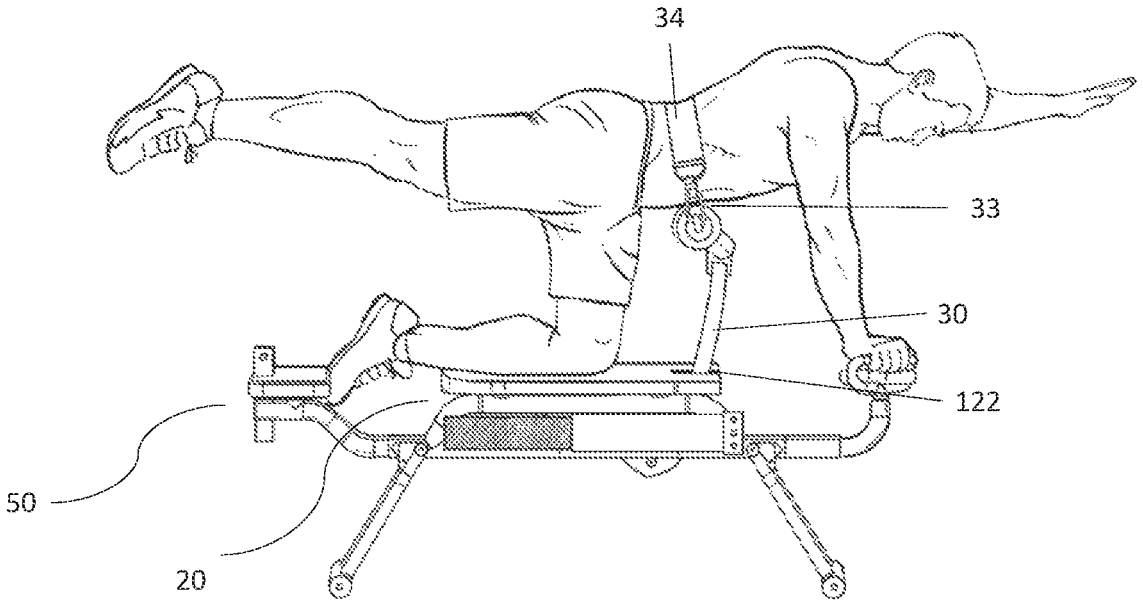
FIG. 62 is a side view of a user on the machine performing an added load bird dog pose exercise.
Figure 63:
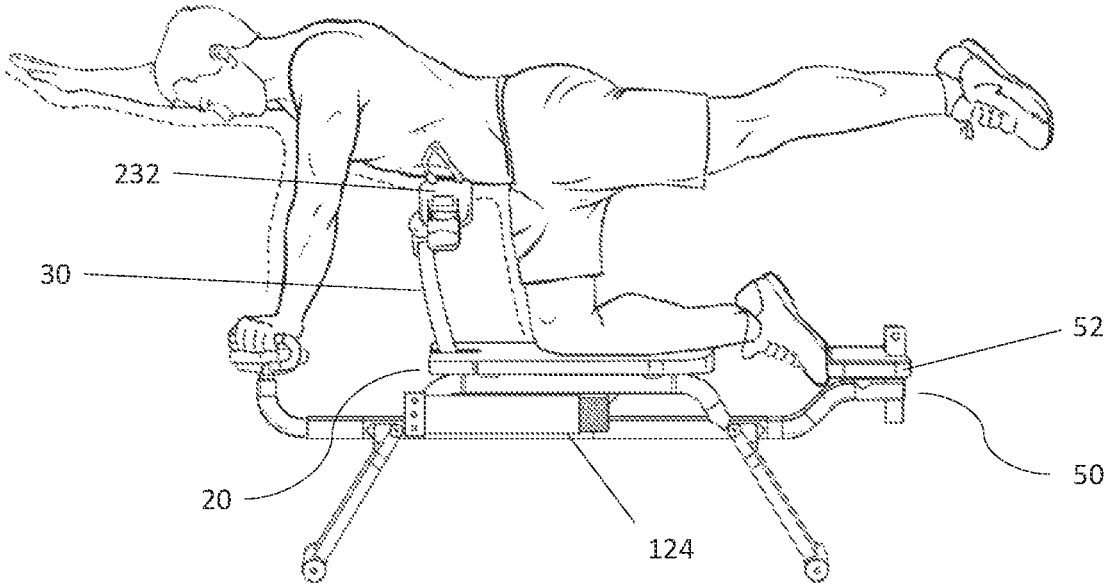
FIG. 63 is a side view of a user on the machine performing an assisted semi-static bird dog exercise.

FIG. 62 is a side view of a user performing an assisted semi-static bird dog exercise. The operation of the machine and the user is the same as above except the user bends forward ever so slightly as they perform the exercise and FIG. 63 is a side view of a user on the machine performing an added load bird dog pose exercise. In the performance of this exercise the user is in the position shown in FIG. 61 above. In the operation of this exercise, the force is originating from the foot support 50 side of the machine and is anchored as part of or outside of the core support 20.

Next, the user engages the machine much like when doing an added load plank or push-up whereby they are connected to the machine by belt 34 or shoulder harness 35. In this operation, the user starts in the down position and brings themselves to the position shown whereby the force producing element is adding resistance and pulling the user away from the position. In this action, the user performs the exercise by resisting the machines inclination to pull them down or out of position. This is a very difficult exercise to perform and requires the user to have very good core strength. Also, some slack in the connection between the retractable belt mechanism 33 and the belt 34 or shoulder harness 35 may need to be employed.

Figure 64:
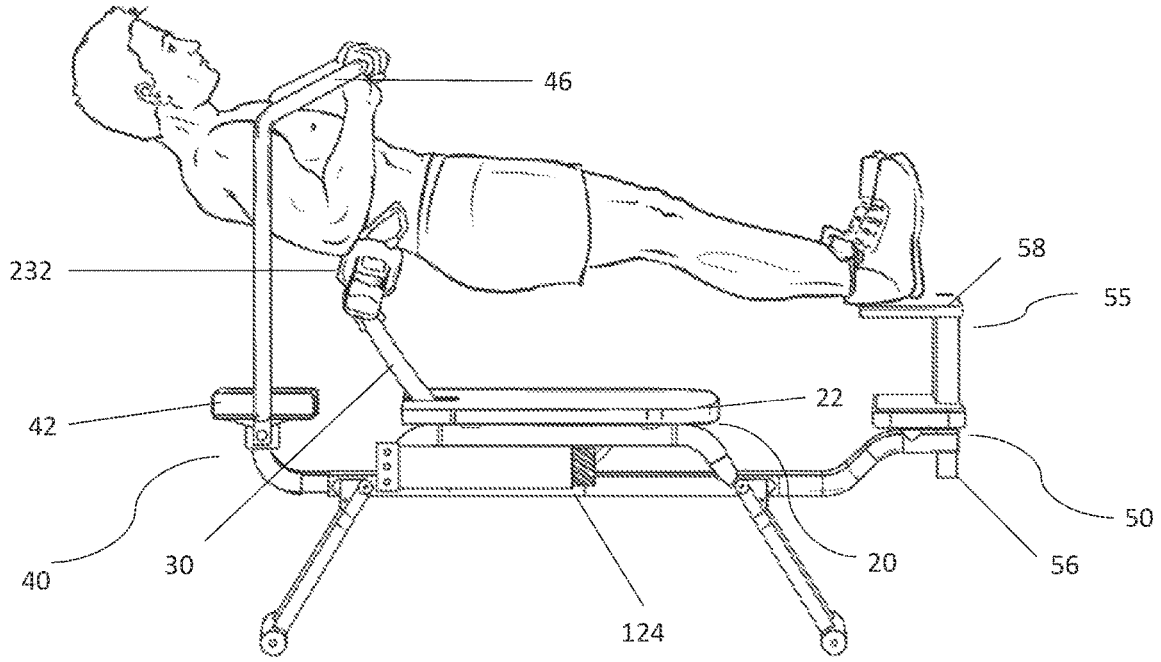
FIG. 64 is a perspective view of the exercise machine with an auxiliary high foot placement attachment embarked.

This is based on how high off the machine the user's torso is it relates to the guide arm 30. FIG. 64 is a perspective view of the machine adapted with the auxiliary foot support attachment 55 with the auxiliary foot pad 58. The higher foot placement attachment is employed when a user performs supine pull-ups or push-up or plank exercises where the body is in a declined position and the feet are above the hands. The higher foot placement attachment 55 can be telescopically affixed in the top of the foot element 54 of the foot support 50.

Figure 65:
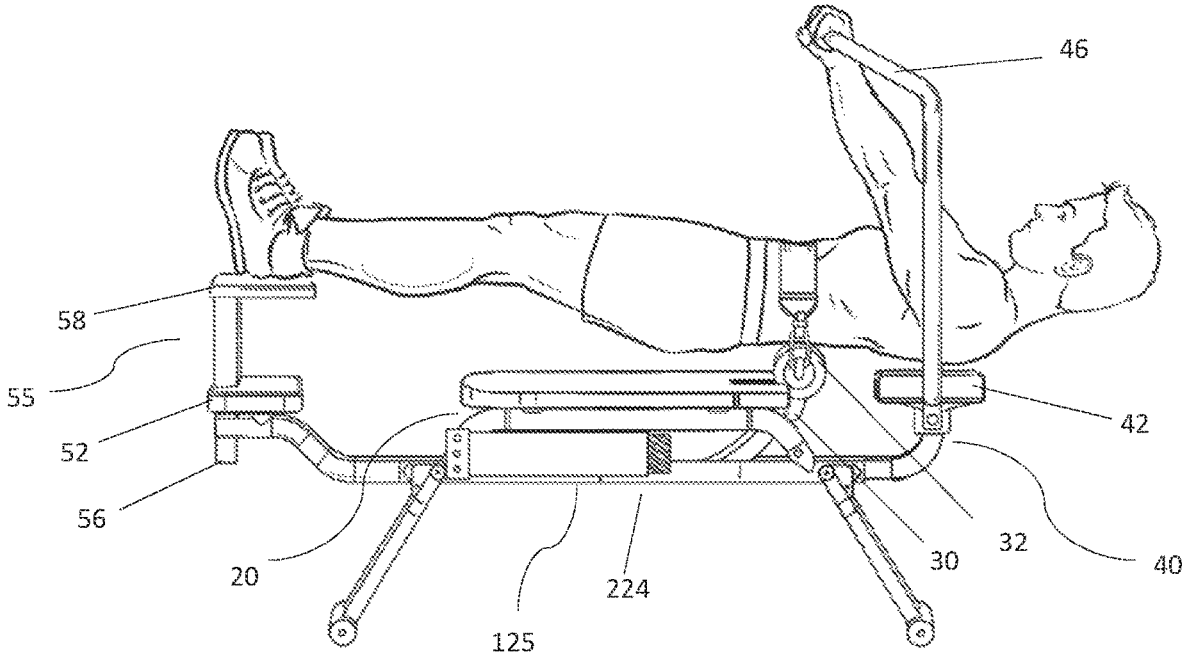
FIG. 65 is a side view of a user on the machine performing an assisted supine pull-up exercise.

FIG. 65 is a side view of a user on the machine 10 performing an assisted supine pull-up. The figure depicts the top or height of the range of motion whereby the user has pulled themselves up to their hands and has been assisted by the force generated from the assisted force canister 224. To perform the exercise the user sits on the body support pad 22 and engages the guide arm pad 32 on their back. Once in this position they lay backward storing energy in the assisted force canister 224. In this position, the top of the user's back is supported by the plank pad 42 of the head of the machine support 40 and the guide arm pad 32 is now in line with the user's lower back.

Next, when the user arrives at that position, the user places their feet up on the auxiliary foot support 55 which is telescopically positioned inside the foot support element 54 and held in place by the foot support positioner 56. At this point the user reaches up to the auxiliary handlebars 46 up over their head and aligned with the chest. From here the user performs an assisted supine pull-up by pulling with their arms and back to bring their chest to the auxiliary handlebars 46. During the performance of the exercise the force is originated from the head of the machine 40 side of the machine and is anchored as part of or outside of the core support 20 and its insertion point is at the bottom of the guide member 30.

As the user moves from the up position to the down position, the force stored inside the force producing element 125 motivates and actuates the guide arm 30 to follow the user's body and provide assistive force. Once at the top of the range of motion, the user performs the downward phase of the movement and returns to the bottom of the range of movement which is on the body pad 22 and plank pad 42. The supine pull-up is an excellent alternative to vertical pull-ups. Doing a pull-up in this position affects the musculature of the back and arms differently. It seems that more of the back is involved as well as the core, and there may be less stress on the shoulders and biceps.

In addition to a supine pull-up, a user can also perform an inverted plank for backside of body. Rather than pulling up toward the auxiliary handlebars, the user can simply hold the position shown with added load. In holding this position, the exercise affects the glute and hamstring musculature in a way that has never been conceived before. The user pushes their heels into the support creating a contraction in the hamstring and gluteus muscles. The arms and the back are affected very intensely as well.

Figure 66:
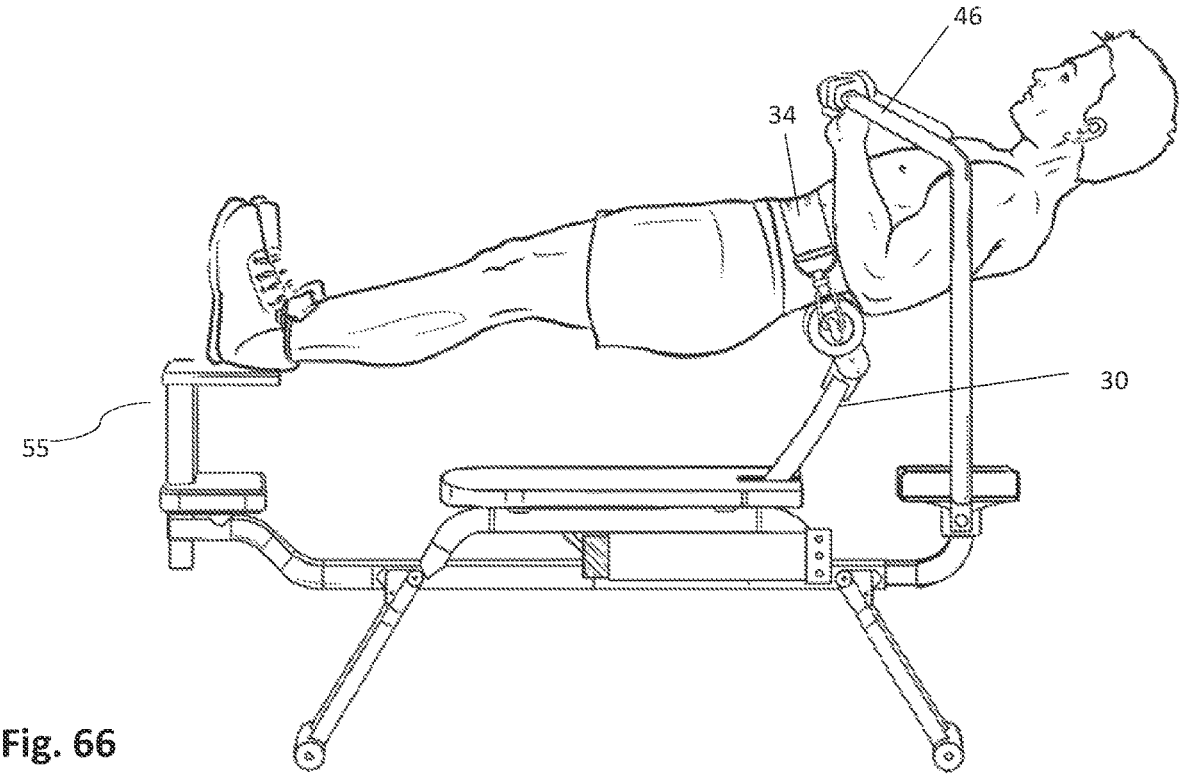
FIG. 66 is a side view of a user on the machine performing an added load supine pull-up exercise.

FIG. 66 Illustrates the ending position of the supine pullup described in FIG. 65 wherein the user has pulled the guide arm 30 up as he lifts his body up toward the auxiliary handlebars 46.

Figure 67:
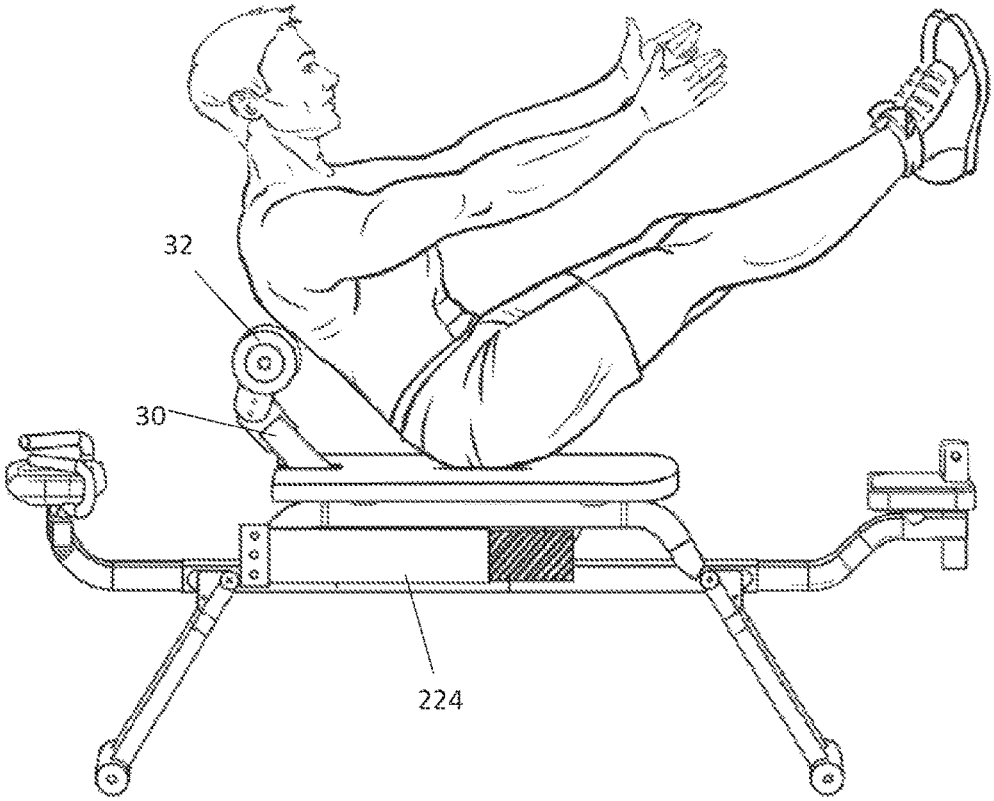
FIG. 67 is a side view of a user on the machine performing an assisted yoga half boat pose.

FIG. 67 is a side view of a user performing an assisted static yoga half boat pose exercise on the machine. In operation of this exercise the user sits on the machine and assumes the position shown. In this position, the user holds the legs in an isometric manner at a 45 degree or so angle and tries to hold their torso at the same angle with the aid of the machine. The force for this exercise originates from the head of the machine support 40 side of the machine and is anchored as part of or outside of the core support 20. When the user performs the exercise, the guide arm 30 has stored potential energy in it from its actions with the force producing element 24.

Figure 68:
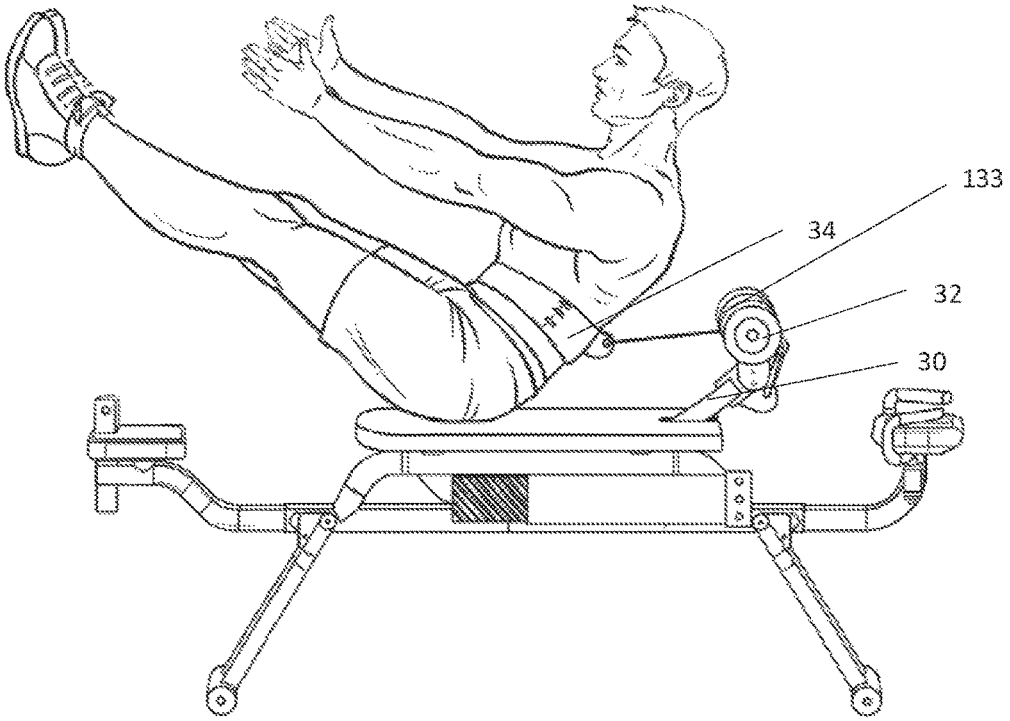
FIG. 68 is a side view of a user on the machine performing an added load yoga half boat pose.

FIG. 68 is a side view of a user performing an added load static yoga half boar pose exercise on the machine. This exercise is performed in the same manner described in FIG. 67 but the user is attached to a retractable harness 34. The harness creates tension, making it more difficult for the user to maintain this pose. Due to the increased difficulty, the user gets an increased core workout.

Figure 69:
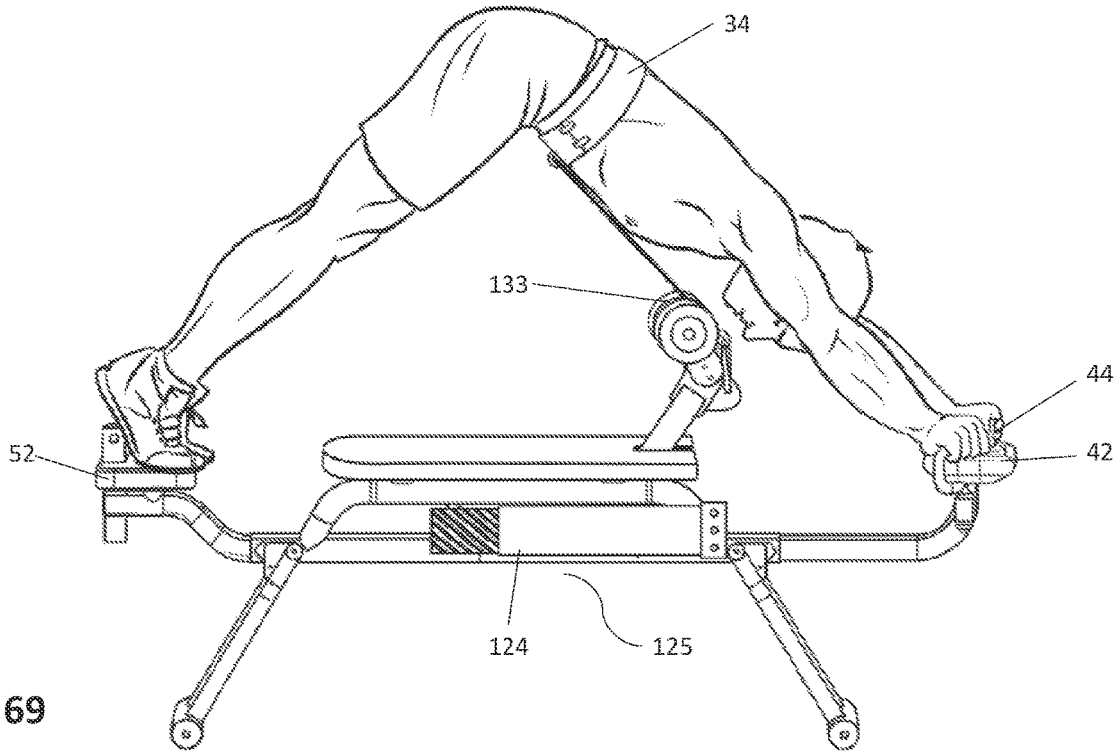
FIG. 69 is a side view of a user on the machine performing an added load downward dog yoga pose.

FIG. 69 is a side view of a user on the machine performing an added load downward dog pose exercise. In the performance of this exercise, the user is in the position illustrated. In the operation of the exercise the force originates from the foot support side of the machine and is part of or outside of the core support 22. The force is produced by the connection of the force element 125 to the insertion point on the bottom of the guide member 30. Said configuration increases the load when the exercise is performed and the user engages the machine much in the same manner as for an added load plank pose exercise, wherein the user reclines across the machine, and connects the machine at the guide arm pad 32, via a belt 34 or shoulder harness 35. Once connected, the user's feet are in contact with the foot element 54 and the foot pad 52, and their hands are on the handlebars 44 or plank pad 42.

In the operation of this exercise, the user starts in a down position and raises their hips as high as the can go while maintaining an inverted V-shape with their body and a connection with the foot element 52 and the handlebars 44. In the instant position, the user is pulling the guide arm off the frame of the machine 10 with their raised hips while machine 10 is under load. In executing this action, the user performs the exercise by resisting the machine 10 inclination to pull the hips of the user down or out of position much like the bird dog above. In concert with this activity, there is an interesting radiation of force through the feet into the legs, specifically the hamstrings up through the hips, the lower back, the upper back, the arms and eventually the hands. This can only really be experienced on the machine 10 and part of this different experience is that the user can push on both the foot element 52 and the inner surface of the handles. This accentuates the radiation of force through the entire body.

In yet another configuration, the user can flex the abdominal muscles as they push the back against the restraint caused by the belt 34 and this would not necessarily be the case if wearing a shoulder harness 35. Much like with the bird dog in FIG. 62 above the user needs to employ the use of slack in the system between the belt 34 or shoulder harness 35 and the retractable belt mechanism 33 as they perform these types of exercises.

Figure 70:
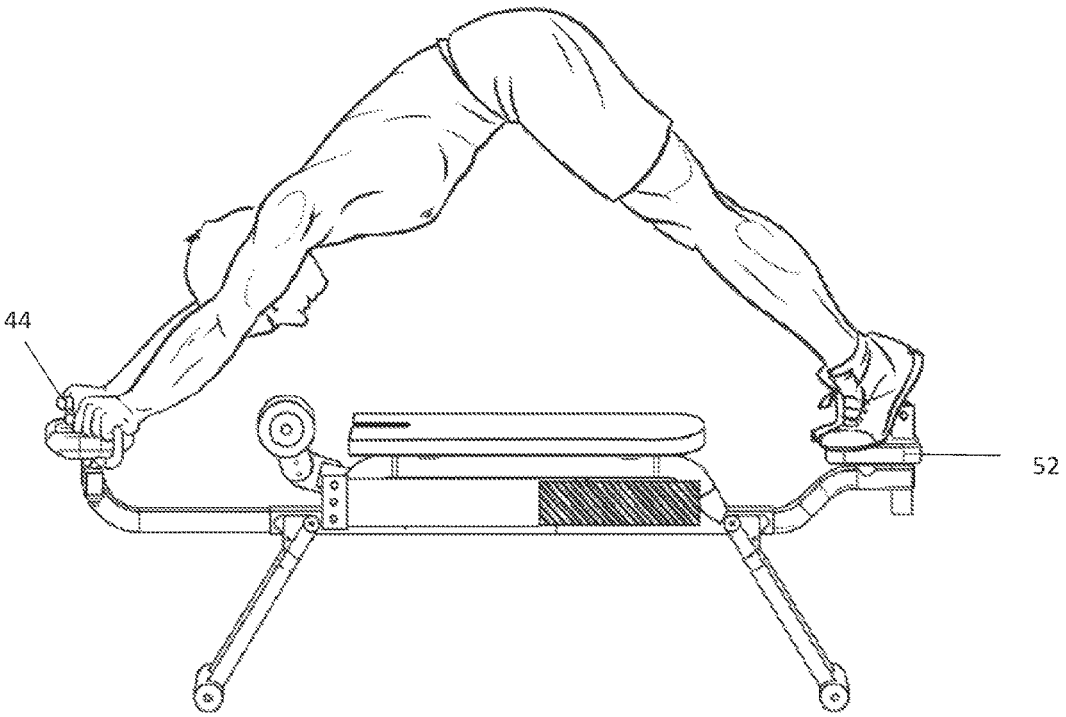
FIG. 70 is an isometric view of a user on the machine performing a downward dog yoga pose with no force hindering the user and just using the apparatus.

FIG. 70 is an isometric view of a user on the machine performing a downward dog pose exercise with no force connection to the machine. The machine at this point seems to be an apparatus, and a really good one for performing this exercise. This is much different than doing the exercise on the floor. The accentuated connection points between the hands and feet create an intensified connection between the entire kinetic chains of the body.

Figure 71:
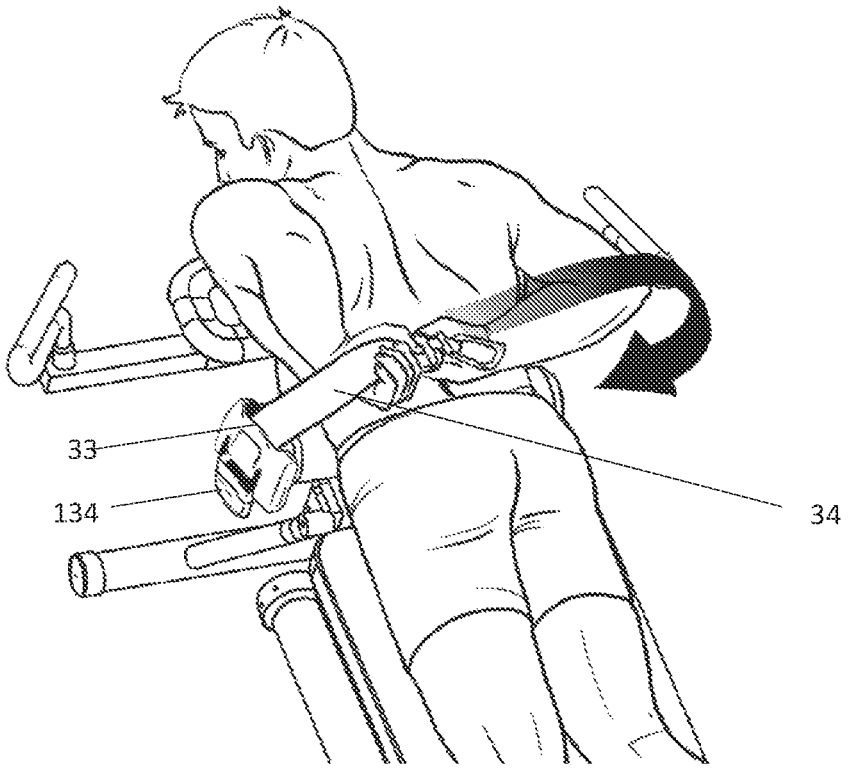
FIG. 71 is a back view of a user extending the retractable harness.

FIG. 71 illustrates the retractable harness 34 being extended from the harness retracting mechanism 33. Extending and retracting the harness is easy and can be accomplished with a single hand, as illustrated in the figure. The retractable harness can also be tightened through use of the harness ratcheting mechanism 134.

Figure 72:
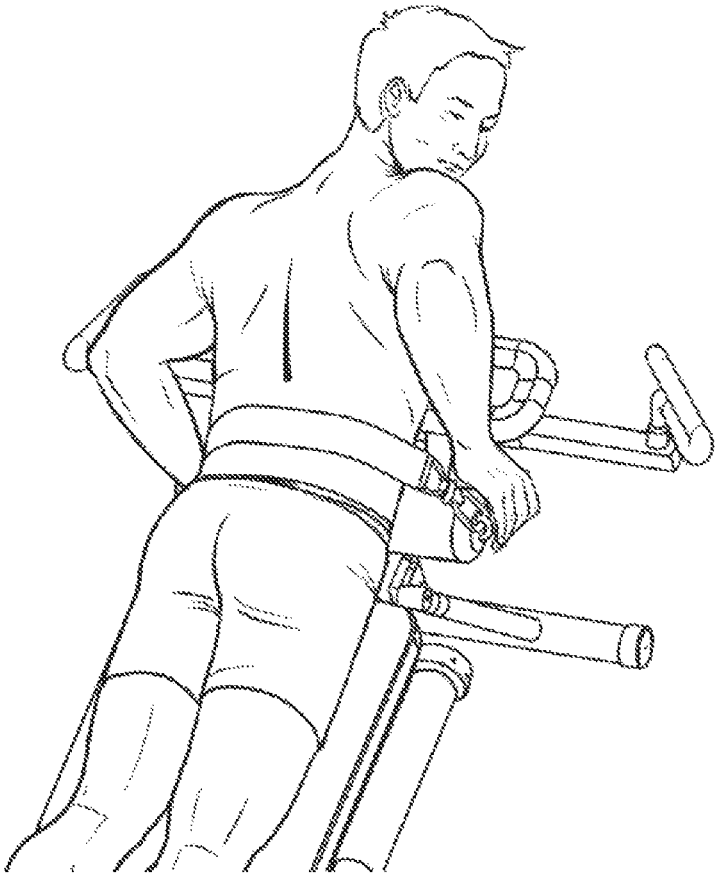
FIG. 72 is a back view of a user securing the retractable harness.

FIG. 72 illustrates the latching of the retractable harness using the harness latching mechanism 137. Additionally, FIG. 72 illustrates an embodiment of the harness with a harness pad 234.

Figure 73:
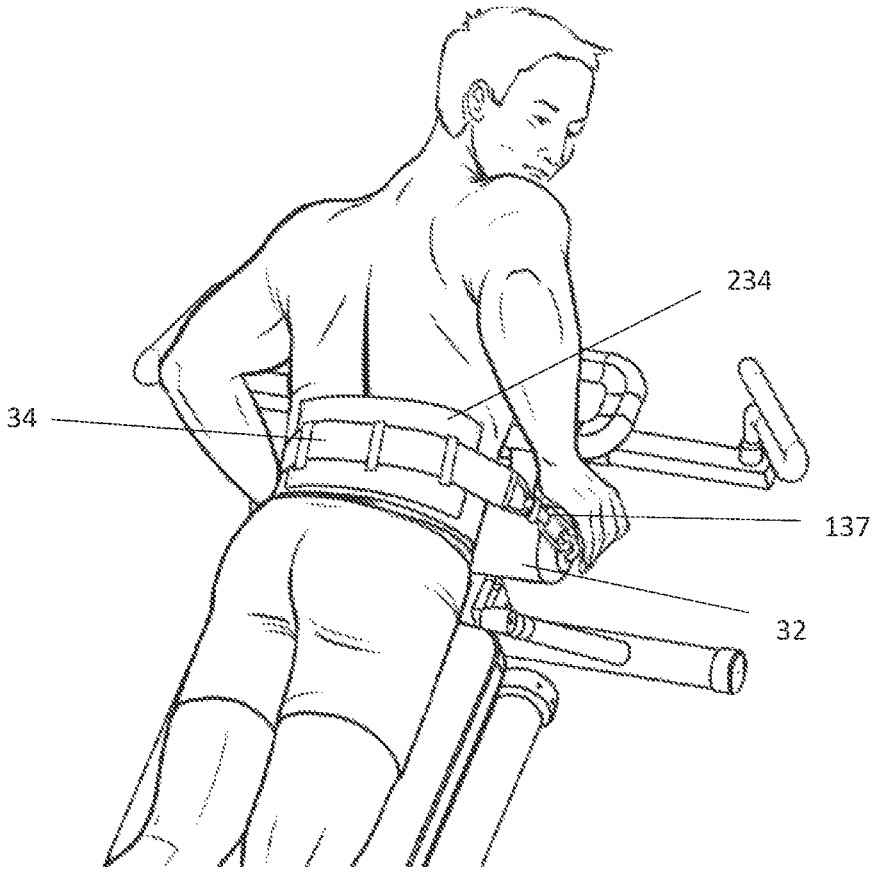
FIG. 73 is a back view of a user utilizing an embodiment of the harness containing a harness pad.

FIG. 73 is a back view of a user utilizing an embodiment of the harness containing a harness pad.

Figures 74A, 74B:
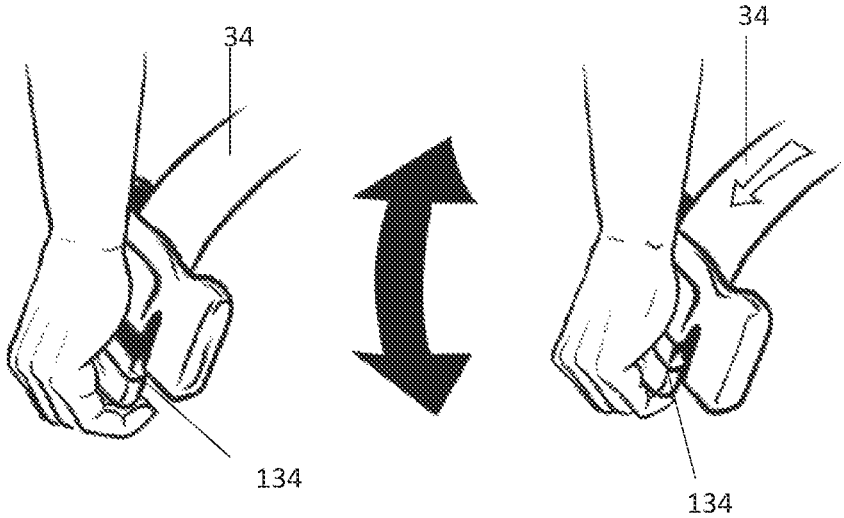
FIGS. 74A-74B are views of the harness ratcheting mechanism.

FIGS. 74A-74B are views of the harness ratcheting mechanism.

Figure 75:
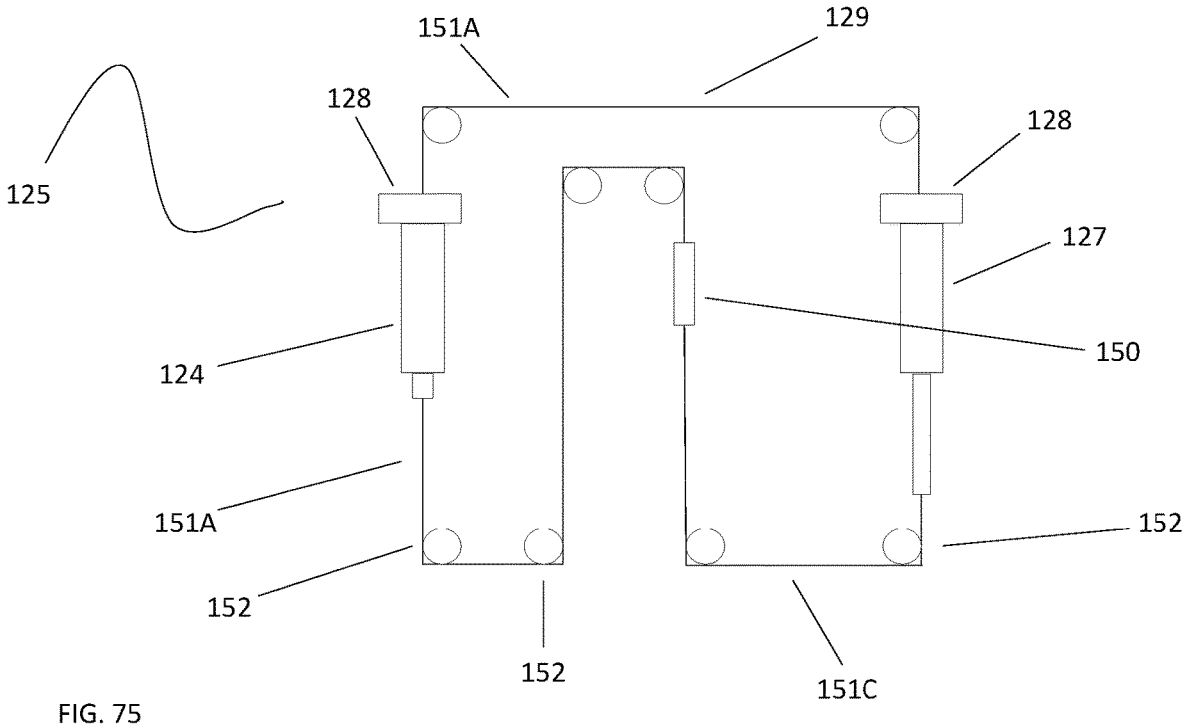
FIG. 75 is a view of the force component loop.

FIG. 75 illustrates an embodiment of a loop 129 as a force component 125 which allows for both assisted and added load systems in the same machine. The loop comprises at least two canisters 124, 224, wherein at least one canister is an added load canister 124 and at least one canister is an assisted canister 224, a trolley 150, and a guide cable 151 with at least three guide cable members 151*a*, 151*b*, 151*c*. The loop also has at least two cable guiding rotating members 152 at the front of the machine and dispersed in various spots on the front and back of the inner frame. The guide cable 151 is looped through the guiding rotating members 152 and connected to the trolley 150 and the two canisters 124, 125. One guide cable member 151*a* connects the back of one canister to the front end of the tang on the trolley. In the process, the guide cable member goes around at least two guide rotating members 152. A second guide cable member 151*c* connects the back end of the tang on the trolley to the back of a second canister. In the process of connecting the back end of the tang on the trolley to the back of a second canister, the guide cable member is looped through the guiding rotating members 152. A third guide cable member 151*b* connects the front end of the added load canister 124 to the front end of the assisted canister 224, once again engaging guiding rotational members 152 along the connection route.

Figure 76:
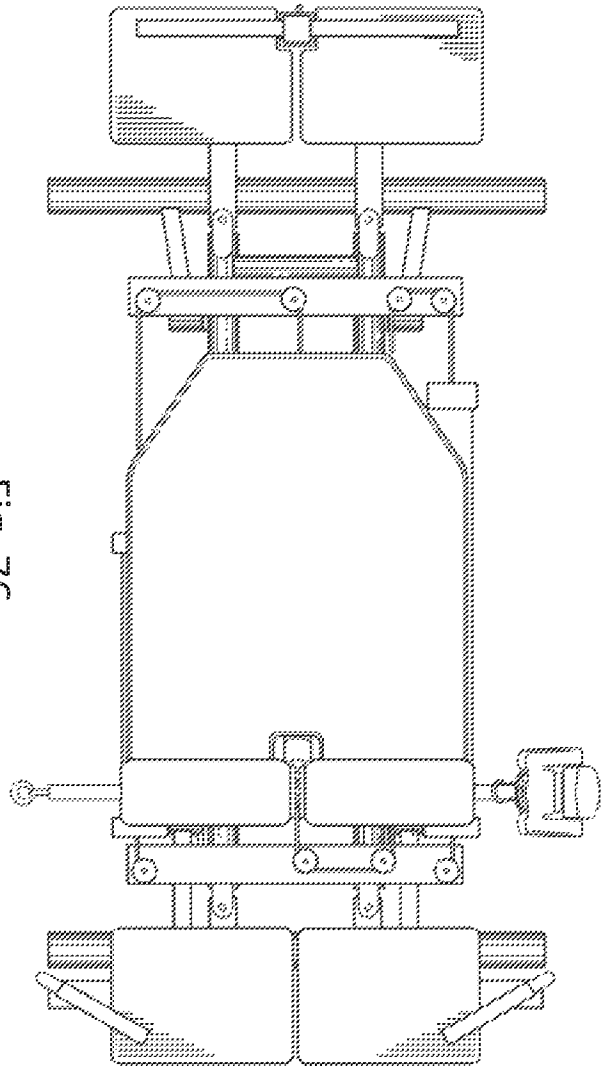
FIG. 76 is a view of one embodiment of the exercise machine with divided head and foot supports.

FIG. 76 illustrates one embodiment of the exercise machine comprising a divided foot support 350, divided foot support pad 352, divided head support 340, and divided plank support pad 342. In this embodiment, each half of the divided foot support 350 and head support 340 are attached to the main support frame 60 of the machine. The two halves of the divided foot support come together to surround the foot element positioner 56.

Figure 76A:
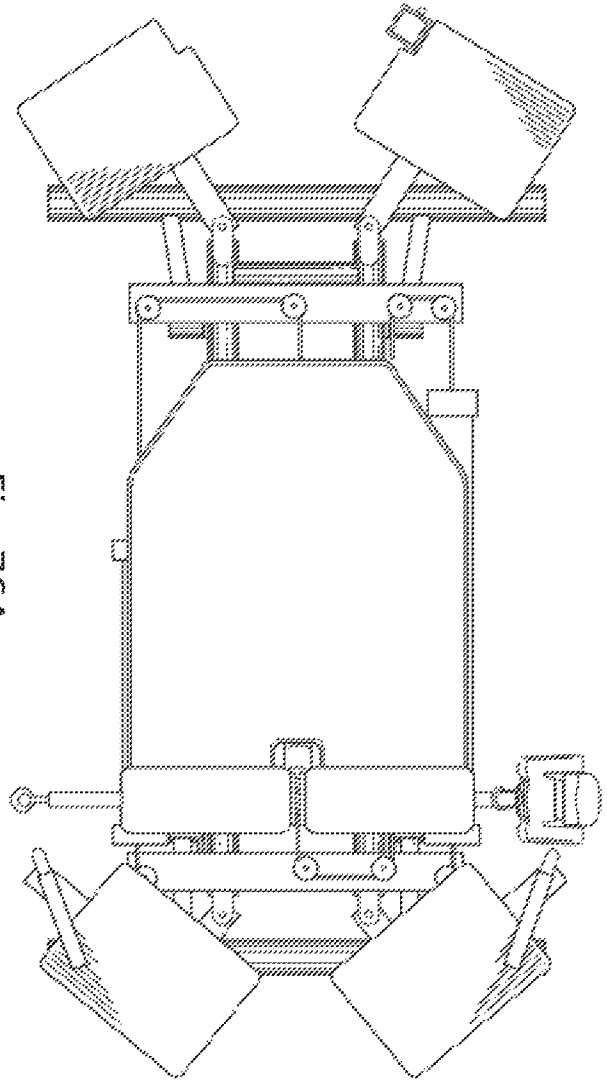
FIG. 76A is a view of the exercise machine with the divided support's rotated outward.

FIG. 76A illustrates the embodiment described in FIG. 76 with the two halves of the divided foot support 350 and the divided head support 340 rotated outwardly, which increases the distance between each half of the divided head support or divided foot support. Increasing the distance allows the user to vary the width and rotation of his or her hand or foot placement for exercise variations.

Figure 77:
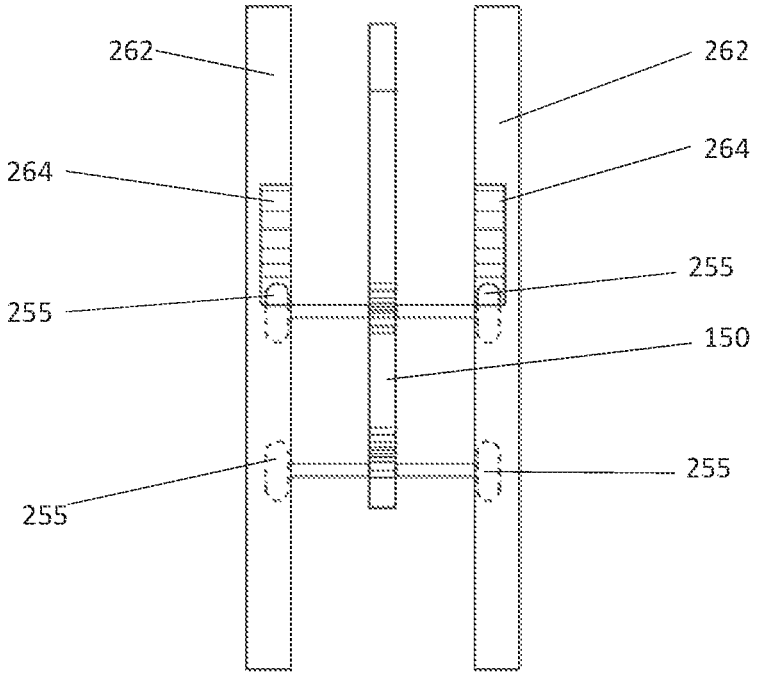
FIG. 77 is an embodiment of the trolley and rail system.

FIG. 77 illustrates an exploded view of an embodiment of the rail and trolley system. In this embodiment, the rails 262 are cut into two solid pieces of material whereby they create a channel 264. The trolley wheels are modified such that the modified trolley wheels 255 fit inside said channel 264. The channel is open on both sides on the tip so the trolley 150 and arm assembly can be fit in for operation.

Figure 78:
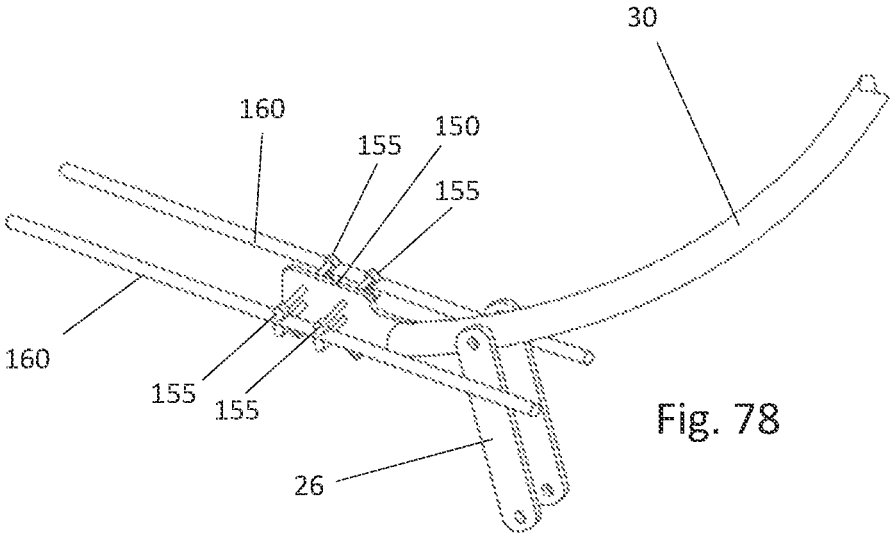
FIG. 78 is a view of an embodiment of the trolley and rail system with the guide arm.

FIG. 78 illustrates an exploded view of an embodiment of a trolley and rail system. It is comprised of the rails 160, the trolley 150 and guide arm 30. The trolley is comprised of at least two wheels 155 that hold it to the rails. The top wheels of the trolley are eccentric to help the wheels seat better on the rails.

Figure 79:
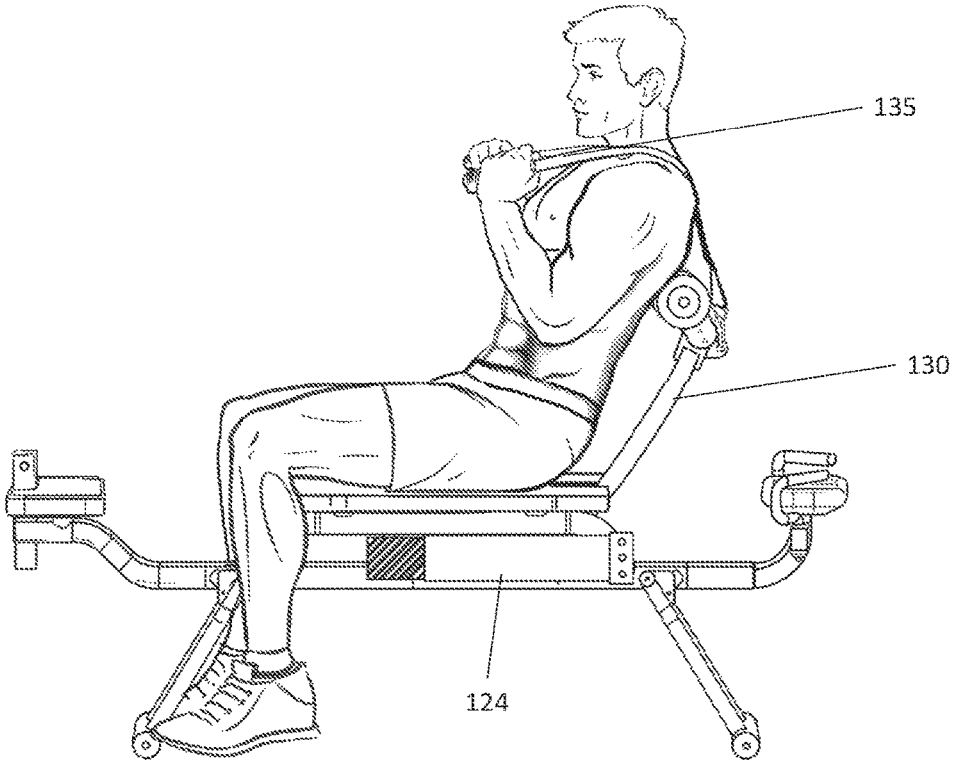
FIG. 79 is a side view of a user performing an added load vertical abdominal vacuum machine exercise.

FIG. 79 illustrates one embodiment of a vacuum exercise in which a user lifts his or her chest to train the intercostal muscles, including the serratus, and pull the abdomen up and in against the resistance of the machine. In this embodiment, the exercise is performed with an added load. To perform the exercise the user sits on the machine as shown in the figures. The user then attaches the harness 34 with an optional harness pad 234, engages the deep inner and lower abdominal musculature by creating a vacuum there and pulling said abdominal musculature up and in. Additionally, the user can lean backward with the machine pulling them. As this is happening, the musculature just mentioned along with the rib and chest supporting musculature resists the movement of the machine. Still further, the user can lift their chest as high as they can and tighten the whole area to affect, strengthen and form the musculature in said area. This exercise can also be performed with a concentration on just one side of the abdomen. Doing so makes the concentration right in the area of the oblique and hip flexor tie in.

Figure 80:
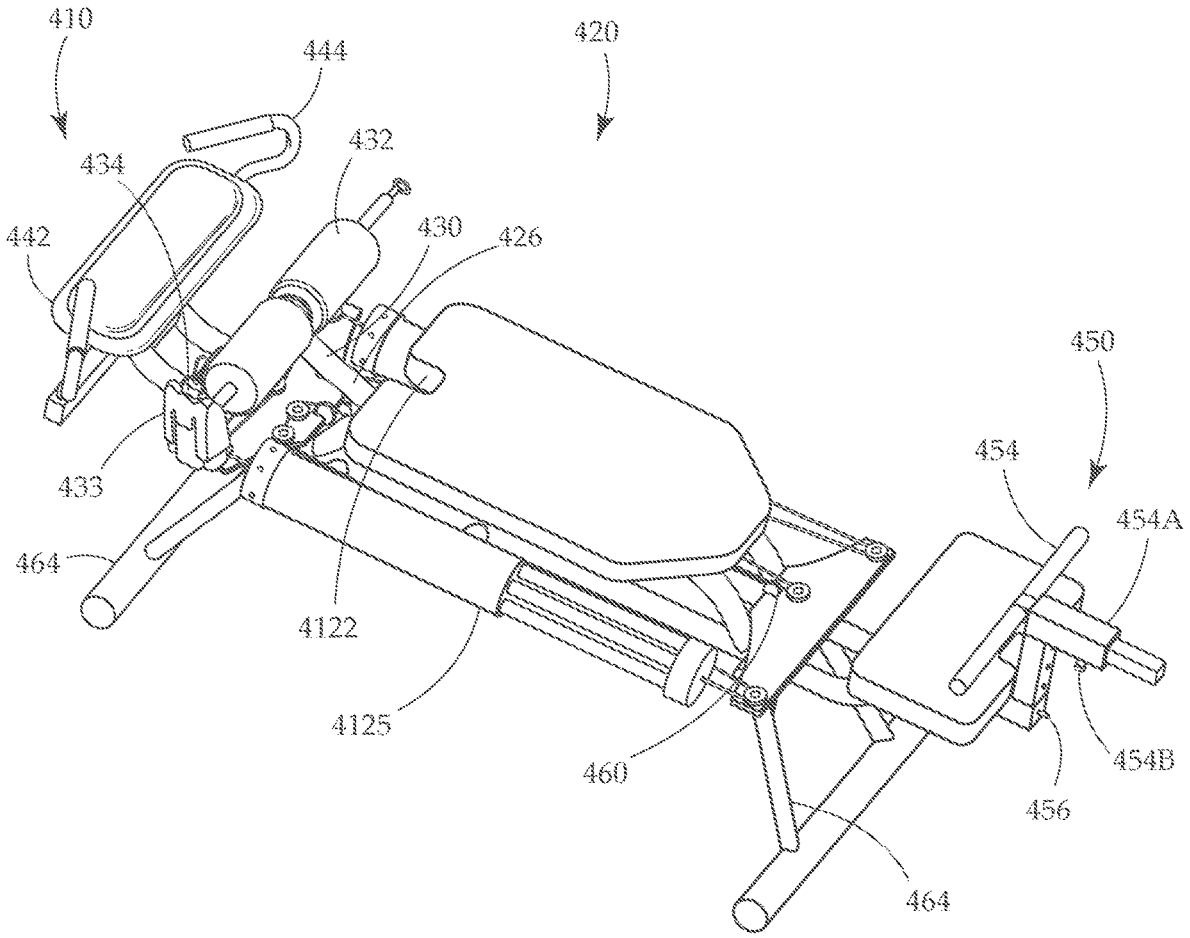
FIG. 80 is a perspective view of one embodiment of an exercise equipment.

FIG. 80 is a perspective view of one embodiment of an exercise equipment 410. The exercise equipment 410 may also be included as an overall system and series of apparatuses. The instant embodiment comprises at least three main support and utilization members, namely at least one core support 420, at least one head support 440, at least one foot support 450, and at least two legs 464. The exercise equipment 410 further includes a main support frame 460 which supports the three main support members, namely the at least one core support, the at least one head support and the at least one foot support 420, 440, 450. The head support 440, more closely depicted in FIGS. 91-93 consists of a plank safety/support pad 442 and a set of handlebars 444. The position of the handlebars 444 may be adjusted by the user depending on the type of exercise desired. The foot support 450, more closely depicted in FIGS. 94-96 consists of a foot pad 452, a lateral foot stabilizer 454, a foot stabilizer positioner 456 a foot stabilizer medial adjustment member 454*a* and a medial adjustment member locking element 454*b*.

Figure 97:
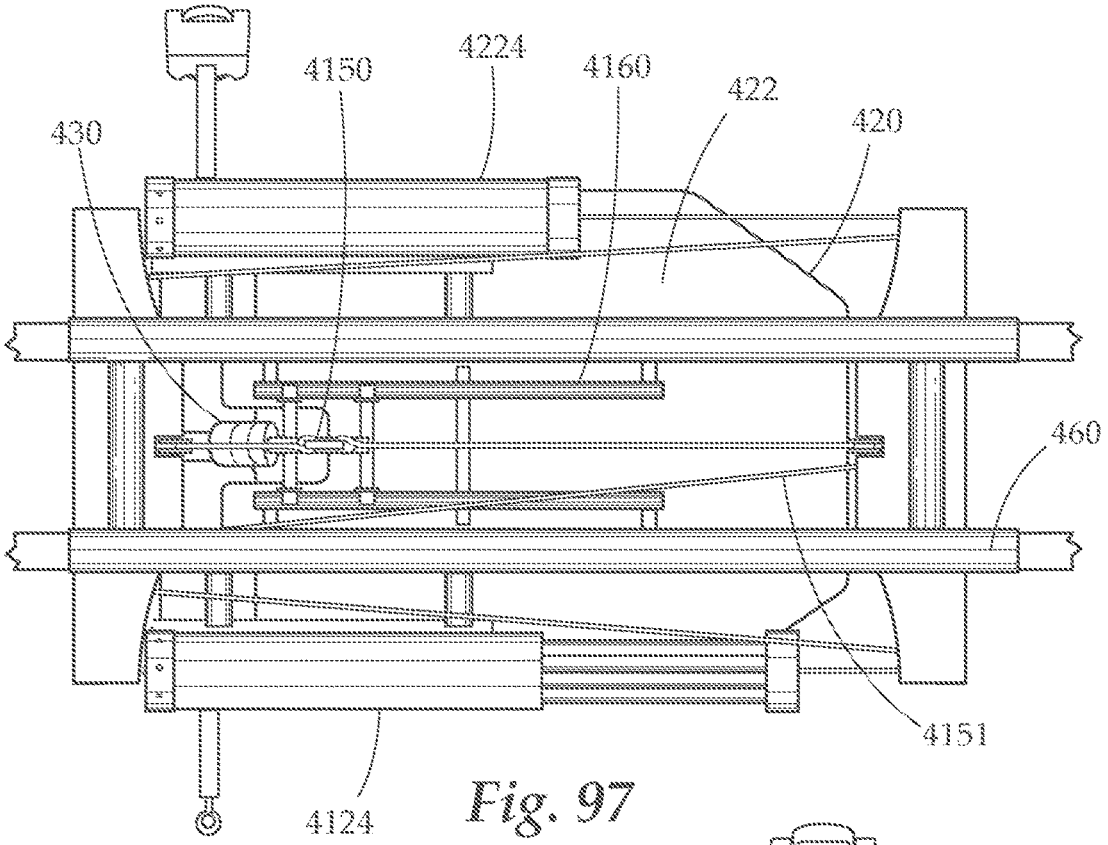
FIG. 97 is a partial bottom view of the core support which comprises a central support frame, body support pad, the guide arm and the force component comprising the reducing load canister, the amplifying load canister, at least two rails, a trolley, and a guide cord.
Figure 98:
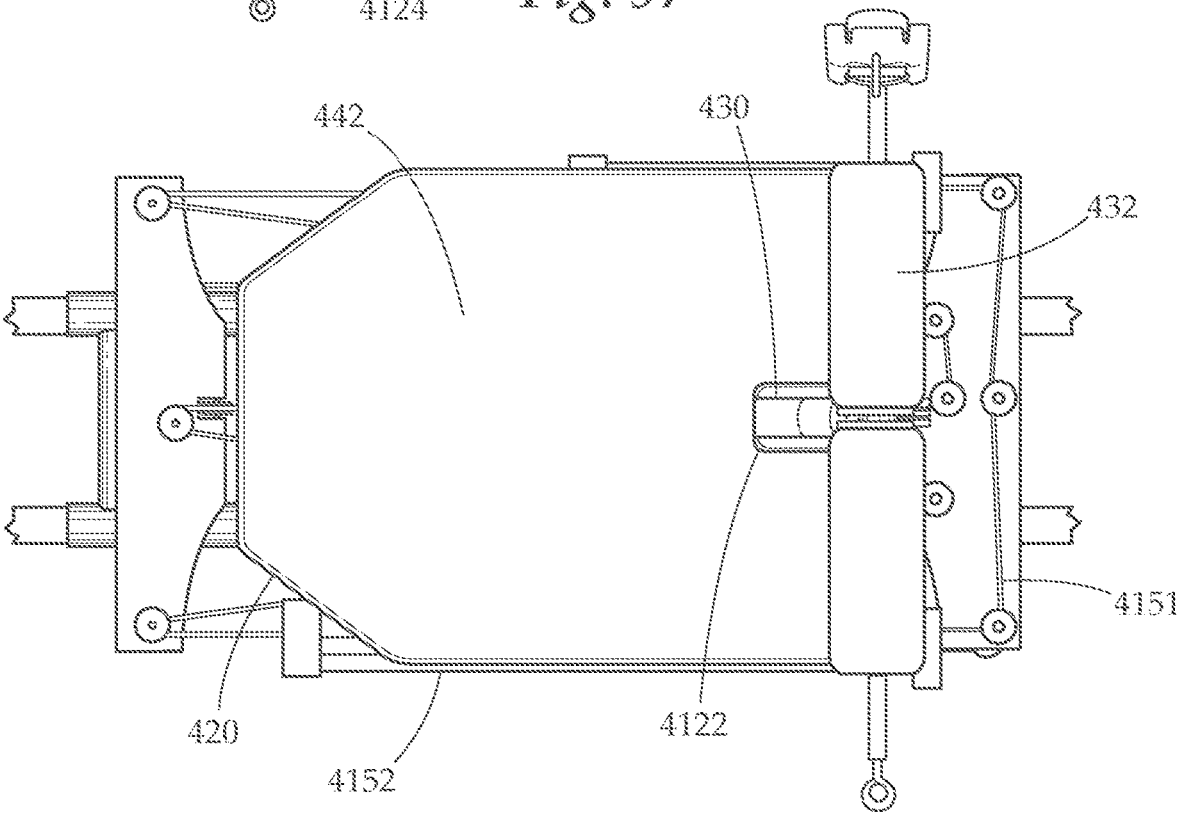
FIG. 98 is a partial top plan view of the core support illustrating the body support pad, the groovein the body support pad, the guide arm and the guide arm pad.
Figure 99:
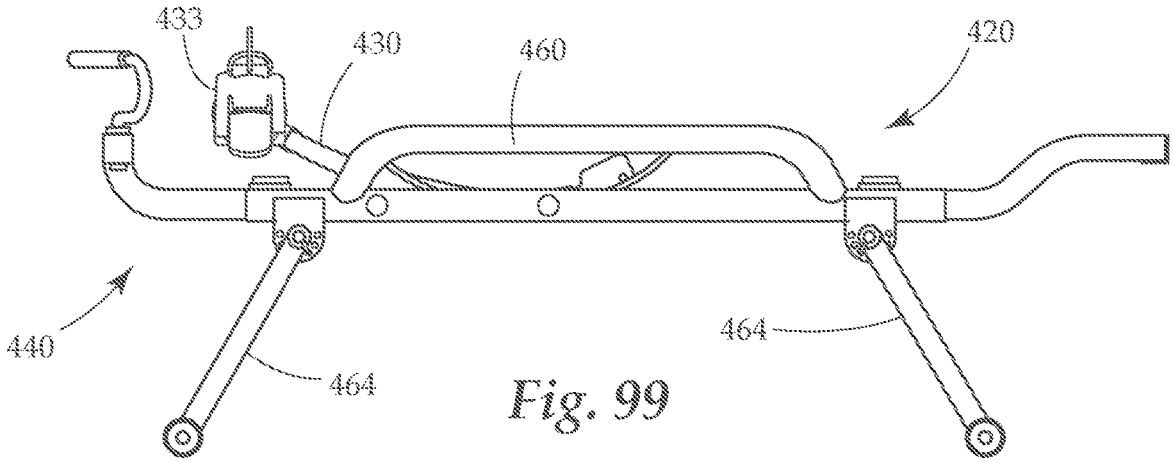
FIG. 99 is a partial side view of the core support illustrating, the core support structure, the legs the guide arm, the guide arm pad, the ratcheting belt mechanism and the components of the head area support.

The core support 420, more closely depicted in FIGS. 97-99 may comprise a body support pad 422, a guide arm 430, a guide arm pad 432, and a retractable ratcheting element 433 and a belt 434. The guide arm 430 has a relationship with the core support 420 by at least one fulcrum 426 that allows the guide arm 430 to move with the user. The guide arm 430 is connected to a trolley 4150 on a single or multiple rails 4160 and creates at least one new way to form a fulcrum 426. The fulcrum 426 preferably has an articulating relationship to a center of the core support 420 and can be extended upwards through a groove 4122 in the body support pad 422. In another embodiment, the guide arm 430 is connected to a force component 4125 that may be varied and adjusted according to the user. The force component 4125 is depicted more closely in FIGS. 104-106

Figure 81:
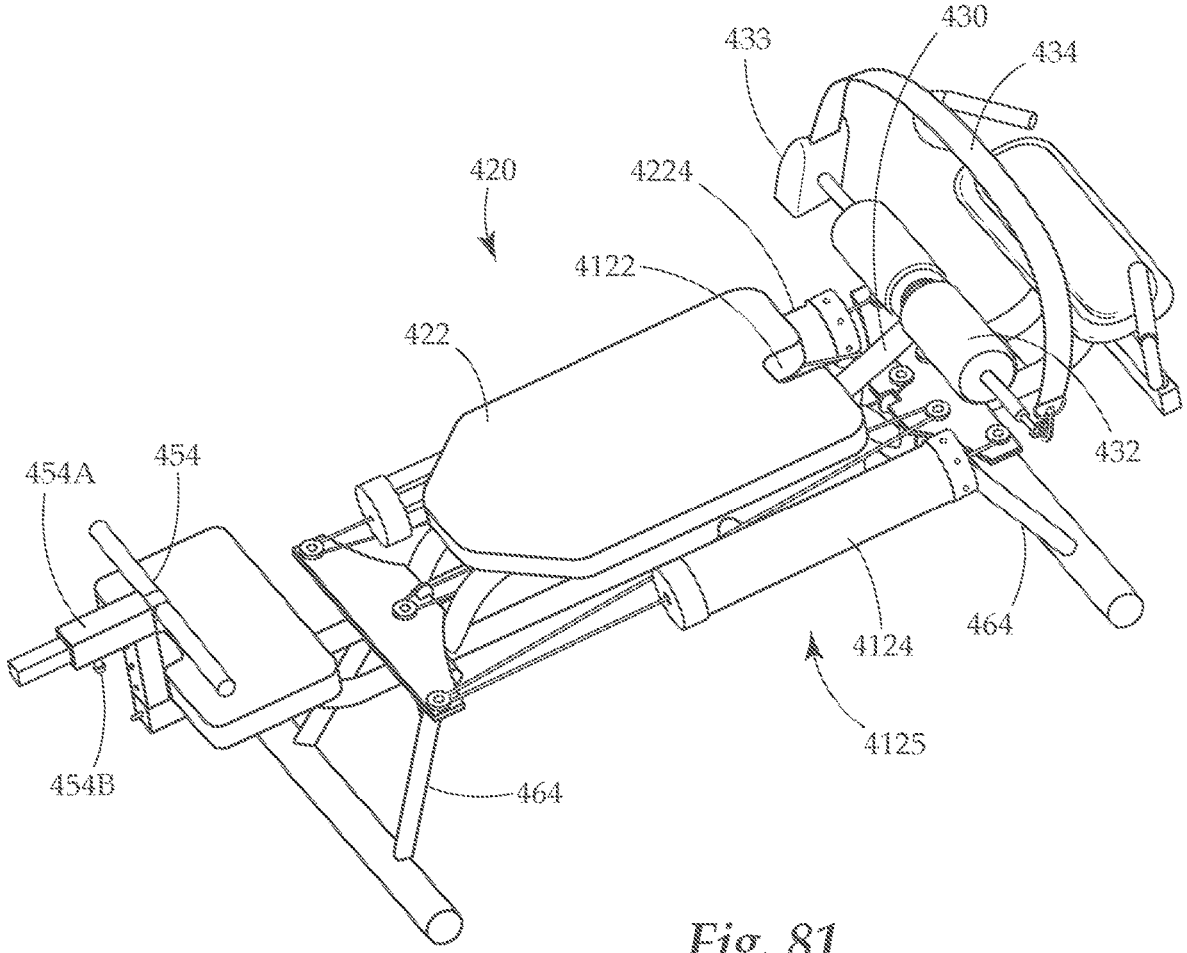
FIG. 81 is a perspective view of the exercise equipment in which the guide arm is in a down or a starting position whereby the force component will produce force that amplifies an effect of gravity on the user.

FIG. 81 is a perspective view of the exercise equipment 410 in which the guide arm 430 is in a down or a starting position whereby the force component 4125 will produce force that amplifies an effect of gravity on the user. In this position the belt mechanism 434 is around the user's torso and is cinched to a comfortable tightness whereby it protects the front of the abdomen and secures the user to the guide arm pad 432 via the ratcheting element 433 of the belt mechanism 434. In this embodiment, the cinching magnifies an inward protective biofeedback flexion of the abdomen and a general awareness of the entire body. The desired selected force of the user is produced by an amplifying canister 4124 and a reducing canister 4224 is neutral during the operation of the exercise equipment 410.

Figure 82:
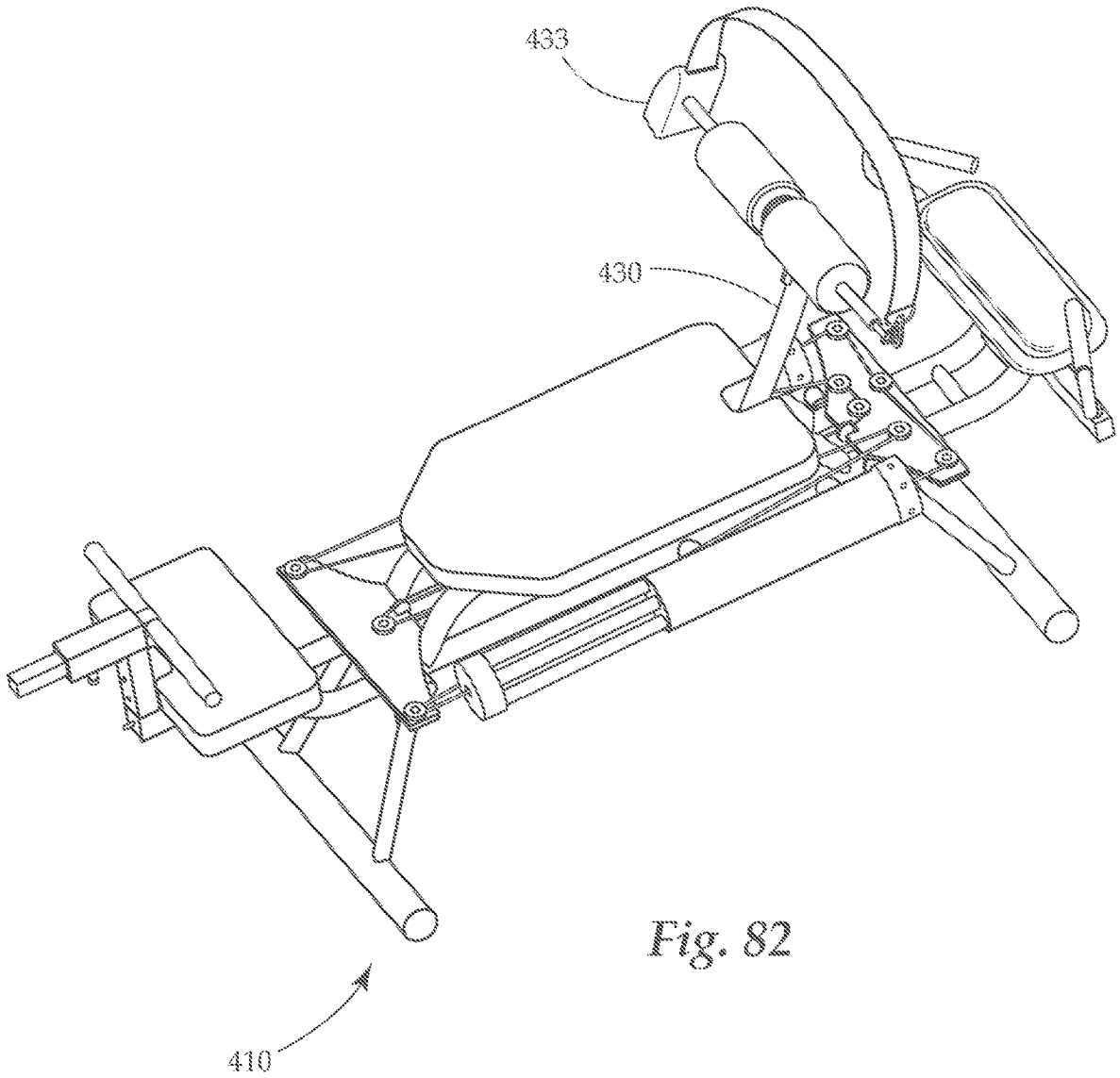
FIG. 82 is a perspective view of the exercise equipment set for amplifying the effect of gravity whereby the user has engaged the exercise equipment, performed an exercise by bringing the guide arm to an up position in which more force is produced than what their body produces naturally.

FIG. 82 is a perspective view of the exercise equipment 410 set for amplifying the effect of gravity whereby the user has engaged the exercise equipment 410, performed an exercise by bringing the guide arm 430 to an up position in which more force is produced than what their body produces naturally. This is the first phase of the exercise. In the second phase of the exercise the user returns to the beginning or down position. In this phase the user's body is kept generally tight and a majority of the musculature flexes eccentrically.

It is noted that a profound advancement and advantage of the present equipment is that safe negative bodyweight resistive exercise repetitions may be performed with amplifying gravitational forces. Additionally, the equipment allows for the safe performance of gravity amplified torso static exercises such as the plank, birddog and mountain climber. The user may now make these typically very arduous exercises fun and challenging by employing progressive overload with body weight resistive exercises. In other words, each set or group of sets gets more and more difficult. In addition, the cinching of the belt mechanism 434 protects the abdomen from bowing out. Moreover, the cinching also creates biofeedback to the user and cues them to, as best they can, pull their abdomen in toward the spine; in conjunction with the guide arm 430 this allows the user to create perfect positioning. As a result, the user becomes excited because they are actually feel themselves getting stronger and more proficient at the exercise.

Figure 83:
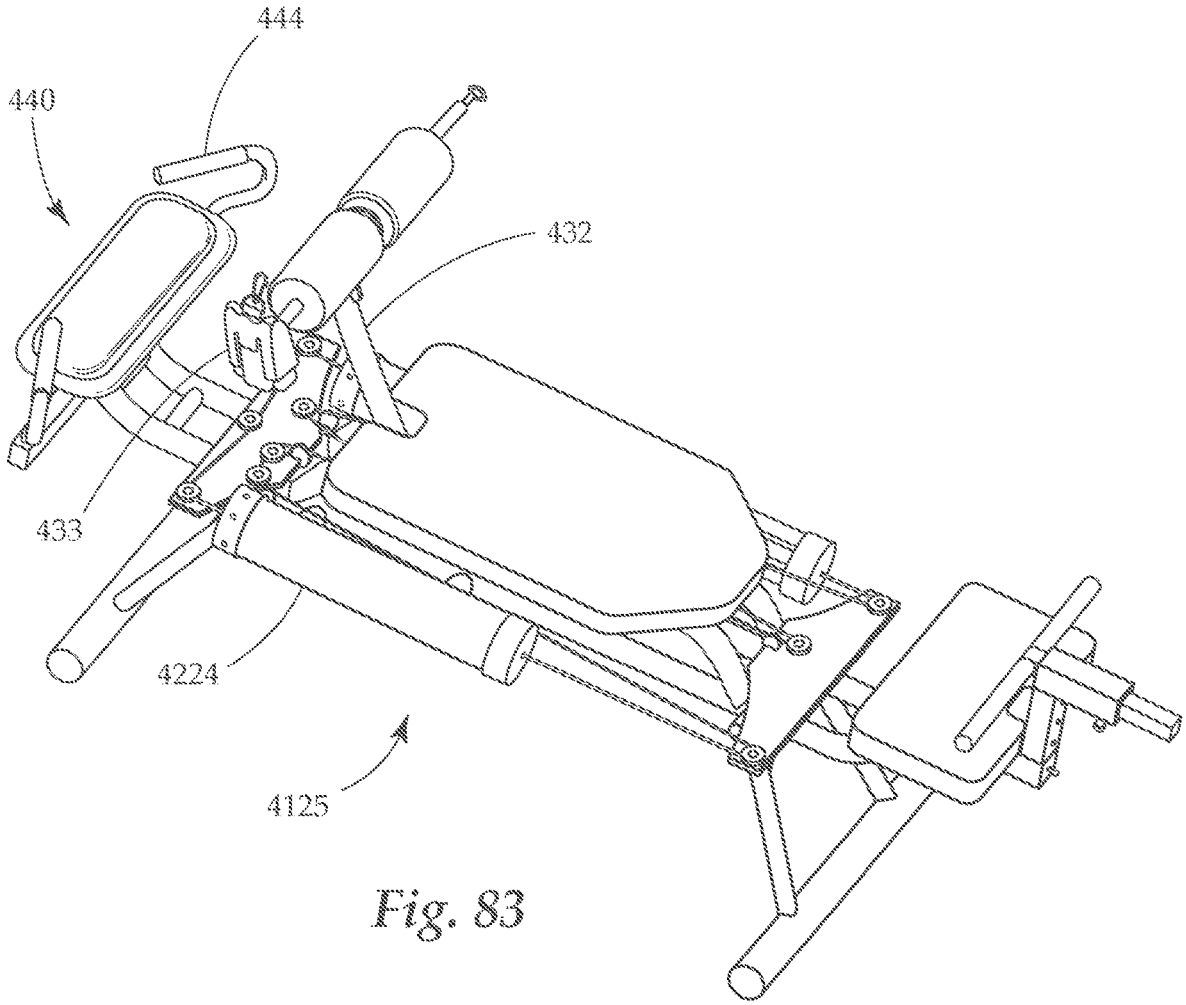
FIG. 83 is a perspective view of the exercise equipment in the up or starting position whereby the force component will produce selected stored energy imparting force that reduces the effect of gravity on the user.

FIG. 83 is a perspective view of the exercise equipment 410 in the up or starting position whereby the force component 4125 will produce selected stored energy imparting force that reduces the effect of gravity on the user. In this position the user's torso contacts the guide arm pad 432, and the user's hands are engaged with either the handlebars 444, or a hand engaging element of the plank safety/support pad 442 of the head area 440 of the equipment 410. The user may perform any bodyweight resistive exercise that is be performed on this machine and the selected forces of the reducing force canister 4224 in conjunction with the guide arm 430 will guide and offset a portion of the user's natural resistance. The belt mechanism 433 as seen above may or may not be utilized for safety and perhaps securing for a forming positioning of the body, particularly the inward biofeedback flexion of the abdomen and general body awareness during the performance of said exercises.

Figure 84:
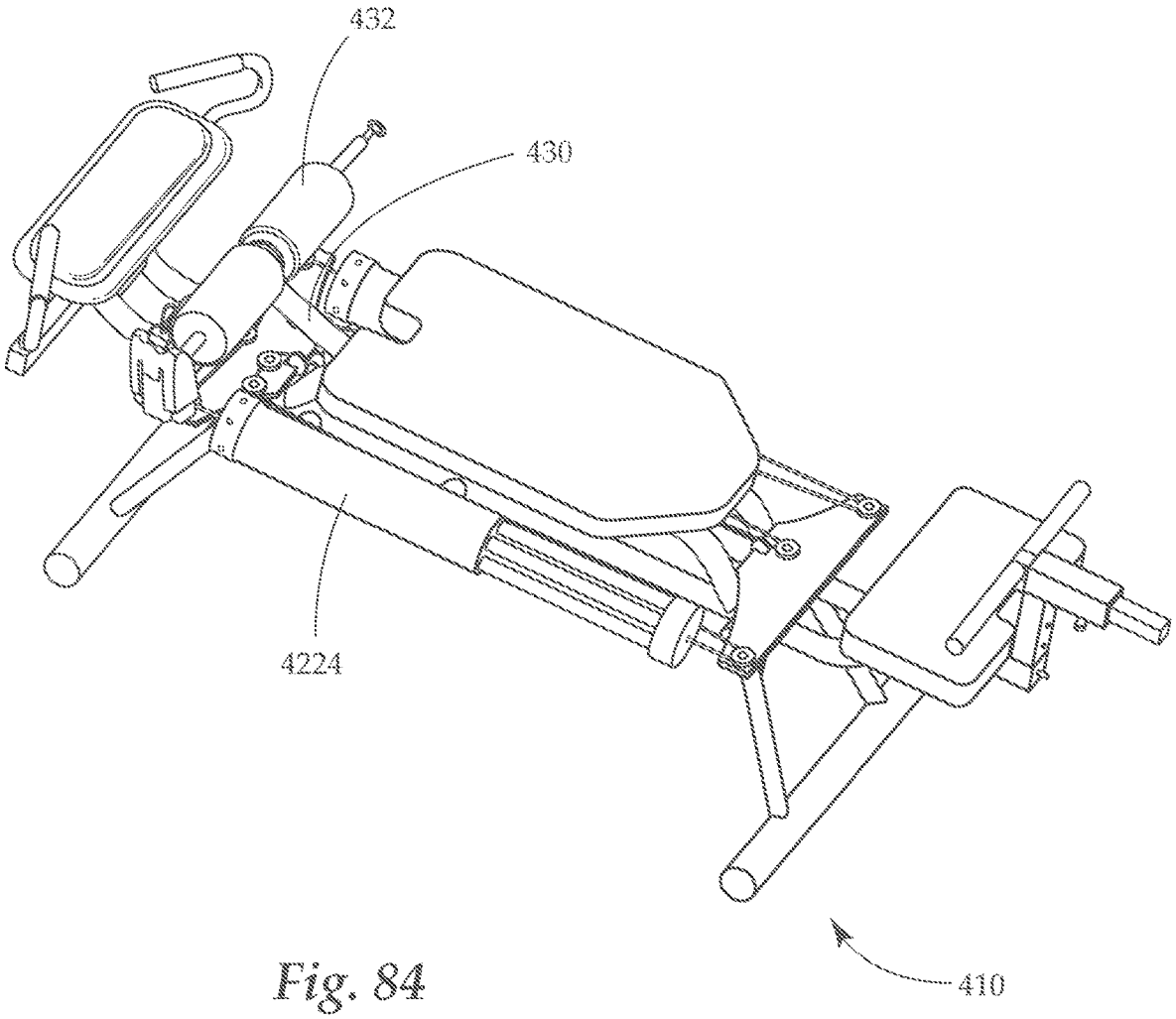
FIG. 84 is a perspective view of the exercise equipment in the down position or middle position of the repetition whereby the action of the reducing force canister is imparting force through the guide arm causing biofeedback and assisting the user to perform the exercise and get back to the top of the range of motion.

FIG. 84 is a perspective view of the exercise equipment 410 in the down position or middle position of the repetition whereby the action of the reducing force canister 4224 is imparting force through the guide arm 430 causing biofeedback and assisting the user to perform the exercise and get back to the top of the range of motion. In static exercises such as the plank, birddog and mountain climber the guide arm 430 does not move unless the exercises are semi-static or dynamic. The guide arm 430 supports the user at the torso by and through the force that is created in the reducing force canister 4224. As stated above the user may now make these typically very arduous exercises fun and challenging by employing progressive overload with body weight resistive exercises in escalating sets; in other words, each set or group of sets get more and more difficult. In addition, the user experiences said biofeedback from the guide arm pad 432 having less and less amplification toward the abdomen. This reducing amplification gives the exerciser cues to pull their abdomen up and in during the performance of the exercise.

The user may also use the muscle concentration that is afforded them by the less amplification and the support of the guide arm pad 432 to concentrate on the best they are mentally bringing to the two halves of their abdomen together. When not utilizing this method, an exerciser potentially creates a dangerous situation. For example, an exerciser with a weak abdomen may experience the abdomen sagging or worse pushing out because of two things gravity and intra-abdominal pressure. The guide arm pad 432 mitigates these factors. When the exercise is dynamic such as in the performance of the push-up, horizontal pull-up and others, in this mode the exercise machine 410 will assist the user back to the starting position as seen in FIG. 83.

Figure 85:
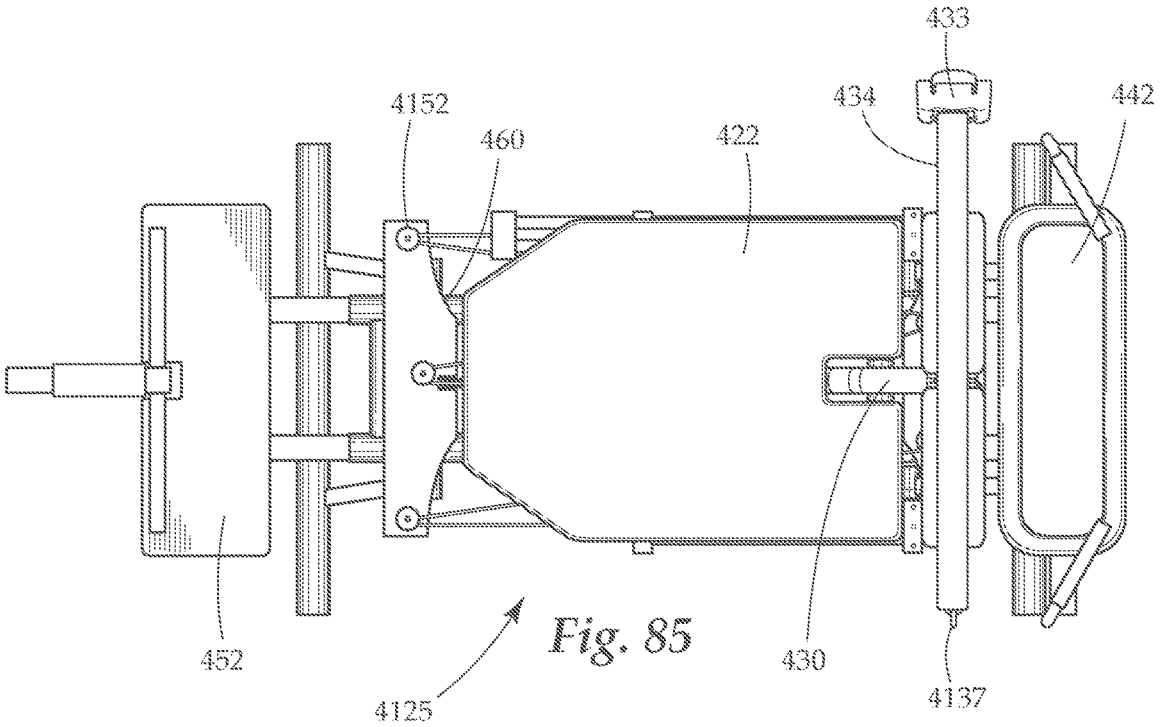
FIG. 85 is a top view of the exercise machine, a main support frame supports the body pad, foot pad, and plank safety/support pad.

FIG. 85 is a top view of the exercise machine, a main support frame 460 supports the body pad 422, foot pad 452, and plank safety/support pad 442. The guide arm 430 extends through the groove 4122 of the body support pad 422. In this embodiment, the retractable and ratcheting harness 434 extends from the guide arm 430 and works through a harness ratchet mechanism 433 before attaching to a harness latch 4137. In this view, the rotating guide members 4152 of the force mechanism 4125 can also be seen below the body pad 422.

Figure 86:
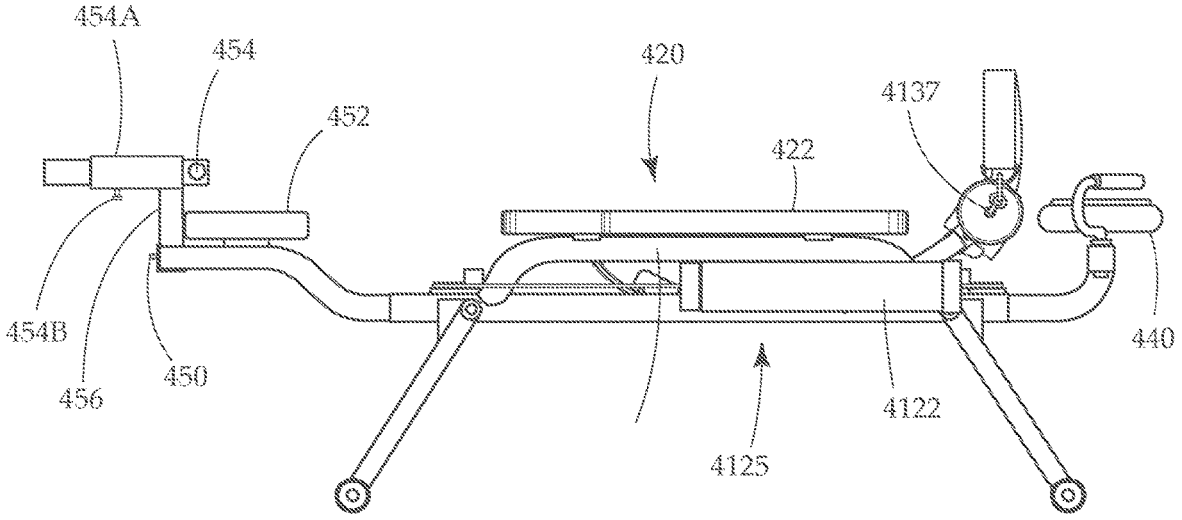
FIG. 86 is a side view of the exercise machine, in this view the main support beam frame supports the core support, the head support, and the foot support, which support the body pad, the plank safety/support pad, and the foot pad, and respectively, the retractable harness is attached to the harness latch.

FIG. 86 is a side view of the exercise machine, in this view the main support beam frame 460 supports the core support 420, the head support 440, and the foot support 450, which support the body pad 422, the plank safety/support pad 442, and the foot pad 452, and respectively, the retractable harness 433 is attached to the harness latch 4137. The foot support 450 comprises the foot support pad 452, the lateral foot stabalizer 454, the foot stabalizer positioner 456, the medial adjustment member 454*a*, and the medial adjustment locking member 454*b*. In this view, the amplifying load canister 4124 of the force component 4125 is located beneath the body support pad 422 next to the core support frame 460.

Figure 87:
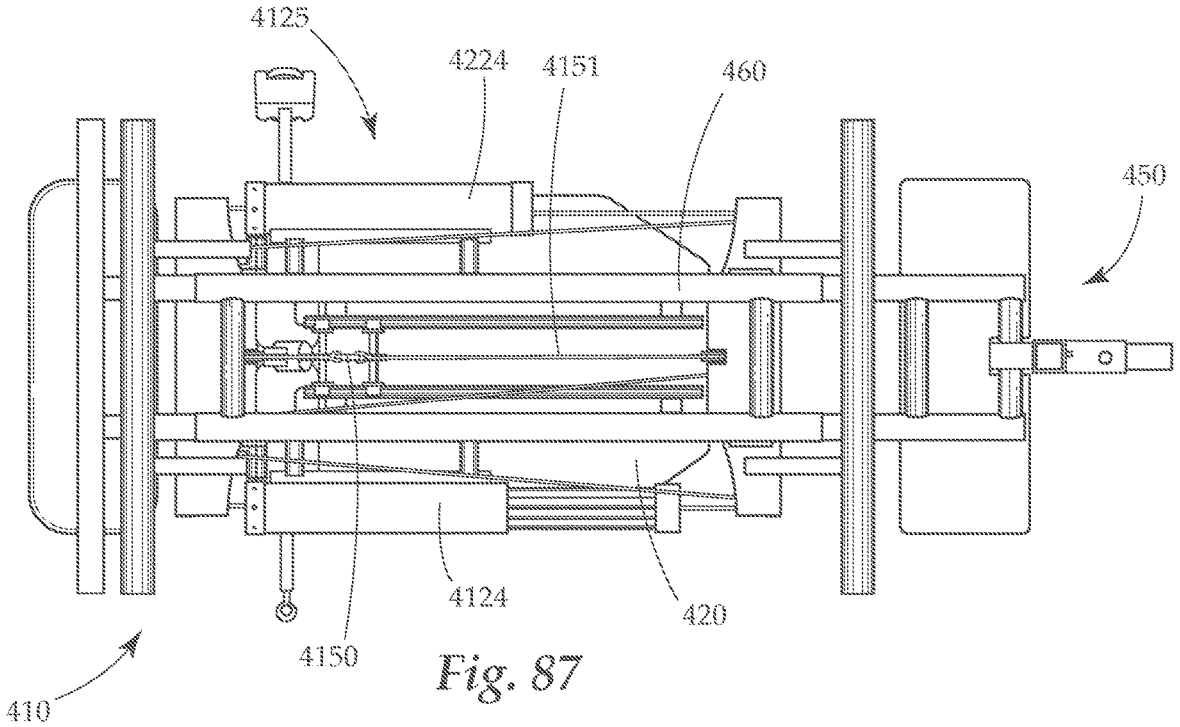
FIG. 87 is a view from the bottom of the exercise equipment, wherein the main support frame runs the length of the exercise equipment and connects the three main supports members of the exercise equipment.

FIG. 87 is a view from the bottom of the exercise equipment 410, wherein the main support frame 460 runs the length of the exercise equipment 410 and connects the three main supports members 420, 440, 450 of the exercise equipment 410. In this embodiment, the main support frame 460 is made up of two vertical beams connected by two cylindrical horizontal beams, forming a rectangular frame. Other embodiments could be imagined, such as a single beam, or horizontal or vertical multiple beams, for additional support. From the bottom, the force component 4125 is shown and includes the reducing load canister 4224 and the amplifying load canister 4124, located on opposing sides of the exercise equipment 410. The reducing load canister 4224 and the amplifying load canister 4124 are connected via a guide cord 4151. The guide cord 4151 connects the reducing load canister 4224 to a trolley 4150 before connecting the trolley 4150 to the amplifying load canister 4124. The guide cord 4151 then completes a loop by connecting the amplifying load canister 4142 to the reducing load canister 4224. The force component will be described in greater detail and views in FIGS. 104-107.

Figure 88:
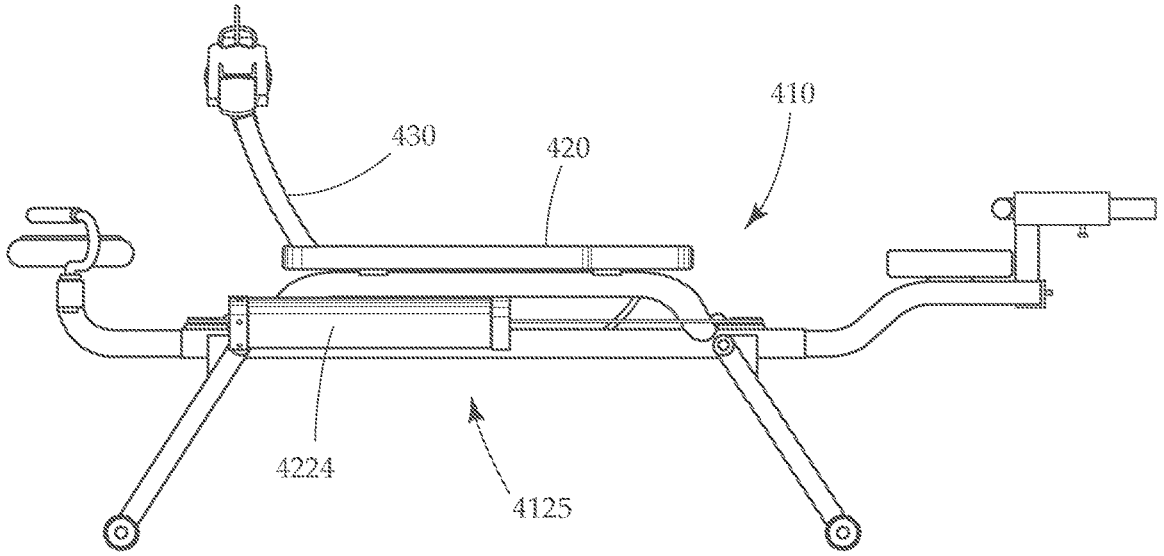
FIG. 88 is a side view of the exercise equipment.

FIG. 88 is a side view of the exercise equipment 410. In this view, the guide member 430 of the core support 420 is up and the reducing load canister 4224 of the force mechanism 4125 can be seen on the side of the exercise machine.

Figure 89:
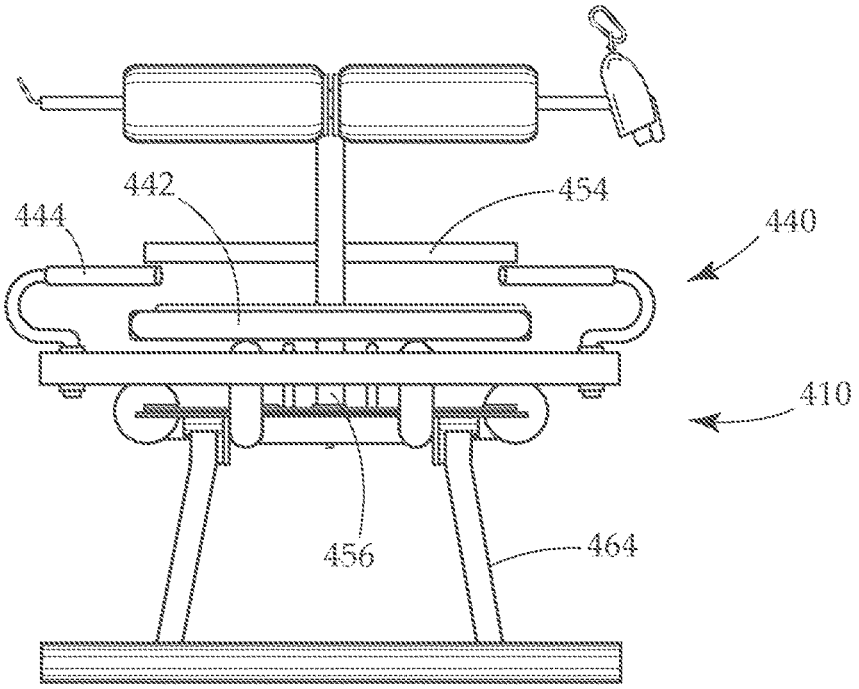
FIG. 89 is a view from the head of one embodiment of the exercise machine showing in essence the front of the equipment.

FIG. 89 is a view from the head of one embodiment of the exercise machine 410 showing in essence the front of the equipment 410. It consists of the head of machine leg 464 the head support 440, the front of the plank safety/support 442, and the set of handlebars 444, and in the background, is seen the lateral foot stabilizer 454 and the foot stabilizer positioner 456.

Figure 90:
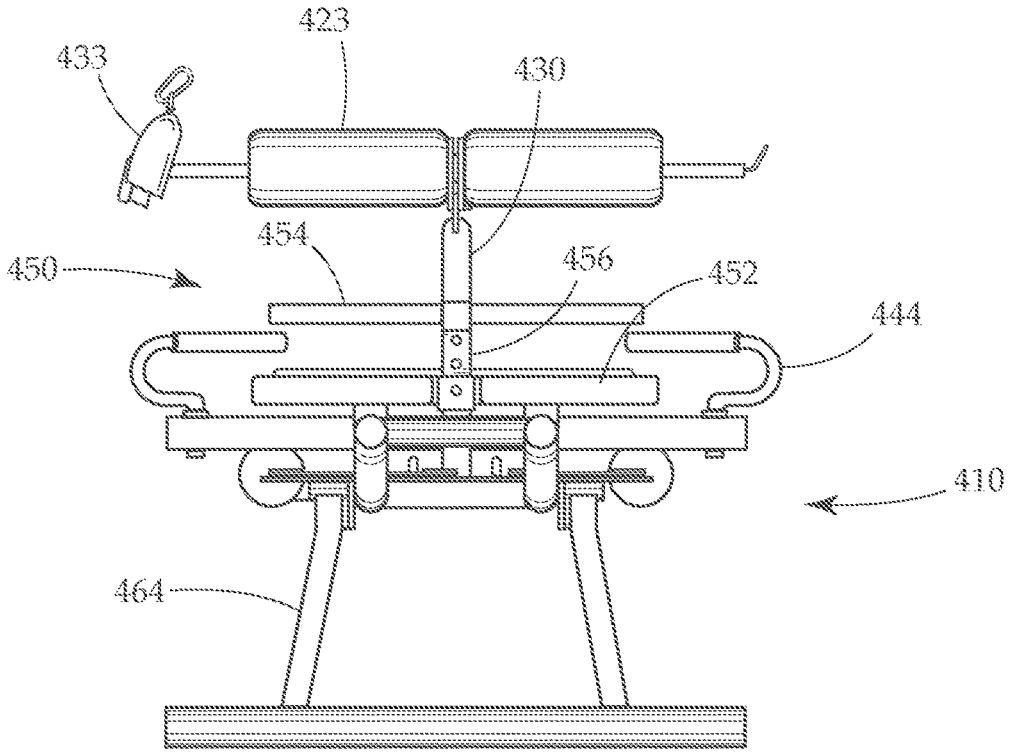
FIG. 90 is a view from the foot of the exercise equipment, in essence showing the back of the equipment.

FIG. 90 is a view from the foot of the exercise equipment 410, in essence showing the back of the equipment 410. It consists of the foot area leg 464, the foot support 450, the back end of the foot pad 452, the lateral foot stabilizer 454, the foot stabilizer positioner 456, and the handle bars 444 are seen in the background. Additionally, the guide arm 430, guide arm pad 423, retractable harness ratchet mechanism 433 are seen.

Figure 91:
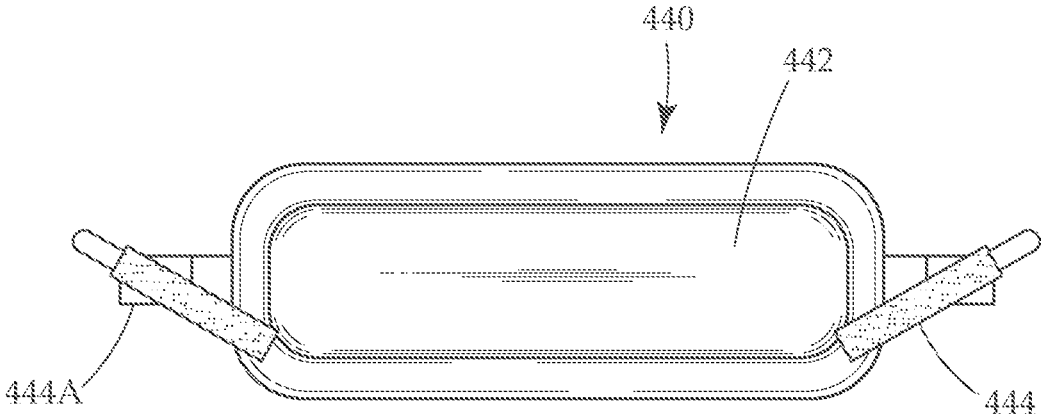
FIG. 91 is the top plan view of the head of the machine support.

FIG. 91 is the top plan view of the head of the machine support 440. It consists of the plank safety/support pad 442, the handle bars 444. The handlebars 444 contain a handle angular adjustment and locking member 444*a*.

Figure 92:
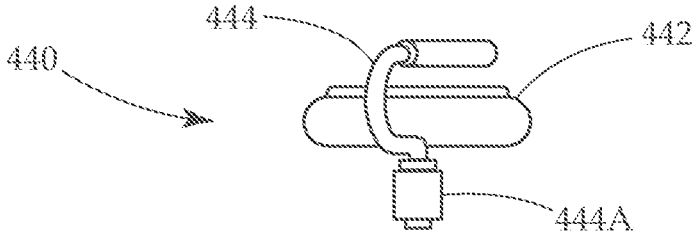
FIG. 92 is a partial front side view of the head of the machine support.

FIG. 92 is a partial front side view of the head of the machine support 440. It consists of a side view of the plank safety/support pad 442, the handlebars 444 and the angular adjustment and locking member 444*a*.

Figure 93:
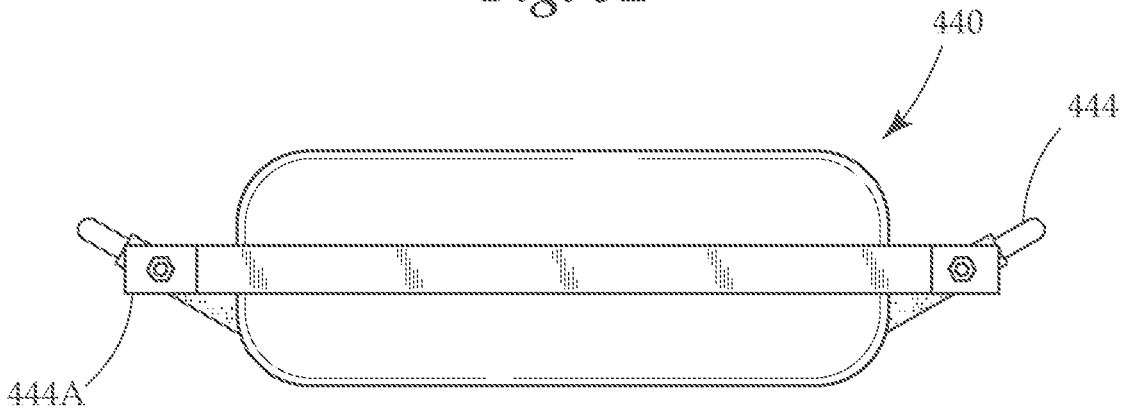
FIG. 93 is a partial bottom view of the head of the machine support, which may comprise a plank safety/support pad the handlebars and their components.

FIG. 93 is a partial bottom view of the head of the machine support 440, which may comprise a plank safety/support pad 442 the handlebars 444 and their components.

Figure 94:
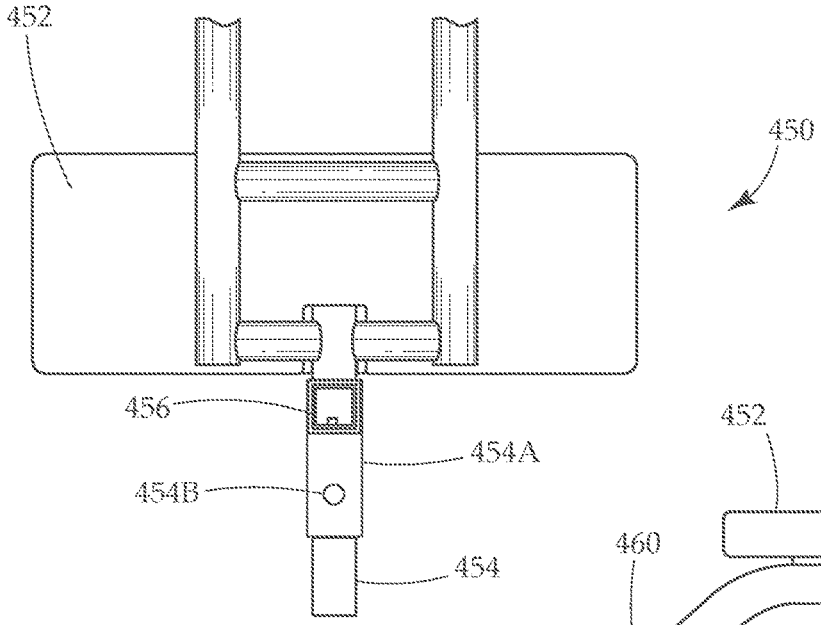
FIG. 94 is a partial bottom view of the foot support which comprises a foot support pad, a foot lateral foot stabilizer and a foot stabilizer positioner, a medial adjustment member and a medial adjustment locking mechanism.

FIG. 94 is a partial bottom view of the foot support 450 which comprises a foot support pad 452, a foot lateral foot stabilizer 454 and a foot stabilizer positioner 456, a medial adjustment member 454*a* and a medial adjustment locking mechanism 454*b*.

Figure 95:
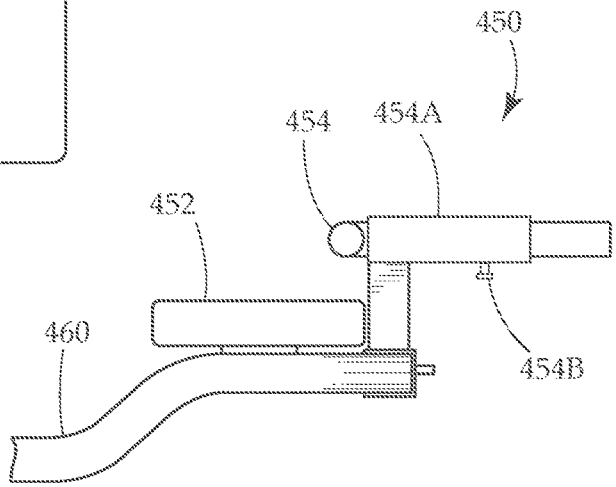
FIG. 95 is a partial front side plan view of the foot support further illustrating the back end of the core support system, a side view of the foot support pad, a side view of the lateral foot stabilizer, the medial adjustment member and the medial adjustment locking member.

FIG. 95 is a partial front side plan view of the foot support 450 further illustrating the back end of the core support system 460, a side view of the foot support pad 452, a side view of the lateral foot stabilizer 454, the medial adjustment member 454*a* and the medial adjustment locking member 454*b*.

Figure 96:
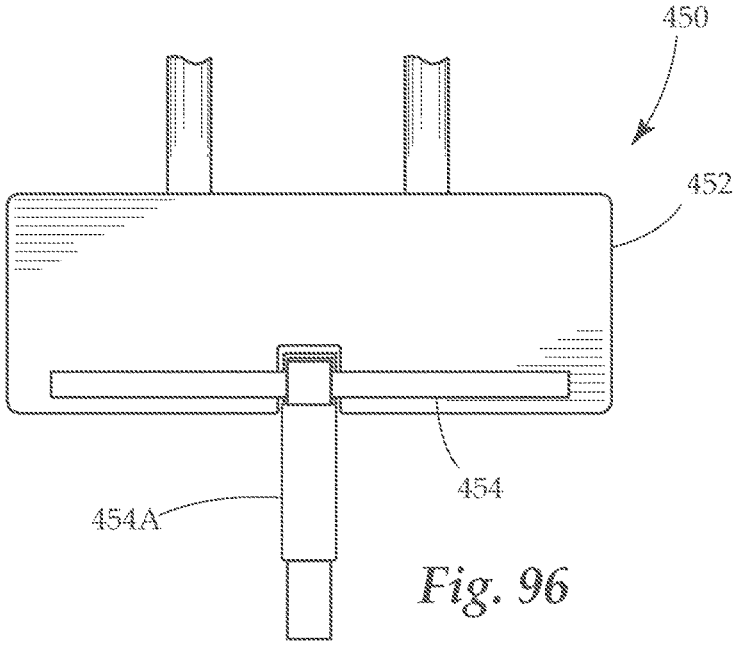
FIG. 96 is a partial top view of the foot support.

FIG. 96 is a partial top view of the foot support 450. It consists of the top view of the foot support pad 452, the top view of the tube of the lateral foot stabilizer 454 and the top view of the tube of the foot stabilizer medial adjustment member 454*a*.

FIG. 97 is a partial bottom view of the core support 420 which comprises a central support frame 460, body support pad 422, the guide arm 430, and the force component comprising the reducing load canister 4224, the amplifying load canister 4124, at least two rails 4160, a trolley 4150, and a guide cord 4151.

FIG. 98 is a partial top plan view of the core support 420 illustrating the body support pad 422, the groove 4122 in the body support pad 422, the guide arm 430 and the guide arm pad 432. Additionally, the rotating guide members 4152, and the guide cord 4151 of the force component 4125 can be seen below the body support pad.

FIG. 99 is a partial side view of the core support 420 illustrating, the core support structure 460, the legs 464 the guide arm 430, the guide arm pad 432, the ratcheting belt mechanism 433 and the components of the head area support 440.

Figure 100:
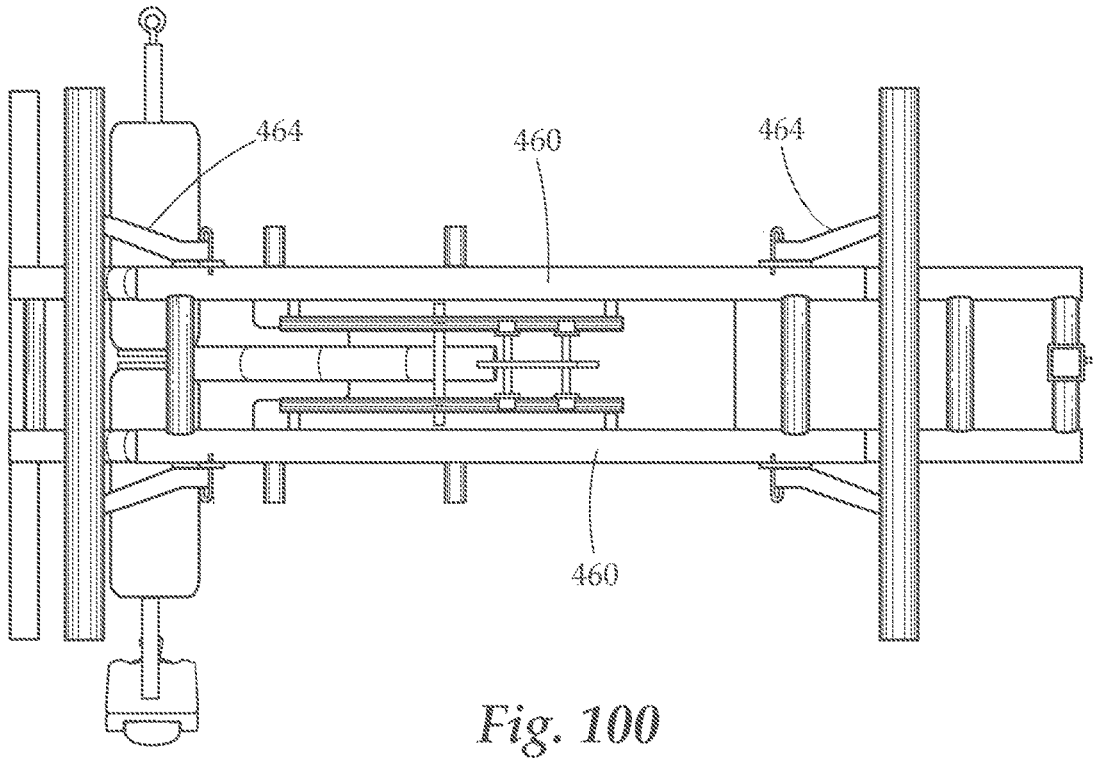
FIG. 100 is the bottom view of the core support frame and the head and foot area legs.

FIG. 100 is the bottom view of the core support frame 460 and the head and foot area legs 464. The rails 4160 and the trolley 4150 are also illustrated, as in FIG. 97.

Figure 101:
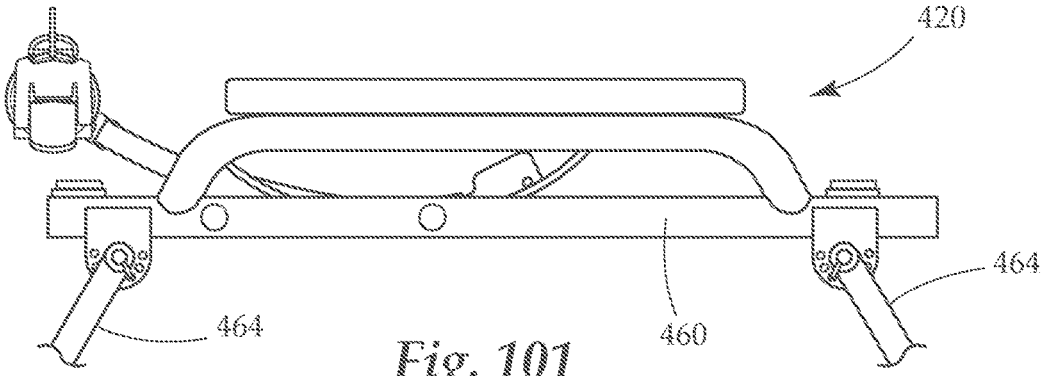
FIG. 101 is a side view of the core support.

FIG. 101 is a side view of the core support 420. This comprises the core support frame 460, the body support pad 422 the guide arm 420, the ratcheting belt mechanism 433, and the head and the foot area legs 464.

Figure 102:
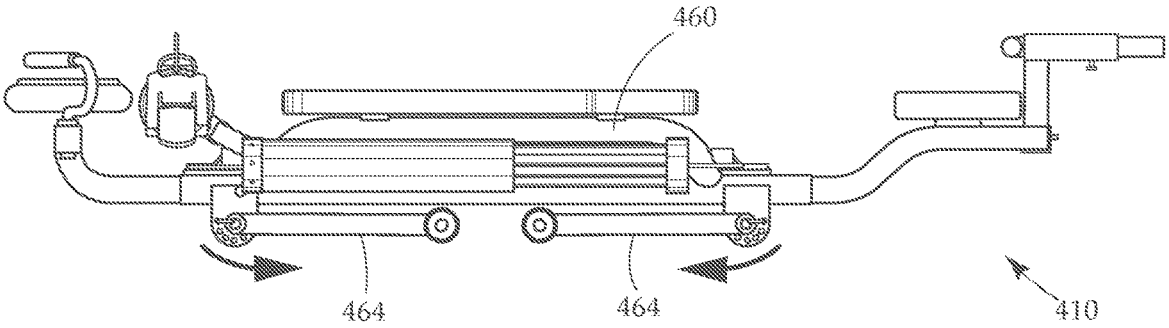
FIG. 102 illustrates the exercise machine with the legs folded inward beneath the main support frame to save space for storage and during transport.

FIG. 102 illustrates the exercise machine with the legs 464 folded inward beneath the main support frame 460 to save space for storage and during transport.

Figure 103:
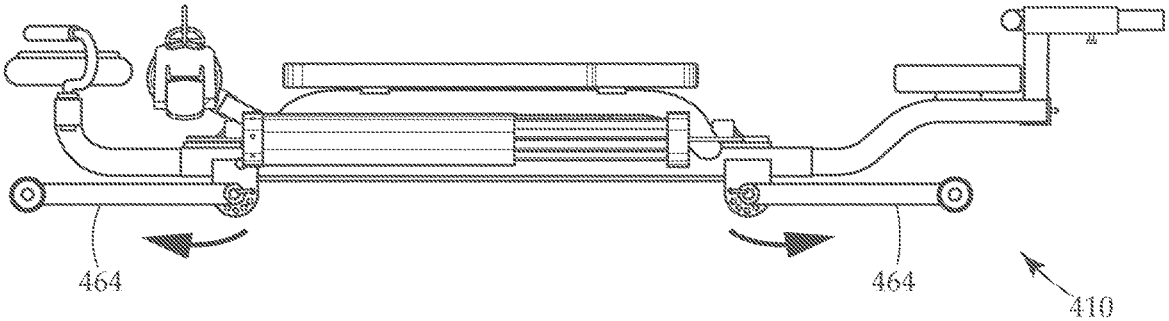
FIG. 103 is a side view of the exercise machine illustrating the head of the machine and foot of the machine legs folded outwardly such that the machine takes up less space vertically, for storing in spaces such as underneath a bed.

FIG. 103 is a side view of the exercise machine 410 illustrating the head of the machine and foot of the machine legs 464 folded outwardly such that the machine takes up less space vertically, for storing in spaces such as underneath a bed.

Figure 104:
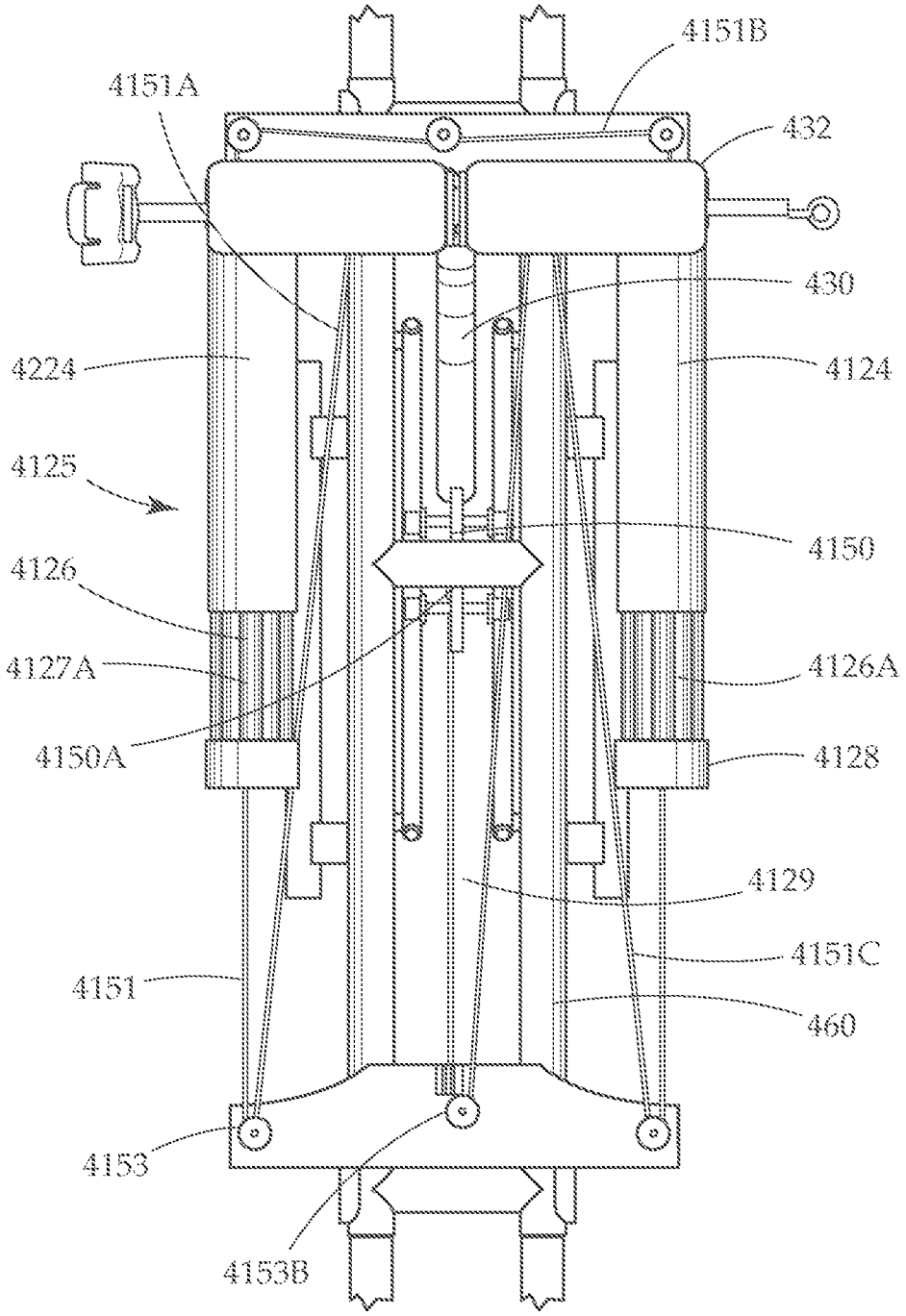
FIG. 104 is a top view of the exercise machine with the body pad removed to show the main support frame, the force component, the guide arm, the guide arm pad.

FIG. 104 is a top view of the exercise machine with the body pad removed to show the main support frame 460, the force component 4125, the guide arm 430, the guide arm pad 432. The force component 4125 comprises a loop 4129 connecting two canisters 4224, 4124 to a trolley 4150. In this view there is no force produced on either side of the machine. To show neutrality the guide arm 430 is in the middle of its range of motion and the canisters 4224, 4124 are both half way extended. The amplifying load canister and the reducing load canister each further comprise a plurality of telescoping tubes. The telescoping tubes further comprise male tubes 4126 and female tubes 4127. The female tubes 4127 (not shown) are fixed inside the canister at a front end of the outer casing tube. The male tubes 4126 are fixed to the canister cap 4128 such that when said male tubes are fully inserted into the female tubes the cap creates a closed canister. The male tubes 4126 of each canister have a smaller diameter than the female tubes 4127. The male tubes 4126 may be inserted into and extend from the female tubes 4127. There is a female and male telescoping tracking protocol 4127*a* in each canister as well that serves two purposes.

The telescoping tracking protocol 4127*a* mitigates twisting of each canister system by keeping everything in line, and it acts as the element that the cords 4151 are connected to for actuation inside the canisters as they apply the intended forces in the system 4129. Each male tube 4126 contains a resilient member 4126*a* (not shown) inside it, common practice is to use rubber/elastic member or gas spring member or a coil spring member for producing force as it is selected. The machine may also be electromechanical and pneumatic cylinders or motors may be used. If no force is applied in the system, and the guide arm 430 is moving toward the down position, the male tubes 4126 of the reducing load canister 4224 will start to extend as the male members 4126 of the amplifying load canister 4124 begin to retract into the female member, as shown by the arrows. The action of each canister therefore counteracts each other. If the reducing load canister 4224 has a selection of force, and is in the up position. The amplifying load canister 4124, on the right, will have zero force. The position and action of the reducing load canister 4224 guide arm 430 and trolley 4150 has pulled the amplifying load canister such that the male tubes 4126 of the amplifying load canister 4124 are completely inserted and the canister cap closes the canister system.

The two canisters and trolley 4150 are connected via the guide cord 4151. The guide cord comprises at least three guide cord members, 4151*a*, 4151*b*, and 4151*c*. One guide cord member 4151*a* is affixed to the front of a tang 4150*a* in the middle of the bottom of the trolley 4150, and extends forward to the first vertical fairlead 4153*f*, from the vertical rotating member 4152 it immediately loops on a horizontal rotating member 4152. From there it continues around another rotating member 4152 in close proximity and to the left of said front fairlead 4153*f*. Once around this rotating member it extends toward the back of machine where it loops around another rotating member 4152 then extends toward and is affixed to the back area of the tracking protocol 4127*a* of reducing load canister 4224. A second cord 4151*b* affixes to the front area of the tracking protocol 4127*a* of reducing load canister and extends toward a rotating member 4152 in front of it. From there, said cord 4152*b* extends toward the middle of the front of the machine where it passes through a front central rotating member 4152 and extends to another rotating member in the front of the amplifying load canister 4124. From here the cord extends around said rotating member 4152 and is affixed to the front area of the tracking protocol 4127*a* of the amplifying load canister 4124. The third cord 4152*c* starts by being affixed to the back area of the tracking protocol 4127*a* of the amplifying load canister 4124. From there it extends around a rotating member 4152 in the back of the machine and heads toward the front, where it loops around another rotating member 4152 that in close proximity to the right of the front fairlead 4153*f*. After it passes through this rotating member 4152 it extends again toward the back of the machine and loops around horizontal rotating member 4152 of the back fairlead 4153*b* which feeds the cord back toward the front of the machine where it is affixed to the back side of the tang 4150*a* on the bottom of the trolley 4150 closing the loop 4129.

Figure 105:
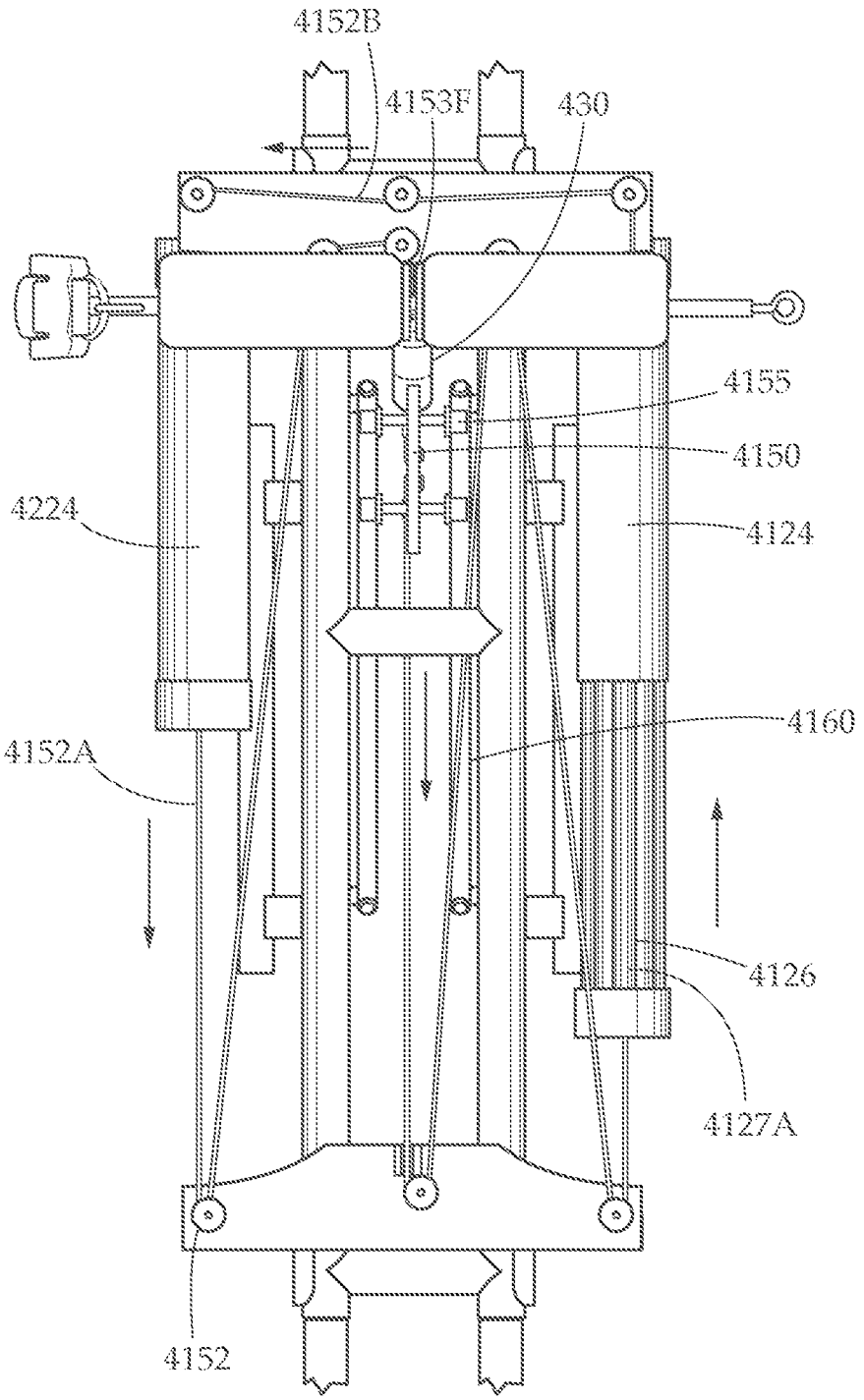
FIG. 105 illustrates an embodiment of the machine in which the body pad has been removed.

FIG. 105 illustrates an embodiment of the machine in which the body pad 422 has been removed. In this embodiment, the guide arm 430 is up, the trolley 4150 is in the front area of the rails 4160 and the reducing load canister has a force selected. As shown by the arrows, the male members of the reducing load canister 4224 extend while the selected cords produce force and create stored potential energy in the system. Simultaneously, the guide cord 4152*b* connected to the front area of the tracking protocol 4127*a* of the reducing load canister pulls the guide cord 4152*b*. Guide cord 4152*a*, the cord attached to the back area of the tracking protocol 4127*a* of the reducing load canister, is looped around a rotating member 4152 and heads toward the front of the machine and around another rotating member 4152 which is in close proximity and to the left of the front fairlead 4153*f*. Said front fairlead sends the cord to the front of the trolley 4150 where the cord is affixed to the front of the tang 4150*a* in the bottom center of said trolley 4150. This action causes the guide cord 4152*b* to pull the amplifying load canister forward and thus pulling the guide cord 4152*c* toward the front of the machine as well, thus pulling the guide cord 4152*a* connected to the back area of the reducing load canister on one end, and the front of the trolley 4150 on the other. This action pulls the reducing load canister 4224 backwards toward the back of the machine while it is under load. The amplifying load system functions when the loop goes in the opposite direction. That is, the guide arm 430 is down and the amplifying load canister 4124 has a selection of force while the reducing canister has a zero force. Action of user on the added load canister 4124 creates the desired force and pulls the reducing load canister until the male tubes of the reducing load canister are completely extended.

Figure 106:
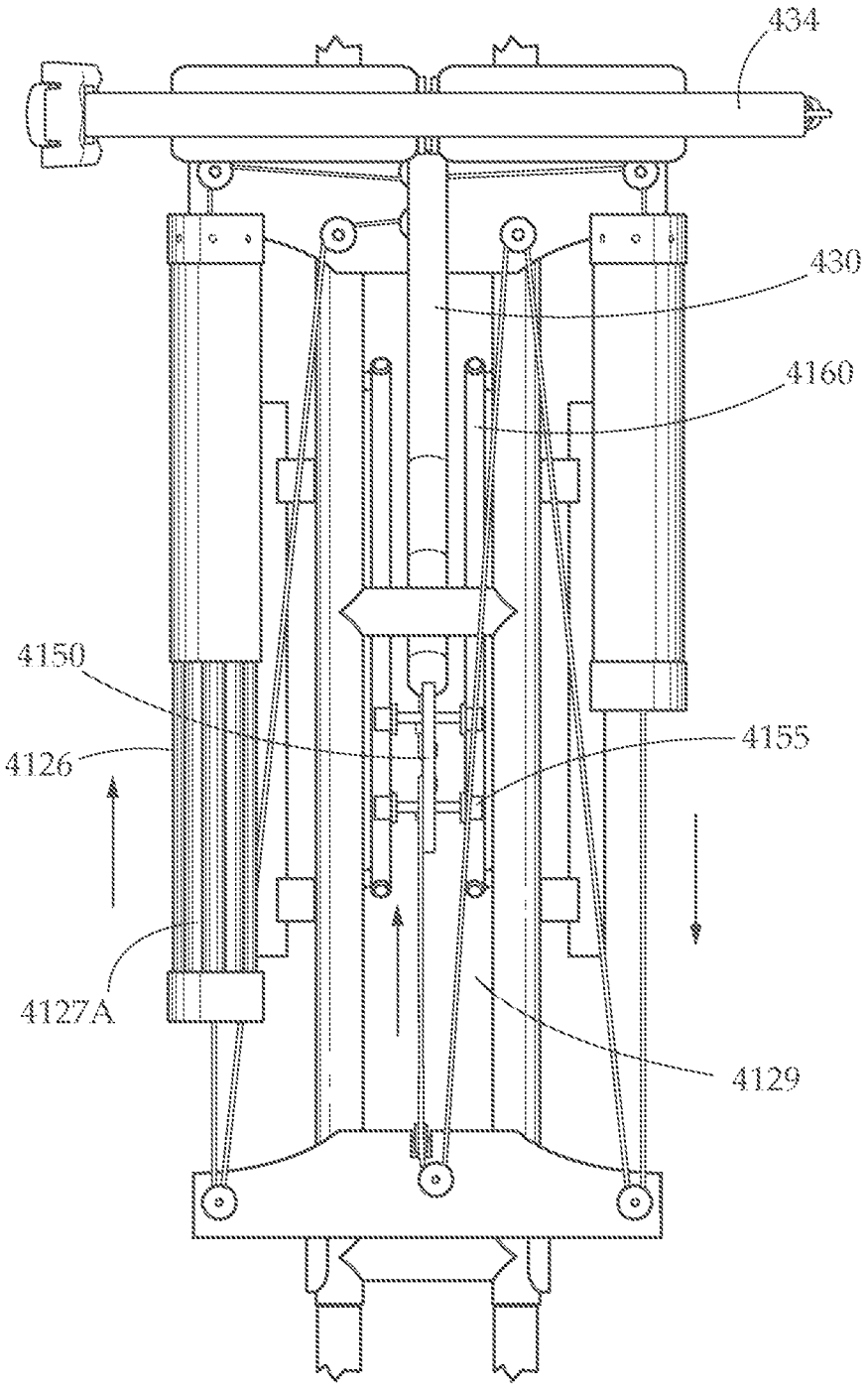

FIG. 106 is a view of the top of the machine with the body pad removed and the guide arm 430 in the down position. In this embodiment, the amplifying load canister has a selection force and the trolley 4150 is located in the back of the rails 4160. In this illustration, the male member tubes 4126 of the amplified load canister have been completely inserted and a force has been selected. Simultaneously, the male member tubes 4126 of the reducing load canister have been pulled from the back area of their tracking protocol 4127*a*, and such, they are completely extended out of the female tube members 4127. The action of the user will cause the male tubes 4126 of the amplifying load canister to extend under force, while the male tubes of the reducing load canister 4224 simultaneously retract via the pulling of their front area tracking protocol 4127*a* and the loop mechanism 4129. The rail system comprises at least two rails 4160, a trolley 4150, and the guide arm 430 which is connected to the trolley 4150. The trolley further comprises at least four wheels 4155 which hold the trolley to the rails 4160. The top wheels of the trolley may be eccentric to help the trolley articulate and fortify the secured slide ability on the rails 4160. Further, alternatively, the shape of rails 4160 can be cut to include a channel in which the trolley wheels can be located. Yet another configuration of this would be to bend channel stock in the desired shape of the curves in the rails 4160 for the wheels 4155 to ride in.

Figure 107:
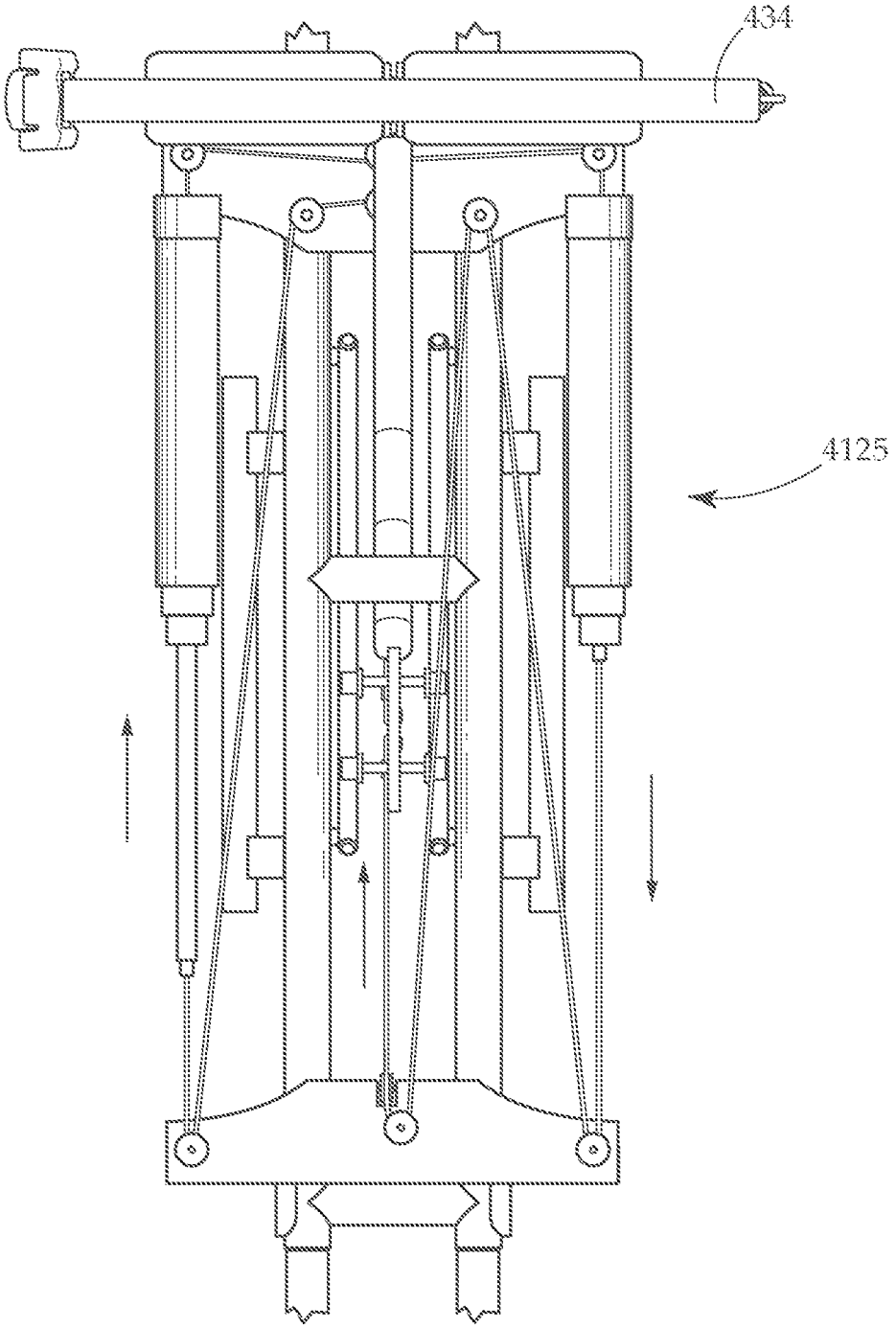

FIG. 107 illustrates the same as above except the force producing element 4125 is comprised of pneumatic reducing and amplifying load cylinders.

Figure 108:
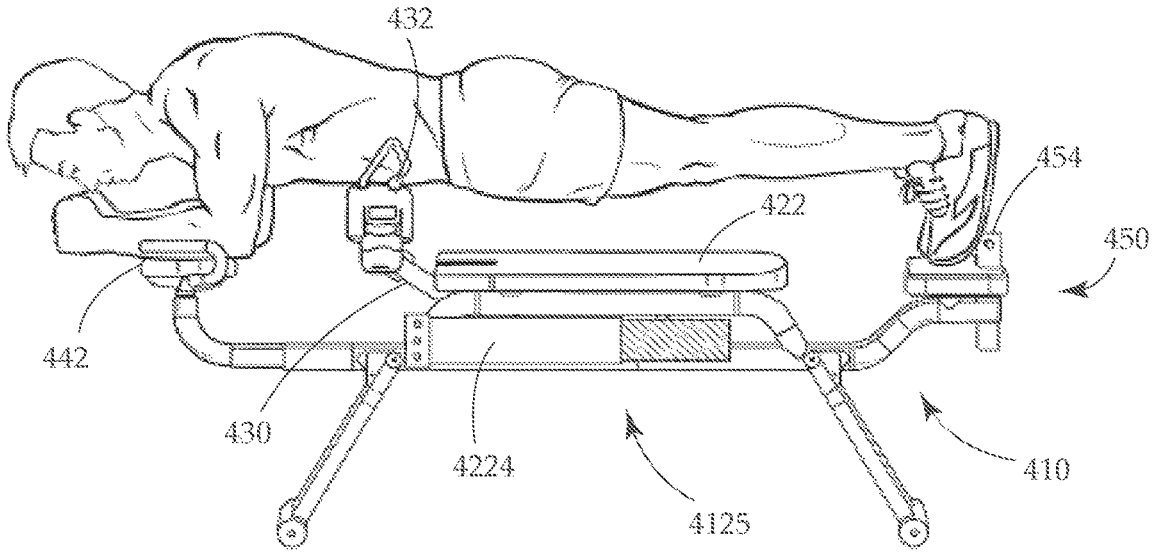

FIG. 108 is a side view of the exercise machine 410 with a user performing an assisted static plank pose position exercise. The exerciser and the machine are both facing left so the action in the reducing load canister 4224 can be seen. In the operation of the exercise the user first kneels on the body support pad 422, then one hand has the natural inclination to touch one embodiment of the guide arm support pad 432 and the other has an inclination to secure positioning on the plank safety/support pad 442. Eventually both hands are on the plank pad and the abdominal area is in contact with the guide arm pad 432. In the next phase of the procedure, the user's feet engage the foot support 450 with the balls of their feet against the lateral foot stabilizer 454. Once in this position the user puts their forearms in a comfortable position on the plank safety/support pad 442. After this sequence, the user performs the plank position by making their body as straight as a board hence "the plank". The machine 410 aids tremendously in this effort. As stated above, the force is generated by the reducing load canister 4224. Said force is radiated through the guide arm 430 and during the performance of the exercise the purpose is to strengthen the entire core, although, the user tightens their entire body to hold the position. The exercise machine 410 provides stability for the entire exercise. More particularly, the guide arm support pad keeps the abdominal muscles from bowing out which is something that is commonly seen when a user has weak abdominal muscles. The variations in the force that can be created by the force producing element 4125 offer the user the ability to change the neuromuscular stimulus differently than what a user could have achieved in the past from their bodyweight alone. When the user is finished with the exercise, he she brings the guide arm 430 back to its up position by kneeing and raising their body off of the guide arm 430, which has a stored tension in it. This alignment removes said tension from the force producing element 4125. At this point the user disengages the machine and very comfortably walks away.

Figure 109:
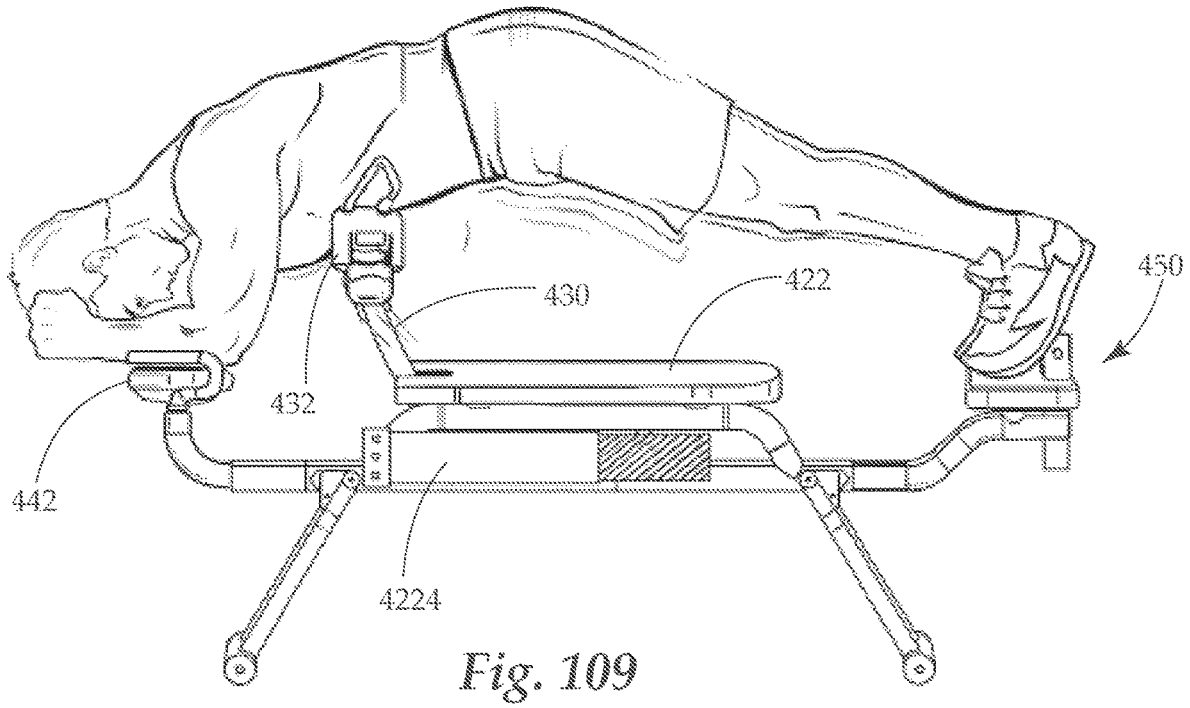

FIG. 109 illustrates one embodiment of a user utilizing the machine to perform an assisted dynamic plank. The exerciser is facing the same way as in the figure above and the reducing load canister 4224 is providing the force. To perform this exercise, a user starts in plank position and pulls his or her body up to achieve the position shown. The user's abdomen is supported by the guide arm 430 and the guide arm pad 432 while the user's arms are on the plank support safety/support pad 442 and their feet are on the foot support 450.

Figure 110:
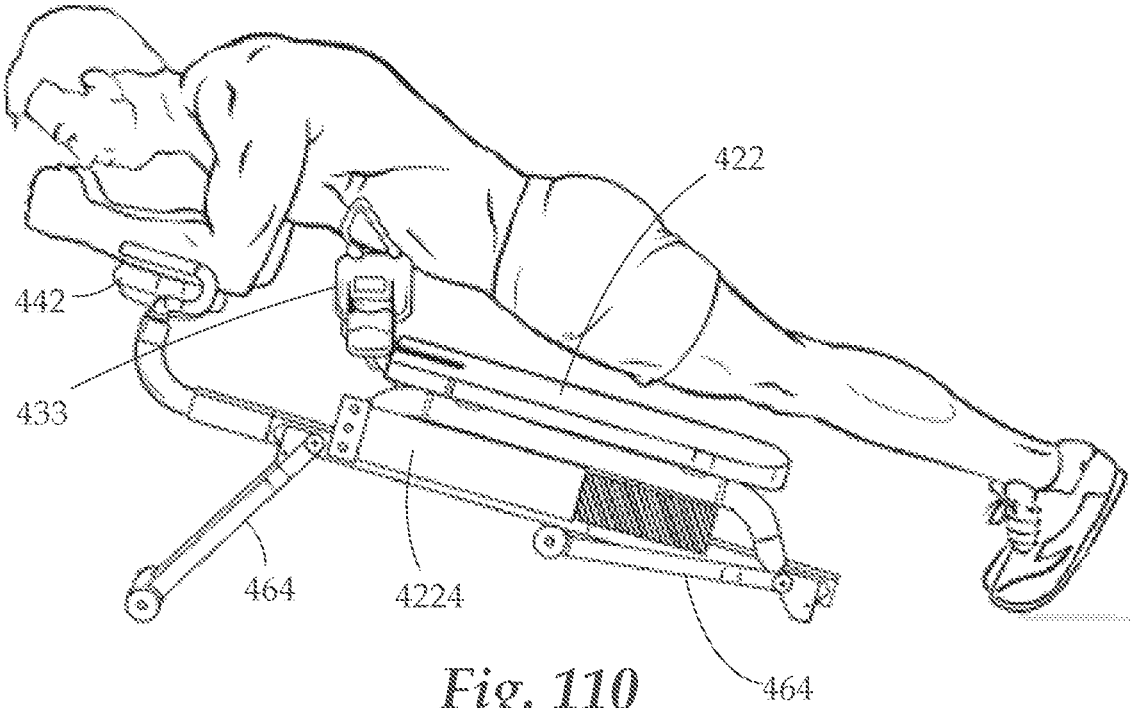

FIG. 110 is a side view of a user performing an assisted static plank pose exercise on the machine 410 with their feet on the floor. This may be utilized in the same or in a separate embodiment. When it is the same embodiment, the foot support area of the machine 410 is removed to make room for the user to get into the position shown with their feet on the floor. The advantages to this may be for a highly debilitated person to be able to engage with the machine 410 easier.

Figure 111:
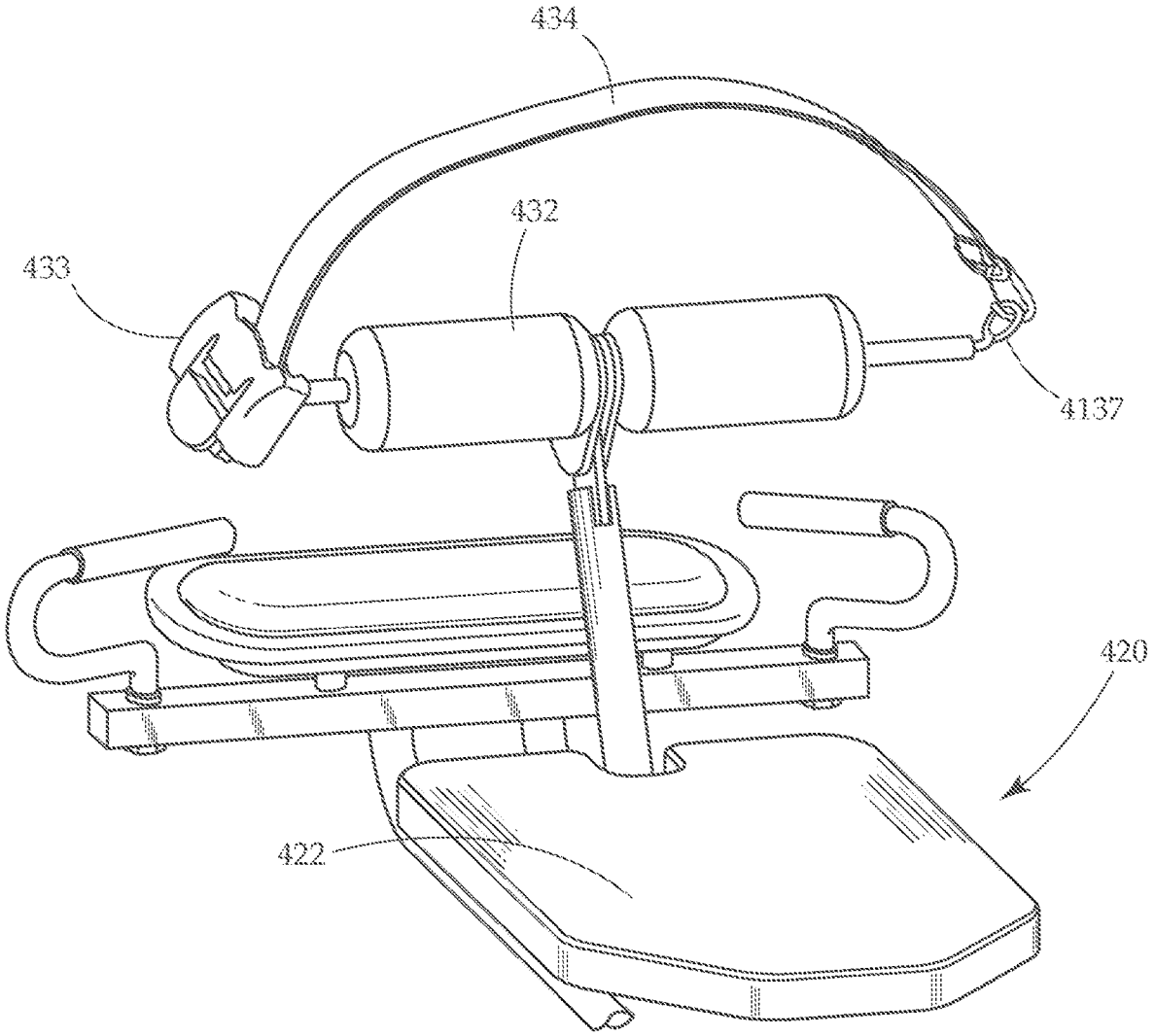

FIG. 111 is a perspective view of the core support 420 illustrating a retractable belt harness 434, with a ratcheting mechanism 433, and a latching element 4137. This retractable harness configuration is oscillatingly attached to the structure that holds the guide arm pad 432. Said structure acts as a connection point to the machine for times when a user is performing amplifying load exercises. The latching element 4137 is on the opposite side of said guide arm structure.

Figure 112:
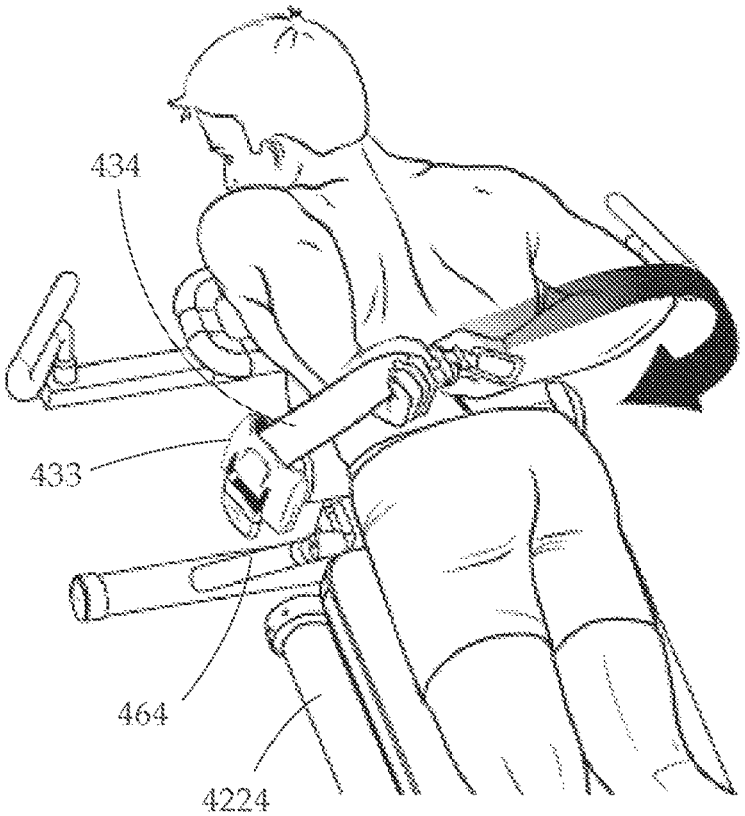

FIG. 112 illustrates the retractable harness 434 being extended from the harness retracting mechanism 433. In operation of this, the user pulls the unlocked belt 434 from its housing 433 with the one arm close to said housing and continues toward the middle of their back where they meet their other hand as illustrated in the next figure.

Figure 113:
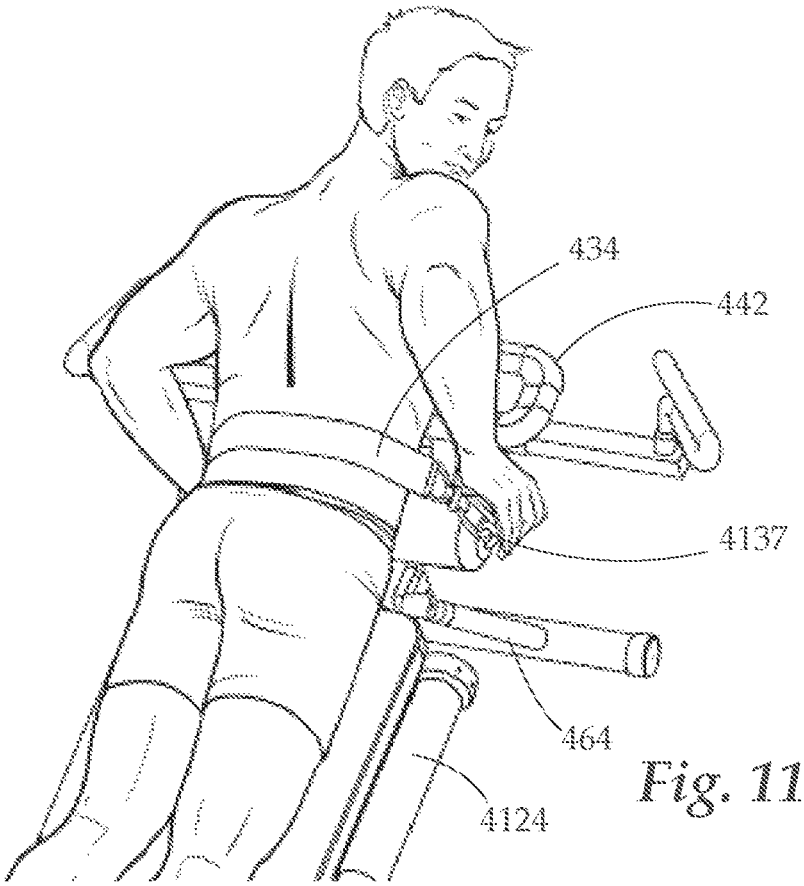

FIG. 113 illustrates when the user has met the first hand with the second hand and is extending the belt 434 to the latching mechanism 4137.

FIG. 114 is a back view of a user utilizing an embodiment of the harness containing a harness pad 4234.

FIG. 115A-115B illustrate the third phase of the operation whereby the user is ratcheting the belt 434 to the desired tightness.

Figure 116:
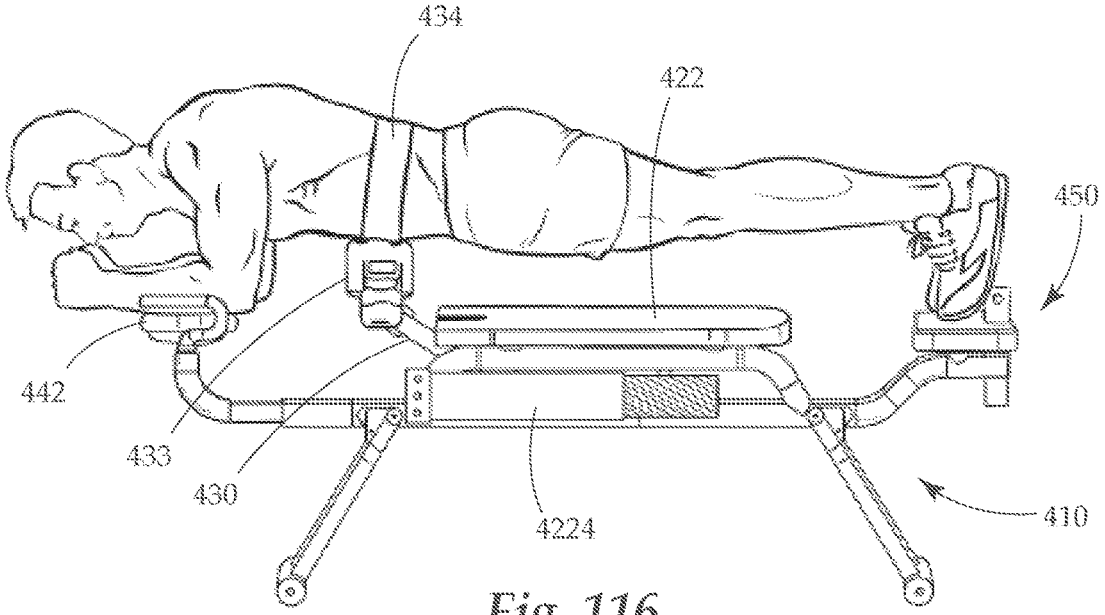

FIG. 116 is a side view of a user on the machine 410 performing an added load static plank position exercise. The operation of the exercise is similar to FIG. 108 above although the force element is selected to go in the opposite direction and amplify the effect of gravity. When the user engages the machine 410, the guide member 430 is under load and is in the down position. In order to operate the machine for this type of exercise the user needs to be connected to the machine. This achieved by the ratcheting belt mechanism 434 being connected to the guide arm 430.

Thus, in line with FIG. 108, the user kneels on the machine, engages their feet with the foot support 450 and the lateral foot stabilizer 454 then they lay across the machine with their chest on the plank safety/support pad 442 and their abdominal area across the guide arm pad 432 which is in the down position and under load. While the user is laying on the machine, their hands are free, which is crucial so that the user can lock and unlock a retractable belt mechanism 433 that creates the connection. Once the user is secured they can proceed to get into the plank position with the machine providing more resistance then what their body produces naturally. Also the strong connection made by the ratcheting of the retracting belt mechanism 433 allows the user to intensify the tension in their body and core during this exercise. Further, the cinching sends cues to the user to pull their abdomen up and in toward the spine as best as they can. This action fosters the best use of this exercise. To perform the exercise the user holds the position for a number of seconds.

When the exercise is completed the user declines across the body support pad 422 and the plank safety/support pad 442, with hands free and is able to disengage from the resistance of the guide member 430 and get up and walk away from the machine as seen in FIG. 108. The magnifying load planks affect the abdomen, core and the entire body.

Figure 117:
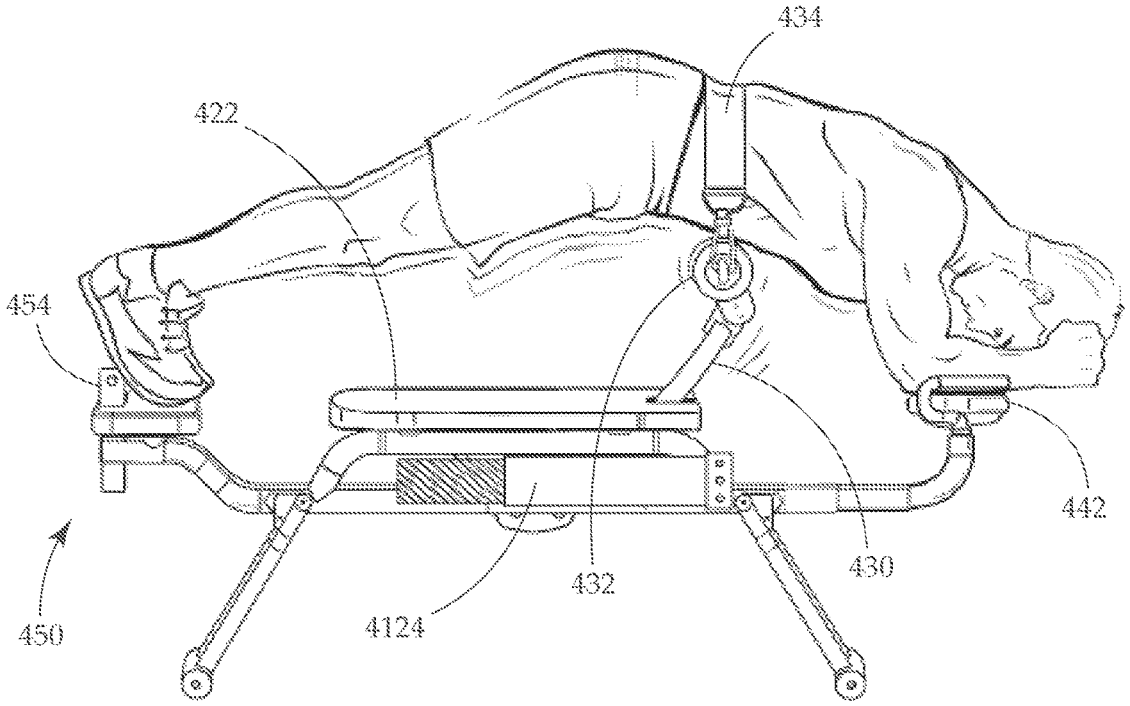

FIG. 117 illustrates another embodiment of a user utilizing the machine to perform a magnifying load version of the exercise described in FIG. 109. The ratcheting and protecting element 433 of the guide arm 430 and belt assembly 434 allow a user to perform this magnifying load exercise. The exercise is performed by starting in plank position and pulling the body up to achieve the position as illustrated. In doing this the user imparts a very different stimulus on the abdomen. The rib and chest musculature are involved as well.

FIG. 118 is a side view of a user on the machine 410 performing a reducing load side plank pose exercise which is performed much like the reducing load straight plank pose exercises as seen in FIGS. 108 and 109 except the user is on the side and the emphasis is on the oblique musculature. Further, instead of both forearms being on the plank safety/support pad 442, only one is in contact with said pad. An alternative to this position would be to use a straight arm. The user's feet are one on top of the another on the foot area support 450 with the side of the bottom foot contacting the foot support pad 452 and the bottom of the bottom foot contacting the lateral foot stabilizer 454. Mounting and dismounting the machine 410 in this position is a little different. The user is on their side the whole time. The process is the nearly identical, just that the user is on their hip as opposed to the position shown in FIGS. 108 and 109.

FIG. 119 is a side view of the machine with a user on it performing a magnifying load side plank pose exercise. The machine and the user are both facing right, and the magnifying load force is created by the amplifying load cylinder 4124 on the right side of the machine. The exercise is performed much like the magnifying load straight plank pose exercise as seen in FIGS. 116 and 117.

FIG. 120 is a side view of a user on the machine 410 performing a reducing load push-up exercise. In the operation of this exercise the user engages the machine 410 much like they would in the performance of the plank exercise. After kneeling on the body pad 422 the user's inclination is to put one hand on the guide arm pad 432 and then proceed to put their other hand on the safety/support plank pad 442 and then from there they put their hands on the handlebars 444.

In conjunction with the prior described alignment, the abdominal area is in contact with the guide arm pad 432, and the user's feet are supported on the foot area support 450. While in the upward position the user declines their body while being supported by the guide arm 430. In the operation of the machine for this exercise the machine and the exerciser are both facing left and force is produced by the reducing load canister 4224 on the left side of the machine. Said force is created under the body pad 422. As the user declines toward the bottom of the range of motion, energy is stored in the force producing element 4125.

Next, once the user gets to the bottom of the range of motion and starts the concentric, or upward phase of the movement, the force producing element assists the user as they perform the exercise. When the user is finished with the exercise, the user kneels on the body pad 422, disengages the guide arm pad 432, places their feet on the floor and walks away from the machine 410.

FIG. 121 illustrates an embodiment of the machine wherein the machine can be propped up by a jack or a telescoping leg mechanism 4464 to form a decline. This creates greater force across the upper chest than is put across the upper chest in a flat bench position, much like how the upper chest is targeted more by performing an incline bench press as opposed to a flat bench press. The purpose of this figure is to illustrate how the user could put their body on an angle thereby affected how the force is being applied to the musculature of the upper body. In the figure, the user is facing left, the machine is facing left and the canister on the left side of the machine is the reducing force canister 4224 producing reducing load force.

FIG. 122 is a side view of a user on the machine 410 performing a magnifying load push-up. In the operation of the machine 410 for this exercise, the user and the machine are facing right, the load is created by the amplifying load canister on the right side of the machine. The user utilizes the same process as shown in FIG. 116 above. To engage the machine the user is harnessed to the machine in the methods shown above in FIGS. 111-115. The operation of the force element 4125 is such that when the user goes from the down position to the up position, the force in the machine 410 is radiated through the guide arm 430 to add an amplified load greater than what the user's body produces naturally. This is seen to be an extremely efficient and effective exercise.

FIG. 123 is a side view of a user on the machine 410 performing a reducing load bird dog static pose exercise. This exercise is performed by assuming the position like a dog pointing at a bird, and hence the "bird dog." When the user performs this exercise, the user kneels on the machine much like is shown in many of the figures above. They have an inclination to put one hand on the guide arm support pad 432 and one hand on the plank pad 442 or one of the handles of the handlebars 444. In this position, the user's abdomen is in contact with the guide arm pad 432, one knee is down on the body support pad 422, the down hand is on the plank pad 442 and opposite the knee on the body support pad 422 or alternately described as diagonal from. Said arm and hand are in the air and pointing preferable straight in front of the user. On the other side of the machine, the foot of the down leg is in contact with the front side of foot pad 452 and the leg opposite the down knee is in the air and preferably pointing back straight.

Much like in performing the plank, the user holds this position for a number of seconds while the machine fortifies their position and allows them to concentrate on good performance of the exercise. This exercise is really great for developing core strength and coordination. The user and the machine are both facing left, and the reducing load canister 4224 is producing force. Said action stores energy inside the force element 4125 and assists the user to maintain the position shown.

FIG. 124 is a side view of a user on the machine performing a magnifying load bird dog pose exercise. In the performance of this exercise the user is in the position shown in FIG. 123 above. In the operation of this exercise, the user and the machine are both facing right, and the amplifying load canister 4124 on the right side of the machine is producing the force.

Next, the user engages the machine much like when doing an added load plank or push-up whereby they are connected to the machine by belt 434 or shoulder harness 435. In this operation, the user starts in the down position and brings themselves to the position shown whereby the force producing element is amplifying resistance and pulling the user away from their position. In this action, the user performs the exercise by resisting the machines inclination to pull them down or out of position. This is a very difficult exercise to perform and requires the user to have very good core strength.

FIG. 125 is a perspective view of the machine adapted with the auxiliary foot support attachment 455 consisting of an auxiliary foot pad 458. The higher foot placement attachment is employed when a user performs supine pull-ups or push-up or plank exercises where the body is in a declined position and the feet are above the hands. The higher foot placement attachment 455 has a telescopic relationship with foot stabilizer positioner 456 of the foot support 450.

FIG. 126 is a side view of a user on the machine 410 performing a reducing load supine pull-up. The figure depicts the bottom of the range of motion whereby the user will pull themselves up to their hands and be assisted by the force generated from the reducing load canister 4224. To perform the exercise the user sits on the body support pad 422 and engages the guide arm pad 432 on their back and eventually lower back. Once in this position they lay backward storing energy in the reducing load canister 4224. In this position, the top of the user's back is supported by the plank pad 442 of the head of the machine support 440 and the guide arm pad 432 is now in line with the user's lower back.

Next, when the user arrives at this position, the user places their feet up on the auxiliary foot support 455 which is telescopically positioned inside the foot support positioner 456. At this point the user reaches up to the auxiliary handlebars 446 up over their head and aligned with the chest. From here the user performs an assisted supine pull-up by pulling with their arms and back to bring their chest to the auxiliary handlebars 446.

As the user moves from the up position to the down position, the force stored inside the force producing element 4125 motivates and actuates the guide arm 430 to follow the user's body and provide assistive force.

FIG. 127 illustrates the user performing the second phase of the figure above. The user performs the second phase of the movement being assisted by the guide arm 430, thus returning to the bottom of the range of movement whereby he/she lays across the body pad 422 with their upper back on the plank pad 442 and lower back on the guide arm pad 432 in the middle. The supine pull-up is an excellent alternative to vertical pull-ups. Doing a pull-up in this position affects the musculature of the back and arms differently. It seems that more of the back is involved as well as the core, and there may be less stress on the shoulders and biceps. It is also the exact opposite movement of the push-up and may foster a better structural development in the rear of the shoulder. Further, because of the counterbalance, a user may be able to perform one arm horizontal pull-ups, which would be extremely difficult to do without the machine.

In addition to a supine pull-up, a user can also perform an inverted plank for backside of body. Rather than pulling up toward the auxiliary handlebars, the user can simply hold the position shown with added load. In holding this position, the exercise affects the glute and hamstring musculature in a way that has never been conceived before. The user pushes their heels into the support creating a contraction in the hamstring and gluteus muscles. The arms and the back are affected very intensely as well.

FIG. 128 illustrates a user in the bottom of the range of motion in the performance of an amplified load horizontal pull-up. In the figure the exerciser and the machine are facing right and the force is created by the amplifying load canister 4124 on the right of the machine as well. The operation is the same as in the FIG. 127 above. Except the guide arm 430 starts in the down position, is under load, goes in the opposite direction and the user in strapped in snug with the belt 434 and ratcheting mechanism 433. In the performance of the exercise the user grasps the auxiliary handlebar 446 and pulls themselves up in a horizontal orientation. As the user does this, their entire body if affected. This is different than when a user performs a vertical pull-up as stated above. In this operation, the benefits go further as the abdomen is protected and formed by the use of the belt 434, and ratcheting mechanism 433 around the user's waist.

FIG. 129 illustrates a user in the upper phase of the movement above. In this phase the user has engaged their arms and back and in some degree their hamstring and gluteal musculature to pull on the auxiliary handlebars 446. This is a performance of an extremely innovative exercise. The user can perform negative exercises from this position or static inverted plank exercises under more load than what their body produces naturally. From this position the user declines to the starting position and when finished, lays across the machine, disengages the ratcheting 433 and belt 434 mechanism and prepares to walk away from the machine.

FIG. 130 illustrates a side view of a user on the machine performing a reducing load mountain climber plank supported by the guide arm 430 of the machine. Whereby the machine and the user are both facing left and the reducing load canister 4224 on right side of the machine is producing the force. In this position, a user places his or her hands on the handle bars 444 or the plank safety support pad 442 while his or her feet are placed on the foot support pad 452 against the foot support element 454. The abdomen of the user is in contact with a padded embodiment of the guide arm pad 432. In operation of this exercise, the user moves one knee inwards towards his or her chest while keeping the both hands on the handle bars or plank safety support pad and one foot on the foot support pad. The user then returns the foot of the leg which has been moved inward back to the foot support pad 452. This operation continues for a number of reps or is timed. The guide arm 430 and guide arm pad 432 allow a unique support and positioning which stabilizes the upper body in strict positioning allowing the user to focus exercise on the lower abdomen and hip flexor muscles. If desired, the user can employ the belt harness 434 and ratcheting belt mechanism 433 to provide protection for the user or to form the abdomen.

FIG. 131 is a side view of a user on the machine performing a reducing load spider man or knee to elbow plank. The positioning of the user and force production of the machine is the same as in FIG. 130 above accept for the motion of the exerciser. Instead of bringing the knees forward, the user lifts the knees outward one at time, and such, their leg is perpendicular to their body. The action is repeated one leg at a time as in the figure above.

FIG. 132 is a side view of a user on the machine performing a magnifying load mountain climber plank connected to the machine with a belt harness 434. In this view, the amplifying load canister 4124 is shown producing an amplified force. In this configuration, the assembly hinders the user as they attempt to complete the exercise, allowing for a more difficult exercise and increasing the workout level.

FIG. 133 is a side view of a user on the machine performing a magnifying load Spiderman knee to elbow plank connected to the machine with a belt harness 434. Like in FIG. 132 the force of the amplifying load canister 4124 hinders the user while they attempt to complete the exercise, allowing for a more challenging workout.

FIG. 134 illustrates one embodiment of a reducing load seated abdominal exercise with the user's abdomen enveloped by a corset pad that is ratcheted tight. In this embodiment, the machine is facing left and the user is facing right. This is a unique exercise in the vertical abdomen exercise grouping. The ratchet housing 433 and belt mechanism 434 employs a belt pad 2434 to create a larger surface area as it envelops the abdomen for the purpose of creating a corset-like connection on the user's torso that cues and gives biofeedback to them to pull their abdomen in as they perform the exercise. This device can also be used to help an exerciser who has a propensity to bow out their abdomen during the performance of a sit-up type exercises. The reducing load canister 4224 is producing force to assist the user in performing this exercise. A user can lean back with assistance and create a vacuum whereby holding the position for a number of seconds. A user can also perform concentric exercise by moving from the position shown to vertical. This ratcheting belt 434 across the front of a person could also be seen in non exercise environments. For example such a device could be affixed to a regular chair or office chair to help workers have better posture at their desks.

FIG. 135 illustrates a patient or exerciser performing a reducing load side vertical abdomen exercise. The subject is facing the viewer of the descriptions and the machine is facing left. The reducing load canister 4224 is producing the force. In the performance of this exercise the user bends to the side with the guidance of the guide arm 430. The ratchet housing 433 and belt 434 is employed here in a different way than in FIGS. 116 and 117. Said assembly is used to strap the user over the thighs to fortify their connection to the body pad 422 for the purpose of making the exercise more correct in that the exerciser has a solid base to perform the exercise from and can therefore concentrate on the musculature that they are trying to affect most, namely the oblique muscles. This exercise is also excellent at fostering the relationship between the two halves of the abdomen. To perform the exercise utilizing this ratchet housing 433 and belt 434 assembly, said assembly is mounted to the back frame of the machine. The belt is then pulled over the thighs of the user and hooked to the front of the machine. Said assembly can also be employed this way going from one side of the machine to the other and over the thighs of the user to fortify their lower body positioning for straight vertical type abdomen exercises as seen in FIG. 133 above.

Figure 136:
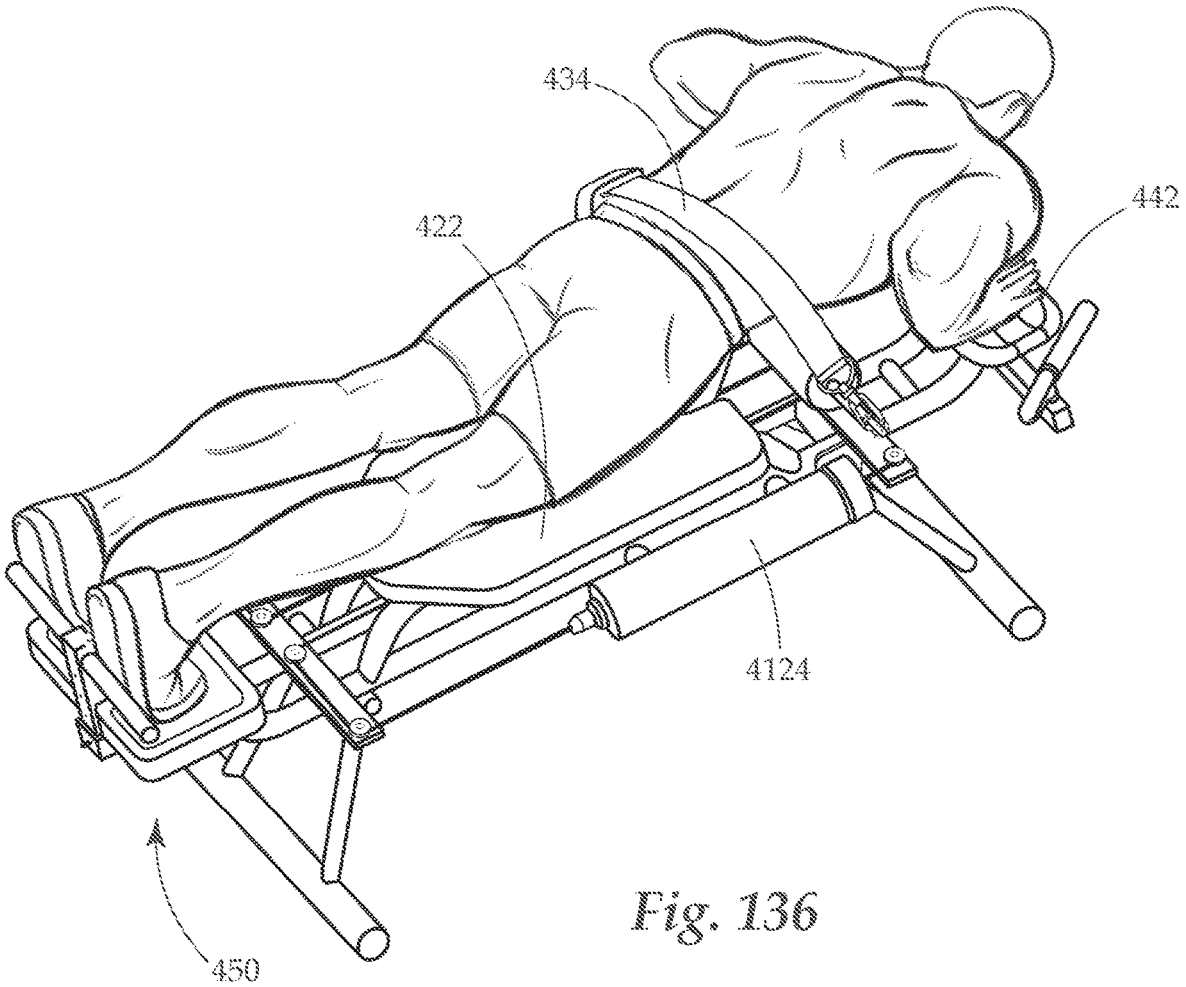
Figure 137:
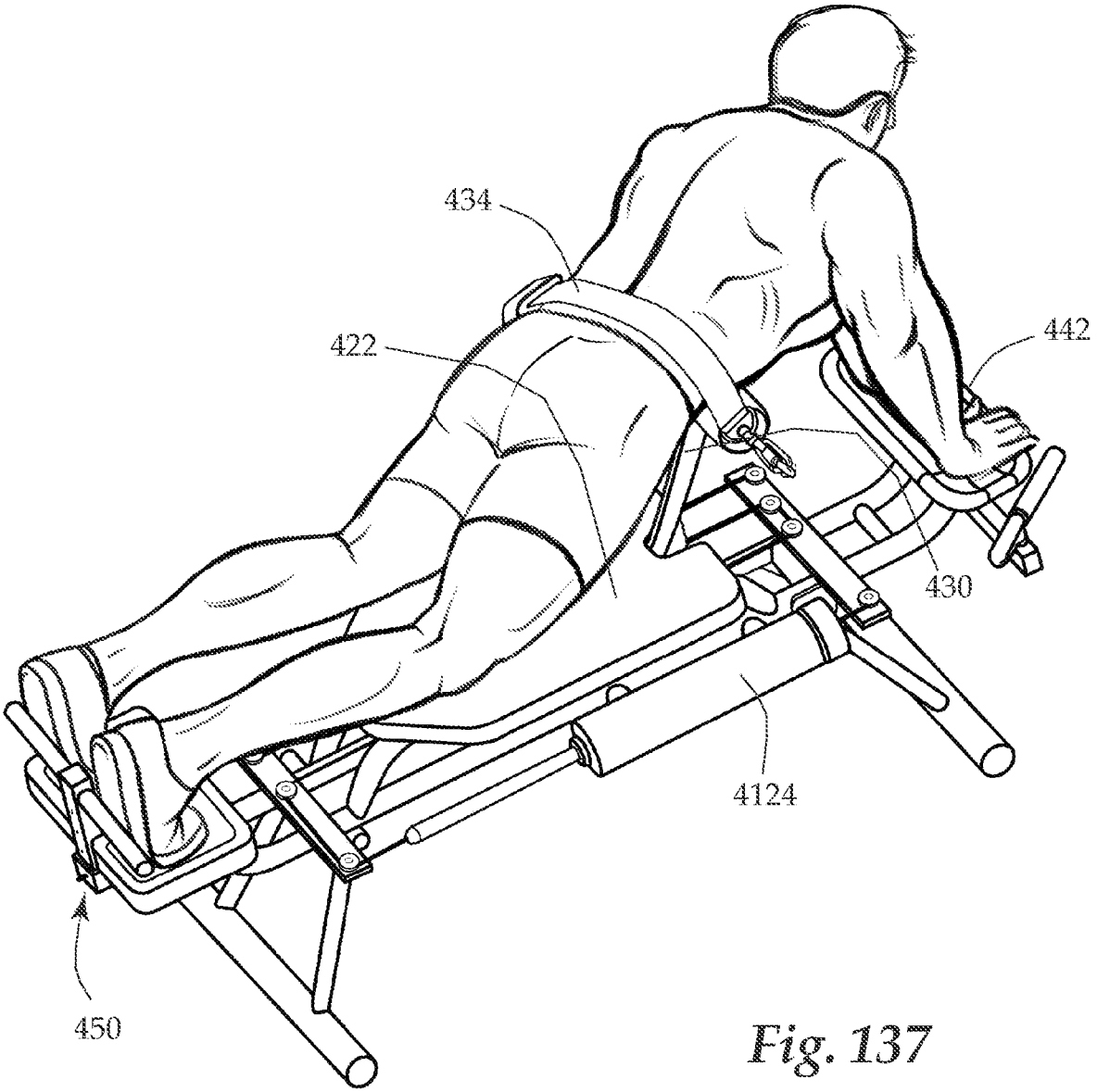
Figure 138:
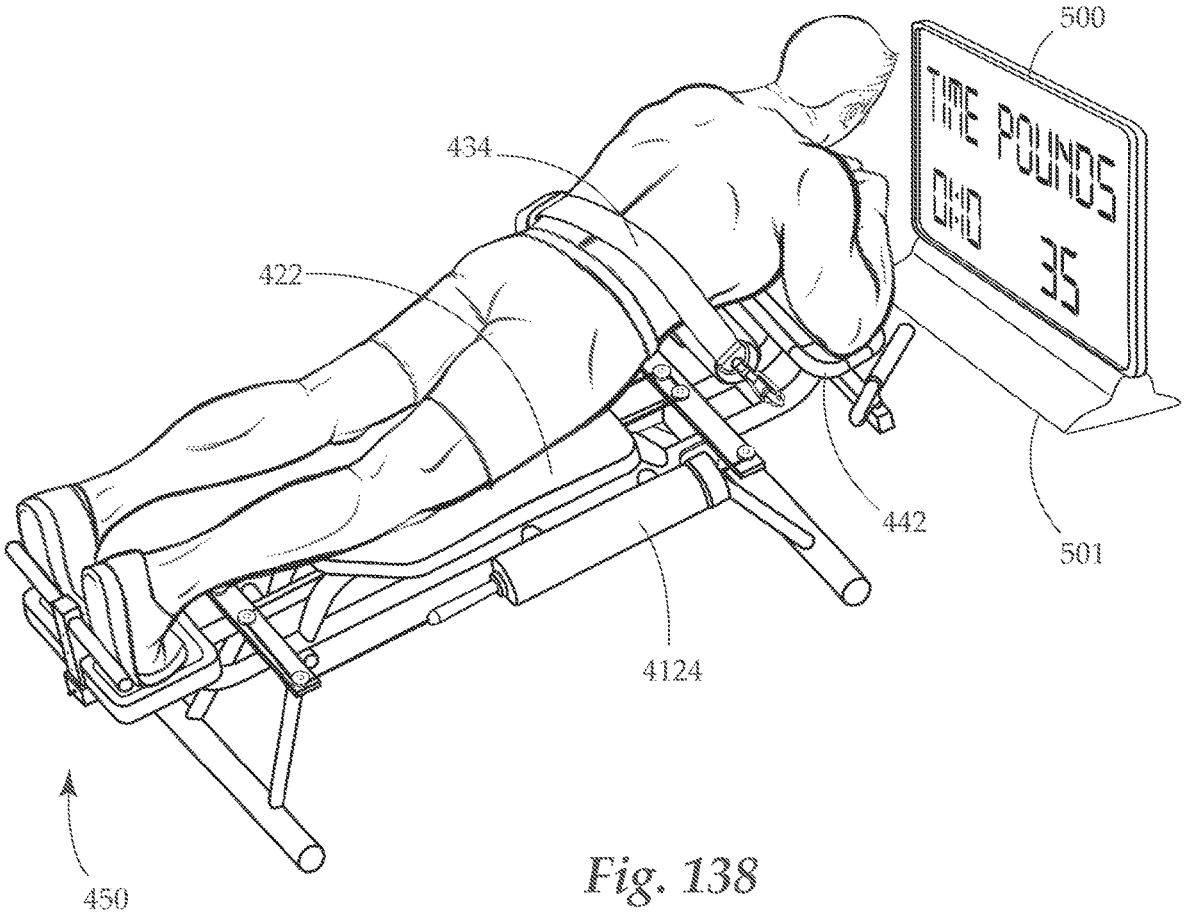

FIGS. 136-139 illustrates the three phases of getting into the machine for an abdominal and core strength baseline test. For this test the machine is adapted with a pneumatic powered electromechanical system 4125*a*. Said system has all the known and appropriate components practiced in the art for this kind of operation. The structure of this test is illustrated in the figures below. An overview of how the test works is such that a subject is connected to the machine for the performance of a timed simultaneous progressive overload plank as is seen in FIG. 116 above. A testing protocol is devised such that the subject holds a plank position while the machine is increasing in force over time. The protocol illustrated in FIG. 139 below shows 5 pounds of force is generated by the machine every 10 seconds shown on the testing monitor 500 that the subject can plainly see and hear as the perform the test until they can no longer hold themselves up in the plank position. As far as is known in the art, no such apparatus or testing protocol like this exists. This test could have profound effects in many areas of human performance. Examples of these are such where this test could be used for people who have occupations that require them to be physically fit, such as police, fire and military. The test could be used by insurance companies to evaluate a person and grade them for the possible incidence of certain types of conditions and potential surgeries. Professional and collegiate sports teams could use this test to determine the strength, endurance and fitness level of an athlete that they are considering for their organization. Strength coaches and trainers should adopt it to determine the level of training an athlete can perform at. For example, if an athlete does not have a certain level of core strength, they should not be doing certain kinds of lifting, such as squatting or Olympic Lifts. There are obviously more examples of uses and different protocols for this test. The figs below illustrate the three steps of performing this test. FIG. 136 illustrates that the subject has engaged the machine and put the ratcheting housing 433 and belt 434 element over their back and is securely strapped in. FIG. 137 illustrates the subject performing the second phase of the test where they position their knees as shown on the body pad 422 of the machine and their hands are on the plank safety/support 442 in the head of the machine 440 for the purpose of getting ready to put their elbows on said plank support for the testing phase as seen in the next Figure. FIG. 138 illustrates the position for the test. The subject has secured their forearms on the plank support 442 and has taken their knees off of the body pad 422. The subject then performs the plank as long as they can when simultaneously looking and or listening or both to the testing monitor 500 and administers of the test. The test commences at a simultaneous progressive overload to a determined and designed number of units of force or weight increasing at a determined and designed number of units of time until the subject can no longer hold the simultaneous amplifying force plank. The example in the Figure shows that the simultaneous progressive overload units of force are 5 pounds and the simultaneous progressive overload units of time are 10 seconds.

FIG. 139 illustrates a digital screen that is supported by a base 501. This screen is used to show measurement of the test illustrated above and it is a motivating tool for the subject.

FIG. 140 illustrates an adapted embodiment for the head area of the machine. Instead of the preferred head area embodiment, a large padded platform is shown. The principal reason for this would be to allow the exerciser the ability to perform exercises whereby the pads of their hands come into contact with the adapted plank safety/support 442 for pushing up. There may be a desire to perform standard hand on floor type push-ups, or there may be a desire to perform more of a plyometric type push-up. It is also an attempt at capturing all the ranges of adjustments therefore, the head of the machine 440 does not need to be telescopically or laterally adjustable. Also, in the US Army's new fitness test the ACFT, the designers implemented what is called hand-release pushups. This embodiment would be a perfect adaption for training for this test. The machine 410 and technology overall would be tremendous for keeping track of soldiers and their fitness, but it would also be a way to count and measure for said test.

FIG. 141 illustrates the machine 410 adapted with a front and back platform with a more robust and non folding construction. Both platforms 442*b* and 452*b* are appropriately cushioned for elbows, hands and feet respectively. The lateral foot stabilizer 454 of the foot area support 450 has a longer lateral extent, the medial adjustment member 454*a* also has a longer medial range. The sizes of said platforms are to allow for all kinds of wider hand, foot placement and plyometric opportunities with assistance or amplified load. Said sizes are also an attempt to mitigate adjustments in the head area 450 and foot area of the machine 450 Also, as stated above could be perfect for training and testing for the US Army ACFT or tests that are designed in the future. This is also well suited to be just a device with no force depicting the current abilities of this practicing art of standard body-weight resistive exercise such as a free push-up and free plank.

FIG. 142 illustrates the multiple bar linkage system 4170. This system is comprised of straight rails 4160, a guide arm 430, a trolley 4150, and two guide arm linkage and stabilizing bars 430*a*.

FIG. 143 illustrates the trolley 4150 and curved rail 4160 system that is connected to the guide arm 430 as seen in the figures above.

FIGS. 144-148 illustrate an innovative squatting machine 410*a*. Much like all the figures and embodiments above this exercise can be performed with reducing or amplifying load. The machine 410*a* is designed like the one above except its mechanical parts that produce the fulcrum are bigger, longer and more robust seeing how this is a machine that will take more abuse and produce heavier loads because of the squat exercise. There are two contemplated force mechanisms as seen in FIGS. 142 and 143 above for the current embodiment. Such mechanisms are seen as the multiple bar linkage system 4170 and the guide arm 430 trolley 4150 curved rail 4160 system as seen in FIG. 143 above. Also and most significantly employed is the ratchet housing 433 and belt 434. One unique aspect that has not been disclosed in previous versions is a squat machine 410*a* that has a ratcheting belt 433 housing incorporated right into the structure of the machine. The multiple bar linkage 4170 and rail 4160 is an attempt to mimic the fulcrum made by the guide arm 430 and curved rail 4160 system. In this attempt, it may have been discovered that the multiple bar linkage 4170 could provide the most appropriate method of designing the mechanical force for the reducing and magnifying load squatting machine 410*a*. Thus, both mechanical assemblies will be described in the following figures. For the multiple bar linkage 4170, a rail 4160 is affixed to a base members 460. The rail 4160 is attached to the base 460*a* such that to allow spacing for a larger guide arm 430 to have a larger range of motion. Said base 460*a* is comprised of two main supports 460 which extend and attach to a footing 460*b* in the front area 440 of the machine 410*a* and a foot platform 450*a* in the foot area of the machine 450. The guide arm is stabilized by two guide arm linkage bars 430*a* as seen in FIG. 142. Said guide arm linkage bars 430*a* articulate and are pivotally affixed to the core frame 460 of the base on one end, and to the insertion end of guide arm 430 on the other. The insertion end of the guide arm 430 rides on or in the rails 4160 that are affixed to the core support 460. The linkage bars 430*a* stabilize and follow the insertion end of the guide arm as it articulates on or with the rails 4160 during the up and down motion of the guide arm in operation. The insertion end of the guide arm is also where the force element 4125 is attached comprising canisters or pneumatic cylinders as in the FIGS. 104-107 above. This propelled variable articulation radiates through the guide arm 430 to the origination end of said guide arm. The origination end of said guide arm comprises a large roller unit 432*a* that the user grasps during the operation of the machine 410*a* in the performance of the exercise. The roller is rotatably mounted on the lateral frame bar 430*c* of the guide arm. Within this roller unit 432*a* there are two grooves 432*c* made for the users forearms to be cradled in while the user grasps the handles 432*h* which are part of the top of the guide arm 430. Said grooves 432*c* and handles 432*h* make this very comfortable and easy for the user to fortify stability as they hold onto said roller unit during performance of this exercise on the machine 410*a*. Said lateral frame bar 430*c* of the guide arm has a left and a right end. Another member of the guide arm unit is made of a left and a right stabilizing bar 432*e*. These stabilizing bars extend downward and contain another smaller roller pad or structurally intense belt-like member 432*f* which is vertically adjustable along its length to allow for different body sizes and torso lengths. On one end of this auxiliary support member 432*f*, the ratcheting belt housing 433 and belt 434 is oscillatingly mounted. On the other end of this smaller roller or belt-like assembly 432*f* is the belt latching element 4137. As stated above, this entire assembly is vertically adjustable to accommodate proper placement of said auxiliary abdominal support element. The purpose of said smaller roller assembly is to pushup against and stabilize the abdomen while the ratcheting belt housing 433 and belt 434 has been tightened to a comfortable level for the performance of the exercise. This securing of the abdomen fortifies the user's abdominal area. For some exercisers this ratcheting and belt mechanism can be used to help maintain a certain posture and position in the abdominal region for shaping the area like a corset during the performance of the exercise. In light of the fact that the force is generated from the front, the fortification of the belt 434 and ratcheting mechanism 433, and the angle the exercise is performed on, two prominent things are realized. One, the contraction and isolation in the quads, hamstrings and glute muscles is highly concentrated. Two, the pressure on the lower back is lessened to a high degree. In addition, lunges and other one legged exercises can be performed both to the front, to the side or at an angle.

FIG. 145 illustrates the side view of an exerciser performing a reducing load squat on the squat machine 410*a*. The exerciser is standing on the platform 450*a* and engaged with the roller assembly unit 432*a* the auxiliary roller 432*f* is positioned and secured via adjustment and by the ratcheting housing 433 and 434 belt assembly. As the exerciser descends, the reducing load canister supports and provides the force that guides and offsets a portion of the user's bodyweight. The ratcheting and belt assembly 433 fortifies and secures the user. It especially enhances the comfort level felt within the abdominal and lower back regions during the performance of the exercise.

FIG. 146 illustrates the user in the squat exercise machine 410*a* in the bottom of the range of motion. In operation from this position, there is stored potential energy in the reducing load canister 4224 and as the user ascends, said energy helps the machine support and guide the user back to the starting point. In both FIGS. 144 and 145 operation and performance of the exercise for magnifying load would be the opposite whereby the user starts in the lower position and is hindered by the machine 410*a* in the ascension phase of the exercise. The operation of the machine and performance of the exercise for magnifying load will be described in more detail in the following two figures utilizing the curved rail 4160 system illustrated in FIG. 143 above.

FIG. 147 illustrates a side view of an exerciser performing the first phase of a magnifying load squat on the squat machine 410*a* adapted with the guide arm 430, trolley, 4105 and curved rail 4160 assembly. The frame structure of this embodiment is the same as in FIGS. 144 and 145 above, except the rails are the curved ones like is seen in FIG. 143. The guide arm 430 is the same as well, although it rides on a trolley 4150. In operation of the machine 410*a* for this embodiment the amplifying load canister is the one producing the force. The guide arm 430 can start at the bottom of the range of motion or it can be loaded and in the top of the range of motion when an exerciser engages the machine 410*a*. If the machine starts under the load it will be secured by either a latching mechanism, like seen on many hack squat or leg press machines or a hooking mechanism as seen on many types of smith machines. If the machine is pneumatic there could be lifting and load mechanisms in the electo-mechanics of the machine. This description is going to illustrate the machine with the arm down and starting unloaded, except for the magnifying force in the machine that will be enacted upon movement of the exerciser. To perform the exercise the user can opt to do it without the use of the auxiliary roller pad 432*f* and ratchet housing 433 and belt 434 assembly. If the exerciser opts to use said ratchet and belt assembly they would engage the machine at the lower level, squatting down on the foot of the machine platform 450*a* and swing the auxiliary pad assembly 432*f* toward themselves. They would grab the belt housing 433 and proceed to perform the action of FIGS. 111-115. Once secure, they will hug the large roller assembly 432*a* whereby their forearms are in the forearm grooves 432*c*, and their hands are grasping the handles 432*h* that are part of the guide arm at the top. At this point the exerciser will begin to ascend during the second phase of the movement. During this movement, the amplifying load canister 4224 produces the force that hinders such movement. The operation of the machine is such that the trolley 4150 starts at the back of the curved rails 4160 and under the load of the system 4125, is pulled to the front by the ascending action of the user. When the exerciser is at the top of the range of motion, in the process of performing one repetition, the exerciser must descend again toward the lower area of the movement. Said, operation is described in more detail in the figure below.

FIG. 148 illustrates the top phase of a side view of an exerciser performing a magnifying load squat on the same embodiment as FIG. 147 above. The operation of the machine 410*a* is such that as the user descends with the amplifying load canister 4124 producing the force, the trolley 4150 moves toward the back of the rails 4160. In the performance of this exercise the user controls the movement by eccentrically contracting his or her leg muscles until the bottom of the exercise is reached as in FIG. 147 above. Upon reaching this position the exerciser ascends again to continue the exercise for more repetitions.

Many other embodiments exist and can be included with moderate improvements or changes. For example, many different force configurations may be utilized in the construction and operation of this machine 10. In one possible embodiment, a rail system including a set of linear bearings connected to a force element connector, which actuates on rods, which are braced under the machine 10 is connected to the guide arm 30 via a link. In the operation of this force production mechanism the link moves the force element connector toward the foot support end of the machine 10. The force is originated or anchored inside or outside of the core support and the desired force is created by the number of elastic or spring elements selected. Separately spaced, but adjacent to the force element connector is the elastic or spring element selector.

Furthermore, in this embodiment the elastic or spring elements are housed between the force element connector and the rod brace originating in the head end of the machine 10. To select an elastic element to be used to produce a desired amount of force the user moves an elastic or spring element from the elastic or spring element selector to the force element connector. When the desired force is selected the movement of the guide arm 30, because of the action of the user causes the link to move the force element selector toward the foot end of the machine whereby the selected elastic or spring elements create tension in the whole mechanism. The elastic or spring elements not activated sit unstretched between the rod brace and the force element selector.

In another embodiment, the force element is a gas spring. The gas spring is affixed between rails of a truss or affixed to the bottom of the main central beam of the core support. This configuration has a link that connects the gas spring to the guide arm 30. In the way that the gas spring works there is relative relationship between the amount of force it produces and the angle of the guide arm 30. This relationship is caused by a crank mechanism which is housed in the back of central rail truss or the housing for the gas spring affixed to the bottom of the main central support beam of the core support. The more the gas spring is pushed forward by the crank mechanism the steeper the angle of the guide arm becomes. The steeper the angle, the more the male member of the gas spring retracts into the female member, thus producing more force. These elements of operation are thereby affected by the action of the user to perform the desired exercise.

In yet another embodiment the force configurations is a rail system force producing mechanism with linear bearings connected to a force element connector, which actuates on rods having head and foot rod braces. This mechanism is located under the body support pad 22 and is affixed to the underside of the components of the central support system. Said mechanism is connected to the guide arm 30 via a link. In the operation of this force production mechanism for assistance, the link moves the force element connector toward the foot support end of the machine being propelled by the action of the user. The force is originated and anchored to the rod brace of the head of machine support area 40 as part of the core support 20 and the desired force is created by the number of elastic or spring elements selected. Separately spaced, but adjacent to the force element connector is the elastic or spring element selector.

In the previously described embodiment, the elastic or spring elements are housed between the force element connector and the rod brace originating in the head end of the machine. To select an elastic element to be used to produce a desired amount of force the user moves an elastic or spring element from the elastic or spring element selector to the force element connector. When the desired force is selected the movement of the raised guide arm 30, because of the action of the user causes the link to move the force element selector toward the foot end 50 of the machine storing energy to assist the user, whereby the selected elastic or spring elements create tension in the whole mechanism. The elastic or spring elements not activated sit housed between the rod brace and the force element selector.

In yet another embodiment force configuration is bidirectional wherein the force element is a gas spring. Said gas spring will have metal members affixed on either end whose purpose is to act as contact points for the pins that will be used to vary the force. The gas spring is housed in the gas spring housing which is affixed to the bottom of the main central beam of the core support 20. This housing includes a series of holes on the head and foot end drilled through on the sides. The purpose of these holes is to create a way to change how much the gas spring compresses, therefore, changing the force it produces. The more it compresses the more force it produces. Said housing, also includes a slot along its bottom. This slot is for the engagement of the link between the gas spring and the guide arm 30. The linking member of this assembly is constructed so its head can fit inside the slot.

In the previously described embodiment, once the guide arm is inside the slot the head, the linking member is twisted by the operation of the twisting mechanism so it cannot come out of the slot. In operation, the head of the linking member will not be connected to, however will push against the gas spring. The gas spring will be varied in its force via the holes drilled through the sides of the head 40 and foot 50 areas of the gas spring housing. Pins will be placed in the holes depending on which direction the linking member will be going in according to the direction that the guide arm 30 will be going in for its intended use. In the operation of this configuration for assistive force, the pin is placed in the desired hole in the selection in the foot area 50 of the mechanism. The guide arm 30 is in the up position whereby any force produced is first stored in the mechanism when the user is at the bottom of the range of motion whereby the stored force is then imparted on the user to assist the user in the exercise.

The link of the guide member 30 has its head inserted into the slot. The amount of angle of the guide arm 30 determines the amount of assistive force that the mechanism will produce. This force is determined by where the pin is placed. The pins purpose is to act as a barrier and stop the gas spring from moving in its housing as the head of the linking member is pushing against it. The further the pin is set from the middle of the machine, the less steep the angle of the guide arm 30 the less force it will produce. The closer the gas spring head stops to the center of the machine the steeper the angle of the guide arm will be and the more assistive force it will produce in the operation of the mechanism. To reverse the direction of the machine and set it up for added load, the head of the linking member is twisted by the head twisting mechanism so the linking member can be removed from the slot.

Moreover, in this embodiment the guide member 30 will be placed in the downward position and the gas spring will be moved to the head of the machine side of the gas spring housing. A pin will be placed in the desired aperture or hole, to produce the desired force. The head of the linking member will be twisted again so it can fit in the slot. Once in the slot the twisting mechanism will twist the head and secure it in the slot. In the operation, the guide arm 30 is connected to the user. The action of the user instituting a pulling force on the guide member causes the linking member to contact the gas spring which is stopped in its desired location by the pin in the apertures of the gas spring housing. The closer the pin is set, the higher the guide arm pad 32 is off of the central support system and the less amount of resistive force can be produced. The farther away from the center of the machine that the pin is set, the closer the guide arm pad 32 is to the central support system the more the gas spring compresses thereby producing more force.

In an alternate embodiment of this force producing mechanism crank mechanism can be utilized to vary the force. Simply put, instead of the apertures and pin configuration, a crank can be twisted to a stop position and establish the relationship between the angle of the guide, the linking member and the gas spring, thereby varying the type and amount of force.

To illustrate the overall operation of the one exemplary embodiment of the system, the three main support members 20, 40, 50 provide user support in performing certain exercises. The body support pad 22 in conjunction with the foot pad 52 and safety pad 42 support the user's body while doing certain closed chain exercises with the exercise equipment 10. The guide arm 30 and guide arm pad 32 provide the user with greater stability and ensures proper posture while doing certain exercises. Further the guide arm 30 provides counterbalances or increases the load to the user and may be positioned in either an up position or a down position respectively. In an alternate embodiment of the invention, there may be an additional harness 34 or 35 component to allow the use to stay connected to the machine during certain exercises, such as planks, push-ups and bird dog exercises to provide the user with additional resistance than what their body provides naturally. In yet another embodiment, the invention may include additional and auxiliary user supports and allow for adjustable positioning of the guide arm 30 to match adjustments of the auxiliary supports.

The force component 24 may comprise any device known to one skilled in the art such as elastic cords, coil springs (extension or compression), torsion systems, gas springs (extension or compression), or any combination thereof, that is mechanically connected to both the guide arm and core support. Minor adjustments to the force component allow for small changes in the tension experienced by the user. In some iterations, large changes in force between sets is greatly felt, therefore, the user fatigues too quickly and the benefits of the machine 10 are diminished, which may cause frustration for those who are just beginning or out of shape. Conversely, said large changes in force between sets may be embraced by avid users and elite athletes because of the neuromuscular shock such large changes in stimuli produce.

In an alternate embodiment of the system, the force component 24 is connected to the guide arm 30 in an alternate location outside the core support 20, this connection is telescopically adjusted between the head of the machine support 40 and the guide arm 30. As the head of machine support 40 is adjusted outward from the core support 20 the angle of the guide arm becomes steeper therefore, producing more assistive force. As the head of machine support 40 is adjusted closer to the core support 20 the angle of the guide arm 30 becomes less steep therefore, producing less assistive force. These actions are characterized as the machine producing assistive force relative to the length and size of the user. On the foot support 50 end of the machine, as the force component anchor is adjusted further away from its insertion on the bottom of the guide arm 30, more force added load force is produced. These actions are characterized as the machine producing more added load force relative to the length and size of the user.

In yet another alternate embodiment of the system, the exercise equipment 10 is pneumatically powered and the force component is able to be changed while in operation. In yet another alternate embodiment of the invention, the force component and guide arm position are adjusted with a crank mechanism. Further still in another embodiment of the system, a rail system with a force element connector that is actuated by linear bearings, and connected to the guide arm 30 via a linking member is constructed under the user support pad 22 main central support beam and core support beam. In still another embodiment of the invention, there is no force component.

The position and shape of the safety pad 42 provides superior support to the user in performing certain exercises, such as the plank exercise, and is integral in providing safety for the user while performing push-ups there is no way for the user to smash their face. Additionally, this support/safety pad 42 is essential when the user is connecting to the machine to perform added load type exercises wherein the guide member 30 is in a down position and under load. The user needs to rest on said plank pad 42 to be able to have their hands free so they can lock the retracting connection device 33, whether that device be part of the machine or part of a belt 34 or shoulder harness 35. Also, this pad/support 42 creates a very comfortable, structured and innovative way for a user to have many close grip options for doing both assistive and added load push-ups. In the art it has been very difficult to achieve comfortable and stable hand positioning as is seen with this new improvement in the exercise as a whole.

The handlebars 44 are capable of being adjusted to a variety of positions, both rotationally to adjust the position of the user's hand and by telescoping laterally in and out of the head of machine support 40 to adjust the width of the user's grip, in order for the user to most optimally perform certain exercises, such as the push-up exercise, as well as adjust the level of difficultly for the user. In an alternate embodiment of the invention, the handlebars 44 may be locked into position with screw locks, or pop pin plunger devices.

The foot support 50 particularly provides stability for the user while performing closed chain exercises. The position of the foot element 54 ensures proper foot placement of the user in certain exercises, such as the push-up, plank and birddog exercises. In an alternate embodiment of the invention, the foot pad 52 and/or the foot element 54 may have resistive surfaces. In another embodiment of the system, the foot element 54 may be positioned at different heights. In still another embodiment of the invention, greater than one foot element may exist at varying heights.

In yet another alternate embodiment of the system, additional foot supports, that do not extend towards the user, may be placed above the foot element. In an alternate embodiment of the invention, the foot element 54 and foot element positioner 56 may be folded down for lower profile storage.

Other embodiments of the system may include variations on stability in the head of machine support 40 and foot support 50. The exercise equipment 10 is also foldable as seen in FIGS. 18 and 29, providing the user convenience in storing and transporting it. In an alternate embodiment of the invention, it is capable of folding multiple times for a smaller footprint storing. Other embodiments may include lighter weight materials to even further improve the user's ease of transporting it.

As stated above FIG. 19 depicts the foldability and ease of transport of the preferred embodiment.

The foregoing descriptions of specific embodiments of the present invention are presented for purposes of illustration and description. They are neither intended to be exhaustive nor to limit the invention to the precise forms disclosed, and obviously, many modifications and variations are possible in light of the above teaching. The embodiments were chosen and described in order to best explain the principles of the invention and its practical application, to thereby enable others skilled in the art to best utilize the invention and its various embodiments with various modifications as are suited to the particular use contemplated. It is, of course, not possible to describe every conceivable combination of components or methodologies for purposes of describing the claimed subject matter, but one of ordinary skill in the art may recognize that many further combinations and permutations of the claimed subject matter are possible. It is intended that the scope of the invention be defined most broadly by the specifications and the figures appended hereto and their equivalents. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A squatting machine comprising:

a base member, wherein the base member comprises:

at least one main support, which extend down and across to form a base area of the squatting machine;

a guide arm wherein the guide arm is connected to the base member by a force mechanism; and a roller unit;

a foot platform in a base area of the squatting machine, wherein the foot platform is connected to the at least one main support;

an auxiliary support member connected to the roller unit; and a ratcheting belt and housing attached to the auxiliary support member.

2. The squatting machine of claim 1 wherein the roller unit is mounted on a lateral frame bar of the guide arm and further comprises:

a pair of handles on top of the guide arm.

3. The squatting machine of claim 1 wherein the force mechanism comprises:

a curved rail system, wherein the curved rail system is connected to the guide arm; and a trolley, wherein the trolley is connected to the guide arm via the curved rail system.

4. The squatting machine of claim 1 wherein the force mechanism comprises:

a multiple bar linkage system comprising:

a pair of straight rails connected to the guide arm;

a trolley; and a pair of guide arm linkage and stabilizing bars.

5. The squatting machine of claim 1, wherein the roller unit is mounted on a lateral frame bar.

6. The squatting machine of claim 1, wherein the guide arm further comprises a stabilizing bar.

7. A method of performing a reducing load squat utilizing the squatting machine of claim 1, comprising the steps of:

standing on the foot platform by a user;

engaging with the roller unity by the user;

securing the ratcheting housing and belt around the user's torso;

performing a squat by the user;

wherein when the user descends into the squat a reducing load canister supports and offsets a portion of the user's bodyweight.

* * * * *